US011056327B2

(12) United States Patent
Cheung et al.

(10) Patent No.: US 11,056,327 B2
(45) Date of Patent: *Jul. 6, 2021

(54) INORGANIC AND ORGANIC MASS SPECTROMETRY SYSTEMS AND METHODS OF USING THEM

(71) Applicant: PERKINELMER HEALTH SCIENCES CANADA, INC., Woodbridge (CA)

(72) Inventors: Tak Shun Cheung, Toronto (CA); Chui Ha Cindy Wong, Markham (CA); Hamid Badiei, Woodbridge (CA); William Fisher, Woodbridge (CA)

(73) Assignee: PerkinElmer Health Sciences Canada, Inc., Woodbridge (CA)

( * ) Notice: Subject to any disclaimer, the term of this patent is extended or adjusted under 35 U.S.C. 154(b) by 0 days.

This patent is subject to a terminal disclaimer.

(21) Appl. No.: 16/383,629

(22) Filed: Apr. 14, 2019

(65) Prior Publication Data

US 2019/0355563 A1 Nov. 21, 2019

Related U.S. Application Data

(63) Continuation of application No. 15/845,419, filed on Dec. 18, 2017, now Pat. No. 10,262,850.
(Continued)

(51) Int. Cl.

| | |
|---|---|
| ***H01J 49/00*** | (2006.01) |
| ***H01J 49/42*** | (2006.01) |
| ***H01J 49/10*** | (2006.01) |

(52) U.S. Cl.
CPC ..... *H01J 49/009* (2013.01); *H01J 49/107* (2013.01); *H01J 49/4225* (2013.01)

(58) Field of Classification Search
CPC ..... H01J 49/009; H01J 49/107; H01J 49/4225
(Continued)

(56) References Cited

U.S. PATENT DOCUMENTS

| | | | |
|---|---|---|---|
| 6,469,297 | B1 | 10/2002 | Kato |
| 6,683,300 | B2 | 1/2004 | Doroshenko |

(Continued)

FOREIGN PATENT DOCUMENTS

| | | |
|---|---|---|
| CN | 106198707 | 12/2016 |
| JP | H07073848 A | 3/1995 |

(Continued)

OTHER PUBLICATIONS

ISR/WO for PCT/IB2017/058079 dated Apr. 16, 2018.

*Primary Examiner* — Nicole M Ippolito
(74) *Attorney, Agent, or Firm* — Rhodes IP PLC; Christopher R Rhodes

(57) ABSTRACT

Certain configurations of systems and methods that can detect inorganic ions and organic ions in a sample are described. In some configurations, the system may comprise one, two, three or more mass spectrometer cores. In some instances, the mass spectrometer cores can utilize common components such as gas controllers, processors, power supplies and vacuum pumps. In certain configurations, the systems can be designed to detect both inorganic and organic analytes comprising a mass from about three atomic mass units, four atomic mass units or five atomic mass units up to a mass of about two thousand atomic mass units.

20 Claims, 103 Drawing Sheets

Related U.S. Application Data

(60) Provisional application No. 62/436,305, filed on Dec. 19, 2016.

(58) Field of Classification Search
USPC ..... 250/281, 282, 283, 285, 288
See application file for complete search history.

(56) References Cited

U.S. PATENT DOCUMENTS

| | | | | |
|---|---|---|---|---|
| 7,161,145 | B2 | 1/2007 | Oser | |
| 7,294,830 | B2 | 11/2007 | Heiftje | |
| 8,772,712 | B2 | 7/2014 | Kimura | |
| 8,803,081 | B2 | 8/2014 | Kenny | |
| 8,957,369 | B2 | 2/2015 | Makarov | |
| 9,159,539 | B2 | 10/2015 | Larson | |
| 10,262,850 | B2 * | 4/2019 | Cheung | H01J 49/009 |
| 2003/0197121 | A1 | 10/2003 | Turecek | |
| 2004/0181343 | A1 | 9/2004 | Wigstrom | |
| 2006/0228802 | A1 | 10/2006 | Tiller | |
| 2009/0083868 | A1 | 3/2009 | Carrano | |
| 2010/0102217 | A1 | 4/2010 | Okumura | |
| 2011/0065207 | A1 | 3/2011 | Ferrari | |
| 2013/0277549 | A1 | 10/2013 | Kimura | |
| 2014/0299577 | A1 | 10/2014 | Chung | |
| 2015/0021587 | A1 | 1/2015 | Mizukami | |
| 2015/0090874 | A1 | 4/2015 | Larson | |
| 2015/0348770 | A1 | 12/2015 | Hoang | |
| 2016/0005578 | A1 | 1/2016 | Koeppen | |

FOREIGN PATENT DOCUMENTS

| | | | |
|---|---|---|---|
| JP | 2000227417 | A | 8/2000 |
| JP | H08124519 | A | 4/2008 |
| JP | 2014520271 | A | 2/2012 |
| JP | 2012516013 | A | 7/2012 |
| JP | 2013516036 | A | 5/2013 |
| JP | 2013242302 | A | 12/2013 |
| JP | 2016503226 | A | 7/2014 |
| JP | 2015510683 | A | 4/2015 |
| JP | 2015514300 | A | 5/2015 |
| WO | 2014114803 | | 7/2014 |

* cited by examiner

INORGANIC AND ORGANIC MASS SPECTROMETRY SYSTEMS AND METHODS OF USING THEM

TECHNOLOGICAL FIELD

This application is directed to inorganic and organic mass spectrometry (IOMS) systems and methods of using them. More particularly, certain configurations described herein are directed to a mass spectrometer comprising one or more ionization cores and one or more mass spectrometer cores that can filter both inorganic ions and organic ions.

BACKGROUND

Mass spectrometry systems are typically designed to analyze either inorganic species or organic species (but not both). Depending on the particular sample to be analyzed, multiple different instruments may be needed to provide for analysis of both inorganic analytes and organic analytes in the sample.

SUMMARY

Certain illustrative configurations are directed to methods and systems which can use a single instrument for analysis of both inorganic analytes and organic analytes in a sample, e.g., to detect analyte species in a sample having atomic mass units (amu's) as low as three amu's up to 2000 amu's or more. As noted in more detail herein, the system may comprise one, two, three or more sample operation cores, one, two or more ionization sources and one, two, three or more mass spectrometer cores (MSCs) to provide for analysis of both inorganic and organic analytes in the sample.

In one aspect, a system comprises an ionization core configured to receive a sample and provide both inorganic ions and organic ions using the received sample, and a mass analyzer fluidically coupled to the ionization core, in which the mass analyzer comprises at least one mass spectrometer core configured to select (i) ions from the inorganic ions received from the ionization core and (ii) ions from the organic ions received from the ionization core, in which the mass analyzer is configured to select the inorganic ions and the organic ions with a mass as low as three atomic mass units and up to a mass as high as two thousand atomic mass units.

In certain examples, the mass analyzer comprises a first single core mass spectrometer and a second single core mass spectrometer, in which the first single core mass spectrometer is configured to select the ions from the inorganic ions received from the ionization core and the second single core mass spectrometer is configured to select the ions from the organic ions received from the ionization core. In other examples, the mass analyzer comprises dual core mass spectrometers. In some embodiments, the dual core mass spectrometer is configured to select the ions from the inorganic ions received from the ionization core using a first frequency and is configured to select the ions from the organic ions received from the ionization core using a second frequency different from the first frequency. In other examples, the dual core mass spectrometer is configured to alternate between the first frequency and the second frequency to sequentially select the inorganic ions and the organic ions.

In some instances, the system comprises a detector fluidically coupled to the mass analyzer, in which the detector is configured to detect the ions selected from the inorganic ions and to detect the ions selected from the organic ions, in which the detector comprises an electron multiplier, a Faraday cup, a multi-channel plate, a scintillation detector, a time of flight device or an imaging detector. In certain examples, the ionization core is configured to provide the inorganic ions and the organic ions to the mass analyzer either sequentially or simultaneously. In other examples, the ionization core comprises a first ionization source and a second ionization source different from the first ionization source. In some embodiments, the first ionization source is configured to provide the organic ions to the mass analyzer.

In other embodiments, the first ionization source comprises one or more of an electrospray ionization source, a chemical ionization source, an atmospheric pressure ionization source, an atmospheric pressure chemical ionization source, a desorption electrospray ionization source, a matrix assisted laser desorption ionization source, a thermospray ionization source, a thermal desorption ionization source, an electron impact ionization source, a field ionization source, a secondary ion source, a plasma desorption source, a thermal ionization source, an electrohydrodynamic ionization source, a direct ionization on silicon ionization source, a direct analysis in real time ionization source or a fast atom bombardment source.

In certain configurations, the second ionization source is configured to provide inorganic ions to the mass analyzer. In other examples, the second ionization source is selected from the group consisting of an inductively coupled plasma, a capacitively coupled plasma, microwave plasma, a flame, an arc and a spark.

In some instances, the system comprises an interface between the first ionization source and the mass analyzer and between the second ionization source and the mass analyzer, in which the interface is configured to provide the organic ions from the first ionization source to the mass analyzer in a first state of the interface and is configured to provide the inorganic ions from the second ionization source to the mass analyzer in a second state of the interface. In some examples, the ionization core comprises a first ionization source and a second ionization source, in which the first ionization source is fluidically coupled to the mass analyzer by positioning the first ionization source in a first position and is fluidically decoupled from the mass analyzer by positioning the first ionization source in a second position different from the first position. In other examples, the second ionization source is fluidically coupled to the mass analyzer when the first ionization source is positioned in the second position. In some examples, one mass spectrometer core comprises a first single core mass spectrometer comprising a first quadrupole. In some examples, the first single core mass spectrometer further comprises a second quadrupole fluidically coupled to the first quadrupole. In some examples, the first single core mass spectrometer comprises a time of flight detector fluidically coupled to the second quadrupole. In other examples, the first single core mass spectrometer comprises an ion trap fluidically coupled to the second quadrupole. In some instances, the first single core mass spectrometer comprises a third quadrupole fluidically coupled to the second quadrupole.

In other examples, the system comprises a detector fluidically couple to the third quadrupole. In some instances, the detector comprises an electron multiplier, a Faraday cup, a multi-channel plate, a scintillation detector, a time of flight device or an imaging detector. In other examples, the mass spectrometer core further comprises a second single core mass spectrometer comprising a first quadrupole. In some examples, the second single core mass spectrometer further comprises a second quadrupole fluidically coupled to the first quadrupole. In other examples, the second single core mass spectrometer comprises a time of flight detector fluidically coupled to the second quadrupole. In some embodiments, the second single core mass spectrometer comprises an ion trap fluidically coupled to the second quadrupole. In other embodiments, the second single core mass spectrometer comprises a third quadrupole fluidically coupled to the second quadrupole. In certain instances, the system comprises a detector fluidically couple to the third quadrupole, in which the detector comprises an electron multiplier, a Faraday cup, a multi-channel plate, a scintillation detector, a time of flight device or an imaging detector.

In some examples, the system comprises a variable frequency generator configured to provide radio frequencies to the mass spectrometer core. In other examples, the system comprises a common processor, a common power source and at least one common vacuum pump used by the first single core mass spectrometer and the second single core mass spectrometer.

In another aspect, a system comprises a sample operation core configured to receive a sample and perform at least one sample operation on the sample to separate two or more analytes in the sample, an ionization core fluidically coupled to sample operation core and configured to receive the separated two or more analytes from the sample operation core, the ionization core configured to provide both inorganic ions and organic ions using the received sample, and a mass analyzer fluidically coupled to the ionization core, in which the mass analyzer comprises at least one mass spectrometer core configured to select (i) ions from the inorganic ions received from the ionization core and (ii) ions from the organic ions received from the ionization core, in which the mass analyzer is configured to select the inorganic ions and the organic ions with a mass as low as three atomic mass units and up to a mass as high as two thousand atomic mass units.

In certain configurations, the ionization core is configured to provide the inorganic ions and the organic ions to the mass analyzer sequentially or simultaneously. In some examples, the mass analyzer comprises a first single core mass spectrometer and a second single core mass spectrometer. In other examples, the ionization core is configured to provide the inorganic ions to the first single core mass spectrometer and is configured to provide the organic ions to the second single core mass spectrometer. In some embodiments, the ionization core is configured to provide the inorganic ions to the first single core mass spectrometer, and wherein the second single core mass spectrometer is inactive when the inorganic ions are provided to the first single core mass spectrometer. In other embodiments, the ionization core is configured to provide the organic ions to the second single core mass spectrometer, and wherein the first single core mass spectrometer is inactive when the organic ions are provided to the second single core mass spectrometer.

In further examples, the system comprises an ionization interface between the sample operation core and the ionization core, in which the interface is configured to provide sample to a first ionization source of the ionization core and to a second ionization source of the ionization core. In other examples, the first ionization source comprises an inorganic ionization source and the second ionization source comprises an organic ionization source. In some examples, the inorganic ion source comprises one or more of an inductively coupled plasma, a capacitively coupled plasma, microwave plasma, a flame, an arc and a spark. In some embodiments, the organic ions source comprises one or more of an electrospray ionization source, a chemical ionization source, an atmospheric pressure ionization source, an atmospheric pressure chemical ionization source, a desorption electrospray ionization source, a matrix assisted laser desorption ionization source, a thermospray ionization source, a thermal desorption ionization source, an electron impact ionization source, a field ionization source, a secondary ion source, a plasma desorption source, a thermal ionization source, an electrohydrodynamic ionization source, a direct ionization on silicon ionization source, a direct analysis in real time ionization source or a fast atom bombardment source.

In certain instances, the system comprises a filtering interface between the ionization core and the mass analyzer, in which the interface is configured to provide ions from a first ionization source of the ionization core to the mass analyzer and is configured to provide ions from a second ionization source of the ionization core to the mass analyzer. In other examples, the filtering interface is configured to provide the ions from the first ionization source to the mass analyzer and from the second ionization source to the mass analyzer sequentially or simultaneously. In some instances, the first ionization source comprises an inorganic ionization source and the second ionization source comprises an organic ionization source.

In other embodiments, the inorganic ion source comprises one or more of an inductively coupled plasma, a capacitively coupled plasma, microwave plasma, a flame, an arc and a spark. In some examples, the organic ions source comprises one or more of an electrospray ionization source, a chemical ionization source, an atmospheric pressure ionization source, an atmospheric pressure chemical ionization source, a desorption electrospray ionization source, a matrix assisted laser desorption ionization source, a thermospray ionization source, a thermal desorption ionization source, an electron impact ionization source, a field ionization source, a secondary ion source, a plasma desorption source, a thermal ionization source, an electrohydrodynamic ionization source, a direct ionization on silicon ionization source, a direct analysis in real time ionization source or a fast atom bombardment source.

In some examples, the system comprises a first single core mass spectrometer fluidically coupled to the first ionization source and a second single core mass spectrometer fluidically coupled to the second ionization source. In some examples, at least one of the first single core mass spectrometer and the second single core mass spectrometer comprises a multipole rod assembly. In other examples, each of the first single core mass spectrometer and the second single core mass spectrometer comprises a multipole rod assembly.

In some embodiments, the system comprises a first detector, in which the first detector can fluidically couple to one or both of the first single core mass spectrometer and the second single core mass spectrometer. In other examples, the system comprises a detector interface between the first and second single core mass spectrometers and the first detector. In other instances, the detector interface is configured to provide ions sequentially to the first detector from each of the first and second single core mass spectrometers. In some examples, the detector interface is configured to provide ions from first single core mass spectrometer to the first detector when inorganic ions are provided from the first ionization source to the first single core spectrometer. In other examples, the detector interface is configured to provide ions from second single core mass spectrometer to the first detector when organic ions are provided from the second ionization source to the second single core spectrometer.

In some configurations, the first detector comprises one or more of an electron multiplier, a Faraday cup, a multi-channel plate, a scintillation detector, a time of flight device or an imaging detector. In other configurations, the system comprises a second detector, in which the first detector is configured to fluidically couple to the first single core mass spectrometer and the second detector is configured to fluidically couple to the second single core mass spectrometer. In certain instances, the first detector and the second detector comprise different detectors.

In other examples, the mass analyzer comprises a dual core mass spectrometer configured to select the inorganic ions and the organic ions sequentially. In some examples, the dual core mass spectrometer comprises a multipole assembly configured to select the inorganic ions using a first frequency and configured to select the organic ions using a second frequency. In certain embodiments, the dual core mass spectrometer is fluidically coupled to a detector, in which the detector comprises one or more of an electron multiplier, a Faraday cup, a multi-channel plate, a scintillation detector, a time of flight device or an imaging detector.

In other examples, the sample operation core comprises one or more of a chromatography device, an electrophoresis device, an electrode, a gas chromatography device, a liquid chromatography device, a direct sample analysis device, a capillary electrophoresis device, an electrochemical device, a cell sorting device, or a microfluidic device.

In an additional aspect, a system comprises a first sample operation core configured to receive a sample and perform at least one sample operation on the sample to separate two or more analytes in the sample. The system may also comprise a second sample operation core configured to receive the sample and perform at least one sample operation on the sample to separate two or more analytes in the sample, in which the first sample operation core is different than the second sample operation core. The system may also comprise an ionization core fluidically coupled to first sample operation core and the second sample operation core and configured to receive the separated two or more analytes from each of the first and second sample operation cores, the ionization core configured to provide both inorganic ions and organic ions using the received samples. The system may also comprise a mass analyzer fluidically coupled to the ionization core, in which the mass analyzer comprises at least one mass spectrometer core configured to select (i) ions from the inorganic ions received from the ionization core and (ii) ions from the organic ions received from the ionization core, in which the mass analyzer is configured to select the inorganic ions and the organic ions with a mass as low as three atomic mass units and up to a mass as high as two thousand atomic mass units.

In certain embodiments, the ionization core is configured to provide the inorganic ions and the organic ions to the mass analyzer sequentially or simultaneously. In other embodiments, the mass analyzer comprises a first single core mass spectrometer and a second single core mass spectrometer. In some examples, the ionization core is configured to provide the inorganic ions to the first single core mass spectrometer and is configured to provide the organic ions to the second single core mass spectrometer. In additional embodiments, the ionization core is configured to provide the inorganic ions to the first single core mass spectrometer, and wherein the second single core mass spectrometer is inactive when the inorganic ions are provided to the first single core mass spectrometer. In other instances, the ionization core is configured to provide the organic ions to the second single core mass spectrometer, and wherein the first single core mass spectrometer is inactive when the organic ions are provided to the second single core mass spectrometer.

In some examples, the system comprises an ionization interface between the first sample operation core and the ionization core and between the second sample operation core and the ionization core, in which the ionization interface is configured to provide sample from the first sample operation core to a first ionization source of the ionization core and to a second ionization source of the ionization core during a first sample period and is configured to provide sample from the second sample operation core to the first ionization source of the ionization core and to the second ionization source of the ionization core during a second sample period. In some embodiments, the first ionization source comprises an inorganic ionization source and the second ionization source comprises an organic ionization source.

In other embodiments, the inorganic ion source comprises one or more of an inductively coupled plasma, a capacitively coupled plasma, microwave plasma, a flame, an arc and a spark. In some examples, the organic ions source comprises one or more of an electrospray ionization source, a chemical ionization source, an atmospheric pressure ionization source, an atmospheric pressure chemical ionization source, a desorption electrospray ionization source, a matrix assisted laser desorption ionization source, a thermospray ionization source, a thermal desorption ionization source, an electron impact ionization source, a field ionization source, a secondary ion source, a plasma desorption source, a thermal ionization source, an electrohydrodynamic ionization source, a direct ionization on silicon ionization source, a direct analysis in real time ionization source or a fast atom bombardment source.

In some instances, the system comprises a filtering interface between the ionization core and the mass analyzer, in which the interface is configured to provide ions from a first ionization source of the ionization core to the mass analyzer and is configured to provide ions from a second ionization source of the ionization core to the mass analyzer. In other examples, the filtering interface is configured to provide the ions from the first ionization source to the mass analyzer and from the second ionization source to the mass analyzer sequentially or simultaneously. In some embodiments, the first ionization source comprises an inorganic ionization source and the second ionization source comprises an organic ionization source. In other embodiments, the inorganic ion source comprises one or more of an inductively coupled plasma, a capacitively coupled plasma, microwave plasma, a flame, an arc and a spark. In some examples, the organic ions source comprises one or more of an electrospray ionization source, a chemical ionization source, an atmospheric pressure ionization source, an atmospheric pressure chemical ionization source, a desorption electrospray ionization source, a matrix assisted laser desorption ionization source, a thermospray ionization source, a thermal desorption ionization source, an electron impact ionization source, a field ionization source, a secondary ion source, a plasma desorption source, a thermal ionization source, an electrohydrodynamic ionization source, a direct ionization on silicon ionization source, a direct analysis in real time ionization source or a fast atom bombardment source.

In some examples, the system comprises a first single core mass spectrometer fluidically coupled to the first ionization source and a second single core mass spectrometer fluidically coupled to the second ionization source. In some examples, at least one of the first single core mass spectrometer and the second single core mass spectrometer comprises a multipole rod assembly. In other examples, each of the first single core mass spectrometer and the second single core mass spectrometer comprises a multipole rod assembly.

In some embodiments, the system comprises a first detector, in which the first detector can fluidically couple to one or both of the first single core mass spectrometer and the second single core mass spectrometer.

In other examples, the system comprises a detector interface between the first and second single core mass spectrometers and the first detector. In some examples, the detector interface is configured to provide ions sequentially to the first detector from each of the first and second single core mass spectrometers. In other examples, the detector interface is configured to provide ions from first single core mass spectrometer to the first detector when inorganic ions are provided from the first ionization source to the first single core spectrometer. In additional examples, the detector interface is configured to provide ions from second single core mass spectrometer to the first detector when organic ions are provided from the second ionization source to the second single core spectrometer.

In other examples, the first detector comprises one or more of an electron multiplier, a Faraday cup, a multi-channel plate, a scintillation detector, a time of flight device or an imaging detector. In some embodiments, the system comprises a second detector, in which the first detector is configured to fluidically couple to the first single core mass spectrometer and the second detector is configured to fluidically couple to the second single core mass spectrometer. In some instances, the first detector and the second detector comprise different detectors.

In some examples, the mass analyzer comprises a dual core mass spectrometer configured to select the inorganic ions and the organic ions sequentially. In some embodiments, the dual core mass spectrometer comprises a multipole assembly configured to select the inorganic ions using a first frequency and configured to select the organic ions using a second frequency. In other embodiments, the dual core mass spectrometer is fluidically coupled to a detector, in which the detector comprises one or more of an electron multiplier, a Faraday cup, a multi-channel plate, a scintillation detector, a time of flight device or an imaging detector.

In some instances, each of the first and second sample operation cores independently comprises one or more of a chromatography device, an electrophoresis device, an electrode, a gas chromatography device, a liquid chromatography device, a direct sample analysis device, a capillary electrophoresis device, an electrochemical device, a cell sorting device, or a microfluidic device.

In another aspect, a system comprises a sample operation core configured to receive a sample and perform at least one sample operation on the sample to separate two or more analytes in the sample. The system may also comprise an ionization core fluidically coupled to sample operation core and configured to receive the separated two or more analytes from the sample operation core, the ionization core comprising an inorganic ionization source configured to provide inorganic ions using from separated analytes, the ionization core further comprising an organic ionization source configured to provide organic ions from the separated analytes. The system may also comprise a mass analyzer fluidically coupled to the ionization core, in which the mass analyzer comprises at least one mass spectrometer core configured to select (i) ions from the inorganic ions provided by the inorganic ionization source and (ii) ions from the organic ions provided by the organic ionization source, in which the mass analyzer comprises a common processor, a common power supply and a common vacuum pump coupled to the mass spectrometer core of the mass analyzer. The system may also comprise a detector configured to receive the ions from the mass analyzer and detect the received ions from the mass analyzer.

In certain examples, the mass analyzer comprise a first single core mass spectrometer and a second single core mass spectrometer, wherein each of the first and second single core mass spectrometers comprise a multipole rod assembly. In other examples, the multipole rod assembly of the first single core mass spectrometer is configured to use a first radio frequency to select the inorganic ions received from the inorganic ionization source. In some embodiments, the multipole rod assembly of the second single core mass spectrometer is configured to use a second radio frequency, different from the first radio frequency, to select the organic ions received from the organic ionization source.

In other embodiments, the first single core mass spectrometer comprises a triple quadrupole rod assembly fluidically coupled to the detector, in which the detector comprise one or more of an electron multiplier, a Faraday cup, a multi-channel plate, a scintillation detector, a time of flight device or an imaging detector.

In some examples, the second single core mass spectrometer comprises a triple quadrupole rod assembly fluidically coupled to the detector, in which the detector comprise one or more of an electron multiplier, a Faraday cup, a multi-channel plate, a scintillation detector, an imaging detector or a time of flight device.

In some instances, the second single core mass spectrometer comprises a two quadrupole rod assembly fluidically coupled to a time of flight device, and wherein the detector is fluidically coupled to the first single core mass spectrometer, in which the detector comprises one or more of an electron multiplier, a Faraday cup, a multi-channel plate, a scintillation detector, an imaging detector or a time of flight device.

In some embodiments, the mass analyzer comprises a dual core mass spectrometer, wherein the dual core mass spectrometer is configured to select ions from the inorganic ions provided by the inorganic ionization source using a first frequency and provide the selected inorganic ions to the detector, and wherein the dual core mass spectrometer is further configured to select ions from the organic ions provided by the organic ionization source using a second frequency and provide the selected organic ions to the detector.

In other examples, the detector comprises one or more of an electron multiplier, a Faraday cup, a multi-channel plate, a scintillation detector, an imaging detector or a time of flight device.

In some examples, the sample operation core comprises one or more of a chromatography device, an electrophoresis device, an electrode, a gas chromatography device, a liquid chromatography device, a direct sample analysis device, a capillary electrophoresis device, an electrochemical device, a cell sorting device, or a microfluidic device.

In an additional aspect, method of sequentially detecting inorganic ions and organic ions using a mass analyzer fluidically coupled to an ionization core comprises sequentially selecting (i) ions from the inorganic ions received from the ionization core and (ii) ions from the organic ions received from the ionization core, in which the mass analyzer comprises a first single core mass spectrometer and a second single core mass spectrometer each configured to use a common processor, a common power source and at least one common vacuum pump, wherein the first single core mass spectrometer is configured to select the ions from the inorganic ions received from the ionization core and the second single core mass spectrometer is configured to select the ions from the organic ions received from the ionization core.

In some examples, the method comprises providing the selected inorganic ions from the first single core mass spectrometer to a first detector during a first analysis period. In other examples, the method comprises providing the selected organic ions from the second single core mass spectrometer to the first detector during a second analysis period different from the first analysis period. In other instances, the method comprises providing the selected inorganic ions from the first single core mass spectrometer to a first detector during a first analysis period and providing the selected organic ions from the second single core mass spectrometer to a second detector during the first analysis period. In some examples, the method comprises providing ions to the first single core mass spectrometer during a first analysis period while preventing ion flow to the second single core mass spectrometer during the first analysis period. In additional examples, the method comprises providing ions to the second single core mass spectrometer during a second analysis period while preventing ion flow to the first single core mass spectrometer during the second analysis period.

In certain instances, the method comprises configuring the ionization core with an inorganic ion source and an organic ion source separate from the inorganic ion source. In some examples, the method comprises providing ions from the inorganic ion source to the first single core mass spectrometer during a first analysis period while preventing ion flow from the organic ion source to the second single core mass spectrometer during the first analysis period. In some instances, the method comprises providing ions from the organic ions source to the second single core mass spectrometer during a second analysis period while preventing ion flow from the inorganic ion source to the first single core mass spectrometer during the second analysis period.

In some examples, the method comprises configuring the mass analyzer with an interface configured to provide ions to a detector from only one of the first single core mass spectrometer and the second single core mass spectrometer during a first analysis period.

In another aspect, a method of sequentially detecting inorganic ions and organic ions using a mass analyzer fluidically coupled to an ionization core, the method comprising sequentially selecting (i) ions from the inorganic ions received from the ionization core and (ii) ions from the organic ions received from the ionization core, in which the mass analyzer comprises a dual core mass spectrometer configured to select both the inorganic ions and the organic ions.

In certain embodiments, the method comprises providing the selected inorganic ions from the dual core mass spectrometer to a first detector during a first analysis period. In some examples, the method comprises providing the selected organic ions from the dual core mass spectrometer to the first detector during a second analysis period different from the first analysis period. In other examples, the method comprises providing the selected inorganic ions from the dual core mass spectrometer to a first detector during a first analysis period and providing the selected organic ions from the dual core mass spectrometer to a second detector during a second analysis period.

In some instances, the method comprises providing inorganic ions to the dual core mass spectrometer during a first analysis period while preventing organic ion flow to the dual core mass spectrometer during the first analysis period. In other examples, the method comprises providing organic ions to the dual core mass spectrometer during a second analysis period while preventing inorganic ion flow to the dual core mass spectrometer during the second analysis period. In some examples, the method comprises configuring the ionization core with an inorganic ion source and an organic ion source separate from the inorganic ion source. In other examples, the method comprises configuring the dual core mass spectrometer co to comprise a dual quadrupole assembly.

In certain examples, the method comprises configuring the dual core mass spectrometer to comprise a dual quadrupole assembly fluidically coupled to a first detector through an interface and fluidically coupled to a second detector through the interface and a quadrupole assembly. In some examples, the method comprises configuring the interface to comprise a non-coplanar interface.

In another aspect, a system comprises a non-coplanar interface configured to fluidically couple an ionization core to a mass analyzer comprises at least one mass spectrometer core configured to select (i) ions from inorganic ions received from the ionization core and (ii) ions from organic ions received from the ionization core, wherein the non-coplanar interface is configured to receive the inorganic ions from the ionization core from a first plane and provide the inorganic ions to the mass analyzer, and wherein the non-coplanar interface is configured to receive the organic ions from the ionization core from a second plane, different from the first plane, and provide the received organic ions to the mass analyzer.

In certain embodiments, the non-coplanar interface comprises a first multipole assembly fluidically coupled to a second multipole assembly, in which the first multipole assembly and the second multipole assembly are positioned in different planes. In other embodiments, the non-coplanar interface is configured to receive the inorganic ions from an inorganic ion source of the ionization core positioned in the first plane. In some examples, the non-coplanar interface is configured to receive the organic ions from an organic ion source of the ionization core positioned in the second plane. In other examples, the non-coplanar interface is configured to sequentially provide the received inorganic ions and the received organic ions to the mass analyzer. In additional examples, the non-coplanar interface is configured to simultaneously provide the received inorganic ions and the received organic ions to the mass analyzer.

In some examples, the system comprises a deflector configured to provide the received organic ions to a first single core mass spectrometer present in the mass analyzer. In other examples, the deflector is configured to provide the received inorganic ions to a second single core mass spectrometer present in the mass analyzer.

In certain instances, the system comprises a deflector configured to provide the received organic ions and the received inorganic ions to a dual core mass spectrometer in the mass analyzer. In some examples, the deflector is configured to provide the received inorganic ions to the dual core mass spectrometer during application of a first radio frequency to the dual core mass spectrometer and to provide the received organic ions to the dual core mass spectrometer during application of a second radio frequency, different from the first radio frequency, to the dual core mass spectrometer.

In an additional aspect, a mass spectrometer comprises mass analyzer comprising at least one mass spectrometer core configured to select (i) ions from inorganic ions received from an ionization core and (ii) ions from organic ions received from the ionization core. The mass spectrometer may also comprise a non-coplanar interface configured to fluidically couple the ionization core to the mass analyzer, wherein the non-coplanar interface is configured to receive the inorganic ions from the ionization core from a first plane and provide the inorganic ions to the mass analyzer, and wherein the non-coplanar interface is configured to receive the organic ions from the ionization core from a second plane, different from the first plane, and provide the received organic ions to the mass analyzer.

In certain examples, the non-coplanar interface comprises a first multipole assembly fluidically coupled to a second multipole assembly, in which the first multipole assembly and the second multipole assembly are positioned in different planes. In some examples, the non-coplanar interface is configured to receive the inorganic ions from an inorganic ion source of the ionization core positioned in the first plane. In other examples, the non-coplanar interface is configured to receive the organic ions from an organic ion source of the ionization core positioned in the second plane. In some embodiments, the non-coplanar interface is configured to sequentially provide the received inorganic ions and the received organic ions to the mass analyzer.

In some instances, the non-coplanar interface is configured to simultaneously provide the received inorganic ions and the received organic ions to the mass analyzer.

In other examples, the system comprises a deflector configured to provide the received organic ions to a first single core mass spectrometer present in the mass analyzer. In some examples, the deflector is configured to provide the received inorganic ions to a second single core mass spectrometer present in the mass analyzer.

In certain examples, the system comprises a deflector configured to provide the received organic ions and the received inorganic ions to a dual core mass spectrometer in the mass analyzer. In other examples, the deflector is configured to provide the received inorganic ions to the dual core mass spectrometer during application of a first radio frequency to the dual core mass spectrometer and to provide the received organic ions to the dual core mass spectrometer during application of a second radio frequency, different from the first radio frequency, to the dual core mass spectrometer.

In another aspect, a dual core mass spectrometer configured to sequentially receive ions from an inorganic ionization source and an organic ionization source comprises a multipole assembly configured to select ions from the received inorganic ions using a first frequency and configured to select ions from the received organic ions using a second frequency different from the first frequency.

In certain examples, the system comprises a non-coplanar interface fluidically coupled to the dual core mass spectrometer, the non-coplanar interface comprising a first multipole assembly fluidically coupled to a second multipole assembly, in which the first multipole assembly and the second multipole assembly are positioned in different planes. In other examples, the non-coplanar interface is configured to provide inorganic ions to the dual core mass spectrometer from an inorganic ion source positioned in a first plane. In some examples, the non-coplanar interface is configured to provide organic ions to the dual core mass spectrometer from an organic ion source positioned in the second plane. In some examples, the non-coplanar interface is configured to sequentially provide the received inorganic ions and the received organic ions to the dual core mass spectrometer. In other examples, the non-coplanar interface is configured to simultaneously provide the received inorganic ions and the received organic ions to the mass analyzer. In some embodiments, the non-coplanar interface comprises an octopole assembly configured to provide the received organic ions to the dual core mass spectrometer without providing any received inorganic ions to the dual core mass spectrometer. In other embodiments, the octopole assembly is configured to provide the received inorganic ions to the dual core mass spectrometer without providing any received organic ions to the dual core mass spectrometer. In some examples, the octopole assembly is configured to provide the received organic ions and the received inorganic ions to the dual core mass spectrometer. In other examples, the octopole assembly is configured to provide the received inorganic ions to the dual core mass spectrometer during application of a first radio frequency to the dual core mass spectrometer and to provide the received organic ions to the dual core mass spectrometer during application of a second radio frequency, different from the first radio frequency, to the dual core mass spectrometer.

In an additional aspect, a method of selecting ions provided from an ionization core comprising two different ionization sources using a dual core mass spectrometer comprises sequentially providing ions from an ionization core comprising an inorganic ionization source and an organic ionization source to the dual core mass spectrometer, selecting ions from the provided ions from the inorganic ionization source using a first frequency provided to the dual core mass spectrometer, and selecting ions from the provided ions from the organic ionization source using a second frequency provided to the dual core mass spectrometer, in which the first frequency is different from the second frequency.

In certain examples, the method comprises configuring the dual core mass spectrometer to switch between the first frequency and the second frequency after a selection period. In other examples, the method comprises configuring the selection period to be 1 millisecond or less. In some embodiments, the method comprises providing an interface between the inorganic ionization source and the dual core mass spectrometer and between the organic ionization source and the dual core mass spectrometer, wherein the interface is configured to provide ions from the inorganic ionization source to the dual core mass spectrometer when the first frequency is provided to the dual core mass spectrometer and is configured to provide ions from the organic ionization source to the dual core mass spectrometer when the second frequency is provided to the dual core mass spectrometer.

In some instances, the method comprises configuring a detector to detect the selected inorganic ions when the first frequency is provided to the dual core mass spectrometer. In other instances, the method comprises the detector to detect the selected organic ions when the second frequency is provided to the dual core mass spectrometer. In some examples, the method comprises configuring the dual core mass spectrometer with a multipole assembly. In some examples, the method comprises configuring the multipole assembly to comprise a dual quadrupole assembly or a triple quadrupole assembly. In some examples, the method comprises configuring the detector to comprise at least one or more an electron multiplier, a Faraday cup, a multi-channel plate, a scintillation detector, an imaging detector or a time of flight device.

In another aspect, a mass spectrometer comprises an ionization core comprising at least a first ionization source and a second ionization source, in which the first and second ionization sources are non-coplanar ionization sources, a mass analyzer configured to select ions received from the non-coplanar ionization sources, and an interface configured to sequentially provide ions from the first ionization core to the mass analyzer during a first period and provide ions from the second ionization core to the mass analyzer during a second period.

In certain embodiments, the mass spectrometer comprises a mass analyzer fluidically coupled to the interface. In some examples, the mass analyzer comprises a first single core mass spectrometer and a second single core mass spectrometer, in which the first single core mass spectrometer is configured to select the ions from the first ionization source and the second single core mass spectrometer is configured to select the ions from the second ionization source. In other examples, the mass analyzer comprises a dual core mass spectrometer. In some examples, the dual core mass spectrometer is configured to select the ions from the first ionization source using a first frequency and is configured to select the ions from the second ionization source a second frequency different from the first frequency.

In some examples, the mass spectrometer comprises a detector fluidically coupled to the mass analyzer, in which the detector is configured to detect the ions selected from the inorganic ions and to detect the ions selected from the organic ions, in which the detector comprises an electron multiplier, a Faraday cup, a multi-channel plate, a scintillation detector, a time of flight device or an imaging detector. In some instances, the first ionization source comprises one or more of an inductively coupled plasma, a capacitively coupled plasma, microwave plasma, a flame, an arc and a spark. In other instances, the second ionization source comprises one or more of an electrospray ionization source, a chemical ionization source, an atmospheric pressure ionization source, an atmospheric pressure chemical ionization source, a desorption electrospray ionization source, a matrix assisted laser desorption ionization source, a thermospray ionization source, a thermal desorption ionization source, an electron impact ionization source, a field ionization source, a secondary ion source, a plasma desorption source, a thermal ionization source, an electrohydrodynamic ionization source, a direct ionization on silicon ionization source, a direct analysis in real time ionization source or a fast atom bombardment source.

In some examples, the dual core mass spectrometer comprises a quadrupole rod assembly or a triple quadrupole rod assembly.

In an additional aspect, a time-of-flight (TOF) mass spectrometer is provided that is configured to sequentially receive ions from a first ionization source and a second ionization source which is non-coplanar with the first ionization source, in which the time of flight mass spectrometer is configured detect the received ions from the first ionization source and a second ionization source.

In certain examples, the TOF mass spectrometer comprises a dual core mass spectrometer fluidically coupled to a time of flight device. In other examples, the dual core mass spectrometer comprises a multipole assembly configured to select inorganic ions from the first ionization source during a first period and is configured to select organic ions from second ionization source during a second period.

In some embodiments, the TOF mass spectrometer comprises a first single core mass spectrometer and a second single core mass spectrometer. In certain instances, the first single core mass spectrometer is fluidically coupled to a time of flight device and the second single core mass detector is fluidically coupled to a detector comprising one or more of an electron multiplier, a Faraday cup, a multi-channel plate, a scintillation detector, and an imaging detector.

In some examples, the TOF mass spectrometer is configured to provide inorganic ions from the first ionization source to the first single core mass spectrometer during a first period and provide organic ions from the second ionization source to the second single core mass spectrometer during the first period, in which the mass spectrometer is configured to detect selected inorganic ions or selected organic ions during the first period.

In other examples, the TOF mass spectrometer is configured to provide inorganic ions from the first ionization source to the first single core mass spectrometer during a first period and provide organic ions from the second ionization source to the second single core mass spectrometer during a second period.

In some examples, the TOF mass spectrometer comprises an interface configured to receive ions from the first ionization source and the second ionization source, in which the interface is configured to provide inorganic ions from the first ionization source to the first single core mass spectrometer during a first period. In some embodiments, the interface is configured to provide organic ions from the second ionization source to the second single core mass spectrometer during a second period. In some examples, the interface comprises a stacked multipole assembly.

In another aspect, a time-of-flight mass spectrometer is configured to simultaneously receive ions from an ionization core comprising two non-coplanar ionization sources and detect the received ions from the ionization core.

In certain examples, the mass spectrometer comprises a dual core mass spectrometer fluidically coupled to a time of flight device. In some examples, the dual core mass spectrometer comprises a multipole assembly configured to select inorganic ions from the ionization core during a first period and is configured to select organic ions from ionization core during the first period. In other examples, the time of flight mass spectrometer comprises a first single core mass spectrometer and a second single core mass spectrometer. In some embodiments, the first single core mass spectrometer is fluidically coupled to a time of flight device and the second single core mass detector is fluidically coupled to a detector comprising one or more of an electron multiplier, a Faraday cup, a multi-channel plate, a scintillation detector, and an imaging detector. In other embodiments, each of the first the mass spectrometer is configured to provide inorganic ions from the ionization core to the first single core mass spectrometer during a first period and provide organic ions from ionization core to the second single core mass spectrometer during the first period. In certain examples, each of the first single core mass spectrometer and the second single core mass spectrometer comprises a multipole assembly.

In some instances, the TOF mass spectrometer comprises an interface configured to receive ions from the first ionization source and the second ionization source, in which the interface is configured to provide inorganic ions from the first ionization source to the first single core mass spectrometer during a first period. In some embodiments, the interface is configured to provide organic ions from the second ionization source to the second single core mass spectrometer during the first period. In other embodiments, the interface comprises a stacked multipole assembly.

In an additional aspect, a time-of-flight mass spectrometer is configured to sequentially receive ions from an ionization core comprising an inorganic ionization source positioned in a first plane and an organic ionization source positioned in a second plane, in which the first plane and the second plane are non-coplanar. The time-of-flight mass spectrometer can be configured to receive and select ions from the inorganic ionization core during a first period and to receive and select ions from the organic ionization core during a second period.

In another aspect, a system comprises an ionization core configured to receive a sample and provide both inorganic ions and organic ions using the received sample, and a mass analyzer fluidically coupled to the ionization core, in which the mass analyzer comprises at least two mass spectrometer cores configured to use common vacuum pumps and a processor to select (i) ions from the inorganic ions received from the ionization core and (ii) ions from the organic ions received from the ionization core.

Additional aspects, features, examples and embodiments are described in more detail below.

BRIEF DESCRIPTION OF THE SEVERAL VIEW OF THE DRAWINGS

Certain configurations of systems and methods used to recycle argon used to sustain an inductively coupled plasma in a mass spectrometer are described below with reference to the accompanying figures in which.

DETAILED DESCRIPTION

Various components are described below in connection with mass spectrometers that use one, two, three or more ionization cores in combination with one, two, three or more mass spectrometer cores to permit analysis of substantially all analyte species in a sample which have a mass ranging, for example, from about three, four or five atomic mass units (amu's) to about two-thousand amu's or more. In some examples, the mass spectrometer cores may utilize common components such as a processor, pumps, detectors, etc. to simplify the overall construction of the systems while still providing increased flexibility for sample analysis. The core components can be used together to provide an inorganic organic mass spectrometer (IOMS) which is configured to detect both inorganic and organic analytes present in a sample.

Certain configurations described herein refer to mass spectrometer cores (MSCs) being present in a system or mass analyzer which is part of a larger system. The MSCs may be described as single MS cores (SMSCs), which are designed to filter/provide ions of a single type, e.g., inorganic ions or organic ions, or dual core MSs (DCMSs) which can filter/provide ions of more than a single type, e.g., can provide inorganic ions and organic ions (either sequentially or simultaneously) depending on the particular configuration of the DCMS. In some examples, the MSC may comprise sub-cores, e.g., individual multipole assemblies, which can be assembled together to form a SMSC or a DCMS depending on the overall configuration of the system. If desired, a SMSC can be converted into a DCMS by rearrangement or altering the electrical coupling (and/or fluidic coupling) of the various sub-core components and/or other components present in the system, and a DCMS can be converted into a SMSC by rearrangement of or altering the electrical coupling (and/or fluidic coupling) of the various sub-core components and/or other components present in the system. While the term "dual core" is used in certain instances, the dual core MS may comprise a single set of assembled common hardware which can be used in different configurations to provide different types of ions, e.g., to provide or output two or more types of ions such as inorganic ions and organic ions depending on the particular configuration of the dual core MS.

Figure 1A:
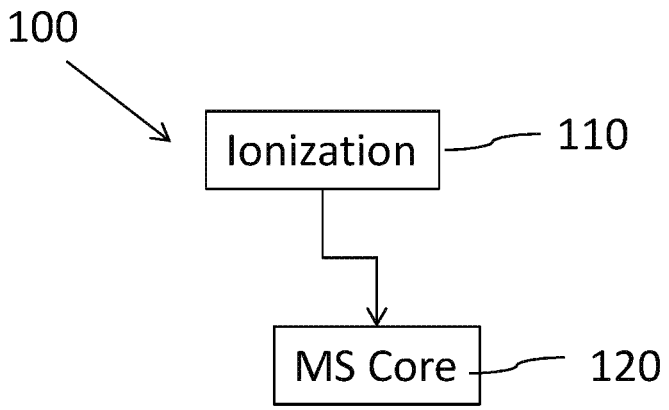
FIG. 1A is a block diagram of a system comprising an ionization core and a mass analyzer comprising a MS core, in accordance with certain examples.

In certain embodiments and referring to FIG. 1A, a simplified block diagram of some core components of a system is shown. The system 100 comprises at least one ionization core 110 fluidically coupled to at least one mass analyzer which may comprise one or more mass spectrometer core 120. The ionization cores(s) 110 can be configured to ionize analyte in the sample using various techniques. For example, in some instances, an ionization source can be present in the ionization core(s) 110 to ionize elemental species, e.g., to ionize inorganic species, prior to providing the elemental ions to the MS core 120. In other instances, an ionization source can be present in the ionization core(s) 110 to produce/ionize molecular species, e.g., to ionize organic species, prior to providing the molecular ions to the core 120. In certain configurations as noted herein, the system 100 may be configured to ionize inorganic species and organic species prior to providing the ions to the core 120. The MS core(s) 120 can be configured to filter/detect ions having a particular mass-to-charge. In some examples, the core 120 can be designed to filter/select/detect inorganic ions and to filter/select/detect organic ions depending on the particular components which are present. While not shown, the MS core(s) 120 typically comprises common components used by the one, two, three or more mass spectrometer cores (MSCs) which may be present in the mass analyzer. For example, common gas controllers, processors, power supplies, vacuum pumps or even a common detector may be used by different mass MSCs present in the mass analyzer.

The system 100 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 100 between any one or more of the cores 110 and 120. Further, the mass analyzer may be separated into two or more individual cores as noted in more detail below.

Figure 1B:
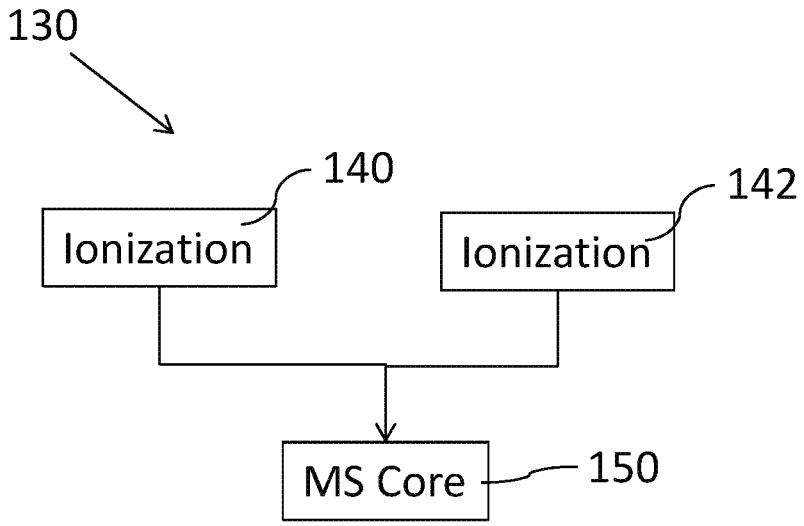
FIG. 1B is a block diagram of a system comprising two ionization cores and a mass analyzer comprising a MS core, in accordance with certain examples.

In some instances as shown in FIG. 1B, a system 130 may comprise two ionization cores 140, 142 coupled to a mass analyzer comprising a MS core 150. While not shown, an interface, valve, or other device (not shown) can be present between the ionization cores 140, 142 and the MS core 150 to provide species from the one of ionization cores 140, 142 to the MS core 150 during use of the system 130. In other configurations, the interface, valve or device can be configured to provide species from the ionization cores 140, 142 simultaneously to the MS core 150. In some examples, the ionization cores 140, 142 can be configured to ionize analyte in the sample using various but different techniques. For example, in some instances, an ionization source can be present in the ionization core(s) 140 to ionize elemental species, e.g., to ionize inorganic species, prior to providing the elemental ions to the MS core 150. In other instances, an ionization source can be present in the ionization core(s) 142 to produce/ionize molecular species, e.g., to ionize organic species, prior to providing the molecular ions to the MS core 150. In certain configurations as noted herein, the system 130 may be configured to ionize both inorganic species and organic species using the ionization cores 140, 142 prior to providing the ions to the MS core 150. The mass analyzer comprising the MS core(s) 150 can be configured to filter/detect ions having a particular mass-to-charge. In some examples, the MS core 150 can be designed to filter/select/detect inorganic ions and to filter/select/detect organic ions depending on the particular components which are present. While not shown, the mass analyzer typically comprises common components used by the one, two, three or more mass spectrometer cores (MSCs) which may be present in the mass analyzer. For example, common gas controllers, processors, power supplies, detectors and vacuum pumps may be used by different mass MSCs present in the mass analyzer. The system 130 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 130 between any one or more of the cores 140, 142, and 150. Further, the mass analyzer may be separated into two or more individual cores as noted in more detail below.

Figure 1C:
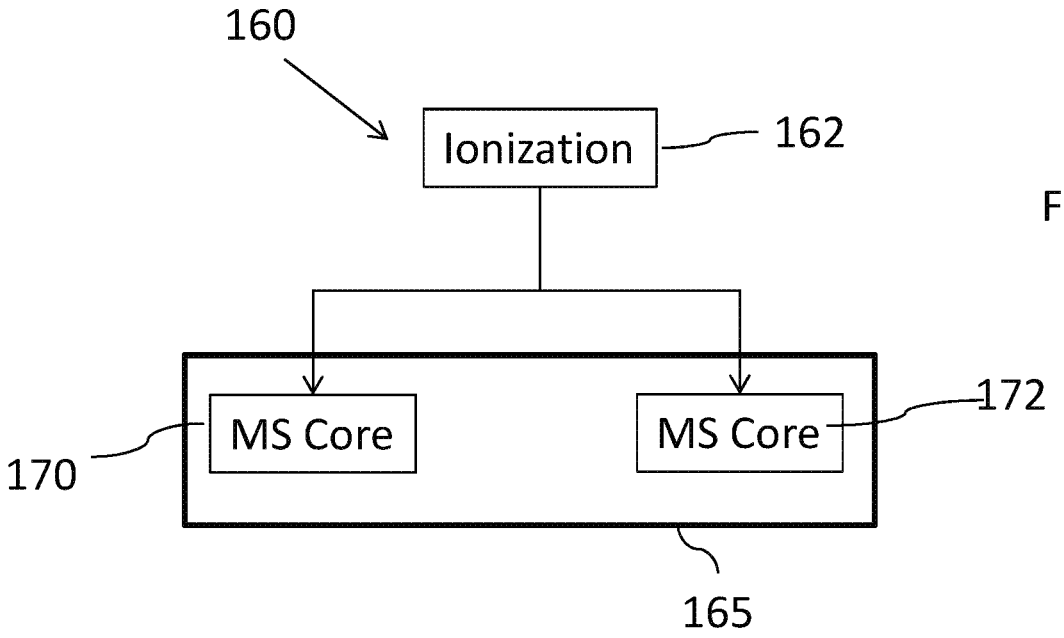
FIG. 1C is a block diagram of a system comprising an ionization core and a mass analyzer comprising two MS cores, in accordance with certain examples.

In certain embodiments and referring to FIG. 1C, a system 160 may comprise at least one ionization core 162 fluidically coupled to a mass analyzer 165 comprising at least two MS cores 170, 172. The ionization cores(s) 162 can be configured to ionize analyte in the sample using various techniques. For example, in some instances, an ionization source can be present in the ionization core(s) 162 to ionize elemental species, e.g., to ionize inorganic species, prior to providing the elemental ions to the MS cores 170, 172. In other instances, an ionization source can be present in the ionization core(s) 162 to produce/ionize molecular species, e.g., to ionize organic species, prior to providing the molecular ions to the MS cores 170, 172. In certain configurations as noted herein, the system 160 may be configured to ionize inorganic species and organic species prior to providing the ions to the MS cores 170, 172. While not shown, an interface can be present between the core 162 and MS cores 170, 172 to provide ions to either or both of the MS core(s) 170, 172. The MS cores 170, 172 can independently be configured to filter/detect ions having a particular mass-to-charge. In some examples, the MS cores 170, 172 can be designed to filter/select/detect inorganic ions and to filter/select/detect organic ions depending on the particular components which are present. While not shown, the mass analyzer 165 typically comprise common components used by the one, two, three or more mass spectrometer cores (MSCs) which may be present in the mass analyzer 165. For example, common gas controllers, processors, power supplies, detectors and vacuum pumps may be used by different MS cores present in the mass analyzer 165. The system 160 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 160 between any one or more of the cores 162, 170 and 172.

Figure 1D:
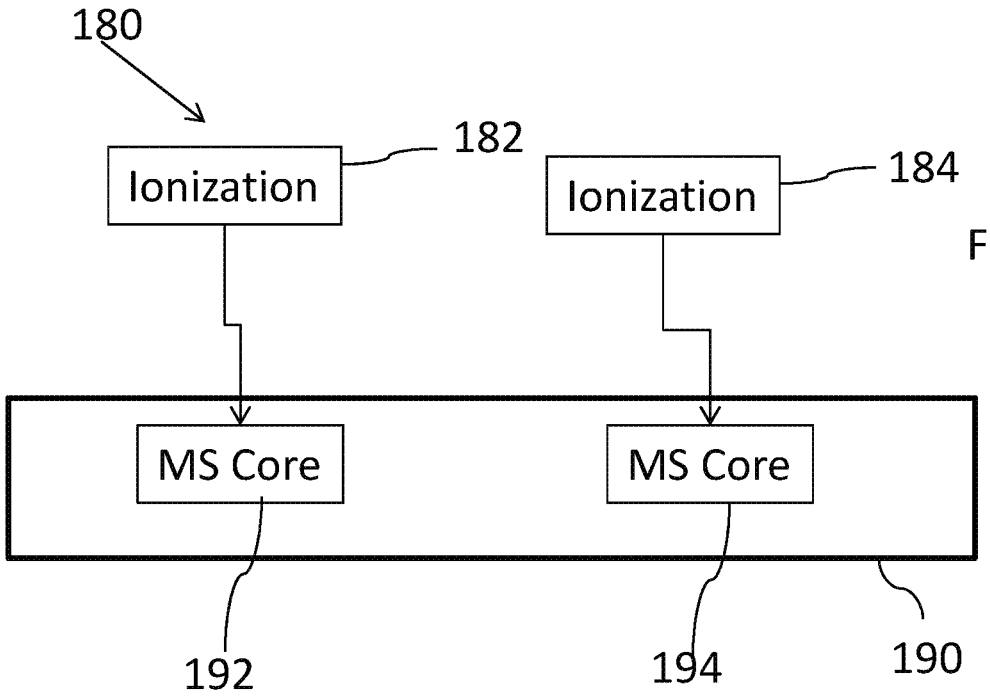
FIG. 1D is a block diagram of a system comprising two ionization cores and a mass analyzer comprising two MS cores, in accordance with certain examples.

In some examples as shown in FIG. 1D, a system 180 may comprise two ionization cores 180, 182 each of which is fluidically coupled to a respective MS core 192, 194 present in a mass analyzer 190. While not shown, an interface, valve, or other device (not shown) can be present between the sample ionization cores 182, 184 if it is desired to provide ions from one of the ionization cores 182, 184 to both of the MS cores 192, 194 during use of the system 180. In other configurations, the interface, valve or device can be configured to provide species from one of the ionization cores 182, 184 simultaneously to the one of the MS cores 192, 194. In some examples, the ionization cores 182, 184 can be configured to ionize analyte in the sample using various but different techniques. For example, in certain instances, an ionization source can be present in the ionization core(s) 182 to ionize elemental species, e.g., to ionize inorganic species, prior to providing the elemental ions to the MS core 192. In other instances, an ionization source can be present in the ionization core(s) 184 to produce/ionize molecular species, e.g., to ionize organic species, prior to providing the molecular ions to the MS core 194. In certain configurations as noted herein, the system 180 may be configured to ionize both inorganic species and organic species using the ionization cores 182, 184 prior to providing the ions to the MS cores 192, 194. The MS core(s) 192, 194 can independently be configured to filter/detect ions having a particular mass-to-charge. In some examples, the MS cores 192, 194 can be designed to filter/select/detect inorganic ions and to filter/select/detect organic ions depending on the particular components which are present. While not shown, the mass analyzer 190 typically comprise common components used by the one, two, three or more mass spectrometer cores (MSCs) which may be present in the mass analyzer 190. For example, common gas controllers, processors, power supplies, detectors and vacuum pumps can be in, on or coupled to the mass analyzer 190 and may be used by different mass MSCs present in the mass analyzer 190. The system 180 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 180 between any one or more of the cores 182, 184, 192 and 194.

Figure 2A:
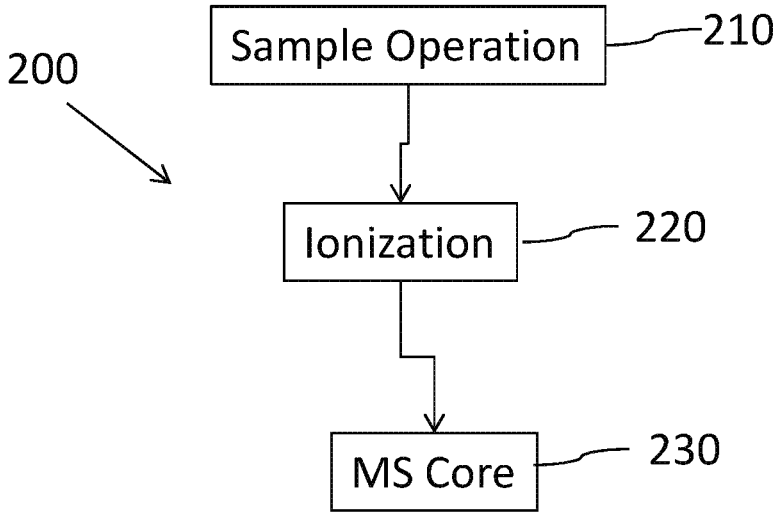
FIG. 2A is a block diagram of a system comprising a sample operation core, an ionization core and a mass analyzer comprising a MS core, in accordance with certain embodiments.

In certain embodiments, the systems described herein may also comprise one or more sample operation/processing cores fluidically coupled to one or more ionization cores. Referring to FIG. 2A, a system 200 comprises a sample operation core(s) 210 fluidically coupled to an ionization core(s) 220, which itself is fluidically coupled to a mass analyzer comprising a MS core(s) 230. Various configurations for each of the cores 210, 220 and 230 are discussed in more detail below. In use of the system 200, a sample can be introduced into the sample operation core(s) 210, and analyte in the sample can be separated, reacted, derivatized, sorted, modified or otherwise acted on in some manner prior to providing the analyte species to the ionization core(s) 220. The ionization cores(s) 220 can be configured to ionize analyte in the sample using various techniques. For example, in some instances, an ionization source can be present in the ionization core(s) 220 to ionize elemental species, e.g., to ionize inorganic species, prior to providing the elemental ions to the core 230. In other instances, an ionization source can be present in the ionization core(s) 220 to produce/ionize molecular species, e.g., to ionize organic species, prior to providing the molecular ions to the core 230. In certain configurations as noted herein, the system 200 may be configured to ionize inorganic species and organic species prior to providing the ions to the MS core 230. The MS core 230 can be configured to filter/detect ions having a particular mass-to-charge. In some examples, the MS core 230 can be designed to filter/select/detect inorganic ions and to filter/select/detect organic ions depending on the particular components which are present. While not shown, the mass analyzer comprising the MS core 230 typically comprises common components used by the one, two, three or more mass spectrometer cores (MSCs) which may be present in the mass analyzer. For example, common gas controllers, processors, power supplies, detectors and vacuum pumps may be used by different mass MSCs present in the mass analyzer. The system 200 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 200 between any one or more of the cores 210, 220 and 230.

Figure 2B:
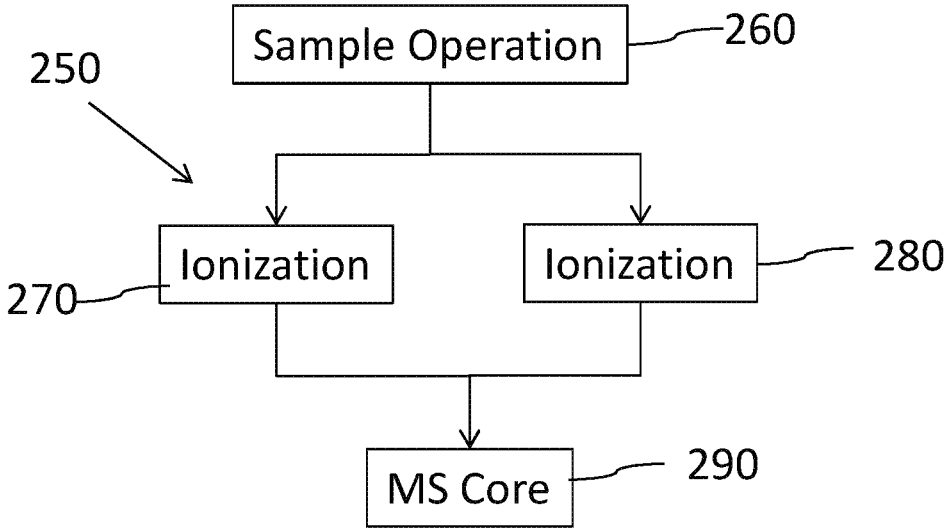
FIG. 2B is a block diagram of a system comprising a sample operation core, two ionization cores and a mass analyzer comprising a MS core, in accordance with certain embodiments.

In certain configurations, any one or more of the cores shown in FIG. 2A can be separated or split into two or more cores. For example and referring to FIG. 2B, a system 250 comprises a sample operation core 260, a first ionization core 270 fluidically coupled to the sample operation core 260 and a second ionization core 280 fluidically coupled to the sample operation core 260. Each of the cores 270, 280 is also fluidically coupled to a common mass analyzer comprising a MS core 290. While not shown, an interface, valve, or other device can be present between the sample operation core 260 and the ionization cores 270, 280 to provide species from the sample operation core 260 to only one of the ionization cores 270, 280 at a selected time during use of the system 250. In other configurations, the interface, valve or device can be configured to provide species from the sample operation core 260 to the ionization cores 270, 280 simultaneously. Similarly, a valve, interface or other device (not shown) can be present between the ionization cores 270, 280 and the MS cores 290 to provide species from the one of the ionization cores 270, 280 to the MS core 290 at a selected time during use of the system 250. In other configurations, the interface, valve or device can be configured to provide species from the ionization cores 270, 280 at the same time to the MS core 290. In use of the system 250, a sample can be introduced into the sample operation core(s) 260, and analyte in the sample can be separated, reacted, derivatized, sorted, modified or otherwise acted on in some manner prior to providing the analyte species to one or both of the ionization core(s) 270, 280. In some instances, the ionization cores 270, 280 can be configured to ionize analyte in the sample using various but different techniques. For example, in some instances, an ionization source can be present in the ionization core(s) 270 to ionize elemental species, e.g., to ionize inorganic species, prior to providing the elemental ions to the MS core 290. In other instances, an ionization source can be present in the ionization core(s) 280 to produce/ionize molecular species, e.g., to ionize organic species, prior to providing the molecular ions to the MS core 290. In certain configurations as noted herein, the system 250 may be configured to ionize both inorganic species and organic species using the ionization cores 270, 280 prior to providing the ions to the MS core 290. The MS core(s) 290 can be configured to filter/detect ions having a particular mass-to-charge. In some examples, the MS core 290 can be designed to filter/select/detect inorganic ions and to filter/select/detect organic ions depending on the particular components which are present. While not shown, the mass analyzer comprising the MS cores 290 typically comprises common components used by the one, two, three or more mass spectrometer cores (MSCs) which may be present in the mass analyzer. For example, common gas controllers, processors, power supplies, detectors and vacuum pumps may be used by different mass MSCs present in the mass analyzer of the system 250. The system 250 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 200 between any one or more of the cores 260, 270, 280 and 290.

Figure 3:
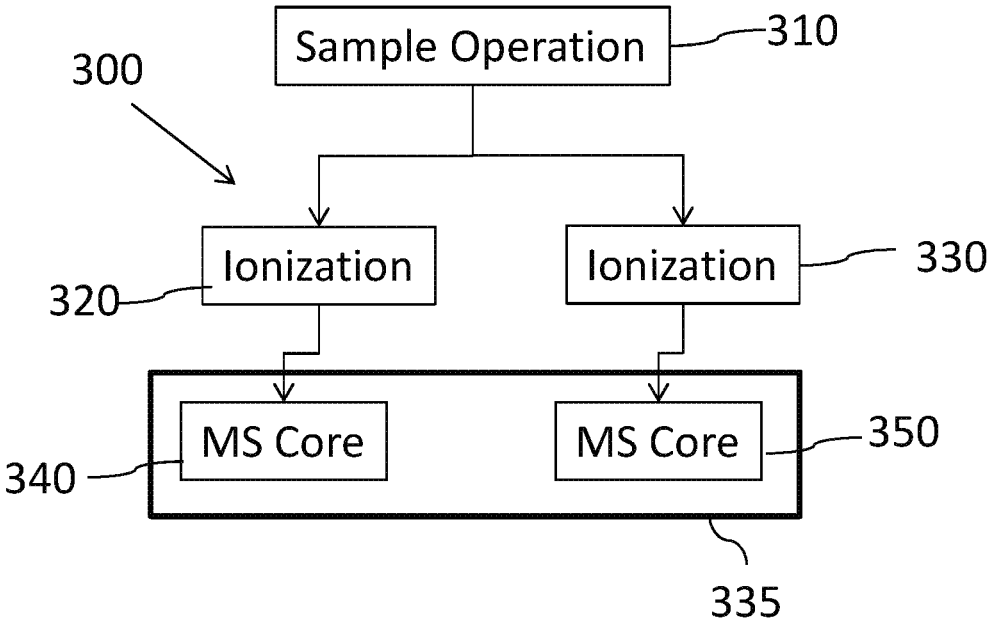
FIG. 3 is a block diagram of a system comprising a sample operation core, two ionization cores and a mass analyzer comprising two MS cores, in accordance with certain configurations.

In other configurations, the mass analyzers described herein may comprise two or more separate MS cores. As noted herein, even though the MS cores can be separated, they still can share certain common components including gas controllers, processors, power supplies, detectors and/or vacuum pumps. Referring to FIG. 3, a system 300 is shown that comprises a sample operation core 310, a first ionization core 320, a second ionization core 330, and a mass analyzer 335 comprising a first MS core 340 and a second MS core 350. The sample operation core 310 is fluidically coupled to each of the ionization cores 320, 330. While not shown, an interface, valve, or other device can be present between the sample operation core 310 and the ionization cores 320, 330 to provide species from the sample operation core 310 to only one of the ionization cores 320, 330 at a selected time during use of the system 300. In other configurations, the interface, valve or device can be configured to provide species from the sample operation core 310 to the ionization cores 320, 330 simultaneously. The ionization core 320 is fluidically coupled to the first MS core 340, and the second ionization core 330 is fluidically coupled to the second MS core 350. In use of the system 300, a sample can be introduced into the sample operation core(s) 310, and analyte in the sample can be separated, reacted, derivatized, sorted, modified or otherwise acted on in some manner prior to providing the analyte species to one or both of the ionization core(s) 320, 330. In some instances, the ionization cores 320, 330 can be configured to ionize analyte in the sample using various but different techniques. For example, in some instances, an ionization source can be present in the ionization core(s) 320 to ionize elemental species, e.g., to ionize inorganic species, prior to providing the elemental ions to the core 340. In other instances, an ionization source can be present in the ionization core(s) 330 to produce/ionize molecular species, e.g., to ionize organic species, prior to providing the molecular ions to the core 350. In certain configurations as noted herein, the system 300 may be configured to ionize both inorganic species and organic species using the ionization cores 320, 330 prior to providing the ions to the MS cores 340, 350. The MS core(s) 340, 350 can be configured to filter/detect ions having a particular mass-to-charge. In some examples, the MS core 340 can be designed to filter/select/detect inorganic ions, and the MS core 350 can be designed to filter/select/detect organic ions depending on the particular components which are present. While not shown, the mass analyzer 335 typically comprises common components used by the one, two, three or more mass spectrometer cores (MSCs) which may independently be present in the mass analyzer 335. For example, common gas controllers, processors, power supplies, detectors and vacuum pumps may be used by different mass MSCs present in the mass analyzer 335, though each of the MS cores 340, 350 may comprise its own gas controllers, processors, power supplies, detector and/or vacuum pumps if desired. The system 300 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 300 between any one or more of the cores 310, 320, 330, 340 and 350.

Figure 4:
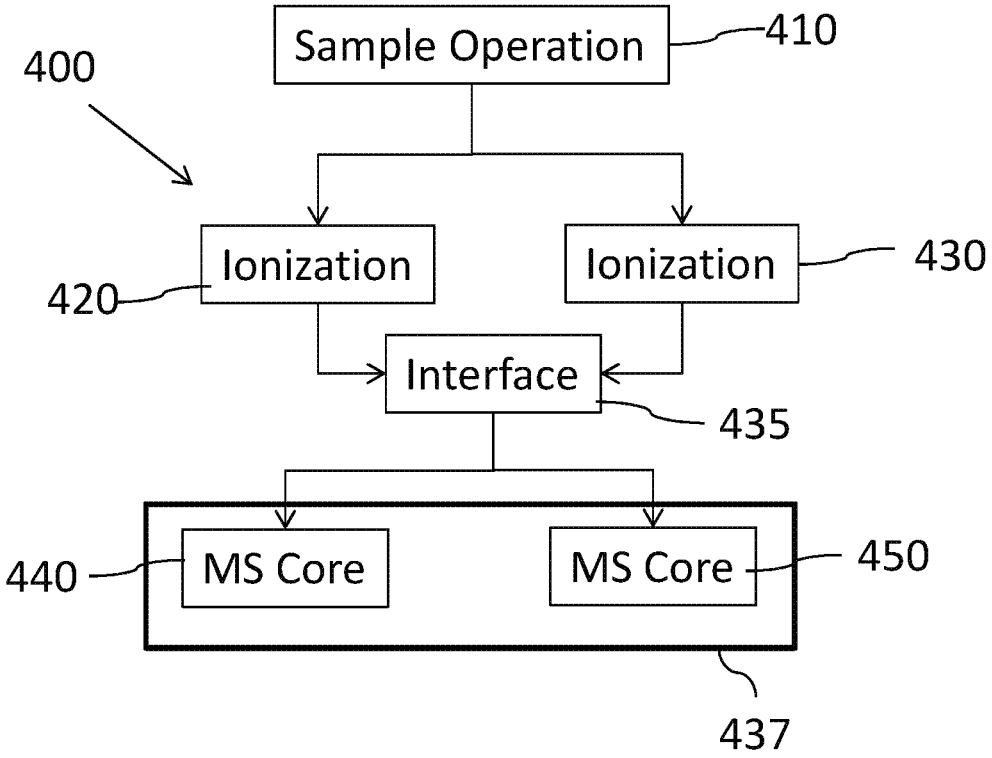
FIG. 4 is a block diagram of a system comprising a sample operation core, two ionization cores, an interface and a mass analyzer comprising two MS cores, in accordance with certain configurations.

In some instances where two ionization cores and two MS cores are present, it may be desirable to provide ions from different ionization cores to different MS cores. For example and referring to FIG. 4, a system 400 is shown that comprises a sample operation core 410, a first ionization core 420, a second ionization core 430, an interface 435, and a mass analyzer 437 comprising a first MS core 440 and a second MS core 450. The sample operation core 410 is fluidically coupled to each of the ionization cores 420, 430. While not shown, an interface, valve, or other device can be present between the sample operation core 410 and the ionization cores 420, 430 to provide species from the sample operation core 410 to only one of the ionization cores 420, 430 at a selected time during use of the system 400. In other configurations, the interface, valve or device can be configured to provide species from the sample operation core 410 to the ionization cores 420, 430 simultaneously. The ionization core 420 is fluidically coupled to the interface 435, and the ionization core 430 is fluidically coupled to the interface 435. The interface 435 is fluidically coupled to each of a first MS core 440 and a second MS core 450. In use of the system 400, a sample can be introduced into the sample operation core(s) 410, and analyte in the sample can be separated, reacted, derivatized, sorted, modified or otherwise acted on in some manner prior to providing the analyte species to one or both of the ionization core(s) 420, 430. In some instances, the ionization cores 420, 430 can be configured to ionize analyte in the sample using various but different techniques. For example, in some instances, an ionization source can be present in the ionization core(s) 420 to ionize elemental species, e.g., to ionize inorganic species, prior to providing the elemental ions to the interface 435. In other instances, an ionization source can be present in the ionization core(s) 430 to produce/ionize molecular species, e.g., to ionize organic species, prior to providing the molecular ions to the interface 435. In certain configurations as noted herein, the system 400 may be configured to ionize both inorganic species and organic species using the ionization cores 420, 330 prior to providing the ions to the interface 435. The interface 435 can be configured to provide ions to either or both of the MS core(s) 440, 450, each of which can be configured to filter/detect ions having a particular mass-to-charge. In some examples, the MS core 440 can be designed to filter/select/detect inorganic ions, and the MS core 450 can be designed to filter/select/detect organic ions depending on the particular components which are present. In some examples, the MS cores 440, 450 are configured differently with a different filtering device and/or detection device. While not shown, the mass analyzer 437 typically comprises common components used by the one, two, three or more mass spectrometer cores (MSCs) which may independently be present in the mass analyzer 437. For example, common gas controllers, processors, power supplies, detectors and vacuum pumps may be used by different mass MSCs present in the mass analyzer 437, though each of the MS cores 440, 450 may comprise its own gas controllers, processors, power supplies, detectors and/or vacuum pumps if desired. The system 400 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 400 between any one or more of the cores 410. 420, 430, 440 and 450.

Figure 5:
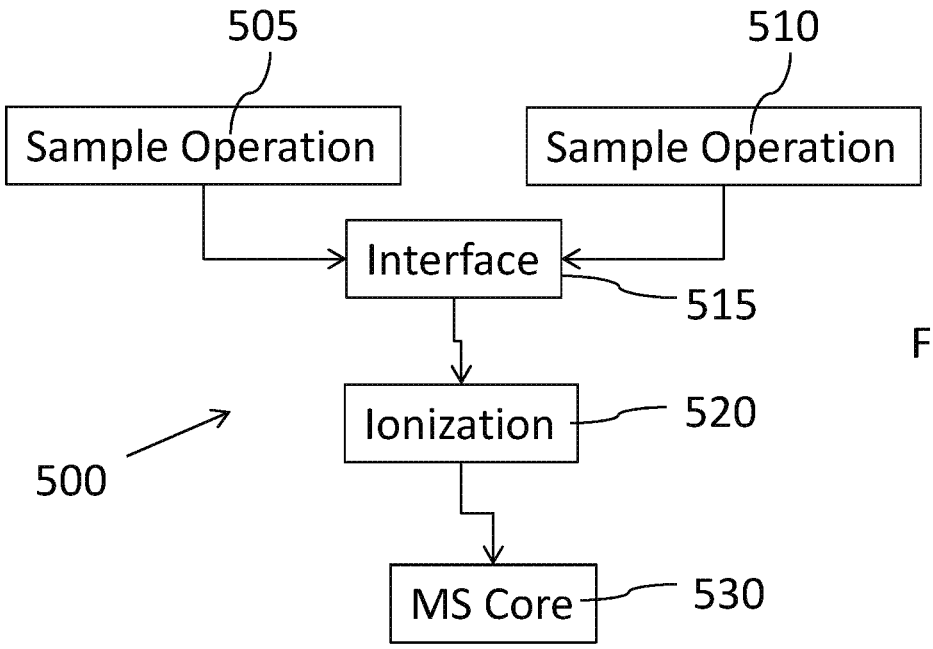
FIG. 5 is a block diagram of a system comprising two sample operation cores, an interface, an ionization core, and a mass analyzer comprising a MS core, in accordance with certain examples.

In certain examples, the sample operation core can be split into two or more cores if desired. For example, it may be desirable to perform different operations when inorganic ions are to be provided to an ionization core or MS core compared to when organic ions are to be provided to an ionization core or MS core. Referring to FIG. 5, a system 500 is shown that comprises a first sample operation core 505 and a second sample operation core 510. Each of the cores 505, 510 is fluidically coupled to an interface 515. The interface 515 is fluidically coupled to an ionization core 520, which itself is fluidically coupled to a mass analyzer comprising a MS core 530. In use of the system 500, a sample can be introduced into one or both of the sample operation cores 505, 550, and analyte in the sample can be separated, reacted, derivatized, sorted, modified or otherwise acted on in some manner prior to providing the analyte species to the interface 515. The interface 515 can be configured to permit passage of sample from one or both of the sample operation cores 505, 510 to the ionization core 520. The ionization cores(s) 520 can be configured to ionize analyte in the sample using various techniques. For example, in some instances, an ionization source can be present in the ionization core(s) 520 to ionize elemental species, e.g., to ionize inorganic species, prior to providing the elemental ions to the MS core 530. In other instances, an ionization source can be present in the ionization core(s) 520 to produce/ionize molecular species, e.g., to ionize organic species, prior to providing the molecular ions to the MS core 530. In certain configurations as noted herein, the system 500 may be configured to ionize inorganic species and organic species prior to providing the ions to the MS core 530. The MS core 530 can be configured to filter/detect ions having a particular mass-to-charge. In some examples, the MS core 530 can be designed to filter/select/detect inorganic ions and to filter/select/detect organic ions depending on the particular components which are present. While not shown, the mass analyzer comprising the MS core 530 typically comprises common components used by the one, two, three or more mass spectrometer cores (MSCs) which may be present in the mass analyzer. For example, common gas controllers, processors, power supplies, detectors and vacuum pumps may be used by different mass MSCs present in the mass analyzer. The system 500 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 500 between any one or more of the cores 505, 510, 520 and 530.

Figure 6:
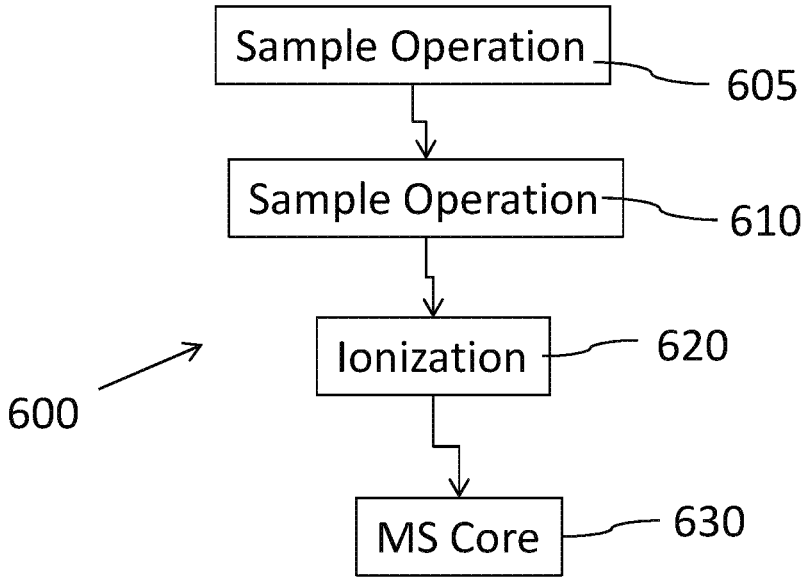
FIG. 6 is a block diagram of a system comprising two serially arranged sample operation cores, an ionization core, and a mass analyzer comprising a MS core, in accordance with certain configurations.

In certain configurations, the sample operation core can be split into two or more cores fluidically coupled to each other if desired. For example, it may be desirable to perform different operations when inorganic ions are to be provided to an ionization core or MS core compared to when organic ions are to be provided to an ionization core or MS core. Referring to FIG. 6, a system 600 is shown that comprises a first sample operation core 605 fluidically coupled to a second sample operation core 610. Depending on the nature of the analyte sample, one of the cores 605, 610 may be present in a passive configuration and generally pass sample without performing any operations on the sample, whereas in other instances each of the cores 605, 610 performs one or more sample operations including, but not limited to, separation, reaction, derivatization, sorting, modification or otherwise acting on the sample in some manner prior to providing the analyte species to the ionization core 620. The ionization cores(s) 620 can be configured to ionize analyte in the sample using various techniques. For example, in some instances, an ionization source can be present in the ionization core(s) 620 to ionize elemental species, e.g., to ionize inorganic species, prior to providing the elemental ions to a mass analyzer comprising a MS core 630. In other instances, an ionization source can be present in the ionization core(s) 620 to produce/ionize molecular species, e.g., to ionize organic species, prior to providing the molecular ions to the MS core 630. In certain configurations as noted herein, the system 600 may be configured to ionize inorganic species and organic species prior to providing the ions to the MS core 630. The MS core 630 can be configured to filter/detect ions having a particular mass-to-charge. In some examples, the MS core 630 can be designed to filter/select/detect inorganic ions and to filter/select/detect organic ions depending on the particular components which are present. While not shown, the mass analyzer comprising the MS core 630 typically comprises common components used by the one, two, three or more mass spectrometer cores (MSCs) which may be present in the mass analyzer. For example, common gas controllers, processors, power supplies, detectors and vacuum pumps may be used by different mass MSCs present in the mass analyzer. The system 600 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 600 between any one or more of the cores 605, 610, 620 and 630.

Figure 7:
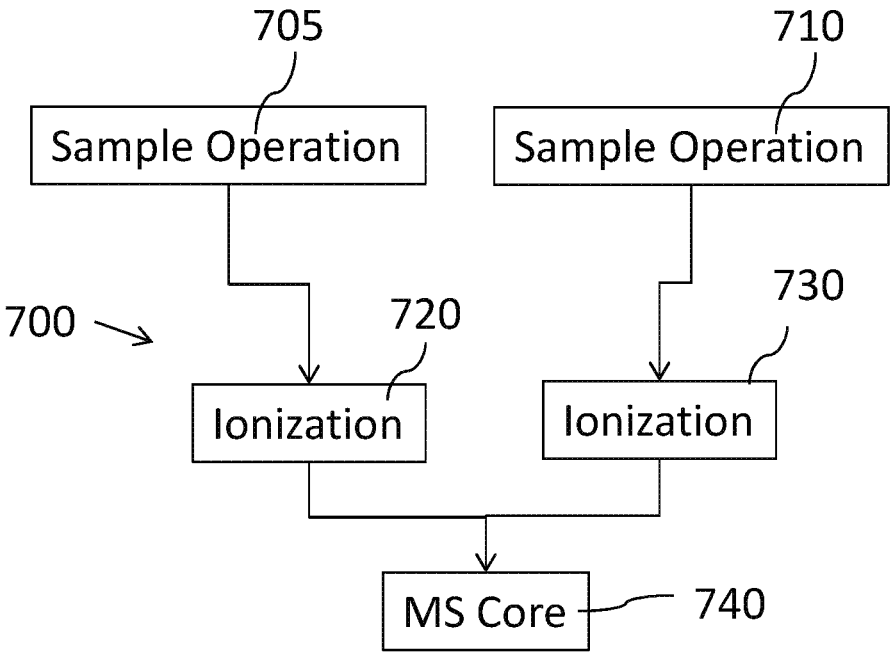
FIG. 7 is a block diagram of a system comprising two sample operation cores, two ionization cores, and a mass analyzer comprising a MS core, in accordance with certain examples.

In certain configurations where two or more sample operation cores are present, each sample operation core may be fluidically coupled to a respective ionization core. For example and referring to FIG. 7, a system 700 comprises a first sample operation core 705, a second sample operation core 710, a first ionization core 720 fluidically coupled to the first sample operation core 705 and a second ionization core 730 fluidically coupled to the second sample operation core 710. Each of the cores 720, 730 is also fluidically coupled to a common mass analyzer comprising a MS core 740. While not shown, a valve, interface or other device can be present between the ionization cores 720, 730 and the MS core 740 to provide species from the one of the ionization cores 720, 730 to the MS core 740 at a selected time during use of the system 700. In other configurations, the interface, valve or device can be configured to provide species from the ionization cores 720, 730 at the same time to the MS core 740. In use of the system 700, a sample can be introduced into the sample operation cores 705, 710, and analyte in the sample can be separated, reacted, derivatized, sorted, modified or otherwise acted on in some manner prior to providing the analyte species to the ionization cores 720, 730. In some instances, the ionization cores 720, 730 can be configured to ionize analyte in the sample using various but different techniques. For example, in some instances, an ionization source can be present in the ionization core(s) 720 to ionize elemental species, e.g., to ionize inorganic species, prior to providing the elemental ions to the core MS 740. In other instances, an ionization source can be present in the ionization core(s) 730 to produce/ionize molecular species, e.g., to ionize organic species, prior to providing the molecular ions to the MS core 740. In certain configurations as noted herein, the system 700 may be configured to ionize both inorganic species and organic species using the ionization cores 720, 730 prior to providing the ions to the MS core 740. The MS core 740 can be configured to filter/detect ions having a particular mass-to-charge. In some examples, the MS core 740 can be designed to filter/select/detect inorganic ions and to filter/select/detect organic ions depending on the particular components which are present. While not shown, the mass analyzer comprising the MS core 740 typically comprises common components used by the one, two, three or more mass spectrometer cores (MSCs) which may be present in the mass analyzer. For example, common gas controllers, processors, power supplies, detectors and vacuum pumps may be used by different mass MSCs present in the mass analyzer. The system 700 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 700 between any one or more of the cores 705, 710, 720, 730 and 740.

Figure 8:
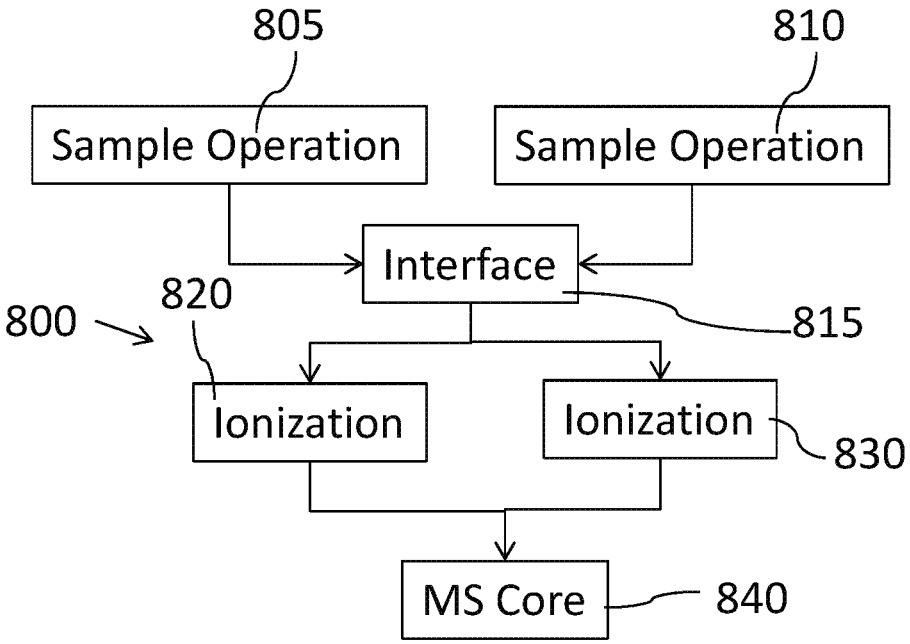
FIG. 8 is a block diagram of a system comprising two sample operation cores, an interface, two ionization cores, and a mass analyzer comprising a MS core, in accordance with certain configurations.

In certain configurations where two or more sample operation cores are present, each sample operation core may be fluidically coupled to a respective ionization core through one or more interfaces. For example and referring to FIG. 8, a system 800 comprises a first sample operation core 805, a second sample operation core 810, an interface 815, a first ionization core 820, and a second ionization core 830. Each of the cores 820, 830 is also fluidically coupled to a common mass analyzer comprising a MS core 840. While not shown, a valve, interface or other device can be present between the ionization cores 820, 830 and the MS core 840 to provide species from the one of the ionization cores 820, 830 to the MS core 840 at a selected time during use of the system 800. In other configurations, the interface, valve or device can be configured to provide species from the ionization cores 820, 830 at the same time to the MS core 840. In use of the system 800, a sample can be introduced into the sample operation cores 805, 810, and analyte in the sample can be separated, reacted, derivatized, sorted, modified or otherwise acted on in some manner prior to providing the analyte species to the ionization cores 820, 830. The interface 815 is fluidically coupled to each of the sample operation cores 805, 810 and can be configured to provide sample to either or both of the ionization cores 820, 830 In some instances, the ionization cores 820, 830 can be configured to ionize analyte in the sample using various but different techniques. For example, in some instances, an ionization source can be present in the ionization core(s) 820 to ionize elemental species, e.g., to ionize inorganic species, prior to providing the elemental ions to the MS core 840. In other instances, an ionization source can be present in the ionization core(s) 830 to produce/ionize molecular species, e.g., to ionize organic species, prior to providing the molecular ions to the core MS 840. In certain configurations as noted herein, the system 800 may be configured to ionize both inorganic species and organic species using the ionization cores 820, 830 prior to providing the ions to the MS core 840. The sample operation cores 805, 810 may receive sample from the same source or from different sources. Where different sample sources are present, the interface 815 can provide analyte from the sample operation core 805 to either of the ionization cores 820, 830. Similarly, the interface 815 can provide analyte from the sample operation core 810 to either of the ionization cores 820, 830. The MS core(s) 840 can be configured to filter/detect ions having a particular mass-to-charge. In some examples, the core 840 can be designed to filter/select/detect inorganic ions and to filter/select/detect organic ions depending on the particular components which are present. While not shown, the mass analyzer comprising the MS core 840 typically comprises common components used by the one, two, three or more mass spectrometer cores (MSCs) which may be present in the mass analyzer. For example, common gas controllers, processors, power supplies, detectors and vacuum pumps may be used by different mass MSCs present in the MS core 840. The system 800 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 800 between any one or more of the cores 805, 810, 820, 830 and 840.

Figure 9:
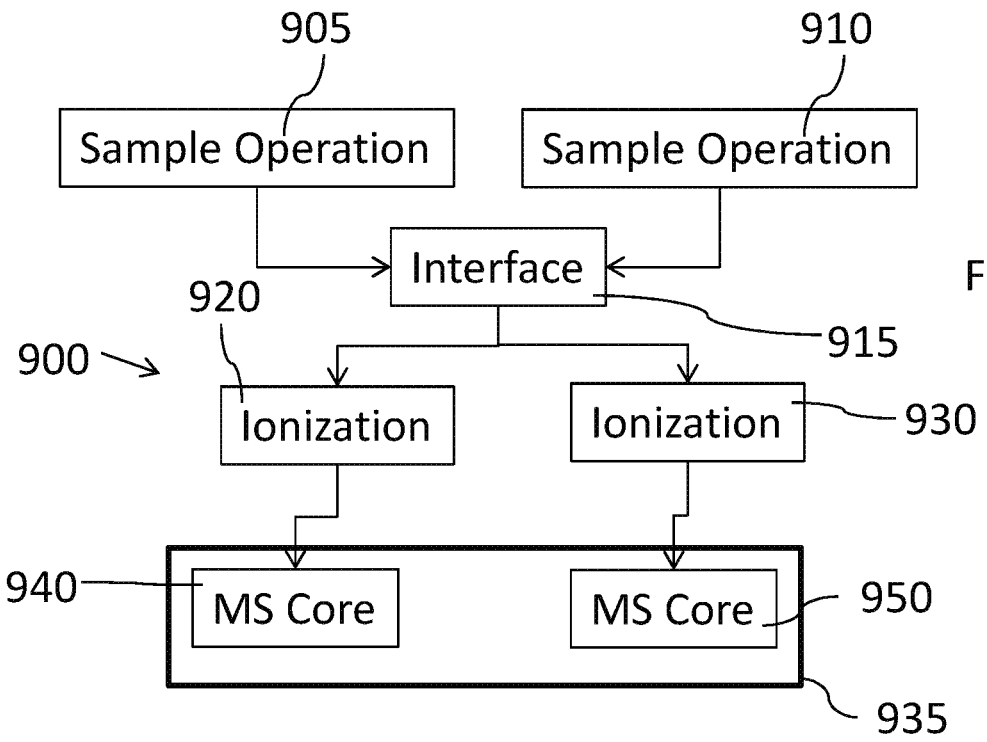
FIG. 9 is a block diagram of a system comprising two sample operation cores, an interface, two ionization cores, and a mass analyzer comprising two MS cores, in accordance with certain examples.

In certain configurations where two or more sample operation cores are present, each sample operation core may be fluidically coupled to a respective ionization core through one or more interfaces and each ionization core may comprise a respective MS core. For example and referring to FIG. 9, a system 900 comprises a first sample operation core 905, a second sample operation core 910, an interface 915, a first ionization core 920, and a second ionization core 930. Each of the cores 920, 930 is also fluidically coupled to a mass analyzer 935 comprising MS cores 940, 950. In use of the system 900, a sample can be introduced into the sample operation cores 905, 910, and analyte in the sample can be separated, reacted, derivatized, sorted, modified or otherwise acted on in some manner prior to providing the analyte species to the ionization cores 920, 930. The interface 915 is fluidically coupled to each of the sample operation cores 905, 910 and can be configured to provide sample to either or both of the ionization cores 920, 930. In some instances, the ionization cores 920, 930 can be configured to ionize analyte in the sample using various but different techniques. For example, in some instances, an ionization source can be present in the ionization core(s) 920 to ionize elemental species, e.g., to ionize inorganic species, prior to providing the elemental ions to the core MS 940. In other instances, an ionization source can be present in the ionization core(s) 930 to produce/ionize molecular species, e.g., to ionize organic species, prior to providing the molecular ions to the MS core 950. In certain configurations as noted herein, the system 900 may be configured to ionize both inorganic species and organic species using the ionization cores 920, 930 prior to providing the ions to the MS cores 940, 950. The sample operation cores 905, 910 may receive sample from the same source or from different sources. Where different sample sources are present, the interface 915 can provide analyte from the sample operation core 905 to either of the ionization cores 920, 930. Similarly, the interface 915 can provide analyte from the sample operation core 910 to either of the ionization cores 920, 930. Each of the MS core(s) 940, 950 can be configured to filter/detect ions having a particular mass-to-charge. In some examples, either or both of the MS cores 940, 950 can be designed to filter/select/detect inorganic ions and to filter/select/detect organic ions depending on the particular components which are present. In some examples, the MS cores 940, 950 are configured differently with a different filtering device and/or detection device. While not shown, the mass analyzer 935 typically comprises common components used by the one, two, three or more mass spectrometer cores (MSCs) which may be present in the mass analyzer 935. For example, common gas controllers, processors, power supplies, detectors and vacuum pumps may be used by different mass MSCs present in the mass analyzer 935. The system 900 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 900 between any one or more of the cores 905, 910, 920, 930, 940 and 950.

Figure 10:
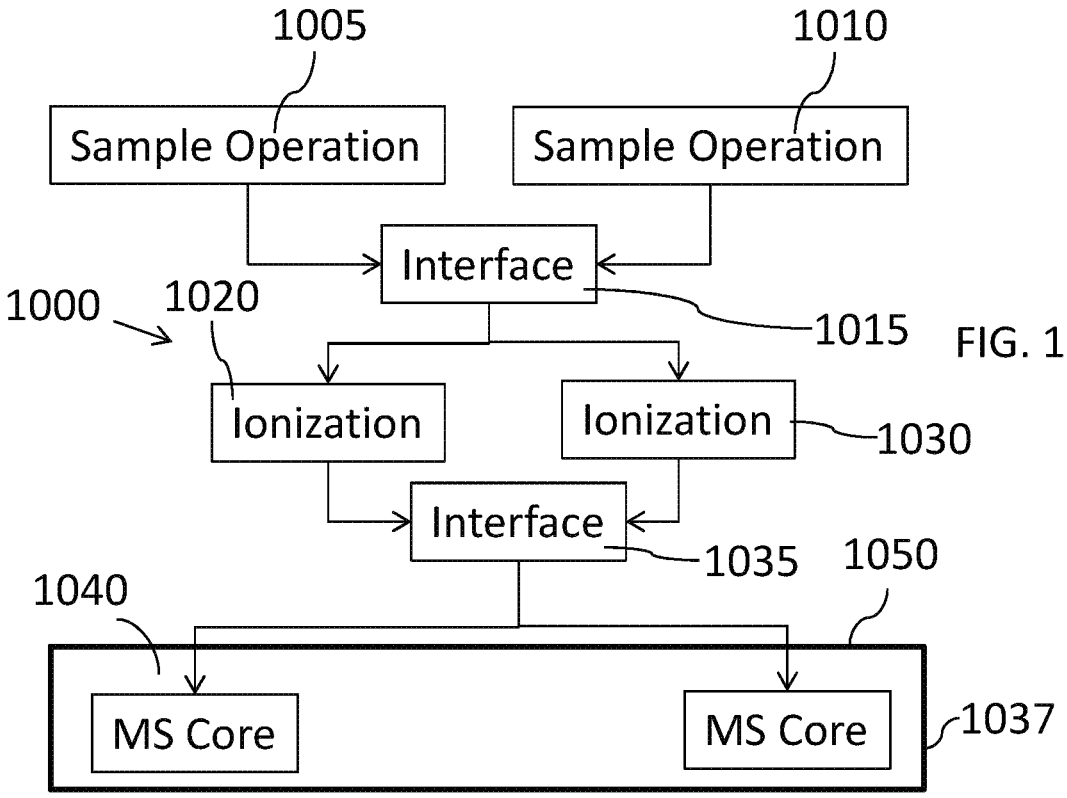
FIG. 10 is a block diagram of a system comprising two sample operation cores, an interface, two ionization cores, another interface, and a mass analyzer comprising two MS cores, in accordance with certain examples.

In certain configurations where two or more sample operation cores are present, each sample operation core may be fluidically coupled to a respective ionization core through one or more interfaces and each ionization core may be coupled to a mass analyzer comprising two or more MS cores through an interface. Referring to FIG. 10, a system 1000 comprises a first sample operation core 1005, a second sample operation core 1010, an interface 1015, a first ionization core 1020, and a second ionization core 1030. Each of the cores 1020, 1030 is also fluidically coupled to a mass analyzer 1037 comprising MS cores 1040, 1050 through an interface 1035. In use of the system 1000, a sample can be introduced into the sample operation cores 1005, 1010, and analyte in the sample can be separated, reacted, derivatized, sorted, modified or otherwise acted on in some manner prior to providing the analyte species to the ionization cores 1020, 1030. The interface 1015 is fluidically coupled to each of the sample operation cores 1005, 1010 and can be configured to provide sample to either or both of the ionization cores 1020, 1030. In some instances, the ionization cores 1020, 1030 can be configured to ionize analyte in the sample using various but different techniques. For example, in some instances, an ionization source can be present in the ionization core(s) 1020 to ionize elemental species, e.g., to ionize inorganic species, prior to providing the elemental ions to the interface 1035. In other instances, an ionization source can be present in the ionization core(s) 1030 to produce/ionize molecular species, e.g., to ionize organic species, prior to providing the molecular ions to the interface 1035. In certain configurations as noted herein, the system 1000 may be configured to ionize both inorganic species and organic species using the ionization cores 1020, 1030 prior to providing the ions to the interface 1035. The sample operation cores 1005, 1010 may receive sample from the same source or from different sources. Where different sample sources are present, the interface 1015 can provide analyte from the sample operation core 1005 to either of the ionization cores 1020, 1030. Similarly, the interface 1015 can provide analyte from the sample operation core 1010 to either of the ionization cores 1020, 1030. The interface 1035 can receive ions from either or both of the ionization cores 1020, 1030 and provide the received ions to one or both of the MS cores 1040, 1050. Each of the MS core(s) 1040, 1050 can be configured to filter/detect ions having a particular mass-to-charge. In some examples, either or both of the MS cores 1040, 1050 can be designed to filter/select/detect inorganic ions and to filter/select/detect organic ions depending on the particular components which are present. In some examples, the MS cores 1040, 1050 are configured differently with a different filtering device and/or detection device. While not shown, the mass analyzer 1037 typically comprises common components used by the one, two, three or more mass spectrometer cores (MSCs) which may be present in the mass analyzer 1037. For example, common gas controllers, processors, power supplies, detectors and vacuum pumps may be used by different mass MSCs present in the mass analyze 1037. The system 1000 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 1000 between any one or more of the cores 1005, 1010, 1020, 1030, 1040 and 1050.

Figure 11:
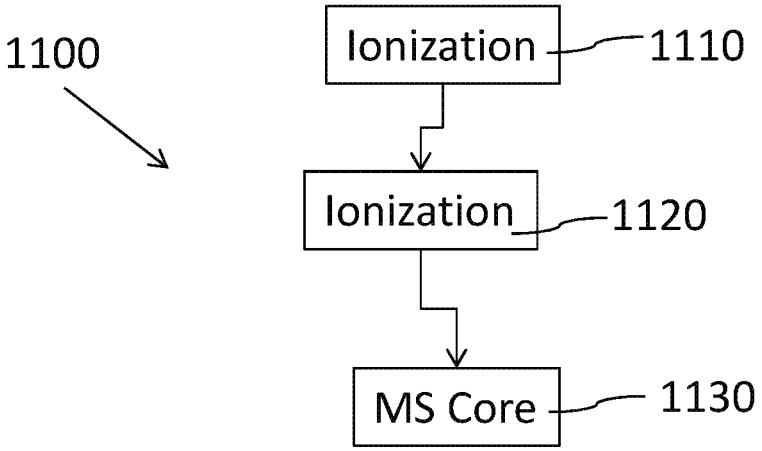
FIG. 11 is a block diagram of a system comprising two serially arranged ionization cores, and a mass analyzer comprising a MS core, in accordance with certain examples.

In certain examples, the ionization cores can be fluidically coupled in a serial arrangement to permit the use of multiple ionization sources. Referring to FIG. 11, a system 1100 is shown that comprise a first ionization core 1110 fluidically coupled to a second ionization core 1120, which itself is fluidically coupled to a mass analyzer comprising a MS core 1130. While not shown, a bypass line may also be present to directly couple the first ionization core 1110 to the MS core 1130 to permit ions to be provided directly from the core 1110 to the MS core 1130 in situations where the ionization core 1120 is not used. In use of the system 1100, a sample can be introduced into the ionization core 1110. The ionization cores(s) 1110, 1120 can independently be configured to ionize analyte in the sample using various techniques. For example, in some instances, an ionization source can be present in the ionization core(s) 1110, 1120 to ionize elemental species, e.g., to ionize inorganic species, prior to providing the elemental ions to the core 1130. In other instances, an ionization source can be present in the ionization core(s) 1110, 1120 to produce/ionize molecular species, e.g., to ionize organic species, prior to providing the molecular ions to the MS core 1130. In certain configurations as noted herein, the system 1100 may be configured to ionize inorganic species and organic species prior to providing the ions to the MS core 1130. The MS core(s) 1130 can be configured to filter/detect ions having a particular mass-to-charge. In some examples, the MS core 1130 can be designed to filter/select/detect inorganic ions and to filter/select/detect organic ions depending on the particular components which are present. While not shown, the mass analyzer comprising the MS core 1130 typically comprises common components used by the one, two, three or more mass spectrometer cores (MSCs) which may be present in the mass analyzer. For example, common gas controllers, processors, power supplies, detectors and vacuum pumps may be used by different mass MSCs present in the mass analyzer. The system 1100 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 1100 between any one or more of the cores 1110, 1120 and 1130. In some instances, any of the systems described and shown in FIGS. 1-10 may comprise a serial arrangement of ionization core similar to the cores 1110, 1120 shown in FIG. 11.

Figure 12:
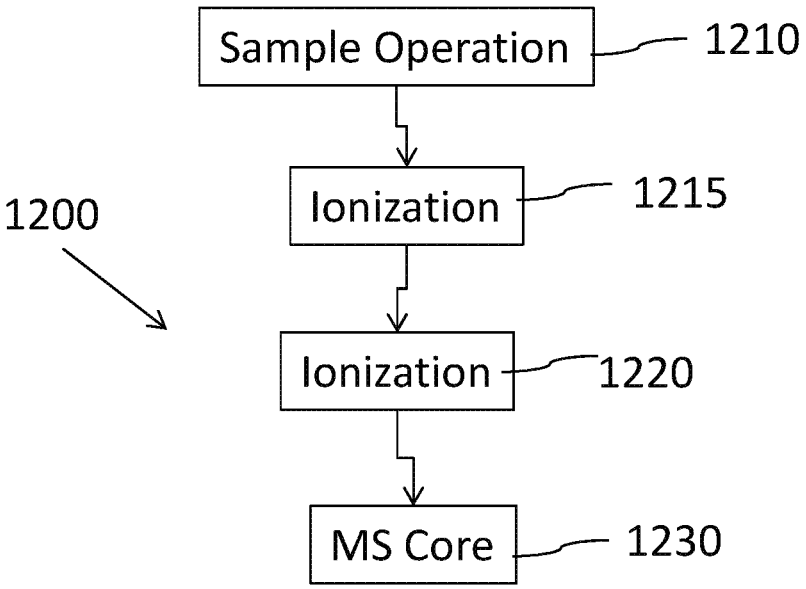
FIG. 12 is a block diagram of a system comprising a sample operation core, two serially arranged ionization cores, and a mass analyzer comprising a MS core, in accordance with certain embodiments.

In certain configurations, one or more serially arranged ionization cores can be present in the systems described herein. For example and referring to FIG. 12, a system 1200 is shown that comprise a sample operation core 1110 fluidically coupled to a first ionization core 1215. The first ionization core 1215 is fluidically coupled to a second ionization core 1220, which itself is fluidically coupled to a mass analyzer comprising a MS core 1230. While not shown, a bypass line may also be present to directly couple the ionization core 1215 to the MS core 1230 if desired to permit ions to be provided directly from the core 1215 to the MS core 1230 in situations where the second ionization core 1220 is not used. Similarly, a bypass line can be present to directly couple the sample operation core 1210 to the ionization core 1220 in situations where it is not desirable to use the ionization core 1215. In use of the system 1200, a sample can be introduced into the sample operation core 1210, and analyte in the sample can be separated, reacted, derivatized, sorted, modified or otherwise acted on in some manner prior to providing the analyte species to the ionization core 1215. The ionization core 1215 can be configured to ionize analyte in the sample using various techniques. For example, in some instances, an ionization source can be present in the ionization core 1215 to ionize elemental species, e.g., to ionize inorganic species, prior to providing the elemental ions to the core 1230. In other instances, an ionization source can be present in the ionization core 1215 to produce/ionize molecular species, e.g., to ionize organic species, prior to providing the molecular ions to the core 1230. The ionization core 1220 can be configured to ionize analyte in the sample using various techniques, which may be the same of different from those used by the core 1215. For example, in some instances, an ionization source can be present in the ionization core 1220 to ionize elemental species, e.g., to ionize inorganic species, prior to providing the elemental ions to the core 1230. In other instances, an ionization source can be present in the ionization core 1220 to produce/ionize molecular species, e.g., to ionize organic species, prior to providing the molecular ions to the MS core 1230. In certain configurations as noted herein, the system 1200 may be configured to ionize inorganic species and organic species prior to providing the ions to the core 1230. The MS core(s) 1230 can be configured to filter/detect ions having a particular mass-to-charge. In some examples, the MS core 1230 can be designed to filter/select/detect inorganic ions and to filter/select/detect organic ions depending on the particular components which are present. While not shown, the mass analyzer comprising the MS core 1230 typically comprises common components used by the one, two, three or more mass spectrometer cores (MSCs) which may be present in the mass analyzer. For example, common gas controllers, processors, power supplies, detectors and vacuum pumps may be used by different mass MSCs present in the mass analyzer. The system 1200 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 1200 between any one or more of the cores 1210, 1215, 1220 and 1230. In some instances, any of the systems described and shown in FIGS. 1-10 may comprise a serial arrangement of ionization cores similar to the cores 1215, 1220 shown in FIG. 12.

Figure 13:
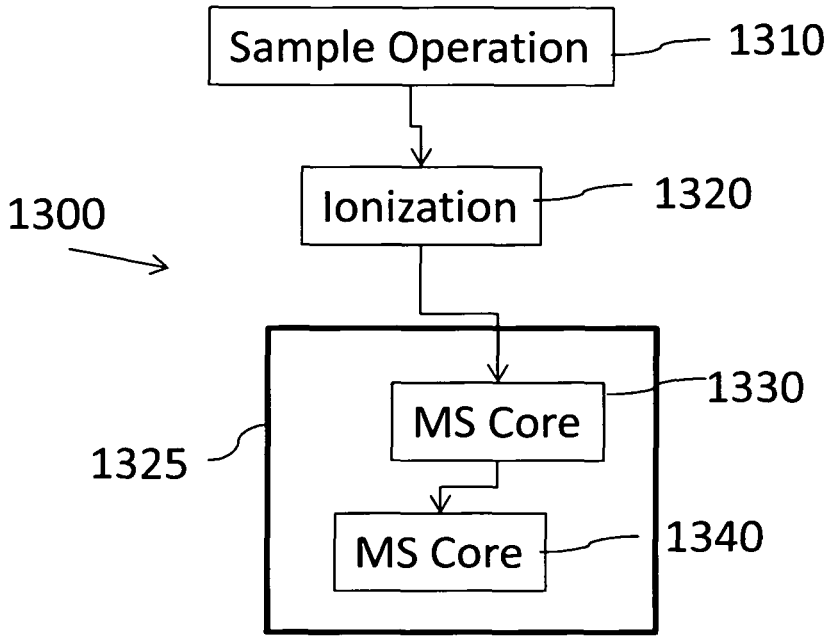
FIG. 13 is a block diagram a system comprising a sample operation core, an ionization core, and mass analyzer comprising two serially arranged MS cores, in accordance with certain embodiments.

In certain configurations, one or more serially arranged MS cores can be present in the systems described herein. For example and referring to FIG. 13, a system 1300 is shown that comprise a sample operation core 1310 fluidically coupled to an ionization core 1320. The ionization core 1320 is fluidically coupled to a mass analyzer 1325 comprising a first MS core 1330, which itself is fluidically coupled to a second MS core 1340. While not shown, a bypass line may also be present to directly couple the ionization core 1320 to the MS core 1340 if desired to permit ions to be provided directly from the core 1320 to the MS core 1340 in situations where the first MS core 1330 is not used. In use of the system 1300, a sample can be introduced into the sample operation core 1310, and analyte in the sample can be separated, reacted, derivatized, sorted, modified or otherwise acted on in some manner prior to providing the analyte species to the ionization core 1320. The ionization core 1320 can be configured to ionize analyte in the sample using various techniques. For example, in some instances, an ionization source can be present in the ionization core 1320 to ionize elemental species, e.g., to ionize inorganic species, prior to providing the elemental ions to the core 1330. In other instances, an ionization source can be present in the ionization core 1320 to produce/ionize molecular species, e.g., to ionize organic species, prior to providing the molecular ions to the core 1330. In certain configurations as noted herein, the system 1300 may be configured to ionize inorganic species and organic species prior to providing the ions to the core 1330. The MS core 1330 can be configured to filter/detect ions having a particular mass-to-charge. In some examples, the MS core 1330 can be designed to filter/select/detect inorganic ions and to filter/select/detect organic ions depending on the particular components which are present. Similarly, the MS core 1340 can be configured to filter/detect ions having a particular mass-to-charge. In some examples, the MS core 1340 can be designed to filter/select/detect inorganic ions and to filter/select/detect organic ions depending on the particular components which are present. While not shown, the mass analyzer 1325 typically comprises common components used by the one, two, three or more mass spectrometer cores (MSCs) which may be present in the mass analyzer 1325. For example, common gas controllers, processors, power supplies, detectors and vacuum pumps may be used by different mass MSCs present in the mass analyzer 1325. The system 1300 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 1300 between any one or more of the cores. In some instances, any of the systems described and shown in FIGS. 1-12 may comprise a serial arrangement of MS cores similar to the cores 1330, 1340 shown in FIG. 13.

In certain embodiments, additional components, devices, etc. may also be present and used with the sample operation cores, ionization cores and mass analyzers comprising one or more MS cores. Various illustrative devices are described in connection with the various cores described in more detail herein.

Sample Operation Cores

In certain embodiments, samples suitable for use in the systems and methods described herein are typically present in gaseous, liquid or solid form and the exact form used can be altered depending on the particular sample operations performed by the sample operation core.

Figure 14:
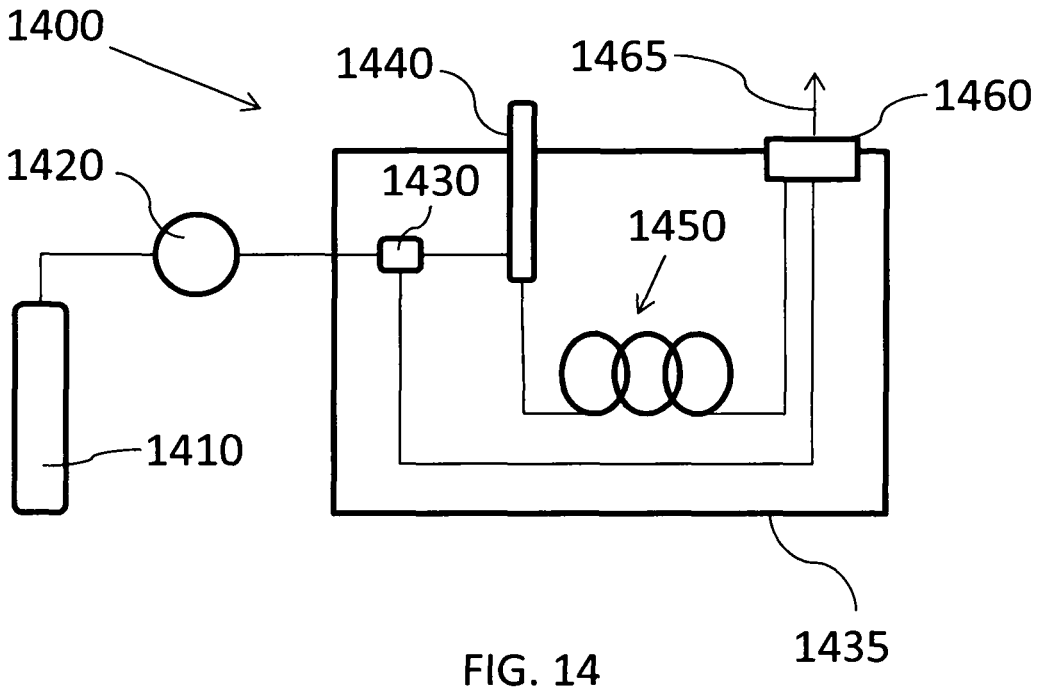
FIG. 14 is an illustration of a gas chromatography system, in accordance with certain examples.

In some instances, the sample operation core may be configured to perform gas chromatography. Without wishing to be bound by any particular theory, gas chromatography uses a gaseous mobile phase and a stationary phase to separate gaseous analytes. A simplified illustration of a GC system is shown in FIG. 14, though other configurations of a GC system will be recognized by the person of ordinary skill in the art, given the benefit of this disclosure. The GC system 1400 comprises a carrier gas source 1410 fluidically coupled to a pressure regulator 1420 through a fluid line. The pressure regulator 1420 is fluidically coupled to a flow splitter 1430 through a fluid line. The flow splitter 1430 is configured to split the carrier gas flow into at least two fluid lines. The fluid splitter 1430 is fluidically coupled to an injector 1440 through one of the fluid lines. A sample is injected into the injector and vaporized in an oven 1435 that can house some portion of the injector 1440 and a column 1450 comprising a stationary phase. While not shown, the injector 1430 could be replaced with a sorbent tube or device configured to adsorb and desorb various analytes, e.g., analytes with three or more carbon atoms. The column 1450 separates the analyte species into individual analyte components and permits exit of those analyte species through an outlet 1460 in the general direction of arrow 1465. The exiting analyte can then be provided to one or more ionization cores as described herein. If desired, two or more separate GC systems can be used in the systems described herein. For example, each ionization core may be fluidically coupled to a common GC system or a respective GC system if desired.

Figure 15A:
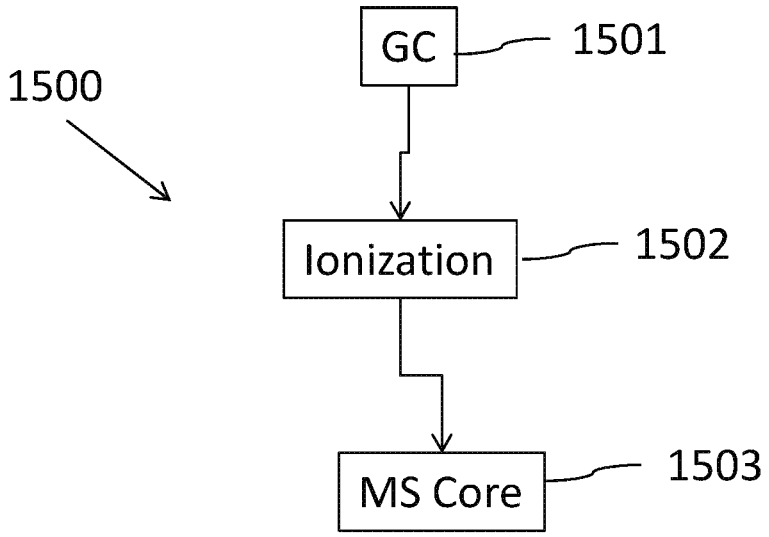
FIG. 15A is a block diagram of a system comprising a GC, an ionization core and a mass analyzer comprising a MS core, in accordance with certain embodiments.

In certain embodiments, the systems described herein may comprise one or more sample operation cores comprising a GC fluidically coupled to one or more ionization cores. Referring to FIG. 15A, a system 1500 comprises a GC 1501 fluidically coupled to an ionization core(s) 1502, which itself is fluidically coupled to a mass analyzer comprising a MS core 1503. In use of the system 1500, a sample can be introduced into the GC 1501, and analyte in the sample can be vaporized, separated, reacted, derivatized, sorted, modified or otherwise acted on in some manner by the GC 1501 prior to providing the analyte species to the ionization core(s) 1502. The ionization cores(s) 1502 can be configured to ionize analyte in the sample using various techniques. For example, in some instances, an ionization source can be present in the ionization core(s) 1502 to ionize elemental species, e.g., to ionize inorganic species, prior to providing the elemental ions to the MS core 1503. In other instances, an ionization source can be present in the ionization core(s) 1502 to produce/ionize molecular species, e.g., to ionize organic species, prior to providing the molecular ions to the MS core 1503. In certain configurations as noted herein, the system 1500 may be configured to ionize inorganic species and organic species prior to providing the ions to the core 1503. The MS core(s) 1503 can be configured to filter/detect ions having a particular mass-to-charge. In some examples, the MS core 1503 can be designed to filter/select/detect inorganic ions and to filter/select/detect organic ions depending on the particular components which are present. While not shown, the mass analyzer comprising the MS core 1503 typically comprises common components used by the one, two, three or more mass spectrometer cores (MSCs) which may be present in the mass analyzer. For example, common gas controllers, processors, power supplies, detectors and vacuum pumps may be used by different mass MSCs present in the mass analyzer. The system 1500 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 1500 between any one or more of the cores 1501, 1502 and 1503.

Figure 15B:
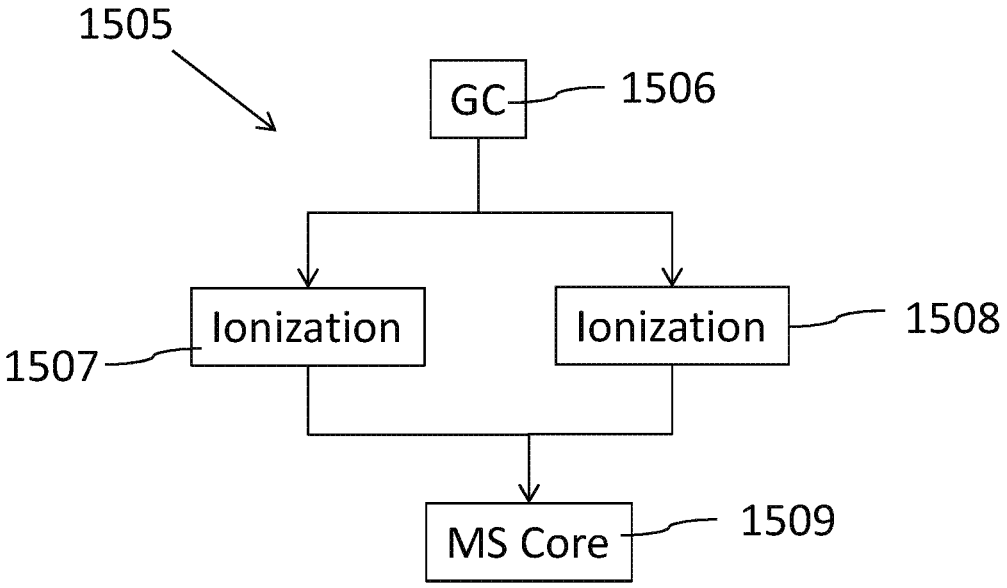
FIG. 15B is a block diagram of a system comprising a GC, two ionization cores and a mass analyzer comprising a MS core, in accordance with certain embodiments.

In certain configurations, any one or more of the cores shown in FIG. 15A can be separated or split into two or more cores. For example and referring to FIG. 15B, a system 1505 comprises a sample operation core comprising a GC 1506, a first ionization core 1507 fluidically coupled to the GC 1506 and a second ionization core 1508 fluidically coupled to the GC 1506. Each of the cores 1507, 1508 is also fluidically coupled to a mass analyzer comprising a MS core 1509. While not shown, an interface, valve, or other device can be present between the GC 1506 and the ionization cores 1507, 1508 to provide species from the GC 1506 to only one of the ionization cores 1507, 1508 at a selected time during use of the system 1505. In other configurations, the interface, valve or device can be configured to provide species from the GC 1506 to the ionization cores 1507, 1508 simultaneously. Similarly, a valve, interface or other device (not shown) can be present between the ionization cores 1507, 1508 and the MS core 1509 to provide species from the one of the ionization cores 1507, 1508 to the MS core 1509 at a selected time during use of the system 150. In other configurations, the interface, valve or device can be configured to provide species from the ionization cores 1507, 1508 at the same time to the MS core 1509. In use of the system 1505, a sample can be introduced into the GC 1506, and analyte in the sample can be vaporized, separated, reacted, derivatized, sorted, modified or otherwise acted on in some manner by the GC 1506 prior to providing the analyte species to one or both of the ionization core(s) 1507, 1508. In some instances, the ionization cores 1507, 1508 can be configured to ionize analyte in the sample using various but different techniques. For example, in some instances, an ionization source can be present in the ionization core(s) 1507 to ionize elemental species, e.g., to ionize inorganic species, prior to providing the elemental ions to the MS core 1509. In other instances, an ionization source can be present in the ionization core(s) 1508 to produce/ionize molecular species, e.g., to ionize organic species, prior to providing the molecular ions to the MS core 1509. In certain configurations as noted herein, the system 1505 may be configured to ionize both inorganic species and organic species using the ionization cores 1507, 1508 prior to providing the ions to the MS core 1509. The MS core(s) 1509 can be configured to filter/detect ions having a particular mass-to-charge. In some examples, the MS core 1509 can be designed to filter/select/detect inorganic ions and to filter/select/detect organic ions depending on the particular components which are present. While not shown, the mass analyzer comprising the MS core 1509 typically comprises common components used by the one, two, three or more mass spectrometer cores (MSCs) which may be present in the mass analyzer. For example, common gas controllers, processors, power supplies, detectors and vacuum pumps may be used by different mass MSCs present in the mass analyzer. The system 1505 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 1505 between any one or more of the cores 1506, 1507, 1508 and 1509.

Figure 15C:
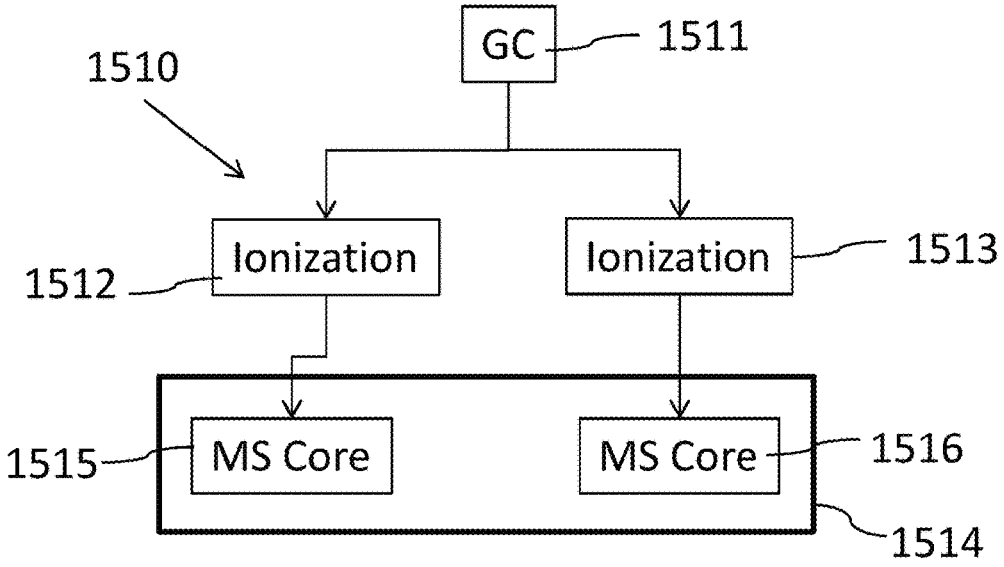
FIG. 15C is a block diagram of a system comprising a GC, two ionization cores and a mass analyzer comprising two MS cores, in accordance with certain configurations.

In other configurations, the mass analyzer comprising the MS cores described herein (when used with a GC) may comprise two or more individual MS cores. As noted herein, even though the MS cores can be separated, they still can share certain common components including gas controllers, processors, power supplies, detectors and/or vacuum pumps. Referring to FIG. 15C, a system 1510 is shown that comprises a sample operation core comprising a GC 1511, a first ionization core 1512, a second ionization core 1513, and a mass analyzer 1514 comprising a first MS core 1515 and a second MS core 1516. The GC 1511 is fluidically coupled to each of the ionization cores 1512, 1513. While not shown, an interface, valve, or other device can be present between the GC 1511 and the ionization cores 1512, 1513 to provide species from the GC 1511 to only one of the ionization cores 1512, 1513 at a selected time during use of the system 1510. In other configurations, the interface, valve or device can be configured to provide species from the GC 1511 to the ionization cores 1512, 1513 simultaneously. The ionization core 1512 is fluidically coupled to the first MS core 1515, and the second ionization core 1513 is fluidically coupled to the second MS core 1516. In use of the system 1510, a sample can be introduced into the GC 1511, and analyte in the sample can be vaporized, separated, reacted, derivatized, sorted, modified or otherwise acted on in some manner prior to providing the analyte species to one or both of the ionization core(s) 1512, 1513. In some instances, the ionization cores 1512, 1513 can be configured to ionize analyte in the sample using various but different techniques. For example, in some instances, an ionization source can be present in the ionization core(s) 1512 to ionize elemental species, e.g., to ionize inorganic species, prior to providing the elemental ions to the MS core 1515. In other instances, an ionization source can be present in the ionization core(s) 1513 to produce/ionize molecular species, e.g., to ionize organic species, prior to providing the molecular ions to the MS core 1516. In certain configurations as noted herein, the system 1510 may be configured to ionize both inorganic species and organic species using the ionization cores 1512, 1513 prior to providing the ions to the MS cores 1515, 1516. The MS core(s) 1515, 1516 can be configured to filter/detect ions having a particular mass-to-charge. In some examples, the MS core 1515 can be designed to filter/select/detect inorganic ions, and the MS core 1516 can be designed to filter/select/detect organic ions depending on the particular components which are present. While not shown, the mass analyzer 1514 comprising the MS core(s) 1515, 1516 typically comprises common components used by the one, two, three or more mass spectrometer cores (MSCs) which may independently be present in the mass analyzer 1514. For example, common gas controllers, processors, power supplies, detectors and vacuum pumps may be used by different mass MSCs present in the mass analyzer 1514, though each of the cores 1515, 1516 may comprise its own gas controllers, processors, power supplies, detectors and/or vacuum pumps if desired. The system 1510 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 1510 between any one or more of the cores 1511, 1512, 1513, 1515 and 1516.

Figure 15D:
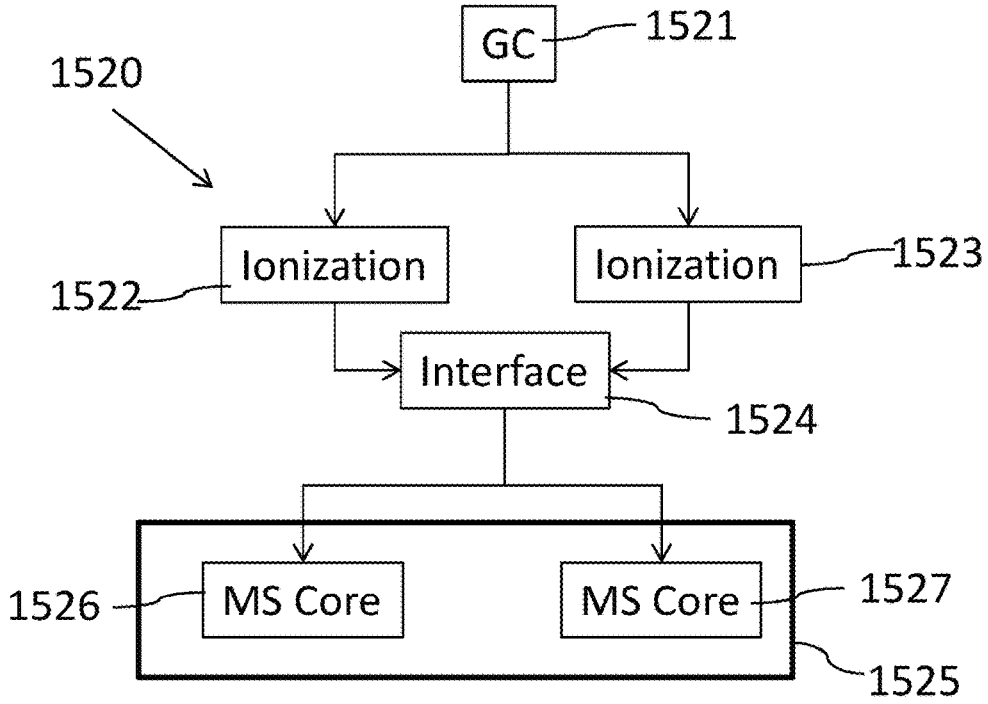
FIG. 15D is a block diagram of a system comprising a GC, two ionization cores, an interface and a mass analyzer comprising two MS cores, in accordance with certain configurations.

In some instances where a GC, two ionization cores and a mass analyzer comprising two MS cores are present, it may be desirable to provide ions from different ionization cores to different MS cores of the mass analyzer. For example and referring to FIG. 15D, a system 1520 is shown that comprises a sample operation core comprising a GC 1521, a first ionization core 1522, a second ionization core 1523, an interface 1524, and a mass analyzer 1525 comprising a first MS core 1526 and a second MS core 1527. The GC 1521 is fluidically coupled to each of the ionization cores 1522, 1523. While not shown, an interface, valve, or other device can be present between the GC 1521 and the ionization cores 1522, 1523 to provide species from the GC 1521 to only one of the ionization cores 1522, 1523 at a selected time during use of the system 1520. In other configurations, the interface, valve or device can be configured to provide species from the GC 1521 to the ionization cores 1522, 1523 simultaneously. The ionization core 1522 is fluidically coupled to the interface 1524, and the ionization core 1523 is fluidically coupled to the interface 1524. The interface 1524 is fluidically coupled to each of a first MS core 1526 and a second MS core 1527. In use of the system 1520, a sample can be introduced into the GC 1521, and analyte in the sample can be vaporized, separated, reacted, derivatized, sorted, modified or otherwise acted on in some manner prior to providing the analyte species to one or both of the ionization core(s) 1522, 1523. In some instances, the ionization cores 1522, 1523 can be configured to ionize analyte in the sample using various but different techniques. For example, in some instances, an ionization source can be present in the ionization core(s) 1522 to ionize elemental species, e.g., to ionize inorganic species, prior to providing the elemental ions to the interface 1524. In other instances, an ionization source can be present in the ionization core(s) 1523 to produce/ionize molecular species, e.g., to ionize organic species, prior to providing the molecular ions to the interface 1524. In certain configurations as noted herein, the system 1520 may be configured to ionize both inorganic species and organic species using the ionization cores 1522, 1523 prior to providing the ions to the interface 1524. The interface 1524 can be configured to provide ions to either or both of the MS core(s) 1526, 1527 each of which can be configured to filter/detect ions having a particular mass-to-charge. In some examples, the MS core 1526 can be designed to filter/select/detect inorganic ions, and the MS core 1527 can be designed to filter/select/detect organic ions depending on the particular components which are present. In some examples, the MS cores 1526, 1527 are configured differently with a different filtering device and/or detection device. While not shown, the mass analyzer 1525 typically comprises common components used by the one, two, three or more mass spectrometer cores (MSCs) which may independently be present in the mass analyzer 1525. For example, common gas controllers, processors, power supplies, detectors and vacuum pumps may be used by different mass MSCs present in the mass analyzer 1525, though each of the MS cores 1526, 1527 may comprise its own gas controllers, processors, power supplies, detectors and/or vacuum pumps if desired. The system 1520 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 1520 between any one or more of the cores 1521, 1522, 1523, 1526 and 1527.

Figure 15E:
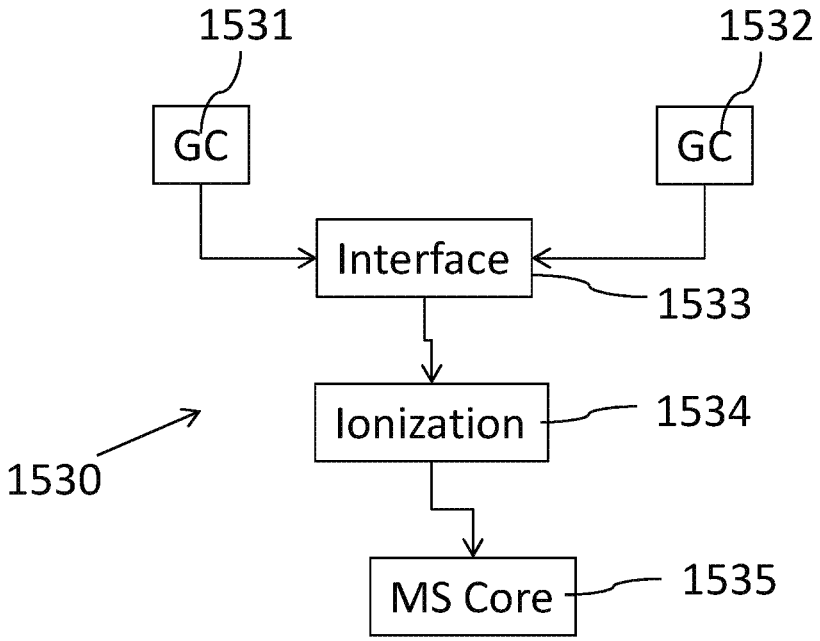
FIG. 15E is a block diagram of a system comprising two GC's, an interface, an ionization core, and a mass analyzer comprising a MS core, in accordance with certain examples.

In certain examples, the sample operation core can be split into two or more cores if desired. For example, it may be desirable to perform different operations when inorganic ions are to be provided to an ionization core or MS core compared to when organic ions are to be provided to an ionization core or MS core. Referring to FIG. 15E, a system 1530 is shown that comprises a sample operation core comprising a first GC 1531 and a second GC 1532, though as noted below one of the GC's 1531, 1532 could be replaced with a sample operation core such as a LC, DSA or other device or system. Each of the GC's 1531, 1532 is fluidically coupled to an interface 1533. The interface 1533 is fluidically coupled to an ionization core 1534, which itself is fluidically coupled to a mass analyzer comprising a MS core 1535. In use of the system 1530, a sample can be introduced into one or both of the GC's 1531, 1532, and analyte in the sample can be vaporized, separated, reacted, derivatized, sorted, modified or otherwise acted on in some manner prior to providing the analyte species to the interface 1533. The different GC's 1531, 1532 can be configured to perform different separations, use different separation conditions, use different carrier gases or include different components. The interface 1533 can be configured to permit passage of sample from one or both of the GC's 1531, 1532 to the ionization core 1534. The ionization cores(s) 1534 can be configured to ionize analyte in the sample using various techniques. For example, in some instances, an ionization source can be present in the ionization core(s) 1534 to ionize elemental species, e.g., to ionize inorganic species, prior to providing the elemental ions to the MS core 1535. In other instances, an ionization source can be present in the ionization core(s) 1534 to produce/ionize molecular species, e.g., to ionize organic species, prior to providing the molecular ions to the MS core 15350. In certain configurations as noted herein, the system 1530 may be configured to ionize inorganic species and organic species prior to providing the ions to the MS core 1535. The MS core(s) 1535 can be configured to filter/detect ions having a particular mass-to-charge. In some examples, the MS core 1535 can be designed to filter/select/detect inorganic ions and to filter/select/detect organic ions depending on the particular components which are present. While not shown, the mass analyzer comprising the MS core 1535 typically comprises common components used by the one, two, three or more mass spectrometer cores (MSCs) which may be present in the mass analyzer. For example, common gas controllers, processors, power supplies, detectors and vacuum pumps may be used by different mass MSCs present in the mass analyzer. The system 1530 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 1530 between any one or more of the cores 1531, 1532, 1534 and 1535.

Figure 15F:
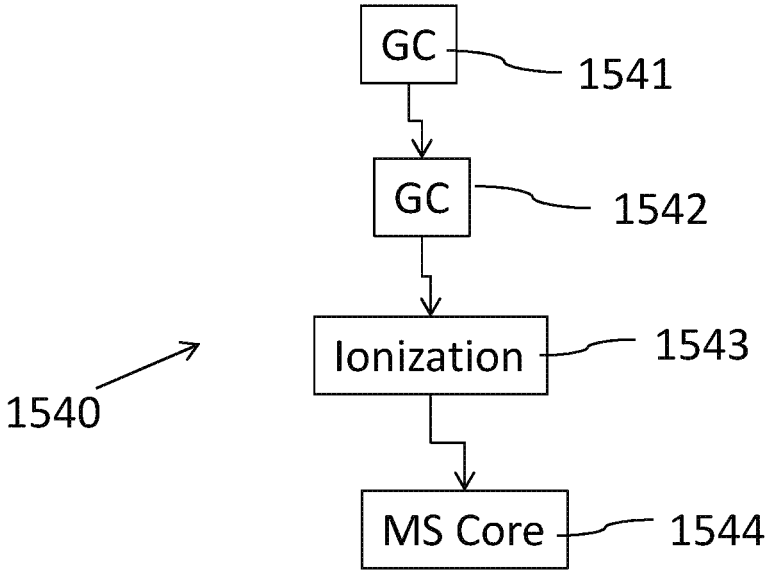
FIG. 15F is a block diagram of a system comprising two serially arranged GC's, an ionization core, and a mass analyzer comprising a MS core, in accordance with certain configurations.

In certain configurations, the GC's of a sample operation core can be serially coupled to each other if desired. For example, it may be desirable to separate analytes in a sample using GC's configured for different separation conditions. Referring to FIG. 15F, a system 1540 is shown that comprises a first GC 1541 fluidically coupled to a second GC 1542. Depending on the nature of the analyte sample, one of the GC's 1541, 1542 may be present in a passive configuration and generally pass sample without performing any operations on the sample, whereas in other instances each of the GC's 1541, 1542 performs one or more sample operations including, but not limited to, vaporization, separation, reaction, derivatization, sorting, modification or otherwise acting on the sample in some manner prior to providing the analyte species to the ionization core 1543. The ionization cores(s) 1543 can be configured to ionize analyte in the sample using various techniques. For example, in some instances, an ionization source can be present in the ionization core(s) 1543 to ionize elemental species, e.g., to ionize inorganic species, prior to providing the elemental ions to a mass analyzer comprising a MS core 1544. In other instances, an ionization source can be present in the ionization core(s) 1543 to produce/ionize molecular species, e.g., to ionize organic species, prior to providing the molecular ions to the MS core 1544. In certain configurations as noted herein, the system 1540 may be configured to ionize inorganic species and organic species prior to providing the ions to the MS core 1544. The MS core(s) 1544 can be configured to filter/detect ions having a particular mass-to-charge. In some examples, the MS core 1544 can be designed to filter/select/detect inorganic ions and to filter/select/detect organic ions depending on the particular components which are present. While not shown, the mass analyzer comprising the MS core 1544 typically comprises common components used by the one, two, three or more mass spectrometer cores (MSCs) which may be present in the mass analyzer. For example, common gas controllers, processors, power supplies, detectors and vacuum pumps may be used by different mass MSCs present in the mass analyzer. The system 1540 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 1540 between any one or more of the cores 1541, 1542, 1543 and 1544.

Figure 15G:
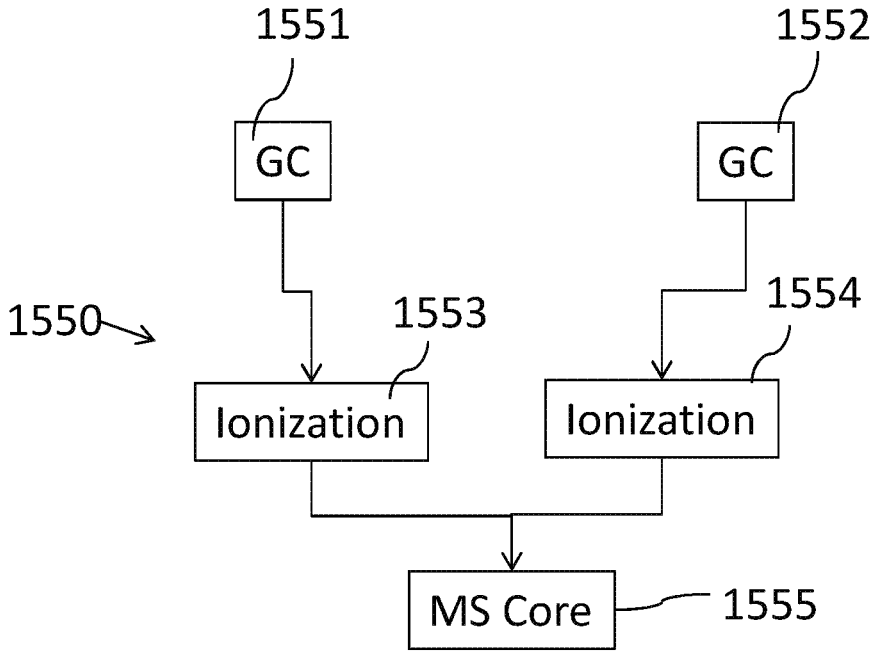
FIG. 15G is a block diagram of a system comprising two GC's, two ionization cores, and a mass analyzer comprising a MS core, in accordance with certain examples.

In certain configurations where two or more GC's are present, each GC may be fluidically coupled to a respective ionization core. For example and referring to FIG. 15G, a system 1550 comprises a first GC 1551, a second GC 1552, a first ionization core 1553 fluidically coupled to the first GC 1551, and a second ionization core 1554 fluidically coupled to the second GC 1552. As noted herein, one of the GC's 1551, 1552 can be replaced with a different sample operation core such as, for example, a LC, DSA device or other sample operation core if desired. Each of the cores 1553, 1554 is also fluidically coupled to a mass analyzer comprising a MS core 1555. While not shown, a valve, interface or other device can be present between the ionization cores 1553, 1554 and the MS cores 1555 to provide species from the one of the ionization cores 1553, 1554 to the MS core 1555 at a selected time during use of the system 1550. In other configurations, the interface, valve or device can be configured to provide species from the ionization cores 1553, 1554 at the same time to the MS core 1555. In use of the system 1550, a sample can be introduced into the GC's 151, 1552, and analyte in the sample can be vaporized, separated, reacted, derivatized, sorted, modified or otherwise acted on in some manner prior to providing the analyte species to the ionization cores 1553, 1554. In some instances, the ionization cores 1553, 1554 can be configured to ionize analyte in the sample using various but different techniques. For example, in some instances, an ionization source can be present in the ionization core(s) 1553 to ionize elemental species, e.g., to ionize inorganic species, prior to providing the elemental ions to the MS core 1555. In other instances, an ionization source can be present in the ionization core(s) 1554 to produce/ionize molecular species, e.g., to ionize organic species, prior to providing the molecular ions to the MS core 1555. In certain configurations as noted herein, the system 1550 may be configured to ionize both inorganic species and organic species using the ionization cores 1553, 1554 prior to providing the ions to the MS core 1555. The MS core 1555 can be configured to filter/detect ions having a particular mass-to-charge. In some examples, the MS core 1555 can be designed to filter/select/detect inorganic ions and to filter/select/detect organic ions depending on the particular components which are present. While not shown, the mass analyzer comprising the MS core 1555 typically comprises common components used by the one, two, three or more mass spectrometer cores (MSCs) which may be present in the mass analyzer. For example, common gas controllers, processors, power supplies, detectors and vacuum pumps may be used by different mass MSCs present in the mass analyzer. The system 1550 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 1550 between any one or more of the cores 1551, 1552, 1553, 1554 and 1555.

Figure 15H:
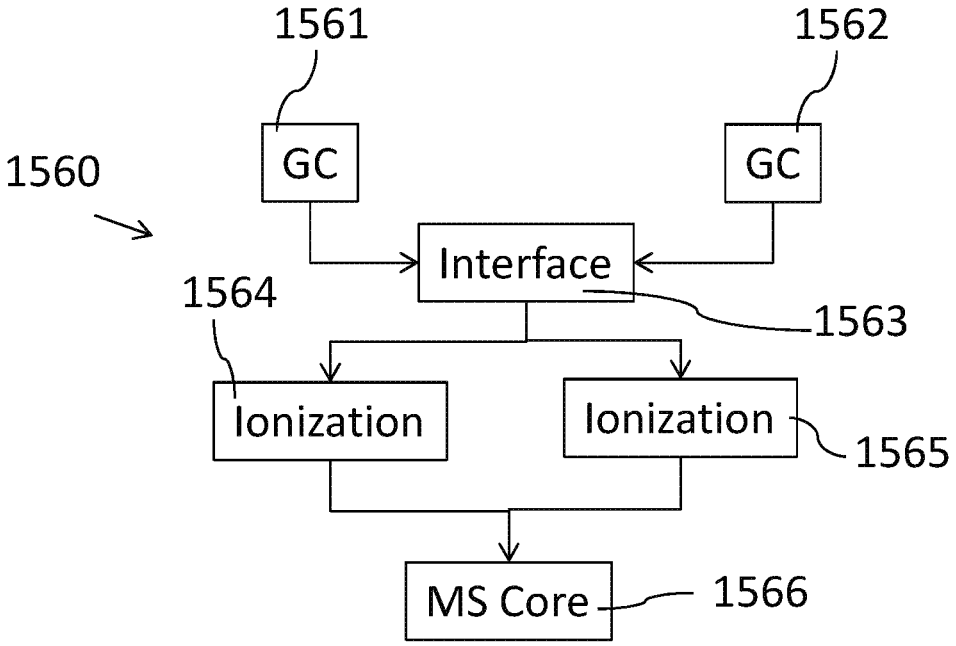
FIG. 15H is a block diagram of a system comprising two GC's, an interface, two ionization cores, and a mass analyzer comprising a MS core, in accordance with certain configurations.

In certain configurations where two or more GC's are present, each GC may be fluidically coupled to a respective ionization core through one or more interfaces. For example and referring to FIG. 15H, a system 1560 comprises a first GC 1561, a second GC 1562, an interface 1563, a first ionization core 1564, and a second ionization core 1565. As noted herein, one of the GC's 1561, 1562 can be replaced with a different sample operation core such as, for example, a LC, DSA device or other sample operation core if desired. Each of the ionization cores 1564, 1565 is also fluidically coupled to a mass analyzer comprising a MS core 1566. While not shown, a valve, interface or other device can be present between the ionization cores 1564, 1565 and the MS core 1566 to provide species from the one of the ionization cores 1564, 1565 to the MS core 1566 at a selected time during use of the system 1560. In other configurations, the interface, valve or device can be configured to provide species from the ionization cores 1564, 1565 at the same time to the MS core 1566. In use of the system 1560, a sample can be introduced into the GC's 1561, 1562, and analyte in the sample can be vaporized, separated, reacted, derivatized, sorted, modified or otherwise acted on in some manner prior to providing the analyte species to the ionization cores 1564, 1565. The interface 1563 is fluidically coupled to each of the GC's 1561, 1562 and can be configured to provide sample to either or both of the ionization cores 1564, 1565. In some instances, the ionization cores 1564, 1565 can be configured to ionize analyte in the sample using various but different techniques. For example, in some instances, an ionization source can be present in the ionization core(s) 1564 to ionize elemental species, e.g., to ionize inorganic species, prior to providing the elemental ions to the core MS 1566. In other instances, an ionization source can be present in the ionization core(s) 1565 to produce/ionize molecular species, e.g., to ionize organic species, prior to providing the molecular ions to the MS core 1566. In certain configurations as noted herein, the system 1560 may be configured to ionize both inorganic species and organic species using the ionization cores 1564, 1565 prior to providing the ions to the MS core 1566. The GC's 1561, 1562 may receive sample from the same source or from different sources. Where different sample sources are present, the interface 1563 can provide analyte from the GC 1561 to either of the ionization cores 1564, 1565. Similarly, the interface 1563 can provide analyte from the GC 1562 to either of the ionization cores 1564, 1565. The MS core(s) 1566 can be configured to filter/detect ions having a particular mass-to-charge. In some examples, the MS core 1566 can be designed to filter/select/detect inorganic ions and to filter/select/detect organic ions depending on the particular components which are present. While not shown, the mass analyzer comprising the MS core 1566 typically comprises common components used by the one, two, three or more mass spectrometer cores (MSCs) which may be present in the mass analyzer. For example, common gas controllers, processors, power supplies, detectors and vacuum pumps may be used by different mass MSCs present in the core 1566. The system 1560 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 1560 between any one or more of the cores 1561, 1562, 1564, 1565 and 1566.

Figure 15I:
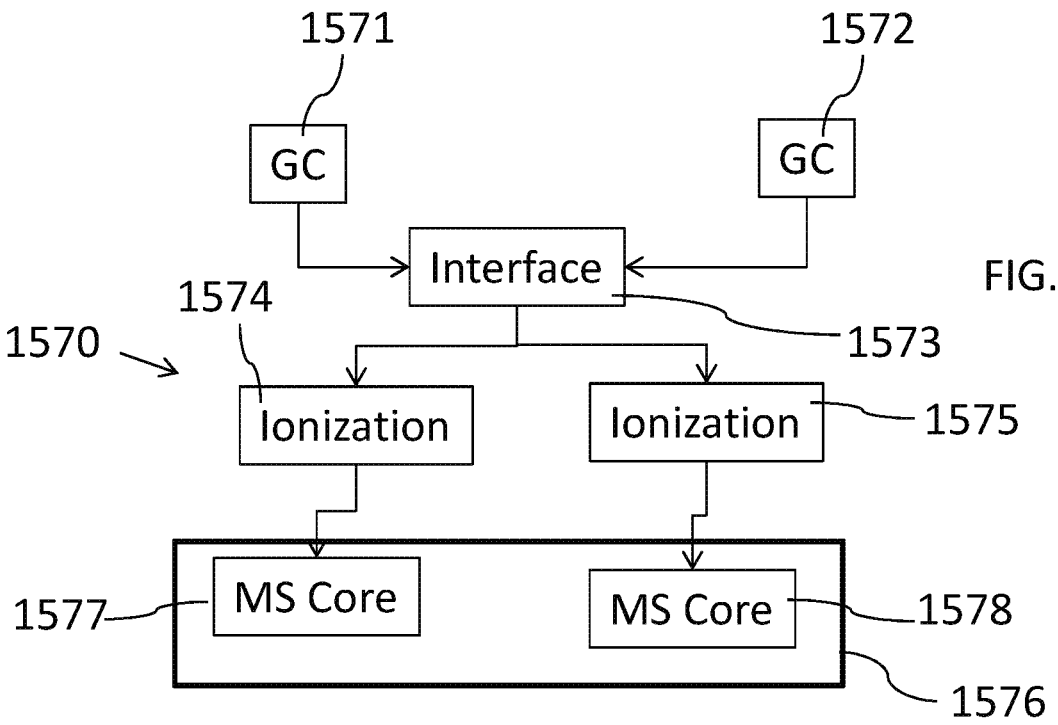
FIG. 15I is a block diagram of a system comprising two GC's, an interface, two ionization cores, and a mass analyzer comprising two MS cores, in accordance with certain examples.

In certain configurations where two or more GC's are present, each GC may be fluidically coupled to a respective ionization core through one or more interfaces and each ionization core may be fluidically coupled to a mass analyzer comprising two or more MS cores. For example and referring to FIG. 15I, a system 1570 comprises a first GC 1571, a second GC 1572, an interface 1573, a first ionization core 1574, and a second ionization core 1575. Each of the ionization cores 1574 and 1575 is also fluidically coupled to a respective MS core in a mass analyzer 1576 comprising MS cores 1577 and 1578. As noted herein, one of the GC's 1571, 1572 can be replaced with a different sample operation core such as, for example, a LC, DSA device or other sample operation core if desired. In use of the system 1570, a sample can be introduced into the GC's 1571, 1572, and analyte in the sample can be vaporized, separated, reacted, derivatized, sorted, modified or otherwise acted on in some manner prior to providing the analyte species to the ionization cores 1574, 1575. The interface 1573 is fluidically coupled to each of the GC's 1571, 1572 and can be configured to provide sample to either or both of the ionization cores 1574, 1575. In some instances, the ionization cores 1574, 1575 can be configured to ionize analyte in the sample using various but different techniques. For example, in some instances, an ionization source can be present in the ionization core(s) 1574 to ionize elemental species, e.g., to ionize inorganic species, prior to providing the elemental ions to the core MS 1577. In other instances, an ionization source can be present in the ionization core(s) 1575 to produce/ionize molecular species, e.g., to ionize organic species, prior to providing the molecular ions to the MS core 1578. In certain configurations as noted herein, the system 1570 may be configured to ionize both inorganic species and organic species using the ionization cores 1574, 1575 prior to providing the ions to the MS cores 1577, 1578. The GC's 1571, 1572 may receive sample from the same source or from different sources. Where different sample sources are present, the interface 1573 can provide analyte from the GC 1571 to either of the ionization cores 1574, 1575. Similarly, the interface 1573 can provide analyte from the GC 1572 to either of the ionization cores 1574, 1575. Each of the MS core(s) 1577, 1578 can be configured to filter/detect ions having a particular mass-to-charge. In some examples, either or both of the MS cores 1577, 1578 can be designed to filter/select/detect inorganic ions and to filter/select/detect organic ions depending on the particular components which are present. In some examples, the MS cores 1577, 1578 are configured differently with a different filtering device and/or detection device. While not shown, the mass analyzer 1576 typically comprises common components used by the one, two, three or more mass spectrometer cores (MSCs) which may be present in the mass analyzer 1576. For example, common gas controllers, processors, power supplies, detectors and vacuum pumps may be used by different mass MSCs present in the mass analyzer 1576. The system 1570 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 1570 between any one or more of the cores 1571, 1572, 1574, 1575, 1577 and 1578.

Figure 15J:
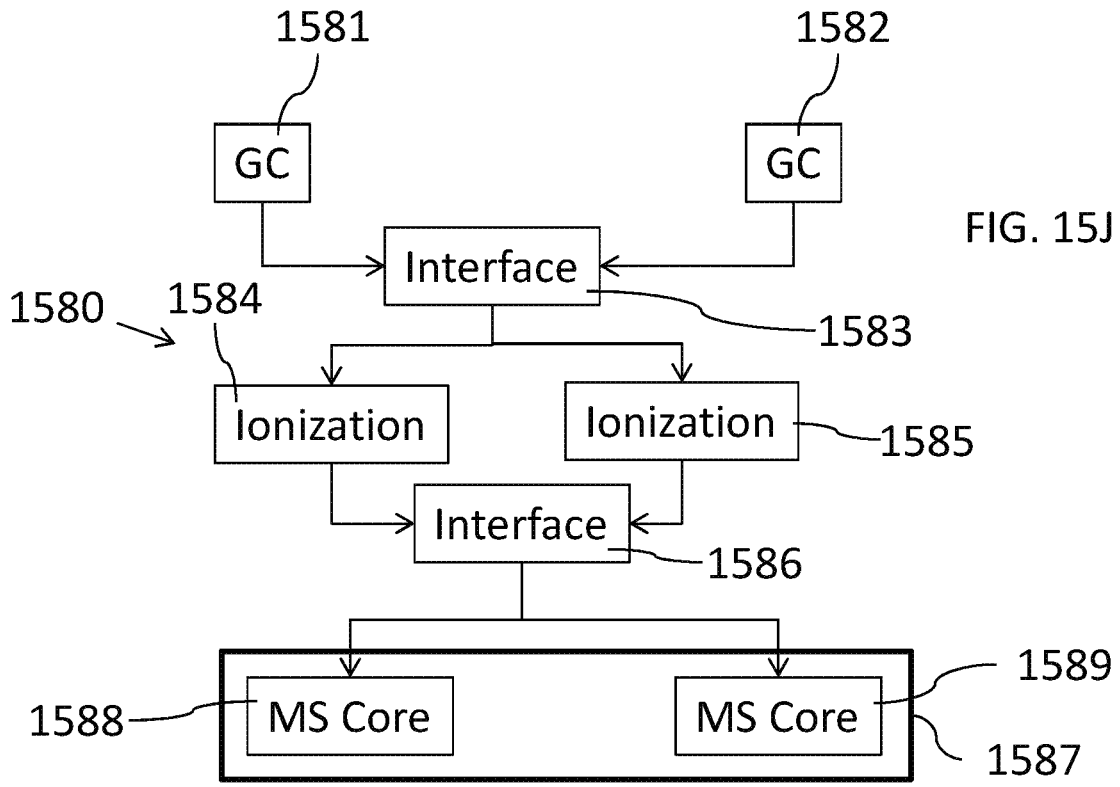
FIG. 15J is a block diagram of a system comprising two GC's, an interface, two ionization cores, another interface, and a mass analyzer comprising two MS cores, in accordance with certain examples.

In certain configurations where two or more GC's are present, each GC may be fluidically coupled to a respective ionization core through one or more interfaces and each ionization core may be coupled to two or more MS cores through an interface. Referring to FIG. 15J, a system 1580 comprises a first GC 1581, a second GC 1582, an interface 1583, a first ionization core 1584, and a second ionization core 1585. Each of the ionization cores 1584, 1585 is also fluidically coupled to a mass analyzer 1587 comprising MS cores 1588, 1589 through an interface 1586. In use of the system 1580, a sample can be introduced into the GC's 1581, 1582, and analyte in the sample can be vaporized, separated, reacted, derivatized, sorted, modified or otherwise acted on in some manner prior to providing the analyte species to the ionization cores 1584, 1585. The interface 1583 is fluidically coupled to each of the GC's 1581, 1582 and can be configured to provide sample to either or both of the ionization cores 1584, 1585. In some instances, the ionization cores 1584, 1585 can be configured to ionize analyte in the sample using various but different techniques. For example, in some instances, an ionization source can be present in the ionization core(s) 1584 to ionize elemental species, e.g., to ionize inorganic species, prior to providing the elemental ions to the interface 1586. In other instances, an ionization source can be present in the ionization core(s)

1585 to produce/ionize molecular species, e.g., to ionize organic species, prior to providing the molecular ions to the interface 1586. In certain configurations as noted herein, the system 1580 may be configured to ionize both inorganic species and organic species using the ionization cores 1584, 1585 prior to providing the ions to the interface 1586. The GC's 1581, 1582 may receive sample from the same source or from different sources. Where different sample sources are present, the interface 1583 can provide analyte from the GC 1581 to either of the ionization cores 1584, 1585. Similarly, the interface 1583 can provide analyte from the sample GC 1582 to either of the ionization cores 1584, 1585. The interface 1586 can receive ions from either or both of the ionization cores 1584, 1585 and provide the received ions to one or both of the MS cores 1588, 1589. Each of the MS core(s) 1588, 1589 can be configured to filter/detect ions having a particular mass-to-charge. In some examples, either or both of the MS cores 1588, 1589 can be designed to filter/select/detect inorganic ions and to filter/select/detect organic ions depending on the particular components which are present. In some examples, the MS cores 1588, 1589 are configured differently with a different filtering device and/or detection device. While not shown, the mass analyzer 1587 typically comprises common components used by the one, two, three or more mass spectrometer cores (MSCs) which may be present in the mass analyzer 1587. For example, common gas controllers, processors, power supplies, detectors and vacuum pumps may be used by different mass MSCs present in the mass analyzer 1587. The system 1580 can be configured to detect low atomic mass unit analytes, e.g., lithium or other elements with a mass down to as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 1580 between any one or more of the cores 1581, 1582, 1584, 1585, 1588 and 1589.

Figure 15K:
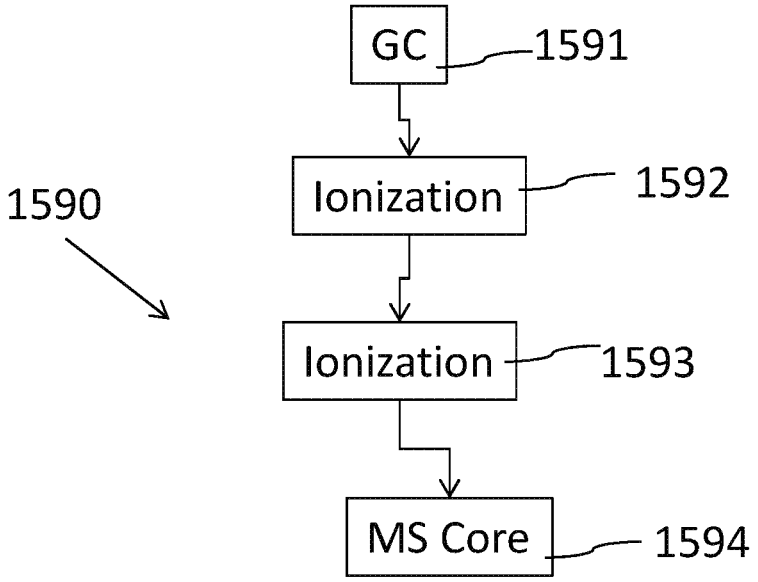
FIG. 15K is a block diagram of a system comprising a GC, two serially arranged ionization cores, and a mass analyzer comprising a MS core, in accordance with certain embodiments.

In certain configurations, one or more serially arranged ionization cores can be present and used with a GC. For example and referring to FIG. 15K, a system 1590 is shown that comprises a sample operation core comprising a GC 1591 fluidically coupled to a first ionization core 1592. The first ionization core 1592 is fluidically coupled to a second ionization core 1593, which itself is fluidically coupled to a mass analyzer comprising a MS core 1594. While not shown, a bypass line may also be present to directly couple the ionization core 1592 to the MS core 1594 if desired to permit ions to be provided directly from the core 1592 to the MS core 1594 in situations where the second ionization core 1593 is not used. Similarly, a bypass line can be present to directly couple the GC 1591 to the ionization core 1593 in situations where it is not desirable to use the ionization core 1592. In use of the system 1590, a sample can be introduced into the GC 1591, and analyte in the sample can be vaporized, separated, reacted, derivatized, sorted, modified or otherwise acted on in some manner prior to providing the analyte species to the ionization core 1592. The ionization core 1592 can be configured to ionize analyte in the sample using various techniques. For example, in some instances, an ionization source can be present in the ionization core 1592 to ionize elemental species, e.g., to ionize inorganic species, prior to providing the elemental ions to the core 1593 or the core 1594. In other instances, an ionization source can be present in the ionization core 1592 to produce/ionize molecular species, e.g., to ionize organic species, prior to providing the molecular ions to the core 1593 or the core 1594. The ionization core 1593 can be configured to ionize analyte in the sample using various techniques, which may be the same of different from those used by the core 1592. For example, in some instances, an ionization source can be present in the ionization core 1593 to ionize elemental species, e.g., to ionize inorganic species, prior to providing the elemental ions to the MS core 1594. In other instances, an ionization source can be present in the ionization core 1593 to produce/ionize molecular species, e.g., to ionize organic species, prior to providing the molecular ions to the MS core 1594. In certain configurations as noted herein, the system 1590 may be configured to ionize inorganic species and organic species prior to providing the ions to the core MS 1594. The MS core(s) 1594 can be configured to filter/detect ions having a particular mass-to-charge. In some examples, the MS core 1594 can be designed to filter/select/detect inorganic ions and to filter/select/detect organic ions depending on the particular components which are present. While not shown, the mass analyzer comprising the MS core 1594 typically comprises common components used by the one, two, three or more mass spectrometer cores (MSCs) which may be present in the mass analyzer. For example, common gas controllers, processors, power supplies, detectors and vacuum pumps may be used by different mass MSCs present in the mass analyzer. The system 1590 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 1590 between any one or more of the cores 1591, 1592, 1593 and 1594. In some instances, any of the systems described and shown in FIGS. 15A-15J may comprise a serial arrangement of ionization cores similar to the cores 1592, 1593 shown in FIG. 15K.

Figure 15L:
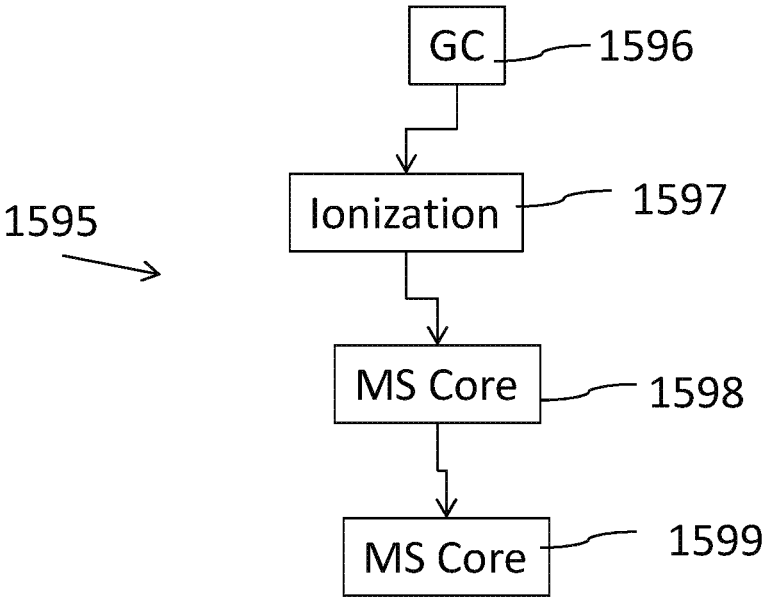
FIG. 15L is a block diagram a system comprising a GC, an ionization core, and a mass analyzer comprising two serially arranged MS cores, in accordance with certain embodiments.

In certain configurations, one or more serially arranged MS cores can be present in the systems described herein. For example and referring to FIG. 15L, a system 1595 is shown that comprises a sample operation core comprising a GC 1596 fluidically coupled to an ionization core 1597. The ionization core 1597 is fluidically coupled to a mass analyzer comprising a first MS core 1598, which itself is fluidically coupled to a second MS core 1599 of the mass analyzer. While not shown, a bypass line may also be present to directly couple the ionization core 1597 to the MS core 1599 if desired to permit ions to be provided directly from the core 1597 to the MS core 1599 in situations where the first MS core 1598 is not used. In use of the system 1595, a sample can be introduced into the GC 1596, and analyte in the sample can be vaporized, separated, reacted, derivatized, sorted, modified or otherwise acted on in some manner prior to providing the analyte species to the ionization core 1597. The ionization core 1597 can be configured to ionize analyte in the sample using various techniques. For example, in some instances, an ionization source can be present in the ionization core 1597 to ionize elemental species, e.g., to ionize inorganic species, prior to providing the elemental ions to the core MS 1598. In other instances, an ionization source can be present in the ionization core 1597 to produce/ionize molecular species, e.g., to ionize organic species, prior to providing the molecular ions to the MS core 1598. In certain configurations as noted herein, the system 1595 may be configured to ionize inorganic species and organic species prior to providing the ions to the MS core 1598. The MS core 1598 can be configured to filter/detect ions having a particular mass-to-charge. In some examples, the MS core 1598 can be designed to filter/select/detect inorganic ions and to filter/select/detect organic ions depending on the particular components which are present. Similarly, the MS core 1599 can be configured to filter/detect ions having a particular mass-to-charge. In some examples, the MS core 1599 can be designed to filter/select/detect inorganic ions and to filter/select/detect organic ions depending on the particular components which are present. While not shown, the mass analyzer comprising the MS cores 1598, 1599 typically comprises common components used by the one, two, three or more mass spectrometer cores (MSCs) which may be present in the mass analyzer. For example, common gas controllers, processors, power supplies, detectors and vacuum pumps may be used by different mass MSCs present in the mass analyzer. The system 1595 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 1595 between any one or more of the cores 1596, 1597, 1598 and 1599. In some instances, any of the systems described and shown in FIGS. 15A-15K may comprise a serial arrangement of MS cores similar to the MS cores 1598, 1599 shown in FIG. 15L.

Figure 16:
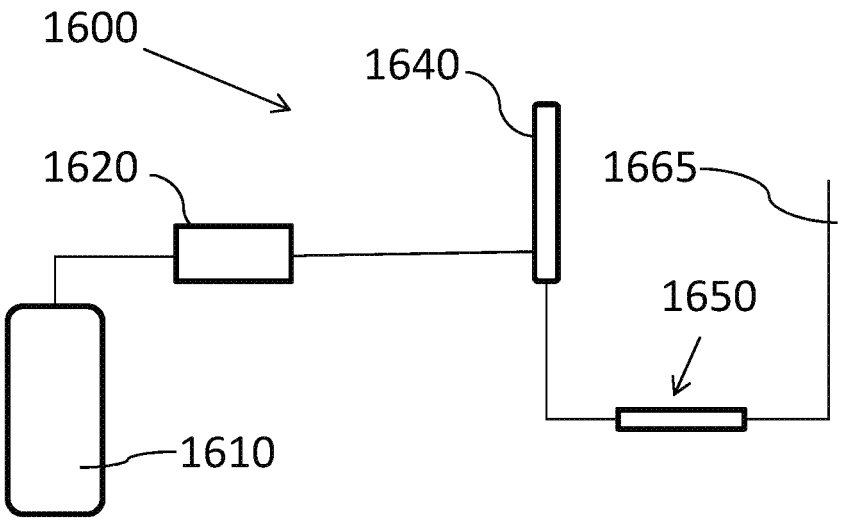
FIG. 16 is an illustration of a liquid chromatography system, in accordance with certain configurations.

In other instances, the sample operation core can be configured to implement liquid chromatography/separation techniques. In contrast to gas chromatography, liquid chromatography (LC) uses a liquid mobile phase and a stationary phase to separate species. Liquid chromatography may be desirable for use in separating various organic or biological analytes from each other. Referring to FIG. 16, a simplified schematic of one configuration of a liquid chromatography system is shown. In this configuration, the system 1600 is configured to perform high performance liquid chromatography. The system 1600 comprises a liquid reservoir(s) or source(s) 1610 fluidically coupled to one or more pumps such as pump 1620. The pump 1620 is fluidically coupled to an injector 1640 through a fluid line. If desired, filters, backpressure regulators, traps, drain valves, pulse dampers or other components may be present between the pump 1620 and the injector 1630. A liquid sample is injected into the injector 1640 and provided to a column 1650. The column 1650 can separate the liquid analyte components in the sample into individual analyte components that elute from the column 1650. The individual analyte components can then exit the column 1650 through a fluid line 1665 and can be provided to one or more ionization cores as described herein. If desired, two or more separate LC systems can be used in the systems described herein. For example, each ionization core may be fluidically coupled to a common LC system or a respective LC system if desired. Further, hybrid systems comprising serial or parallel GC/LC systems can also be used to vaporize certain analyte components and separate them using GC while permitting other components to be separated using LC techniques prior to providing the separated analyte components to one or more ionization cores.

Figure 17:
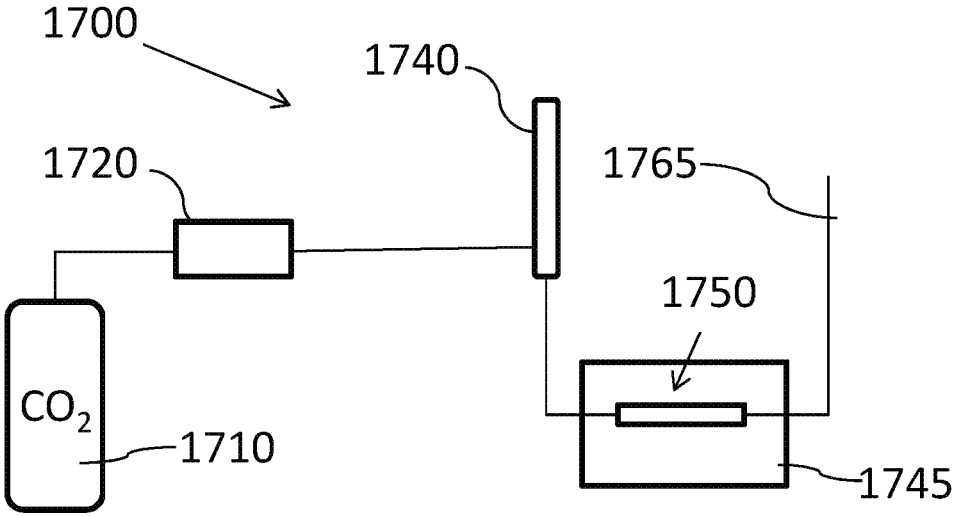
FIG. 17 is an illustration of a supercritical fluid chromatography system, in accordance with certain configurations.

In some instances, other liquid chromatography techniques such as size exclusion liquid chromatography, ion-exchange chromatography, hydrophobic interaction chromatography, fast protein liquid chromatography, thin layer chromatography, immunoseparations or other chromatographic techniques can also be used. In certain embodiments, a supercritical fluid chromatography (SFC) system can be used. Referring to FIG. 17, the system 1700 comprises a carbon dioxide source 1710 fluidically coupled to one or more pumps such as pump 1720. The pump 1720 is fluidically coupled to an injector 1740 through a fluid line. If desired, filters, backpressure regulators, traps, drain valves, pulse dampers or other components may be present between the pump 1720 and the injector 1730. A liquid sample is injected into the injector 1740 and provided to a column 1750 within an oven 1745. The column 1750 can use supercritical carbon dioxide to separate the liquid analyte components in the sample into individual analyte components that elute from the column 1750. The individual analyte components can then exit the column 1750 through a fluid line 1765 and can be provided to one or more ionization cores as described herein. If desired, two or more separate SFC systems can be used in the systems described herein. For example, each ionization core may be fluidically coupled to a common SFC system or a respective SFC system if desired. Further, hybrid systems comprising serial or parallel GC/SFC systems can also be used to vaporize certain analyte components and separate them using GC while permitting other components to be separated using SFC techniques prior to providing the separated analyte components to one or more ionization cores.

Figure 18A:
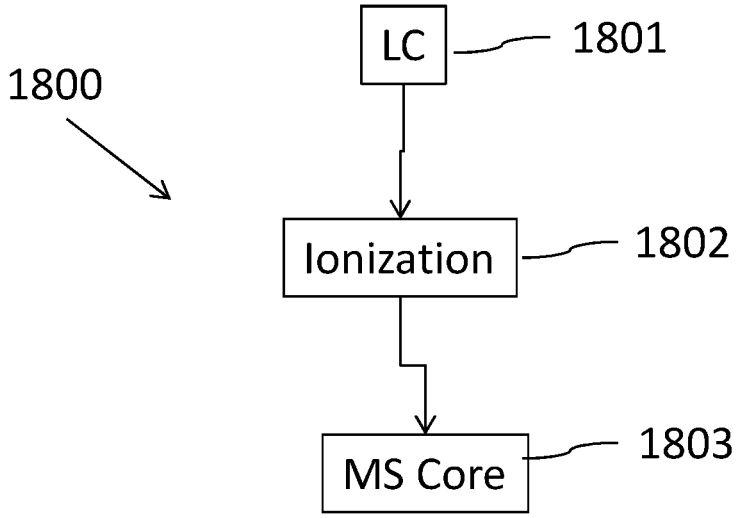
FIG. 18A is a block diagram of a system comprising a LC, an ionization core and a mass analyzer comprising a MS core, in accordance with certain embodiments.

In certain embodiments, the systems described herein may comprise one or more sample operation cores comprising a LC fluidically coupled to one or more ionization cores. Referring to FIG. 18A, a system 1800 comprises a sample operation core comprising a LC 1801 fluidically coupled to an ionization core(s) 1802, which itself is fluidically coupled to a filtering/detection core(s) 1803. In use of the system 1800, a sample can be introduced into the LC 1801, and analyte in the sample can be separated, reacted, derivatized, sorted, modified or otherwise acted on in some manner by the LC 1801 prior to providing the analyte species to the ionization core(s) 1802. The ionization cores(s) 1802 can be configured to ionize analyte in the sample using various techniques. For example, in some instances, an ionization source can be present in the ionization core(s) 1802 to ionize elemental species, e.g., to ionize inorganic species, prior to providing the elemental ions to the MS core 1803. In other instances, an ionization source can be present in the ionization core(s) 1802 to produce/ionize molecular species, e.g., to ionize organic species, prior to providing the molecular ions to the MS core 1803. In certain configurations as noted herein, the system 1800 may be configured to ionize inorganic species and organic species prior to providing the ions to the core 1803. The MS core(s) 1803 can be configured to filter/detect ions having a particular mass-to-charge. In some examples, the core 1803 can be designed to filter/select/detect inorganic ions and to filter/select/detect organic ions depending on the particular components which are present. While not shown, the mass analyzer comprising the MS core 1803 typically comprises common components used by the one, two, three or more mass spectrometer cores (MSCs) which may be present in the mass analyzer. For example, common gas controllers, processors, power supplies, detectors and vacuum pumps may be used by different mass MSCs present in the mass analyzer. The system 1800 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 1800 between any one or more of the cores 1801, 1802 and 1803.

Figure 18B:
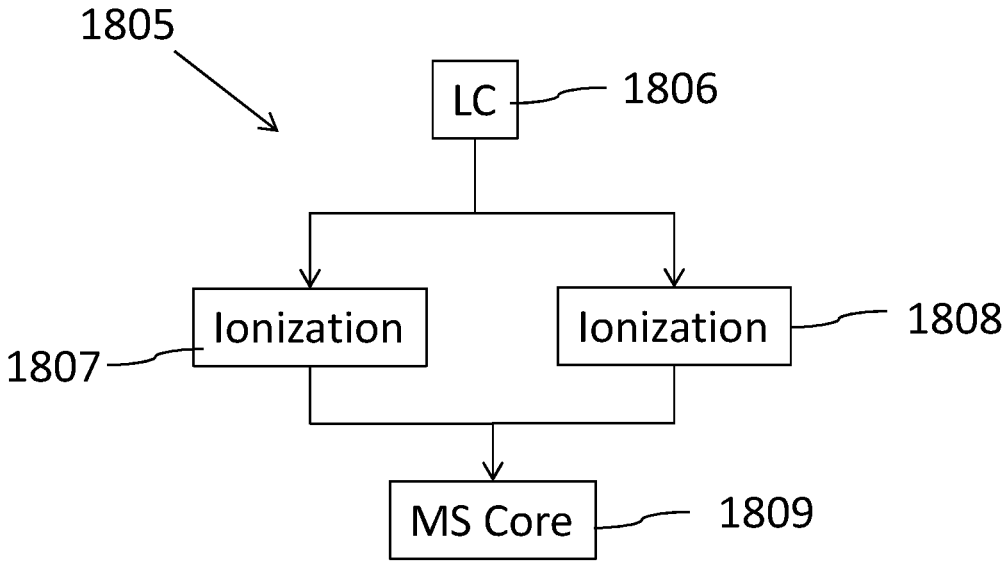
FIG. 18B is a block diagram of a system comprising a LC, two ionization cores and a mass analyzer comprising a MS core, in accordance with certain embodiments.

In certain configurations, any one or more of the cores shown in FIG. 18A can be separated or split into two or more cores. For example and referring to FIG. 18B, a system 1805 comprises a sample operation core comprising a LC 1806, a first ionization core 1807 fluidically coupled to the LC 1806 and a second ionization core 1808 fluidically coupled to the LC 1806. Each of the cores 1807, 1808 is also fluidically coupled to a mass analyzer comprising a MS core 1809. While not shown, an interface, valve, or other device can be present between the LC 1806 and the ionization cores 1807, 1808 to provide species from the LC 1806 to only one of the ionization cores 1807, 1808 at a selected time during use of the system 1805. In other configurations, the interface, valve or device can be configured to provide species from the LC 1806 to the ionization cores 1807, 1808 simultaneously. Similarly, a valve, interface or other device (not shown) can be present between the ionization cores 1807, 1808 and the MS core 1809 to provide species from the one of the ionization cores 1807, 1808 to the MS core 1809 at a selected time during use of the system 180. In other configurations, the interface, valve or device can be configured to provide species from the ionization cores 1807, 1808 at the same time to the MS core 1809. In use of the system 1805, a sample can be introduced into the LC 1806, and analyte in the sample can be separated, reacted, derivatized, sorted, modified or otherwise acted on in some manner by the LC 1806 prior to providing the analyte species to one or both of the ionization core(s) 1807, 1808. In some instances, the ionization cores 1807, 1808 can be configured to ionize analyte in the sample using various but different techniques. For example, in some instances, an ionization source can be present in the ionization core(s) 1807 to ionize elemental species, e.g., to ionize inorganic species, prior to providing the elemental ions to the MS core 1809. In other instances, an ionization source can be present in the ionization core(s) 1808 to produce/ionize molecular species, e.g., to ionize organic species, prior to providing the molecular ions to the MS core 1809. In certain configurations as noted herein, the system 1805 may be configured to ionize both inorganic species and organic species using the ionization cores 1807, 1808 prior to providing the ions to the MS core 1809. The MS core(s) 1809 can be configured to filter/detect ions having a particular mass-to-charge. In some examples, the MS core 1809 can be designed to filter/select/detect inorganic ions and to filter/select/detect organic ions depending on the particular components which are present. While not shown, the mass analyzer comprising the MS core 1809 typically comprises common components used by the one, two, three or more mass spectrometer cores (MSCs) which may be present in the mass analyzer. For example, common gas controllers, processors, power supplies, detectors and vacuum pumps may be used by different mass MSCs present in the mass analyzer. The system 1805 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 1805 between any one or more of the cores 1806, 1807, 1808 and 1809.

Figure 18C:
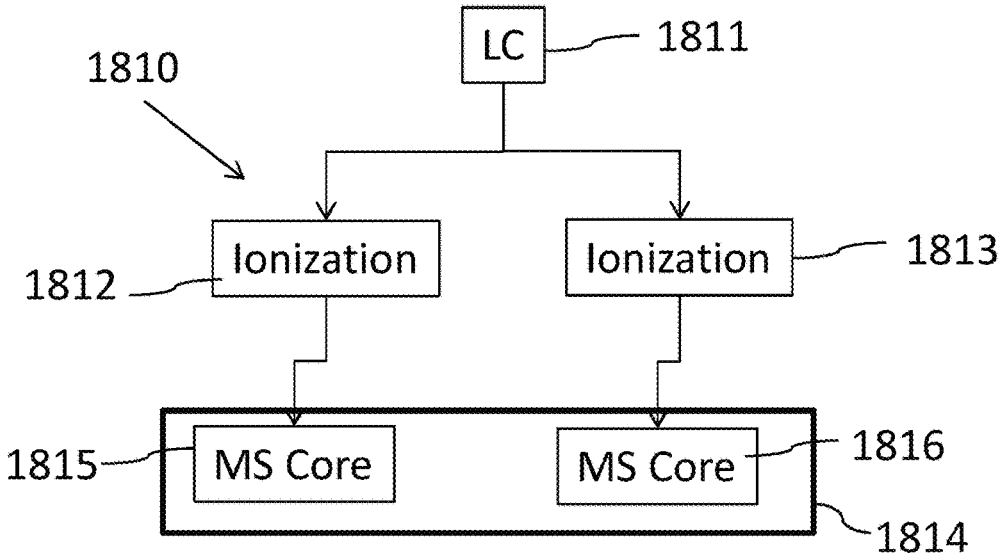
FIG. 18C is a block diagram of a system comprising a LC, two ionization cores and a mass analyzer comprising two MS cores, in accordance with certain configurations.

In other configurations, the mass analyzers described herein (when used with a LC) may comprise two or more individual MS cores. As noted herein, even though the MS cores can be separated, they still can share certain common components including gas controllers, processors, power supplies, detectors and/or vacuum pumps. Referring to FIG. 18C, a system 1810 is shown that comprises a LC 1811, a first ionization core 1812, a second ionization core 1813, and a mass analyzer 1814 comprising a first MS core 1815 and a second MS core 1816. The LC 1811 is fluidically coupled to each of the ionization cores 1812, 1813. While not shown, an interface, valve, or other device can be present between the LC 1811 and the ionization cores 1812, 1813 to provide species from the LC 1811 to only one of the ionization cores 1812, 1813 at a selected time during use of the system 1810. In other configurations, the interface, valve or device can be configured to provide species from the LC 1811 to the ionization cores 1812, 1813 simultaneously. The ionization core 1812 is fluidically coupled to the first MS core 1815, and the second ionization core 1813 is fluidically coupled to the second MS core 1816. In use of the system 1810, a sample can be introduced into the LC 1811, and analyte in the sample can be separated, reacted, derivatized, sorted, modified or otherwise acted on in some manner prior to providing the analyte species to one or both of the ionization core(s) 1812, 1813. In some instances, the ionization cores 1812, 1813 can be configured to ionize analyte in the sample using various but different techniques. For example, in some instances, an ionization source can be present in the ionization core(s) 1812 to ionize elemental species, e.g., to ionize inorganic species, prior to providing the elemental ions to the MS core 1815. In other instances, an ionization source can be present in the ionization core(s) 1813 to produce/ionize molecular species, e.g., to ionize organic species, prior to providing the molecular ions to the MS core 1816. In certain configurations as noted herein, the system 1810 may be configured to ionize both inorganic species and organic species using the ionization cores 1812, 1813 prior to providing the ions to the cores 1815, 1816. The MS core(s) 1815, 1816 can be configured to filter/detect ions having a particular mass-to-charge. In some examples, the core 1815 can be designed to filter/select/detect inorganic ions, and the core 1816 can be designed to filter/select/detect organic ions depending on the particular components which are present. While not shown, the mass analyzer 1814 typically comprises common components used by the one, two, three or more mass spectrometer cores (MSCs) which may independently be present in the mass analyzer 1814. For example, common gas controllers, processors, power supplies, detectors and vacuum pumps may be used by different mass MSCs present in the mass analyzer 1814, though each of the cores 1815, 1816 may comprise its own gas controllers, processors, power supplies, detectors and/or vacuum pumps if desired. The system 1810 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 1810 between any one or more of the cores 1811, 1812, 1813, 1815 and 1816.

Figure 18D:
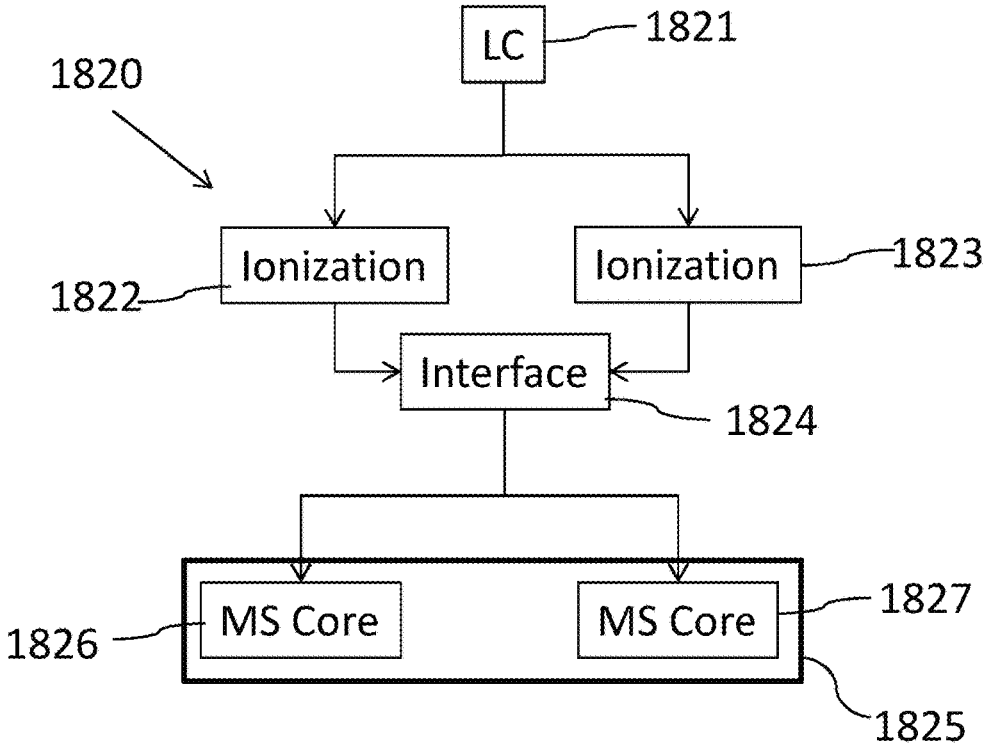
FIG. 18D is a block diagram of a system comprising a LC, two ionization cores, an interface and a mass analyzer comprising two MS cores, in accordance with certain configurations.

In some instances where a LC, two ionization cores and two MS cores are present, it may be desirable to provide ions from different ionization cores to different MS cores. For example and referring to FIG. 18D, a system 1820 is shown that comprises a LC 1821, a first ionization core 1822, a second ionization core 1823, an interface 1824, and a mass analyzer 1825 comprising a first MS core 1826 and a second MS core 1827. The LC 1821 is fluidically coupled to each of the ionization cores 1822, 1823. While not shown, an interface, valve, or other device can be present between the LC 1821 and the ionization cores 1822, 1823 to provide species from the LC 1821 to only one of the ionization cores 1822, 1823 at a selected time during use of the system 1820. In other configurations, the interface, valve or device can be configured to provide species from the LC 1821 to the ionization cores 1822, 1823 simultaneously. The ionization core 1822 is fluidically coupled to the interface 1824, and the ionization core 1823 is fluidically coupled to the interface 1824. The interface 1824 is fluidically coupled to each of a first MS core 1826 and a second MS core 1827. In use of the system 1820, a sample can be introduced into the LC 1821, and analyte in the sample can be separated, reacted, derivatized, sorted, modified or otherwise acted on in some manner prior to providing the analyte species to one or both of the ionization core(s) 1822, 1823. In some instances, the ionization cores 1822, 1823 can be configured to ionize analyte in the sample using various but different techniques. For example, in some instances, an ionization source can be present in the ionization core(s) 1822 to ionize elemental species, e.g., to ionize inorganic species, prior to providing the elemental ions to the interface 1824. In other instances, an ionization source can be present in the ionization core(s) 1823 to produce/ionize molecular species, e.g., to ionize organic species, prior to providing the molecular ions to the interface 1824. In certain configurations as noted herein, the system 1820 may be configured to ionize both inorganic species and organic species using the ionization cores 1822, 1823 prior to providing the ions to the interface 1824. The interface 1824 can be configured to provide ions to either or both of the MS core(s) 1826, 1827 each of which can be configured to filter/detect ions having a particular mass-to-charge. In some examples, the MS core 1826 can be designed to filter/select/detect inorganic ions, and the MS core 1827 can be designed to filter/select/detect organic ions depending on the particular components which are present. In some examples, the cores 1826, 1827 are configured differently with a different filtering device and/or detection device. While not shown, the mass analyzer 1825 typically comprises common components used by the one, two, three or more mass spectrometer cores (MSCs) which may independently be present in the mass analyzer 1825. For example, common gas controllers, processors, power supplies, detectors and vacuum pumps may be used by different mass MSCs present in the mass analyzer 1825, though each of the MS cores 1826, 1827 may comprise its own gas controllers, processors, power supplies, detectors and/or vacuum pumps if desired. The system 1820 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 1820 between any one or more of the cores 1821, 1822, 1823, 1826 and 1827.

Figure 18E:
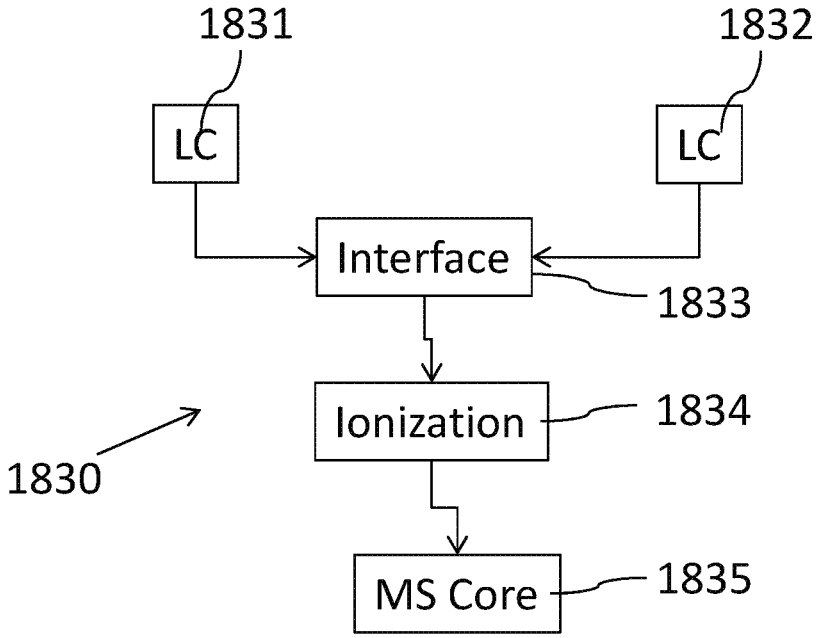
FIG. 18E is a block diagram of a system comprising two LC's, an interface, an ionization core, and a mass analyzer comprising a MS core, in accordance with certain examples.

In certain examples, the sample operation core can be split into two or more cores if desired. For example, it may be desirable to perform different operations when inorganic ions are to be provided to an ionization core or MS core compared to when organic ions are to be provided to an ionization core or MS core. Referring to FIG. 18E, a system 1830 is shown that comprises a sample operation core comprising a first LC 1831 and a second LC 1832, though as noted herein one of the LC's 1831, 1832 could be replaced with a sample operation core such as a GC, DSA or other device or system. Each of the LC's 1831, 1832 is fluidically coupled to an interface 1833. The interface 1833 is fluidically coupled to an ionization core 1834, which itself is fluidically coupled to a mass analyzer comprising a MS core 1835. In use of the system 1830, a sample can be introduced into one or both of the LC's 1831, 1832, and analyte in the sample can be separated, reacted, derivatized, sorted, modified or otherwise acted on in some manner prior to providing the analyte species to the interface 1833. The different LC's 1831, 1832 can be configured to perform different separations, use different separation conditions, use different carrier gases or include different components. The interface 1833 can be configured to permit passage of sample from one or both of the LC's 1831, 1832 to the ionization core 1834. The ionization cores(s) 1834 can be configured to ionize analyte in the sample using various techniques. For example, in some instances an ionization source can be present in the ionization core(s) 1834 to ionize elemental species, e.g., to ionize inorganic species, prior to providing the elemental ions to the MS core 1835. In other instances, an ionization source can be present in the ionization core(s) 1834 to produce/ionize molecular species, e.g., to ionize organic species, prior to providing the molecular ions to the MS core 1835. In certain configurations as noted herein, the system 1830 may be configured to ionize inorganic species and organic species prior to providing the ions to the core MS 1835. The MS core(s) 1835 can be configured to filter/detect ions having a particular mass-to-charge. In some examples, the MS core 1835 can be designed to filter/select/detect inorganic ions and to filter/select/detect organic ions depending on the particular components which are present. While not shown, the mass analyzer comprising the MS core 1835 typically comprises common components used by the one, two, three or more mass spectrometer cores (MSCs) which may be present in the mass analyzer. For example, common gas controllers, processors, power supplies, detectors and vacuum pumps may be used by different mass MSCs present in the mass analyzer. The system 1830 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 1830 between any one or more of the cores 1831, 1832, 1834 and 1835.

Figure 18F:
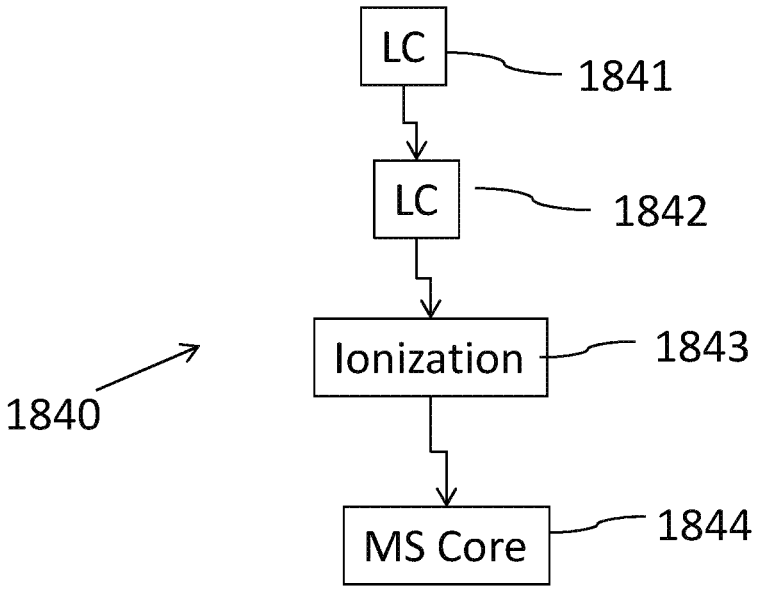
FIG. 18F is a block diagram of a system comprising two serially arranged LC's, an ionization core, and a mass analyzer comprising a MS core, in accordance with certain configurations.

In certain configurations, the LC's can be serially coupled to each other if desired. For example, it may be desirable to perform separate analytes in a sample using LC's configured for different separation conditions. Referring to FIG. 18F, a system 1840 is shown that comprises a first LC 1841 fluidically coupled to a second LC 1842. Depending on the nature of the analyte sample, one of the LC's 1841, 1842 may be present in a passive configuration and generally pass sample without performing any operations on the sample, whereas in other instances each of the LC's 1841, 1842 performs one or more sample operations including, but not limited to, separation, reaction, derivatization, sorting, modification or otherwise acting on the sample in some manner prior to providing the analyte species to the ionization core 1843. The ionization cores(s) 1843 can be configured to ionize analyte in the sample using various techniques. For example, in some instances, an ionization source can be present in the ionization core(s) 1843 to ionize elemental species, e.g., to ionize inorganic species, prior to providing the elemental ions to a mass analyzer comprising a MS core 1844. In other instances, an ionization source can be present in the ionization core(s) 1843 to produce/ionize molecular species, e.g., to ionize organic species, prior to providing the molecular ions to the core MS 1844. In certain configurations as noted herein, the system 1840 may be configured to ionize inorganic species and organic species prior to providing the ions to the MS core 1844. The MS core 1844 can be configured to filter/detect ions having a particular mass-to-charge. In some examples, the MS core 1844 can be designed to filter/select/detect inorganic ions and to filter/select/detect organic ions depending on the particular components which are present. While not shown, the mass analyzer comprising the MS core 1844 typically comprises common components used by the one, two, three or more mass spectrometer cores (MSCs) which may be present in the mass analyzer. For example, common gas controllers, processors, power supplies, detectors and vacuum pumps may be used by different mass MSCs present in the mass analyzer. The system 1840 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 1840 between any one or more of the cores 1841, 1842, 1843 and 1844.

Figure 18G:
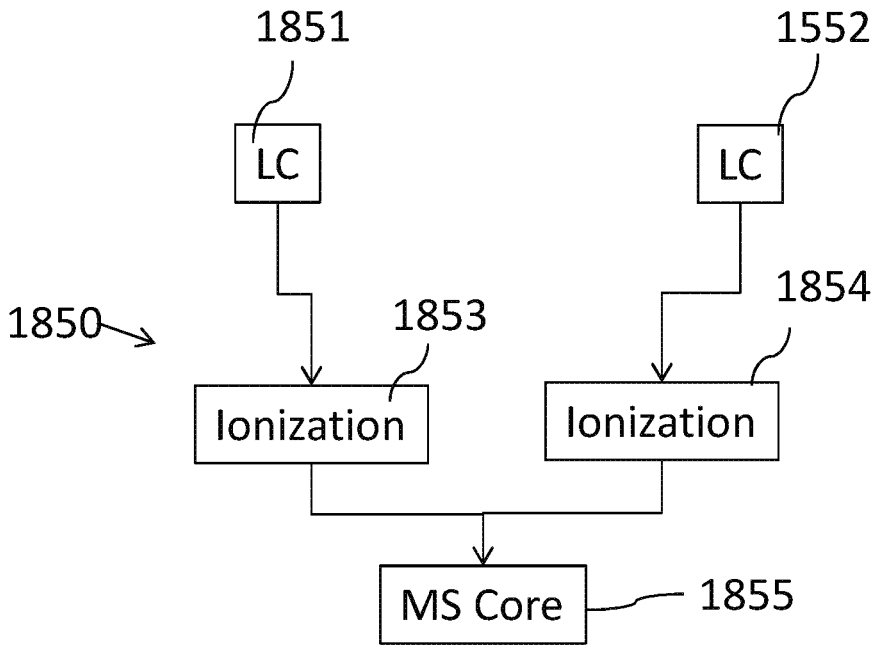
FIG. 18G is a block diagram of a system comprising two LC's, two ionization cores, and a mass analyzer comprising a MS core, in accordance with certain examples.

In certain configurations where two or more LC's are present, each LC may be fluidically coupled to a respective ionization core. For example and referring to FIG. 18G, a system 1860 comprises a sample operation core comprising a first LC 1851, a second LC 1852, a first ionization core 1853 fluidically coupled to the first LC 1851, and a second ionization core 1854 fluidically coupled to the second LC 1852. As noted herein, one of the LC's 1851, 1852 can be replaced with a different sample operation core such as, for example, a GC, DSA device or other sample operation core if desired. Each of the cores 1853, 1854 is also fluidically coupled to a mass analyzer comprising a MS core 1855. While not shown, a valve, interface or other device can be present between the ionization cores 1853, 1854 and the MS core 1855 to provide species from the one of the ionization cores 1853, 1854 to the MS core 1855 at a selected time during use of the system 1850. In other configurations, the interface, valve or device can be configured to provide species from the ionization cores 1853, 1854 at the same time to the MS core 1855. In use of the system 1850, a sample can be introduced into the LC's 181, 1852, and analyte in the sample can be separated, reacted, derivatized, sorted, modified or otherwise acted on in some manner prior to providing the analyte species to the ionization cores 1853, 1854. In some instances, the ionization cores 1853, 1854 can be configured to ionize analyte in the sample using various but different techniques. For example, in some instances, an ionization source can be present in the ionization core(s) 1853 to ionize elemental species, e.g., to ionize inorganic species, prior to providing the elemental ions to the MS core 1855. In other instances, an ionization source can be present in the ionization core(s) 1854 to produce/ionize molecular species, e.g., to ionize organic species, prior to providing the molecular ions to the MS core 1855. In certain configurations as noted herein, the system 1850 may be configured to ionize both inorganic species and organic species using the ionization cores 1853, 1854 prior to providing the ions to the MS core 1855. The MS core 1855 can be configured to filter/detect ions having a particular mass-to-charge. In some examples, the MS core 1855 can be designed to filter/select/detect inorganic ions and to filter/select/detect organic ions depending on the particular components which are present. While not shown, the mass analyzer comprising the MS core 1855 typically comprises common components used by the one, two, three or more mass spectrometer cores (MSCs) which may be present in the mass analyzer. For example, common gas controllers, processors, power supplies, detectors and vacuum pumps may be used by different mass MSCs present in the mass analyzer. The system 1850 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 1850 between any one or more of the cores 1851, 1852, 1853, 1854 and 1855.

Figure 18H:
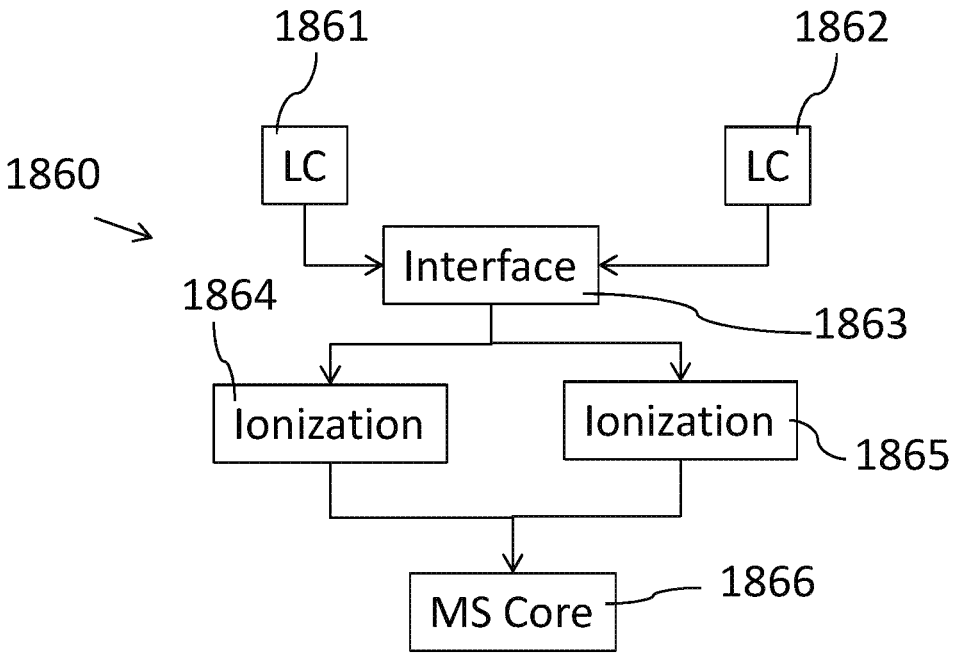
FIG. 18H is a block diagram of a system comprising two LC's, an interface, two ionization cores, and a mass analyzer comprising a MS core, in accordance with certain configurations.

In certain configurations where two or more LC's are present, each LC may be fluidically coupled to a respective ionization core through one or more interfaces. For example and referring to FIG. 18H, a system 1860 comprises a first LC 1861, a second LC 1862, an interface 1863, a first ionization core 1864, and a second ionization core 1865. As noted herein, one of the LC's 1861, 1862 can be replaced with a different sample operation core such as, for example, a GC, DSA device or other sample operation core if desired. Each of the ionization cores 1864, 1865 is also fluidically coupled to a mass analyzer comprising a MS core 1866. While not shown, a valve, interface or other device can be present between the ionization cores 1864, 1865 and the MS core 1866 to provide species from the one of the ionization cores 1864, 1865 to the MS core 1866 at a selected time during use of the system 1860. In other configurations, the interface, valve or device can be configured to provide species from the ionization cores 1864, 1865 at the same time to the MS core 1866. In use of the system 1860, a sample can be introduced into the LC's 1861, 1862, and analyte in the sample can be separated, reacted, derivatized, sorted, modified or otherwise acted on in some manner prior to providing the analyte species to the ionization cores 1864, 1865. The interface 1863 is fluidically coupled to each of the LC's 1861, 18652 and can be configured to provide sample to either or both of the ionization cores 1864, 1865. In some instances, the ionization cores 1864, 1865 can be configured to ionize analyte in the sample using various but different techniques. For example, in some instances, an ionization source can be present in the ionization core(s) 1864 to ionize elemental species, e.g., to ionize inorganic species, prior to providing the elemental ions to the MS core 1866. In other instances, an ionization source can be present in the ionization core(s) 1865 to produce/ionize molecular species, e.g., to ionize organic species, prior to providing the molecular ions to the MS core 1866. In certain configurations as noted herein, the system 1860 may be configured to ionize both inorganic species and organic species using the ionization cores 1864, 1865 prior to providing the ions to the MS core 1866. The LC's 1861, 1862 may receive sample from the same source or from different sources. Where different sample sources are present, the interface 1863 can provide analyte from the LC 1861 to either of the ionization cores 1864, 1865. Similarly, the interface 1863 can provide analyte from the LC 1862 to either of the ionization cores 1864, 1865. The MS core(s) 1866 can be configured to filter/detect ions having a particular mass-to-charge. In some examples, the MS core 1866 can be designed to filter/select/detect inorganic ions and to filter/select/detect organic ions depending on the particular components which are present. While not shown, the mass analyzer comprising the MS core 1866 typically comprises common components used by the one, two, three or more mass spectrometer cores (MSCs) which may be present in the MS core 1866. For example, common gas controllers, processors, power supplies, detectors and vacuum pumps may be used by different mass MSCs present in the mass analyzer. The system 1860 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 1860 between any one or more of the cores 1861, 1862, 1864, 1865 and 1866.

Figure 18I:
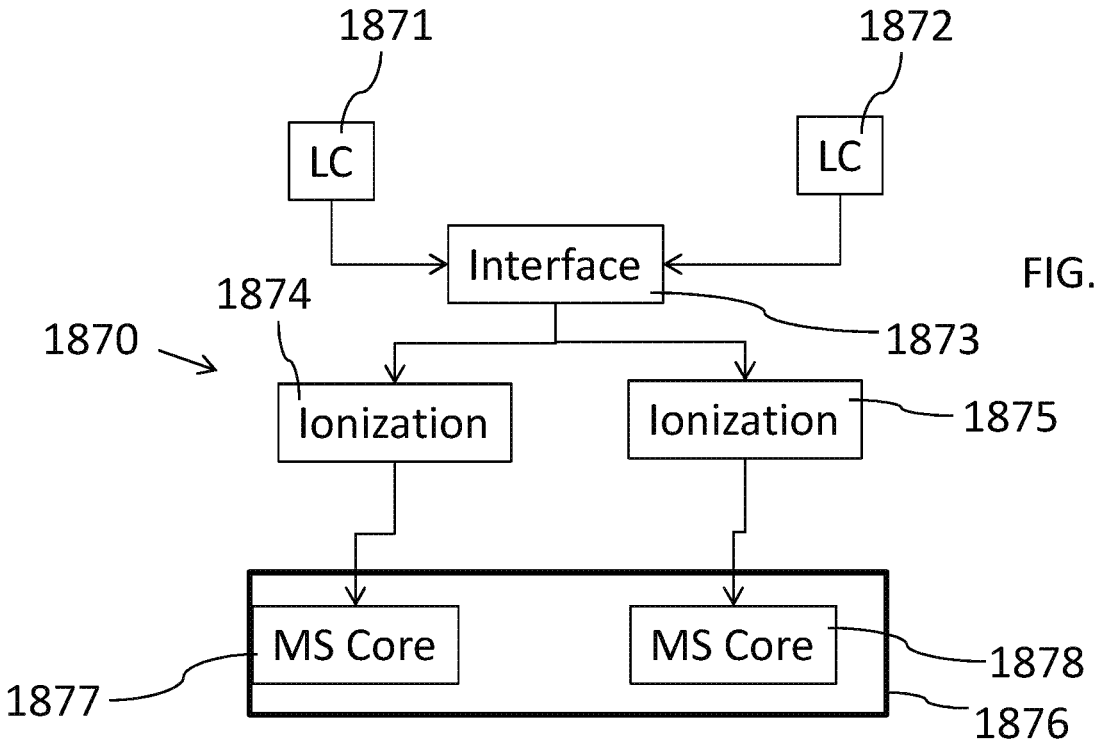
FIG. 18I is a block diagram of a system comprising two LC's, an interface, two ionization cores, and a mass analyzer comprising two MS cores, in accordance with certain examples.

In certain configurations where two or more LC's are present, each LC may be fluidically coupled to a respective ionization core through one or more interfaces and each ionization core may comprise a respective MS core. For example and referring to FIG. 18I, a system 1870 comprises a sample operation core comprising a first LC 1871, a second LC 1872, an interface 1873, a first ionization core 1874, and a second ionization core 1875. Each of the ionization cores 1874, 1875 is also fluidically coupled to a mass analyzer 1876 comprising MS cores 1877, 1878. As noted herein, one of the LC's 1871, 1872 can be replaced with a different sample operation core such as, for example, a GC, DSA device or other sample operation core if desired. In use of the system 1870, a sample can be introduced into the LC's 1871, 1872, and analyte in the sample can be separated, reacted, derivatized, sorted, modified or otherwise acted on in some manner prior to providing the analyte species to the ionization cores 1874, 1875. The interface 1873 is fluidically coupled to each of the LC's 1871, 1872 and can be configured to provide sample to either or both of the ionization cores 1874, 1875. In some instances, the ionization cores 1874, 1875 can be configured to ionize analyte in the sample using various but different techniques. For example, in some instances, an ionization source can be present in the ionization core(s) 1874 to ionize elemental species, e.g., to ionize inorganic species, prior to providing the elemental ions to the MS core 1877. In other instances, an ionization source can be present in the ionization core(s) 1875 to produce/ionize molecular species, e.g., to ionize organic species, prior to providing the molecular ions to the MS core 1878. In certain configurations as noted herein, the system 1870 may be configured to ionize both inorganic species and organic species using the ionization cores 1874, 1875 prior to providing the ions to the MS cores 1877, 1878. The LC's 1871, 1872 may receive sample from the same source or from different sources. Where different sample sources are present, the interface 1873 can provide analyte from the LC 1871 to either of the ionization cores 1874, 1875. Similarly, the interface 1873 can provide analyte from the LC 1872 to either of the ionization cores 1874, 1875. Each of the MS core(s) 1877, 1878 can be configured to filter/detect ions having a particular mass-to-charge. In some examples, either or both of the cores 1877, 1878 can be designed to filter/select/detect inorganic ions and to filter/select/detect organic ions depending on the particular components which are present. In some examples, the cores 1877, 1878 are configured differently with a different filtering device and/or detection device. While not shown, the mass analyzer 1876 comprising the MS cores 1877, 1878 typically comprises common components used by the one, two, three or more mass spectrometer cores (MSCs) which may be present in the mass analyzer 1876. For example, common gas controllers, processors, power supplies, detectors and vacuum pumps may be used by different mass MSCs present in the mass analyzer 1876. The system 1870 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 1870 between any one or more of the cores 1871, 1872, 1874, 1875, 1877 and 1878.

Figure 18J:
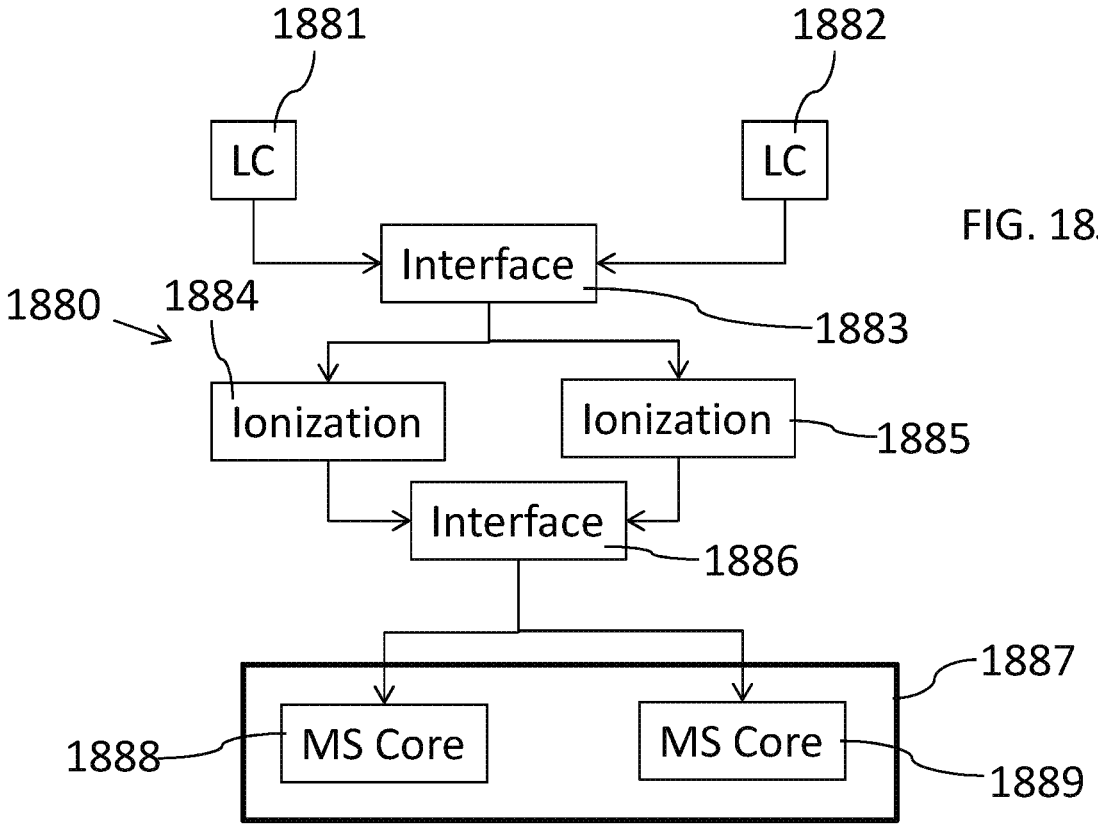
FIG. 18J is a block diagram of a system comprising two LC's, an interface, two ionization cores, another interface, and a mass analyzer comprising two MS cores, in accordance with certain examples.

In certain configurations where two or more LC's are present, each LC may be fluidically coupled to a respective ionization core through one or more interfaces and each ionization core may be coupled to two or more MS cores through an interface. Referring to FIG. 18J, a system 1880 comprises a first LC 1881, a second LC 1882, an interface 1883, a first ionization core 1884, and a second ionization core 1885. Each of the ionization cores 1884, 1885 is also fluidically coupled to a mass analyzer 1887 comprising MS cores 1888, 1889 through an interface 1886. In use of the system 1880, a sample can be introduced into the LC's 1881, 1882, and analyte in the sample can be separated, reacted, derivatized, sorted, modified or otherwise acted on in some manner prior to providing the analyte species to the ionization cores 1884, 1885. The interface 1883 is fluidically coupled to each of the LC's 1881, 1882 and can be configured to provide sample to either or both of the ionization cores 1884, 1885. In some instances, the ionization cores 1884, 1885 can be configured to ionize analyte in the sample using various but different techniques. For example, in some instances, an ionization source can be present in the ionization core(s) 1884 to ionize elemental species, e.g., to ionize inorganic species, prior to providing the elemental ions to the interface 1886. In other instances, an ionization source can be present in the ionization core(s) 1885 to produce/ionize molecular species, e.g., to ionize organic species, prior to providing the molecular ions to the interface 1886. In certain configurations as noted herein, the system 1880 may be configured to ionize both inorganic species and organic species using the ionization cores 1884, 1885 prior to providing the ions to the interface 1886. The LC's 1881, 1882 may receive sample from the same source or from different sources. Where different sample sources are present, the interface 1883 can provide analyte from the LC 1881 to either of the ionization cores 1884, 1885. Similarly, the interface 1883 can provide analyte from the LC 1882 to either of the ionization cores 1884, 1885. The interface 1886 can receive ions from either or both of the ionization cores 1884, 1885 and provide the received ions to one or both of the MS cores 1888, 1889 of the mass analyzer 1887. Each of the MS core(s) 1888, 1889 can be configured to filter/detect ions having a particular mass-to-charge. In some examples, either or both of the cores 1888, 1889 can be designed to filter/select/detect inorganic ions and to filter/select/detect organic ions depending on the particular components which are present. In some examples, the cores 1888, 1889 are configured differently with a different filtering device and/or detection device. While not shown, the mass analyzer 1887 comprising the MS cores 1888, 1889 typically comprises common components used by the one, two, three or more mass spectrometer cores (MSCs) which may be present the mass analyzer 1887. For example, common gas controllers, processors, power supplies, detectors and vacuum pumps may be used by different mass MSCs present in the mass analyzer 1887. The system 1880 can be configured to detect low atomic mass unit analytes, e.g., lithium or other elements with a mass down to as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 1880 between any one or more of the cores 1881, 1882, 1884, 1885, 1888 and 1889.

Figure 18K:
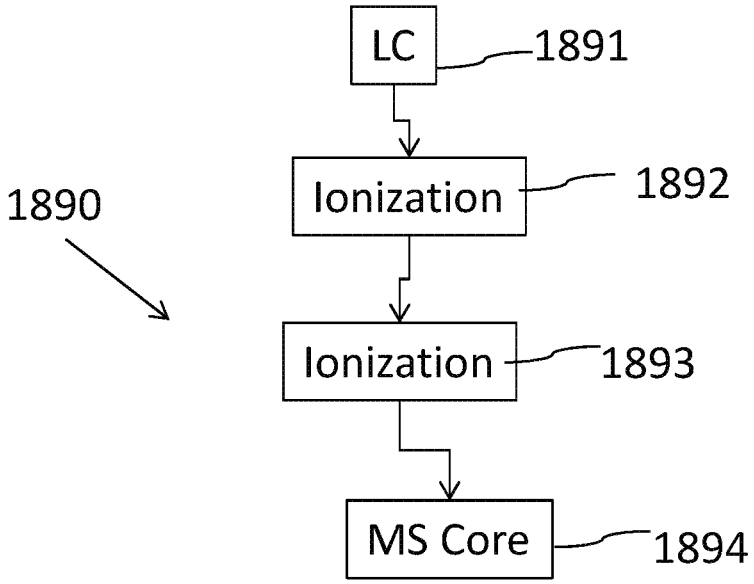
FIG. 18K is a block diagram of a system comprising a LC, two serially arranged ionization cores, and a mass analyzer comprising a MS core, in accordance with certain embodiments.

In certain configurations, one or more serially arranged ionization cores can be present and used with a LC. For example and referring to FIG. 18K, a system 1890 is shown that comprise a LC 1891 fluidically coupled to a first ionization core 1892. The first ionization core 1892 is fluidically coupled to a second ionization core 1893, which itself is fluidically coupled to a mass analyzer comprising a MS core 1894. While not shown, a bypass line may also be present to directly couple the ionization core 1892 to the MS core 1894 if desired to permit ions to be provided directly from the core 1892 to the MS core 1894 in situations where the second ionization core 1893 is not used. Similarly, a bypass line can be present to directly couple the LC 1891 to the ionization core 1893 in situations where it is not desirable to use the ionization core 1892. In use of the system 1890, a sample can be introduced into the LC 1891, and analyte in the sample can be separated, reacted, derivatized, sorted, modified or otherwise acted on in some manner prior to providing the analyte species to the ionization core 1892. The ionization core 1892 can be configured to ionize analyte in the sample using various techniques. For example, in some instances, an ionization source can be present in the ionization core 1892 to ionize elemental species, e.g., to ionize inorganic species, prior to providing the elemental ions to the ionization core 1893 or the MS core 1894. In other instances, an ionization source can be present in the ionization core 1892 to produce/ionize molecular species, e.g., to ionize organic species, prior to providing the molecular ions to the ionization core 1893 or the MS core 1894. The ionization core 1893 can be configured to ionize analyte in the sample using various techniques, which may be the same of different from those used by the core 1892. For example, in some instances, an ionization source can be present in the ionization core 1893 to ionize elemental species, e.g., to ionize inorganic species, prior to providing the elemental ions to the MS core 1894. In other instances, an ionization source can be present in the ionization core 1893 to produce/ionize molecular species, e.g., to ionize organic species, prior to providing the molecular ions to the MS core 1894. In certain configurations as noted herein, the system 1890 may be configured to ionize inorganic species and organic species prior to providing the ions to the MS core 1894. The MS core 1894 can be configured to filter/detect ions having a particular mass-to-charge. In some examples, the MS core 1894 can be designed to filter/select/detect inorganic ions and to filter/select/detect organic ions depending on the particular components which are present. While not shown, the mass analyzer comprising the MS core 1894 typically comprises common components used by the one, two, three or more mass spectrometer cores (MSCs) which may be present in the mass analyzer. For example, common gas controllers, processors, power supplies and vacuum pumps may be used by different mass MSCs present in the mass analyzer. The system 1890 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 1890 between any one or more of the cores 1891, 1892, 1893 and 1894. In some instances, any of the systems described and shown in FIGS. 18A-18J may comprise a serial arrangement of ionization cores similar to the cores 1892, 1893 shown in FIG. 18K.

Figure 18L:
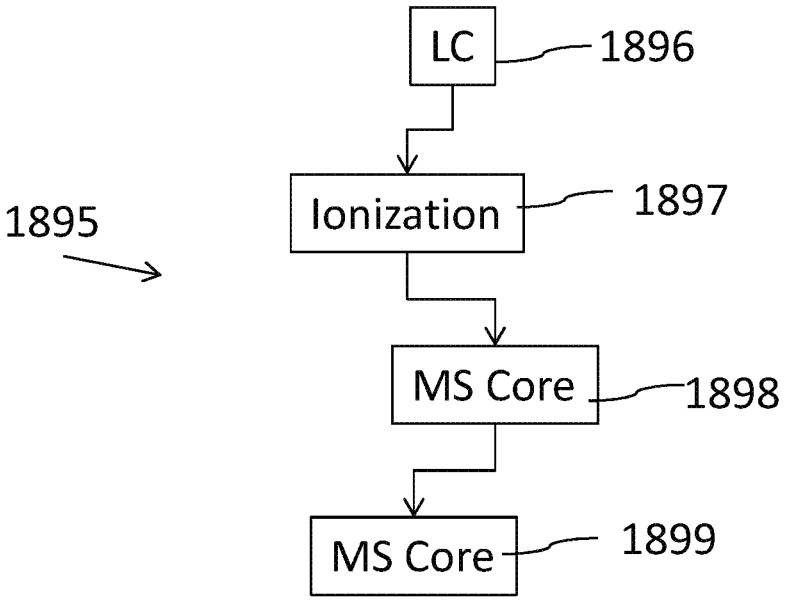
FIG. 18L is a block diagram a system comprising a LC, an ionization core, and a mass analyzer comprising two serially arranged MS cores, in accordance with certain embodiments.

In certain configurations, one or more serially arranged MS cores can be present in the systems described herein. For example and referring to FIG. 18L, a system 1895 is shown that comprise a LC 1896 fluidically coupled to an ionization core 1897. The ionization core 1897 is fluidically coupled to a mass analyzer comprising a first MS core 1898, which itself is fluidically coupled to a second MS core 1899 of the mass analyzer. While not shown, a bypass line may also be present to directly couple the ionization core 1897 to the MS core 1899 if desired to permit ions to be provided directly from the ionization core 1897 to the MS core 1899 in situations where the first MS core 1898 is not used. In use of the system 1895, a sample can be introduced into the LC 1896, and analyte in the sample can be separated, reacted, derivatized, sorted, modified or otherwise acted on in some manner prior to providing the analyte species to the ionization core 1897. The ionization core 1897 can be configured to ionize analyte in the sample using various techniques. For example, in some instances, an ionization source can be present in the ionization core 1897 to ionize elemental species, e.g., to ionize inorganic species, prior to providing the elemental ions to the MS core 1898. In other instances, an ionization source can be present in the ionization core 1897 to produce/ionize molecular species, e.g., to ionize organic species, prior to providing the molecular ions to the core MS 1898. In certain configurations as noted herein, the system 1895 may be configured to ionize inorganic species and organic species prior to providing the ions to the MS core 1898. The MS core 1898 can be configured to filter/detect ions having a particular mass-to-charge. In some examples, the MS core 1898 can be designed to filter/select/detect inorganic ions and to filter/select/detect organic ions depending on the particular components which are present. Similarly, the MS core 1899 can be configured to filter/detect ions having a particular mass-to-charge. In some examples, the MS core 1899 can be designed to filter/select/detect inorganic ions and to filter/select/detect organic ions depending on the particular components which are present. While not shown, the mass analyzer comprising the MS cores 1898, 1899 typically comprises common components used by the one, two, three or more mass spectrometer cores (MSCs) which may be present in the mass analyzer. For example, common gas controllers, processors, power supplies, detectors and vacuum pumps may be used by different mass MSCs present in the mass analyzer. The system 1895 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 1895 between any one or more of the cores 1896, 1897, 1898 and 1899. In certain instances, any of the systems described and shown in FIGS. 18A-18K may comprise a serial arrangement of MS cores similar to the cores 1898, 1899 shown in FIG. 18L.

Figure 19:
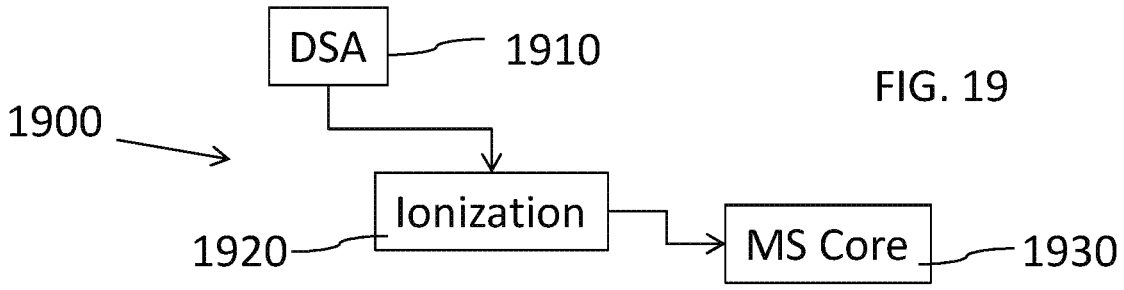
FIG. 19 is a block diagram of a system comprising a DSA device, an ionization core and a mass analyzer comprising a MS core, in accordance with certain examples.

In some examples, other sample operation cores can be used in place of GC, LC or SCF systems. For example, direct sample analysis (DSA) devices can be used prior to providing analyte species to one or more ionization cores and/or one or more MS cores. In some instances, direct sample analysis techniques may permit introduction of ions into the MS core without the need to use a separate ionization core. Alternatively, direct sample analysis techniques can provide ions to another ionization core prior to MS. Without wishing to be bound by any particular theory, direct sample analysis can use a needle to ionize sample present on or within a substrate or holder. The resulting ions can be provided to a suitable MS core for detection or to other ionization cores, sample operation cores or other devices. The sample operation cores comprising a GC, as shown in any of the illustrations shown in FIGS. 15A-15K, could instead be replaced with a sample operation core comprising a DSA or other sample operation core. Similarly, the sample operation cores comprising a LC, as shown in any of the illustrations shown in FIGS. 18A-18K, could instead be replaced with a sample operation core comprising a DSA or other sample operation core. Referring to FIG. 19, one illustration of a system 1900 comprises a sample operation core comprising a DSA device 1910 fluidically coupled to an ionization core(s) 1920, which itself is fluidically coupled to a mass analyzer comprising a MS core 1930. In use of the system 1900, a sample can be introduced into the DSA device 1910, and analyte in the sample can be ionized or otherwise acted on in some manner by the DSA 1910 prior to providing the analyte species to the ionization core(s) 1920. The ionization cores (s) 1920 can be configured to ionize analyte in the sample using various techniques. For example, in some instances, an ionization source can be present in the ionization core(s) 1920 to ionize elemental species, e.g., to ionize inorganic species, prior to providing the elemental ions to the MS core 1930. In other instances, an ionization source can be present in the ionization core(s) 1920 to produce/ionize molecular species, e.g., to ionize organic species, prior to providing the molecular ions to the MS core 1930. In certain configurations as noted herein, the system 1900 may be configured to ionize inorganic species and organic species prior to providing the ions to the MS core 1930. The MS core(s) 1930 can be configured to filter/detect ions having a particular mass-to-charge. In some examples, the MS core 1930 can be designed to filter/select/detect inorganic ions and to filter/select/detect organic ions depending on the particular components which are present. While not shown, the mass analyzer comprising the MS core 1930 typically comprises common components used by the one, two, three or more mass spectrometer cores (MSCs) which may be present in the mass analyzer. For example, common gas controllers, processors, power supplies, detectors and vacuum pumps may be used by different mass MSCs present in the mass analyzer. The system 1900 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 1900 between any one or more of the cores 1910, 1920 and 1930. If desired, the DSA device may be used to replace the LC devices shown in FIGS. 18B-18L. Further, a DSA device can be used in combination with a LC device or GC device if desired.

In certain examples, the sample operation core may be configured to implement cell sorting (CS) or other techniques which can separate one type of cells from other types of cells. In other instances, antibody or immunoseparation of immunoassays can be used to separate certain cells, proteins or other materials from each other prior to providing them an ionization core. In some examples, electric field separation, e.g., by performing electrophoresis such as capillary electrophoresis (CE), can be performed to separate biological molecules, e.g., amino acids, proteins, peptides, carbohydrates, lipids, etc. from each other prior to providing the separated analyte to one or more ionization cores. If desired, ion selective electrode separation can be implemented to separate one or more analytes from other analytes in a sample. Any one or more of CS, CE or other sample operation cores can replace with LC components shown in FIGS. 18A-18L. Further, a CS or CE device can be used in combination with a LC device if desired.

In certain examples, the separated analyte can be provided to the ionization cores described herein using suitable interfaces which may comprise atomizers, nebulizers, spray chambers, valves, fluid lines, nozzles or other devices which can provide a gas, liquid or solid from a sample operation core to an ionization core. The interface can be separate from the sample operation core or integral to the sample operation core. In other configurations, the interface can be integral to the ionization core. If desired, autosamplers may also be present and used with the sample operation cores described herein.

Ionization Cores

In certain examples, the systems described herein may comprise one or more ionization cores which can be configured to provide ions, e.g., inorganic ions, molecular ions, etc. to one or more mass spectrometer cores (MSCs). The exact ionization core(s) selected for use may depend on the particular sample to be analyzed. In some instances, the ionization core used in the instrument described herein may comprise a first ionization source configured to provide inorganic ions, e.g., elemental ions, and a second ionization source configured to provide molecular ions, e.g., organic ions. As noted herein, the ionization core can be configured to provide low mass ions, e.g., ions with a mass of three, four or five amu's, and high mass ions, e.g., ions with a mass of up to 2000 amu's. In some examples, the ionization core may comprise an ionization device which can provide inorganic ions. Illustrative ionization devices which can provide inorganic ions include, but are not limited to, an inductively coupled plasma (ICP), a capacitively coupled plasma (CCP), a microwave plasma, a flame, an arc, a spark or other high energy sources.

Figure 20:
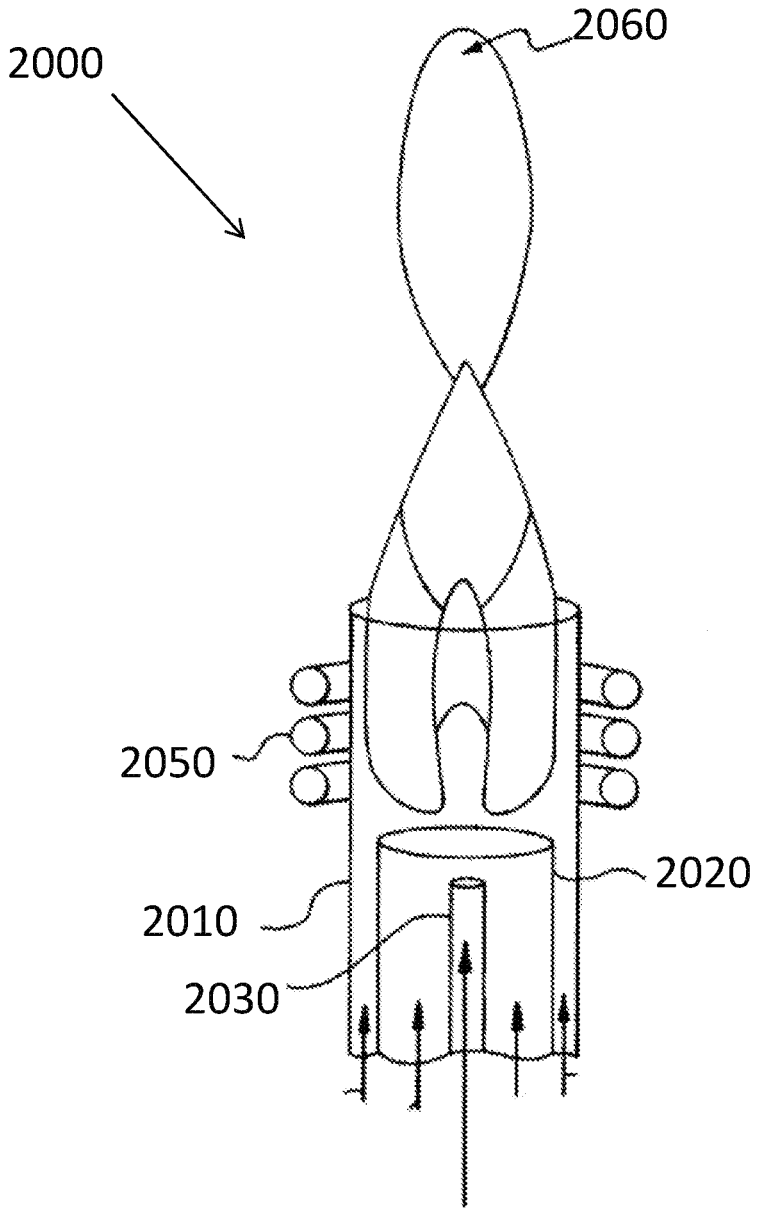
FIG. 20 is an illustration of an ionization core comprising an inductively coupled plasma sustained using an induction coil, in accordance with certain configurations.

In certain configurations, the ionization core may comprise an inductively coupled plasma (ICP) device. Referring to FIG. 20, an inductively coupled plasma device 2000 is shown that comprises a torch and an induction coil 2050. The ICP device 2000 comprises a torch comprising an outer tube 2010, an inner tube 2020, a nebulizer 2030 and a helical induction coil 2050. The device 2000 can be used to sustain an inductively coupled plasma 2060 using the gas flows shown generally by the arrows in FIG. 20. The helical induction coil 550 may be electrically coupled to a radio frequency energy source (not shown) to provide radio frequency energy to the torch to sustain the plasma 2060 within the torch. In some embodiments, inorganic ions can exit from the plasma 2060 and be provided to mass analyzer as described herein.

Figure 21:
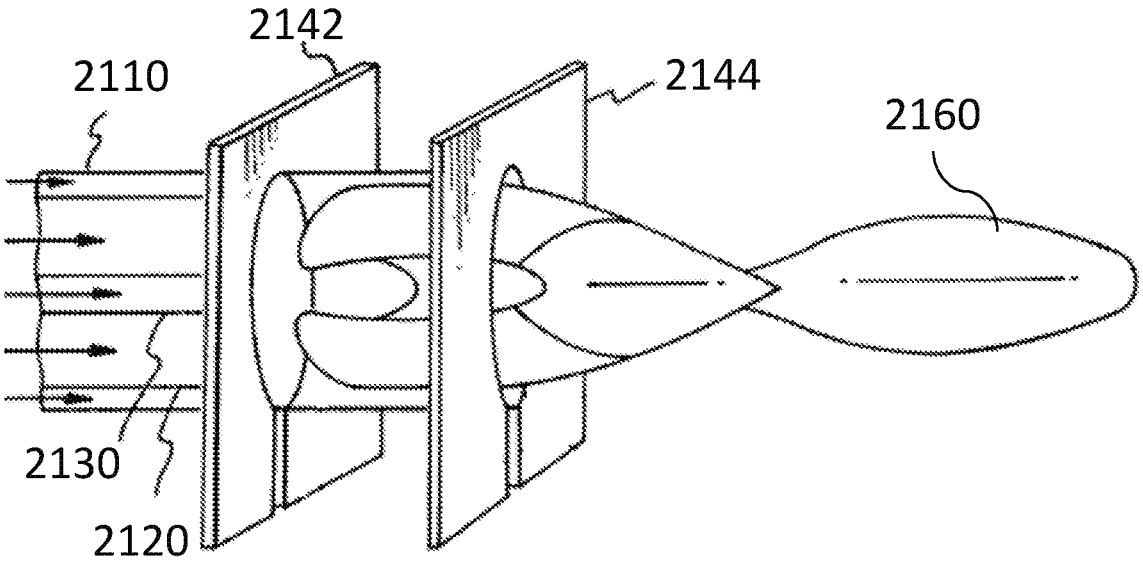
FIG. 21 is an illustration of an ionization core comprising an inductively coupled plasma sustained using an induction plate, in accordance with certain configurations.

In some configurations, the ionization core may comprise an inductively coupled plasma device comprising an induction device with one or more plate electrodes. For example and referring to FIG. 21, an ICP device 2100 comprises an outer tube 2110, an inner tube 2120, a nebulizer 2130 and a plate electrode 2142. An optional second plate electrode 2144 is shown as being present, and, if desired, three or more plate electrodes may also be present. The outer tube 2110 can be positioned within apertures of the plate electrodes 2142, 2144 as shown in FIG. 21. The ICP device 2100 can be used to sustain a plasma 2160 using the gas flows shown by the arrows in FIG. 21. The plate electrode(s) 2142, 2144 may be electrically coupled to a radio frequency energy source (not shown) to provide radio frequency energy to the torch to sustain the plasma 2160 within the torch. In some examples, inorganic ions can exit from the plasma 2160 and be provided to mass analyzer as described herein. Illustrative plate electrodes and their use are described, for example, in commonly assigned U.S. Pat. Nos. 7,511,246, 8,263,897, 8633,416, 8,786,394, 8,829,386, 9,259,798 and 6,504,137.

Figure 22A:
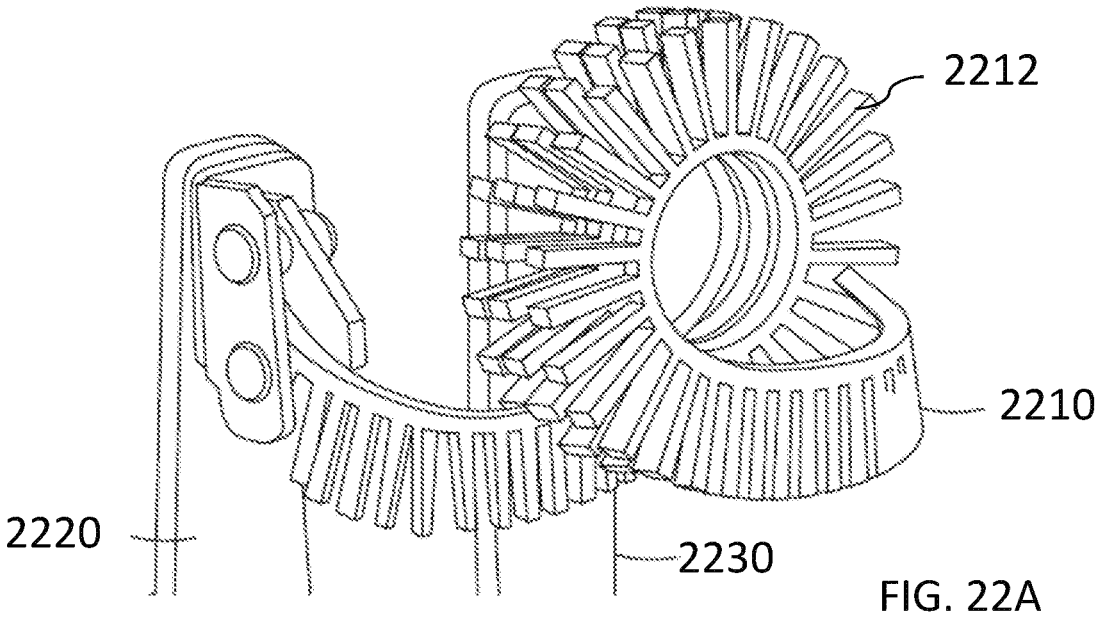
FIG. 22A and FIG. 22B are an illustrations showing an ionization core comprising an radial induction device which can be used to sustain an induction plate, in accordance with certain configurations.
Figure 22B:
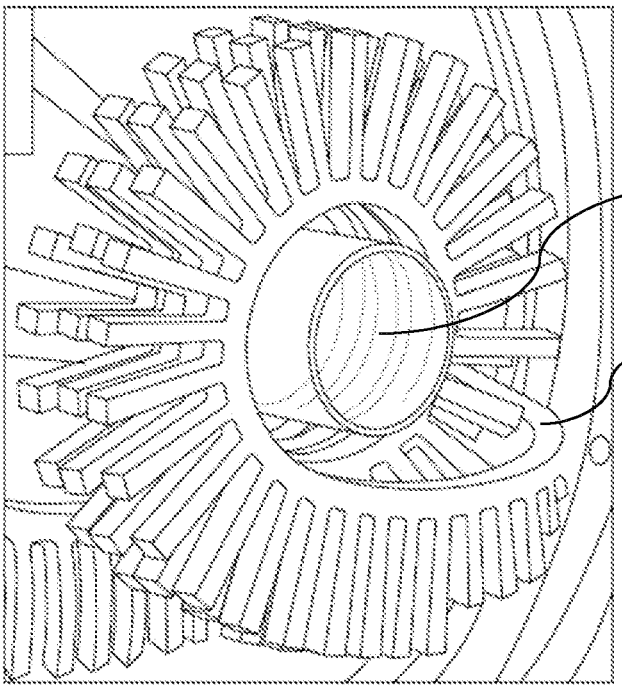

In certain configurations, an ionization core may comprise a "pine cone" induction devices as shown in FIGS. 22A and 22B. The induction device 2210 generally comprises one or more radial fins 2212. The induction device 1210 is electrically coupled to a mount or interface through interconnects or legs 2220, 2230. For example, one end of the induction device 2210 is electrically coupled to the leg 2220, and the other end of the induction device 2210 is electrically coupled to the leg 2230. Current of opposite polarity can be provided to each of the legs 2220, 2230 or a current may be provided to the induction device 2210 through the leg 2220 and the leg 2230 can be connected to ground, for example. In some instances, one of the legs 2220, 2230 may be omitted, and the other end of the induction device 2210 may be electrically coupled to ground. If desired, the induction device, at some point between the legs 2220 and 2230, may be electrically coupled to ground. Cooling gas may be provided to the induction device 2210 and can flow around the fins and the base of the induction device 2210 to enhance thermal transfer and keep the induction device 2210 and/or torch from degrading due to excessive temperature. The induction device 2210 may coil to form an inner aperture (see FIG. 22B) which can receive a torch 2250, which can be designed similar to the torches described in reference to FIGS. 20 and 21 or similar to the other torches described herein. Illustrative induction devices with radial fins are described in more detail in commonly assigned U.S. Pat. No. 9,433,073.

Figure 23:
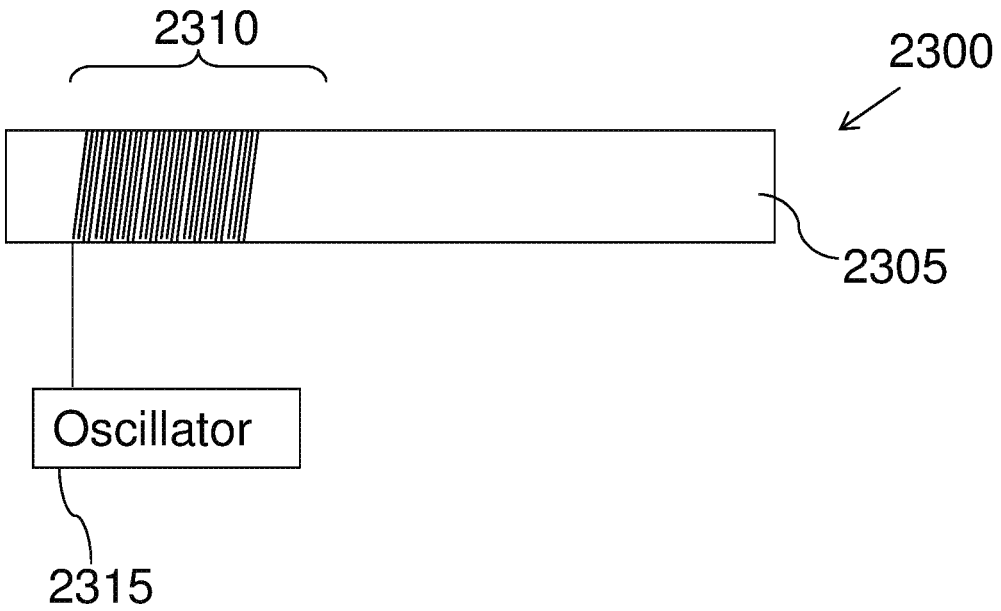
FIG. 23 is an illustration of an ionization core comprising a capacitively coupled plasma, in accordance with certain examples.

In some examples, the ionization cores described herein may comprise a capacitively coupled plasma device which can provide inorganic ions to a mass analyzer. Referring to FIG. 23, an ionization core 2300 comprises a capacitive device 2310 around a torch 2305. The capacitive device 2310 is electrically coupled to an oscillator 2315. The oscillator 2315 can be controlled such that the capacitive devices 2 is provided radio frequency energy at a desired frequency. For example, the capacitive device 2310 can provide radio frequency energy from a 27 MHz oscillator, a 38.5 MHz oscillator or a 40 MHz oscillator electrically coupled to the capacitive devices 2310. The 27 MHz, 38.5 MHz and 40 MHz operation of the oscillators is merely illustrative and is not required for sustaining a capacitively coupled plasma in a torch. If desired, two, three or more capacitive devices can be coupled to a single torch to sustain a capacitively coupled plasma in the torch. Any one or more of the capacitive devices can be electrically coupled to the same oscillator as another capacitive device or can be electrically coupled to different oscillators. In addition, the capacitive devices need not be the same type or kind. For example, one capacitive device can take the form of a wire coil and the other capacitive device can be a plate electrode or other different type of capacitive device. Illustrative capacitive devices which can be used in an ionization core are described in commonly assigned U.S. Pat. No. 9,504, 137.

Figure 24:
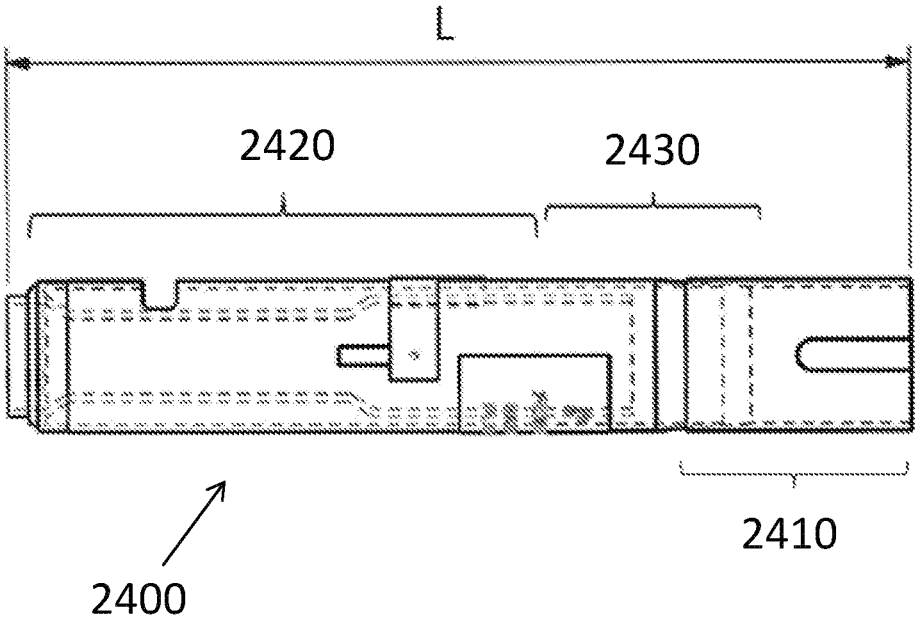
FIG. 24 is an illustration of a torch comprising a refractory tip, in accordance with some examples.

In some embodiments, an ionization core as described herein may comprise a torch with a refractory tip or end to increase the overall lifetime of the torch. Referring to FIG. 24, a torch 2400 comprises a length L and comprises a tip 2410, e.g., a silicon nitride tip, is present from the end of the torch. A ground glass joint 2430 (or a material other than the material present in the tip 2410 and the body 2420) can be present between the quartz body 2420 and the tip 2410. If desired, the ground glass joint can be polished or otherwise rendered substantially optically transparent to permit better visualization of the plasma in the torch. In some examples, inorganic ions can exit from a plasma produced using the torch 2400 and be provided to mass analyzer as described herein. Illustrative torches with refractory tips or ends and their use are described, for example, in U.S. Pat. Nos. 9,259,798 and 9,516,735.

Figure 25A:
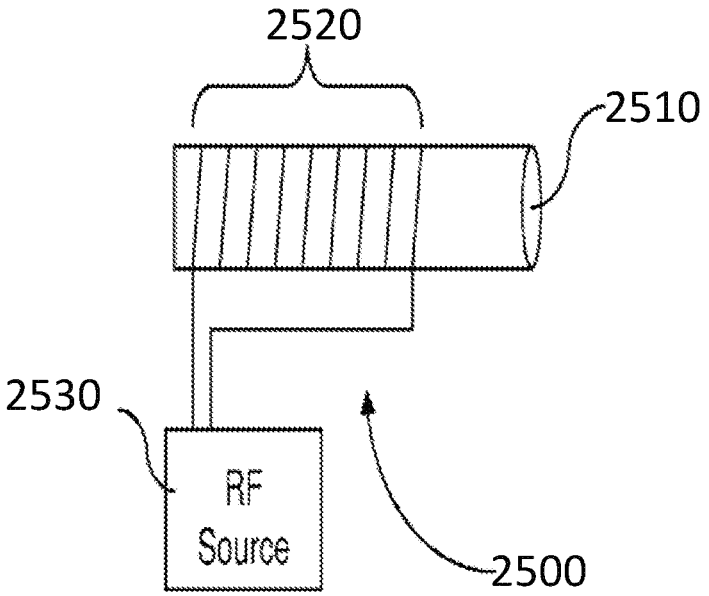
FIGS. 25A and 25B are illustrations of an ionization core comprising a boost device, in accordance with certain configurations.
Figure 25B:
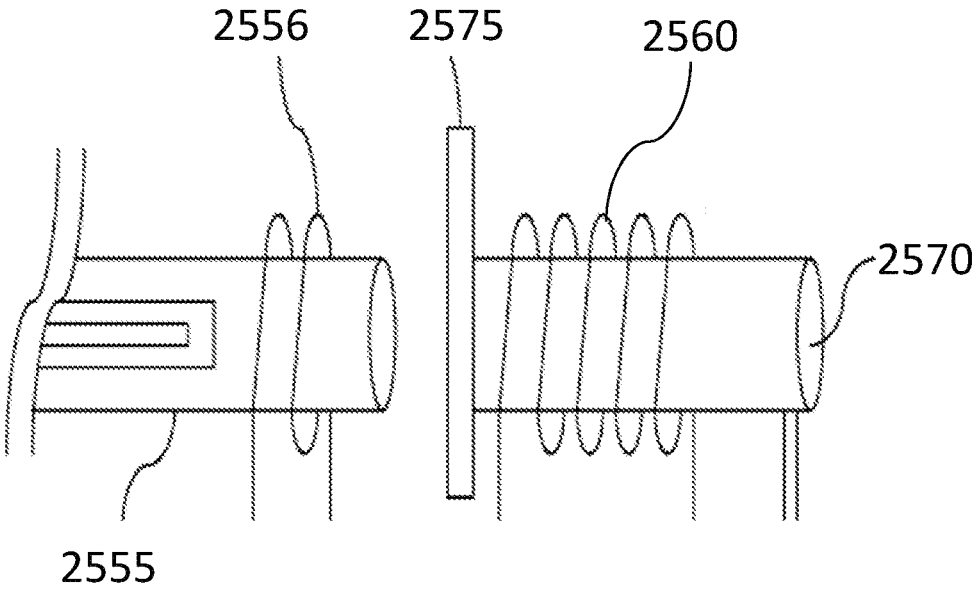

In some embodiments, the ionization core may comprise a boost device to enhance ionization. For example, a boost device is typically used in combination with an inorganic ion source to provide additional radio frequency energy into a torch and can assist in ionization of hard to ionize elements. Referring to FIG. 25A, a system 2500 comprises a boost device 2520 is shown surrounding a torch 2510. The torch 2510 is also surrounded by an induction coil or one or more plate electrodes (not shown) that can be used to sustain an inductively coupled plasma or capacitively coupled plasma in the torch 2510. Radio frequency energy from an RF source 2530 can be provided to the boost device 2520 to provide additional radio frequency into the torch 2510. The boost device may be present on the same torch as an induction coil, plate electrode, etc. For example and referring to FIG. 25B, a system 2550 is shown that comprises a boost device 2560 surrounding a separate chamber 2570 from a torch 2555 and induction coil 2556 used to sustain a plasma. The torch 2555 and the chamber 2570 are separated through an interface 2575 though the interface 2575 can be omitted if desired.

Figure 26A:
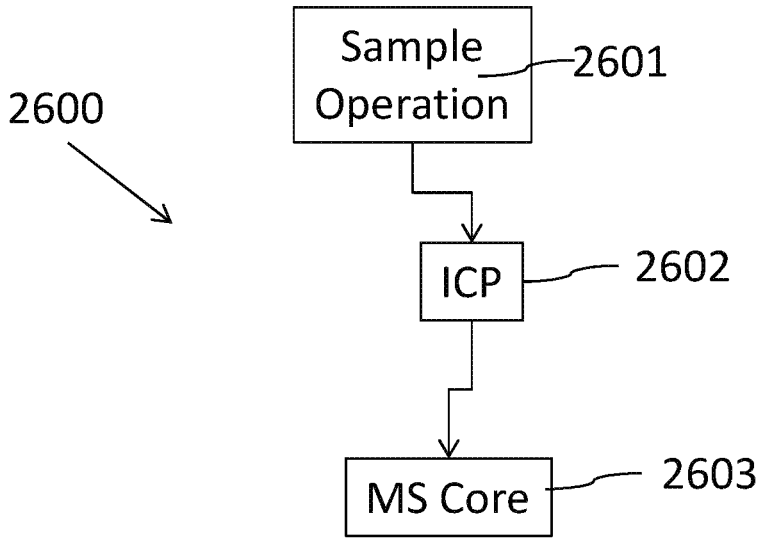
FIG. 26A is a block diagram of a system comprising a sample operation core, an ionization core comprising an ICP and a MS core, in accordance with certain embodiments.
Figure 26B:
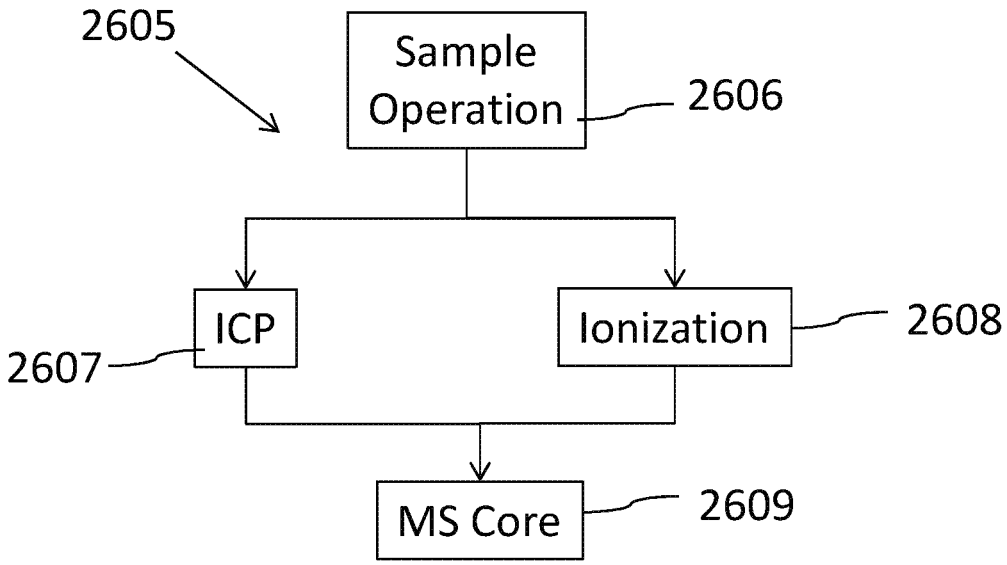
FIG. 26B is a block diagram of a system comprising a sample operation core, two ionization cores with one ionization core comprising an ICP, and a MS core, in accordance with certain embodiments.

In other instances, the ionization core may comprise one or more of a flame, arc, spark, etc. to provide inorganic ions. An arc can be produced between two electrodes by providing a current to the electrodes. A flame can be produced using suitable fuel sources and burners. A spark can be produced by passing a current through electrodes comprising a sample or other material. Any of these ionization sources can be used in the ionization cores described herein. For convenience, various configurations of an ionization core(s) comprising an ICP is described in reference to FIGS. 26A-26L. Other inorganic ionization sources can be used instead of the ICP, e.g., a CCP can be used, a microwave plasma can be used, or an arc can be used, or a flame can be used, or a spark can be used, etc. if desired. Referring to FIG. 26A, a system 2600 comprises a sample operation core 2601 fluidically coupled to an ionization core(s) comprising an ICP 2602, which itself is fluidically coupled to a mass analyzer comprising a MS core(s) 2603. In use of the system 2600, a sample can be introduced into the sample operation core 2601, and analyte in the sample can be vaporized, separated, reacted, derivatized, sorted, modified or otherwise acted on in some manner by the sample operation core 2601 prior to providing the analyte species to the ICP 2602. The ICP 2602 can be configured to ionize analyte in the sample using various techniques. In some examples, the ICP 2602 can be replaced with a CCP or a microwave plasma. In other examples, the ICP 2602 can be replaced with a flame. In further examples, the ICP 2602 can be replaced with an arc. In other examples, the ICP 2602 can be replaced with a spark. In additional examples, the ICP 2602 can be replaced with another inorganic ionization core. In some instances, the ICP can ionize elemental species, e.g., ionize inorganic species, prior to providing the elemental ions to the MS core 2603. In other instances, another ionization source can be present in the ionization core(s) to produce/ionize molecular species, e.g., to ionize organic species, prior to providing the molecular ions to the MS core 2603. In certain configurations as noted herein, the system 2600 may be configured to ionize inorganic species and organic species prior to providing the ions to the MS core 2603. The MS core(s) 2603 can be configured to filter/detect ions having a particular mass-to-charge. In some examples, the MS core 2603 can be designed to filter/select/detect inorganic ions and to filter/select/detect organic ions depending on the particular components which are present. While not shown, mass analyzer comprising the MS core 2603 typically comprises common components used by the one, two, three or more mass spectrometer cores (MSCs) which may be present in the mass analyzer. For example, common gas controllers, processors, power supplies, detectors and vacuum pumps may be used by different mass MSCs present in the mass analyzer. The system 2600 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 2600 between any one or more of the cores 2601, 2602 and 2603.

In certain configurations, any one or more of the cores shown in FIG. 26A can be separated or split into two or more cores. For example and referring to FIG. 26B, a system 2605 comprises a sample operation core 2606, a first ionization core comprising an ICP 2607 fluidically coupled to the sample operation core 2606 and a second ionization core 2608 fluidically coupled to the sample operation core 2606. Each of the cores 2607, 2608 is also fluidically coupled to a mass analyzer comprising a MS core 2609. While not shown, an interface, valve, or other device can be present between the sample operation core 2606 and the ionization cores 2607, 2608 to provide species from the sample operation core 2606 to only one of the ionization cores 2607, 2608 at a selected time during use of the system 2605. In other configurations, the interface, valve or device can be configured to provide species from the sample operation core 2606 to the ionization cores 2607, 2608 simultaneously. Similarly, a valve, interface or other device (not shown) can be present between the ionization cores 2607, 2608 and the MS core 2609 to provide species from the one of the ionization cores 2607, 2608 to the MS core 2609 at a selected time during use of the system 2605. In other configurations, the interface, valve or device can be configured to provide species from the ionization cores 2607, 2608 at the same time to the MS core 2609. In use of the system 2605, a sample can be introduced into the sample operation core 2606, and analyte in the sample can be vaporized, separated, reacted, derivatized, sorted, modified or otherwise acted on in some manner by the sample operation core 2606 prior to providing the analyte species to one or both of the ionization core(s) 2607, 2608. In some instances, the ionization cores 2607, 2608 can be configured to ionize analyte in the sample using various but different techniques. In some examples, the ICP 2607 can be replaced with a CCP or a microwave plasma. In other examples, the ICP 2607 can be replaced with a flame. In further examples, the ICP 2607 can be replaced with an arc. In other examples, the ICP 2607 can be replaced with a spark. In additional examples, the ICP 2607 can be replaced with another inorganic ionization core. In some instances, the ionization core(s) comprising the ICP 2607 can ionize elemental species, e.g., to ionize inorganic species, prior to providing the elemental ions to the core 2609. In other instances, an ionization source can be present in the ionization core(s) 2608 to produce/ionize molecular species, e.g., to ionize organic species, prior to providing the molecular ions to the MS core 2609. In certain configurations as noted herein, the system 2605 may be configured to ionize both inorganic species and organic species using the ionization cores 2607, 2608 prior to providing the ions to the MS core 2609. The MS core(s) 2609 can be configured to filter/detect ions having a particular mass-to-charge. In some examples, the core 2609 can be designed to filter/select/detect inorganic ions and to filter/select/detect organic ions depending on the particular components which are present. While not shown, the mass analyzer comprising the MS core 2609 typically comprises common components used by the one, two, three or more mass spectrometer cores (MSCs) which may be present in the mass analyzer. For example, common gas controllers, processors, power supplies, detectors and vacuum pumps may be used by different mass MSCs present in the core 2609. The system 2605 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 2605 between any one or more of the cores 2606, 2607, 2608 and 2609.

Figure 26C:
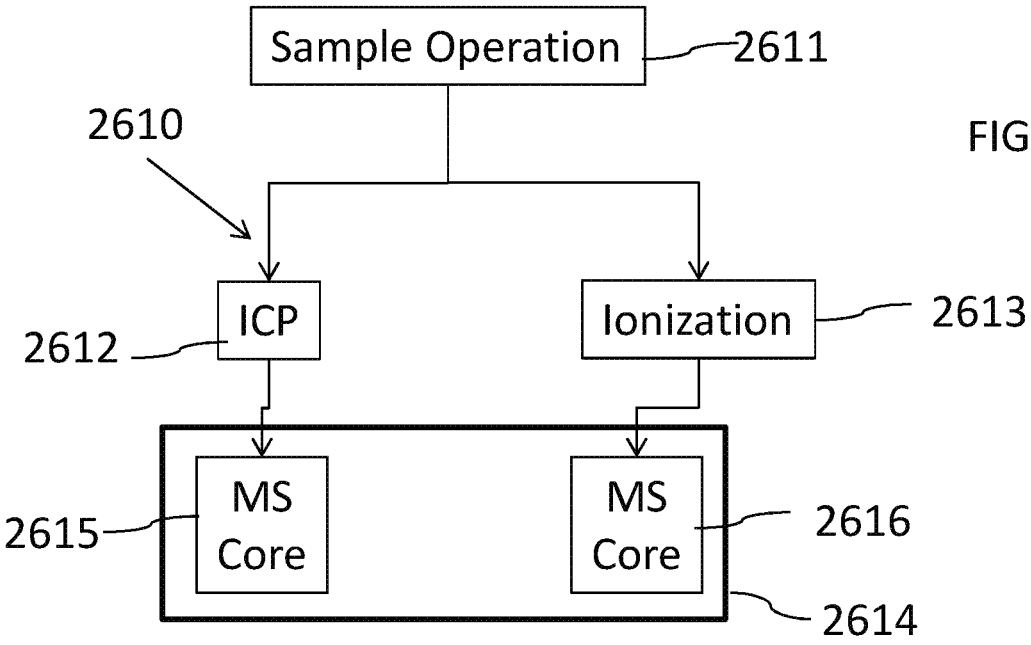
FIG. 26C is a block diagram of a system comprising a sample operation core, two ionization cores with one ionization core comprising an ICP, and two MS cores, in accordance with certain configurations.
Figure 26D:
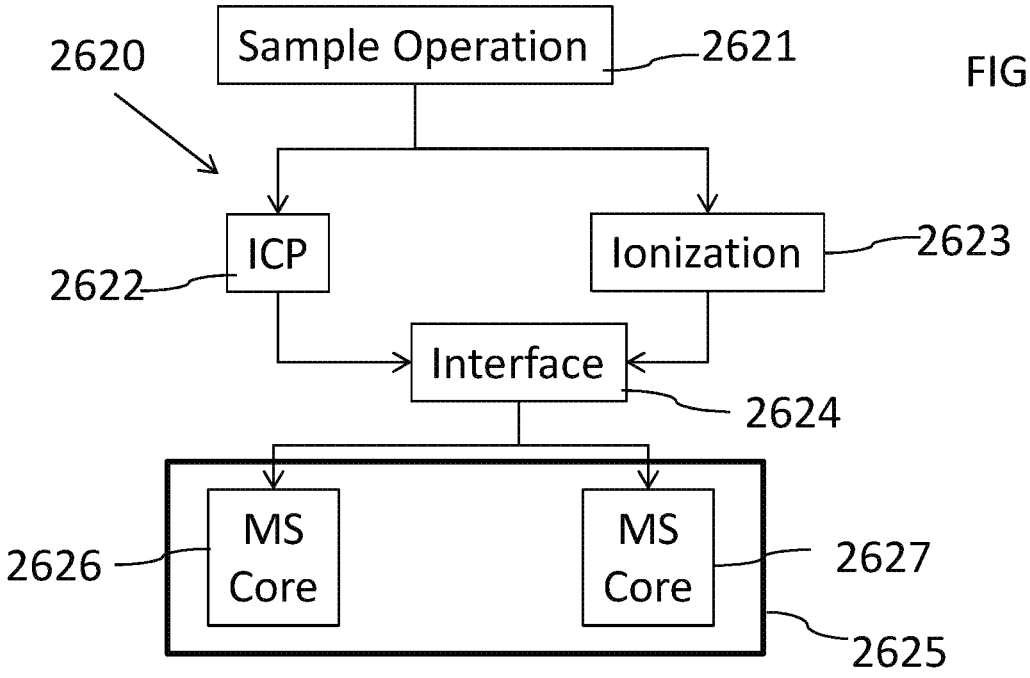
FIG. 26D is a block diagram of a system comprising a sample operation core, two ionization cores with one ionization core comprising an ICP, an interface and two MS cores, in accordance with certain configurations.

In other configurations, the MS cores described herein (when used with a sample operation) may be separated into two or more individual cores. As noted herein, even though the MS cores can be separated, they still can share certain common components including gas controllers, processors, power supplies, and/or vacuum pumps. Referring to FIG. 26C, a system 2610 is shown that comprises a sample operation core 2611, a first ionization core comprising an ICP 2612, a second ionization core 2613, and a mass analyzer 2614 comprising a first MS core 2615 and a second MS core 2616. The sample operation core 2611 is fluidically coupled to each of the ionization cores 2612, 2613. While not shown, an interface, valve, or other device can be present between the sample operation core 2611 and the ionization cores 2612, 2613 to provide species from the sample operation core 2611 to only one of the ionization cores 2612, 2613 at a selected time during use of the system 2610. In other configurations, the interface, valve or device can be configured to provide species from the sample operation core 2611 to the ionization cores 2612, 2613 simultaneously. The ionization core 2612 is fluidically coupled to the first MS core 2615, and the second ionization core 2613 is fluidically coupled to the second MS core 2616. In use of the system 2610, a sample can be introduced into the sample operation core 2611, and analyte in the sample can be vaporized, separated, reacted, derivatized, sorted, modified or otherwise acted on in some manner prior to providing the analyte species to one or both of the ionization core(s) 2612, 2613. In some instances, the ionization cores 2612, 2613 can be configured to ionize analyte in the sample using various but different techniques. For example, in some instances, the ICP 2612 can ionize elemental species, e.g., to ionize inorganic species, prior to providing the elemental ions to the MS core 2615. In some examples, the ICP 2612 can be replaced with a CCP or a microwave plasma. In other examples, the ICP 2612 can be replaced with a flame. In further examples, the ICP 2612 can be replaced with an arc. In other examples, the ICP 2612 can be replaced with a spark. In additional examples, the ICP 2612 can be replaced with another inorganic ionization core. In other instances, an ionization source can be present in the ionization core(s) 2613 to produce/ionize molecular species, e.g., to ionize organic species, prior to providing the molecular ions to the MS core 2616. In certain configurations as noted herein, the system 2610 may be configured to ionize both inorganic species and organic species using the ionization cores 2612, 2613 prior to providing the ions to the MS cores 2615, 2616. The MS core(s) 2615, 2616 can be configured to filter/detect ions having a particular mass-to-charge. In some examples, the MS core 2615 can be designed to filter/select/detect inorganic ions, and the MS core 2616 can be designed to filter/select/detect organic ions depending on the particular components which are present. While not shown, the mass analyzer 2614 typically comprises common components used by the one, two, three or more mass spectrometer cores (MSCs) which may independently be present in the mass analyzer 2614. For example, common gas controllers, processors, power supplies, detectors and vacuum pumps may be used by different mass MSCs present in the mass analyzer 2614, though each of the MS cores 2615, 2616 may comprise its own gas controllers, processors, power supplies, detectors and/or vacuum pumps if desired. The system 2610 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 2610 between any one or more of the cores of the system 2610.

In some instances where a sample operation core, two ionization cores and two MS cores are present, it may be desirable to provide ions from different ionization cores to different MS cores. For example and referring to FIG. 26D, a system 2620 is shown that comprises a sample operation core 2621, a first ionization core comprising an ICP 2622, a second ionization core 2623, an interface 2624, and a mass analyzer 2625 comprising a first MS core 2626 and a second MS core 2627. The sample operation core 2621 is fluidically coupled to each of the ionization cores 2622, 2623. While not shown, an interface, valve, or other device can be present between the sample operation core 2621 and the ionization cores 2622, 2623 to provide species from the sample operation core 2621 to only one of the ionization cores 2622, 2623 at a selected time during use of the system 2620. In other configurations, the interface, valve or device can be configured to provide species from the sample operation core 2621 to the ionization cores 2622, 2623 simultaneously. The ionization core 2622 is fluidically coupled to the interface 2624, and the ionization core 2623 is fluidically coupled to the interface 2624. The interface 2624 is fluidically coupled to each of the first MS core 2626 and a second MS core 2627. In use of the system 2620, a sample can be introduced into the sample operation core 2621, and analyte in the sample can be vaporized, separated, reacted, derivatized, sorted, modified or otherwise acted on in some manner prior to providing the analyte species to one or both of the ionization core(s) 2622, 2623. In some instances, the ionization cores 2622, 2623 can be configured to ionize analyte in the sample using various but different techniques. For example, in some instances, the ICP 2622 can ionize elemental species, e.g., to ionize inorganic species, prior to providing the elemental ions to the interface 2624. In some examples, the ICP 2622 can be replaced with a CCP or a microwave plasma. In other examples, the ICP 2622 can be replaced with a flame. In further examples, the ICP 2622 can be replaced with an arc. In other examples, the ICP 2622 can be replaced with a spark. In additional examples, the ICP 2622 can be replaced with another inorganic ionization core. In other instances, an ionization source can be present in the ionization core(s) 2623 to produce/ionize molecular species, e.g., to ionize organic species, prior to providing the molecular ions to the interface 2624. In certain configurations as noted herein, the system 2620 may be configured to ionize both inorganic species and organic species using the ionization cores 2622, 2623 prior to providing the ions to the interface 2624. The interface 2624 can be configured to provide ions to either or both of the MS core(s) 2626, 2627 each of which can be configured to filter/detect ions having a particular mass-to-charge. In some examples, the MS core 2626 can be designed to filter/select/detect inorganic ions, and the MS core 2627 can be designed to filter/select/detect organic ions depending on the particular components which are present. In some examples, the MS cores 2626, 2627 are configured differently with a different filtering device and/or detection device. While not shown, the mass analyzer 2625 typically comprises common components used by the one, two, three or more mass spectrometer cores (MSCs) which may independently be present in the mass analyzer 2625. For example, common gas controllers, processors, power supplies, detectors and vacuum pumps may be used by different mass MSCs present in the mass analyzer 2625, though each of the MS cores 2626, 2627 may comprise its own gas controllers, processors, power supplies, detectors and/or vacuum pumps if desired. The system 2620 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 2620 between any one or more of the cores of the system 2620.

Figure 26E:
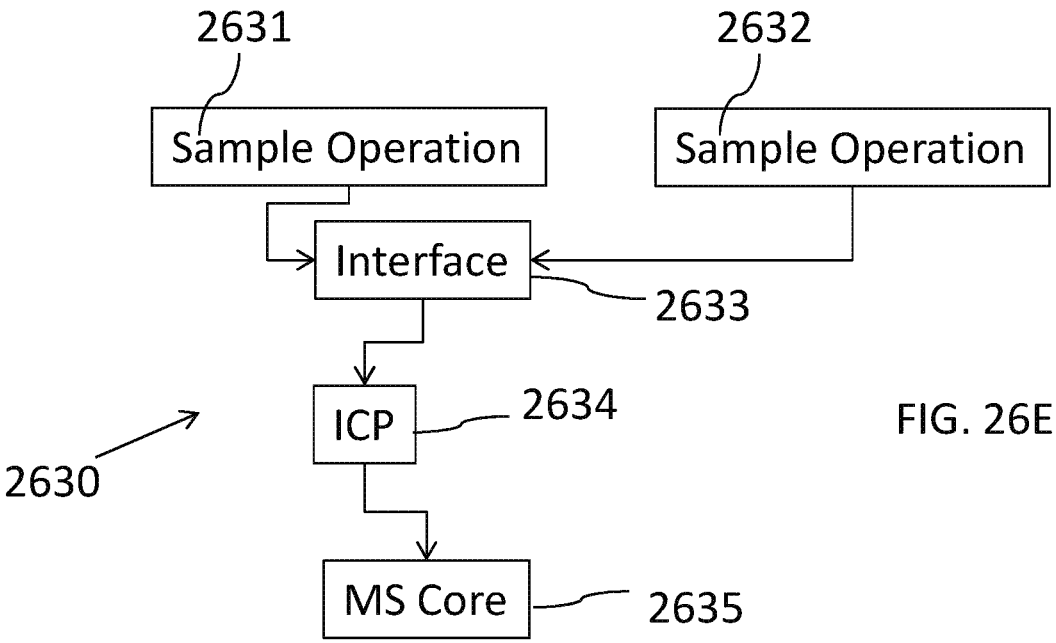
FIG. 26E is a block diagram of a system comprising two sample operation cores, an interface, an ionization core comprising an ICP, and a MS core, in accordance with certain examples.

In certain examples, the sample operation core can be split into two or more cores if desired. For example, it may be desirable to perform different operations when inorganic ions are to be provided to an ionization core or MS core compared to when organic ions are to be provided to an ionization core or MS core. Referring to FIG. 26E, a system 2630 is shown that comprises a first sample operation core 2631 and a second sample operation core 2632. Each of the sample operation cores 2631, 2632 is fluidically coupled to an interface 2633. The interface 2633 is fluidically coupled to an ionization core comprising an ICP 2634, which itself is fluidically coupled to a mass analyzer comprising a MS core 2635. In use of the system 2630, a sample can be introduced into one or both of the sample operation cores 2631, 2632, and analyte in the sample can be vaporized, separated, reacted, derivatized, sorted, modified or otherwise acted on in some manner prior to providing the analyte species to the interface 2633. The different sample operation cores 2631, 2632 can be configured to perform different separations, use different separation conditions, use different carrier gases or include different components. The interface 2633 can be configured to permit passage of sample from one or both of the sample operation cores 2631, 2632 to the ionization core comprising the ICP 2634. The ionization cores(s) 2634 can be configured to ionize analyte in the sample using various techniques. For example, in some instances, an ICP 2634 can ionize elemental species, e.g., to ionize inorganic species, prior to providing the elemental ions to the MS core 2635. In some examples, the ICP 2634 can be replaced with a CCP or a microwave plasma. In other examples, the ICP 2634 can be replaced with a flame. In further examples, the ICP 2634 can be replaced with an arc. In other examples, the ICP 2634 can be replaced with a spark. In additional examples, the ICP 2634 can be replaced with another inorganic ionization core. In other instances, another ionization source can be present in the ionization core(s) 2634 to produce/ionize molecular species, e.g., to ionize organic species, prior to providing the molecular ions to the core 26350. In certain configurations as noted herein, the system 2630 may be configured to ionize inorganic species and organic species prior to providing the ions to the core 2635. The MS core(s) 2635 can be configured to filter/detect ions having a particular mass-to-charge. In some examples, the core 2635 can be designed to filter/select/detect inorganic ions and to filter/select/detect organic ions depending on the particular components which are present. While not shown, the mass analyzer comprising the MS core 2635 typically comprises common components used by the one, two, three or more mass spectrometer cores (MSCs) which may be present in the mass analyzer. For example, common gas controllers, processors, power supplies, detectors and vacuum pumps may be used by different mass MSCs present in the mass analyzer. The system 2630 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 2630 between any one or more of the cores of the system 2630.

Figure 26F:
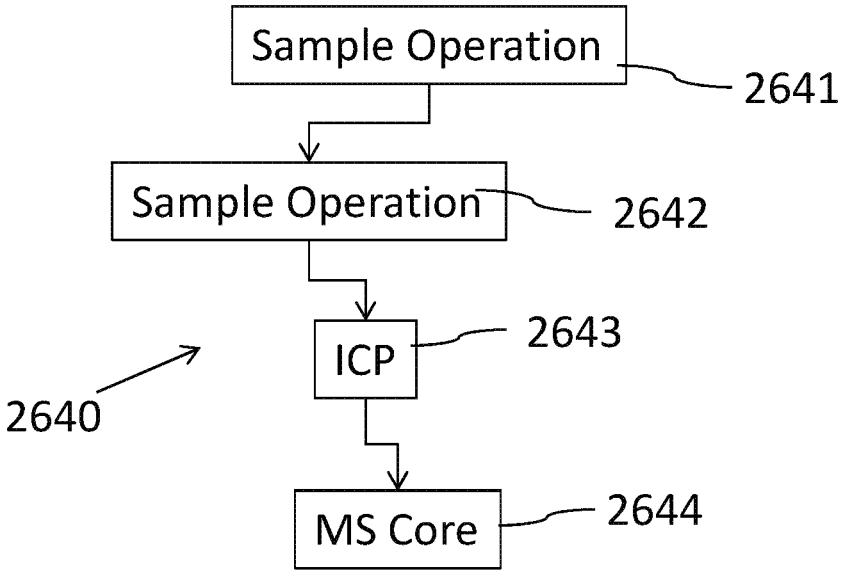
FIG. 26F is a block diagram of a system comprising two serially arranged sample operation cores, an ionization core comprising an ICP, and a MS core, in accordance with certain configurations.
Figure 26G:
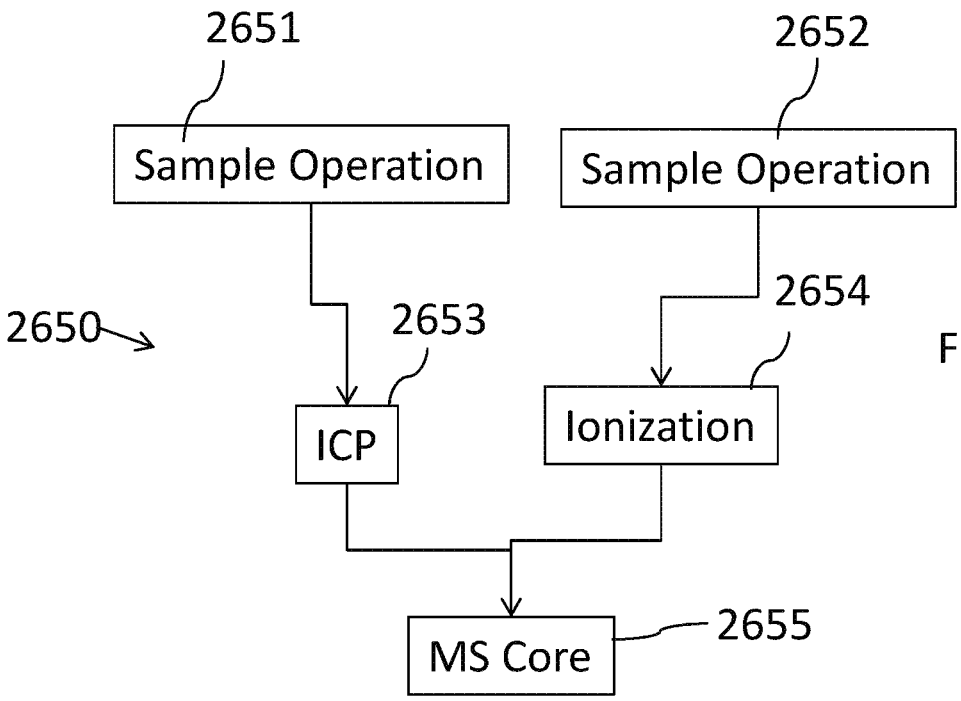
FIG. 26G is a block diagram of a system comprising two sample operation cores, two ionization cores with one ionization core comprising an ICP, and a MS core, in accordance with certain examples.
Figure 26H:
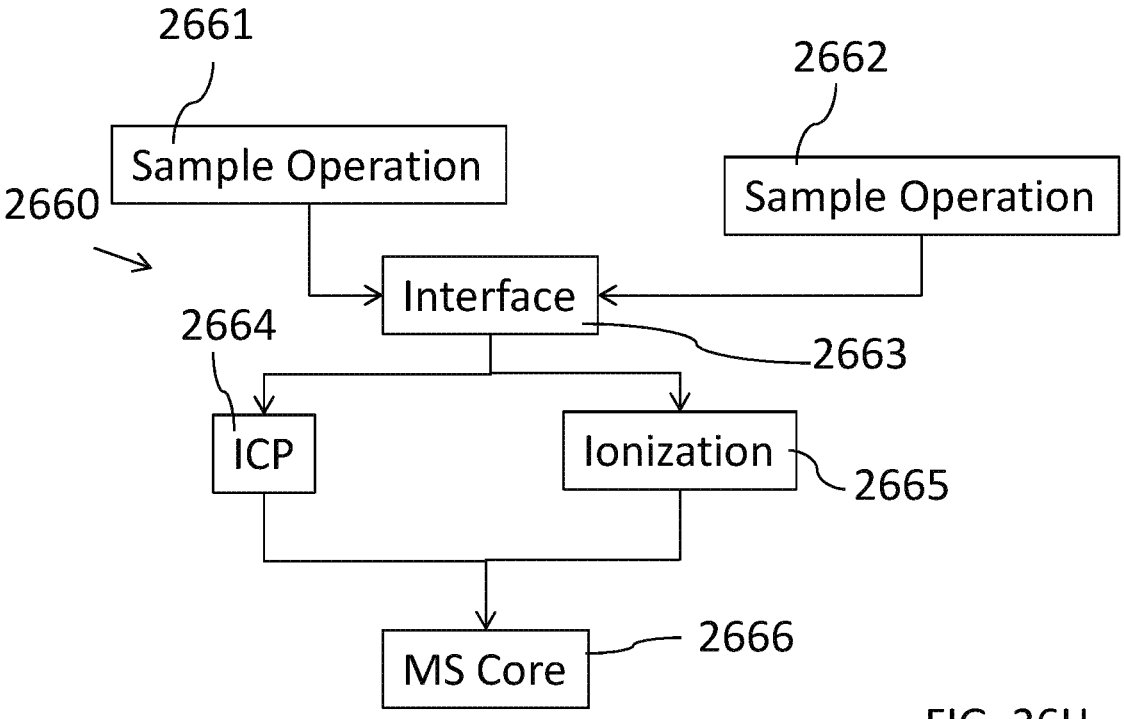
FIG. 26H is a block diagram of a system comprising two sample operation cores, an interface, two ionization cores with one ionization core comprising an ICP, and a MS core, in accordance with certain configurations.
Figure 26I:
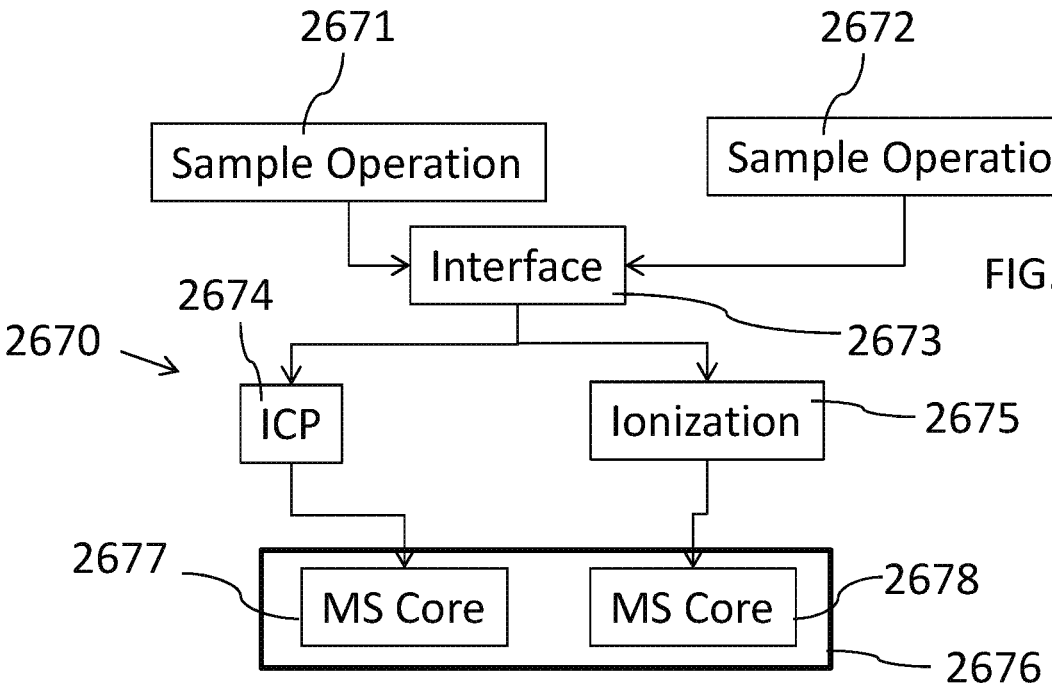
FIG. 26I is a block diagram of a system comprising two sample operation cores, an interface, two ionization cores with one ionization core comprising an ICP, and two MS cores, in accordance with certain examples.

In certain configurations, the sample operation cores can be serially coupled to each other if desired. For example, it may be desirable to perform separate analytes in a sample using sample operation's configured for different separation conditions. Referring to FIG. 26F, a system 2640 is shown that comprises a first sample operation core 2641 fluidically coupled to a second sample operation core 2642. Depending on the nature of the analyte sample, one of the sample operation cores 2641, 2642 may be present in a passive configuration and generally pass sample without performing any operations on the sample, whereas in other instances each of the sample operation cores 2641, 2642 performs one or more sample operations including, but not limited to, vaporization, separation, reaction, derivatization, sorting, modification or otherwise acting on the sample in some manner prior to providing the analyte species to the ionization core 2643. The ionization cores(s) comprising the ICP 2643 can be configured to ionize analyte in the sample using various techniques. For example, the ICP can ionize elemental species, e.g., to ionize inorganic species, prior to providing the elemental ions to a mass analyzer comprising a MS core 2644. In some examples, the ICP 2643 can be replaced with a CCP or a microwave plasma. In other examples, the ICP 2643 can be replaced with a flame. In further examples, the ICP 2643 can be replaced with an arc. In other examples, the ICP 2643 can be replaced with a spark. In additional examples, the ICP 2643 can be replaced with another inorganic ionization core. In other instances, another ionization source can be present in the ionization core(s) 2643 to produce/ionize molecular species, e.g., to ionize organic species, prior to providing the molecular ions to the core 2644. In certain configurations as noted herein, the system 2640 may be configured to ionize inorganic species and organic species prior to providing the ions to the MS core 2644. The MS core(s) 2644 can be configured to filter/detect ions having a particular mass-to-charge. In some examples, the MS core 2644 can be designed to filter/select/detect inorganic ions and to filter/select/detect organic ions depending on the particular components which are present. While not shown, the mass analyzer comprising the MS core 2644 typically comprises common components used by the one, two, three or more mass spectrometer cores (MSCs) which may be present in the mass analyzer. For example, common gas controllers, processors, power supplies, detectors and vacuum pumps may be used by different mass MSCs present in the mass analyzer. The system 2640 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 2640 between any one or more of the cores of the system 2640.

In certain configurations where two or more sample operation cores are present, each sample operation may be fluidically coupled to a respective ionization core. For example and referring to FIG. 26G, a system 2660 comprises a first sample operation core 2651, a second sample operation core 2652, a first ionization core comprising an ICP 2653 fluidically coupled to the first sample operation core 2651, and a second ionization core 2654 fluidically coupled to the second sample operation core 2652. Each of the ionization cores 2653, 2654 is also fluidically coupled to a mass analyzer comprising a MS core 2655. While not shown, a valve, interface or other device can be present between the ionization cores 2653, 2654 and the MS cores 2655 to provide species from the one of the ionization cores 2653, 2654 to the MS core 2655 at a selected time during use of the system 2650. In other configurations, the interface, valve or device can be configured to provide species from the ionization cores 2653, 2654 at the same time to the MS core 2655. In use of the system 2650, a sample can be introduced into the sample operation's 261, 2652, and analyte in the sample can be vaporized, separated, reacted, derivatized, sorted, modified or otherwise acted on in some manner prior to providing the analyte species to the ionization cores 2653, 2654. In some instances, the ionization cores 2653, 2654 can be configured to ionize analyte in the sample using various but different techniques. For example, in some instances, the ICP 2653 can ionize elemental species, e.g., to ionize inorganic species, prior to providing the elemental ions to the MS core 2655. In some examples, the ICP 2653 can be replaced with a CCP or a microwave plasma. In other examples, the ICP 2653 can be replaced with a flame. In further examples, the ICP 2653 can be replaced with an arc. In other examples, the ICP 2653 can be replaced with a spark. In additional examples, the ICP 2653 can be replaced with another inorganic ionization core. In other instances, an ionization source can be present in the ionization core(s) 2654 to produce/ionize molecular species, e.g., to ionize organic species, prior to providing the molecular ions to the MS core 2655. In certain configurations as noted herein, the system 2650 may be configured to ionize both inorganic species and organic species using the ionization cores 2653, 2654 prior to providing the ions to the MS core 2655. The MS core(s) 2655 can be configured to filter/detect ions having a particular mass-to-charge. In some examples, the MS core 2655 can be designed to filter/select/detect inorganic ions and to filter/select/detect organic ions depending on the particular components which are present. While not shown, the mass analyzer comprising the MS core 2655 typically comprises common components used by the one, two, three or more mass spectrometer cores (MSCs)

which may be present in the mass analyzer. For example, common gas controllers, processors, power supplies, detectors and vacuum pumps may be used by different mass MSCs present in the mass analyzer. The system 2650 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 2650 between any one or more of the cores of the system 2650.

In certain configurations where two or more sample operation cores are present, each sample operation may be fluidically coupled to a respective ionization core through one or more interfaces. For example and referring to FIG. 26H, a system 2660 comprises a first sample operation core 2661, a second sample operation core 2662, an interface 2663, a first ionization core comprising an ICP 2664, and a second ionization core 2665. Each of the ionization cores 2664, 2665 is also fluidically coupled to a mass analyzer comprising a MS core 2666. While not shown, a valve, interface or other device can be present between the ionization cores 2664, 2665 and the MS core 2666 to provide species from the one of the ionization cores 2664, 2665 to the MS core 2666 at a selected time during use of the system 2660. In other configurations, the interface, valve or device can be configured to provide species from the ionization cores 2664, 2665 at the same time to the MS core 2666. In use of the system 2660, a sample can be introduced into the sample operation's 2661, 2662, and analyte in the sample can be vaporized, separated, reacted, derivatized, sorted, modified or otherwise acted on in some manner prior to providing the analyte species to the ionization cores 2664, 2665. The interface 2663 is fluidically coupled to each of the sample operation cores 2661, 2662 and can be configured to provide sample to either or both of the ionization cores 2664, 2665. In some instances, the ionization cores 2664, 2665 can be configured to ionize analyte in the sample using various but different techniques. For example, in some instances, the ICP 2664 can ionize elemental species, e.g., to ionize inorganic species, prior to providing the elemental ions to the core 2666. In some examples, the ICP 2664 can be replaced with a CCP or a microwave plasma. In other examples, the ICP 2664 can be replaced with a flame. In further examples, the ICP 2664 can be replaced with an arc. In other examples, the ICP 2664 can be replaced with a spark. In additional examples, the ICP 2664 can be replaced with another inorganic ionization core. In other instances, an ionization source can be present in the ionization core(s) 2665 to produce/ionize molecular species, e.g., to ionize organic species, prior to providing the molecular ions to the MS core 2666. In certain configurations as noted herein, the system 2660 may be configured to ionize both inorganic species and organic species using the ionization cores 2664, 2665 prior to providing the ions to the MS core 2666. The sample operation cores 2661, 2662 may receive sample from the same source or from different sources. Where different sample sources are present, the interface 2663 can provide analyte from the sample operation core 2661 to either of the ionization cores 2664, 2665. Similarly, the interface 2663 can provide analyte from the sample operation core 2662 to either of the ionization cores 2664, 2665. The MS core(s) 2666 can be configured to filter/detect ions having a particular mass-to-charge. In some examples, the MS core 2666 can be designed to filter/select/detect inorganic ions and to filter/select/detect organic ions depending on the particular components which are present. While not shown, the mass analyzer comprising the MS core 2666 typically comprises common components used by the one, two, three or more mass spectrometer cores (MSCs) which may be present in the mass analyzer. For example, common gas controllers, processors, power supplies, detectors and vacuum pumps may be used by different mass MSCs present in the mass analyzer. The system 2660 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 2660 between any one or more of the cores of the system 2660.

In certain configurations where two or more sample operation cores are present, each sample operation may be fluidically coupled to a respective ionization core through one or more interfaces and each ionization core may comprise a respective MS core. For example and referring to FIG. 26I, a system 2670 comprises a first sample operation core 2671, a second sample operation core 2672, an interface 2673, a first ionization core comprising an ICP 2674, and a second ionization core 2675. Each of the ionization cores 2674, 2675 is also fluidically coupled to a mass analyzer 2676 comprising MS cores 2677, 2678. In use of the system 2670, a sample can be introduced into the sample operation cores 2671, 2672, and analyte in the sample can be vaporized, separated, reacted, derivatized, sorted, modified or otherwise acted on in some manner prior to providing the analyte species to the ionization cores 2674, 2675. The interface 2673 is fluidically coupled to each of the sample operation cores 2671, 2672 and can be configured to provide sample to either or both of the ionization cores 2674, 2675. In some instances, the ionization cores 2674, 2675 can be configured to ionize analyte in the sample using various but different techniques. For example, in some instances, the ICP 2674 can ionize elemental species, e.g., to ionize inorganic species, prior to providing the elemental ions to the MS core 2677. In some examples, the ICP 2674 can be replaced with a CCP or a microwave plasma. In other examples, the ICP 2674 can be replaced with a flame. In further examples, the ICP 2674 can be replaced with an arc. In other examples, the ICP 2674 can be replaced with a spark. In additional examples, the ICP 2674 can be replaced with another inorganic ionization core. In other instances, an ionization source can be present in the ionization core(s) 2675 to produce/ionize molecular species, e.g., to ionize organic species, prior to providing the molecular ions to the core 2678. In certain configurations as noted herein, the system 2670 may be configured to ionize both inorganic species and organic species using the ionization cores 2674, 2675 prior to providing the ions to the MS cores 2677, 2678. The sample operation cores 2671, 2672 may receive sample from the same source or from different sources. Where different sample sources are present, the interface 2673 can provide analyte from the sample operation core 2671 to either of the ionization cores 2674, 2675. Similarly, the interface 2673 can provide analyte from the sample operation core 2672 to either of the ionization cores 2674, 2675. Each of the MS core(s) 2677, 2678 can be configured to filter/detect ions having a particular mass-to-charge. In some examples, either or both of the MS cores 2677, 2678 can be designed to filter/select/detect inorganic ions and to filter/select/detect organic ions depending on the particular components which are present. In some examples, the MS cores 2677, 2678 are configured differently with a different filtering device and/or detection device. While not shown, the mass analyzer 2676 typically comprises common components used by the one, two, three or more mass spectrometer cores (MSCs) which may be present in the mass analyzer 2676. For example, common gas controllers, processors, power supplies, detectors and vacuum pumps may be used by different mass MSCs present in the mass analyzer 2676. The system 2670 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 2670 between any one or more of the cores of the system 2670.

Figure 26J:
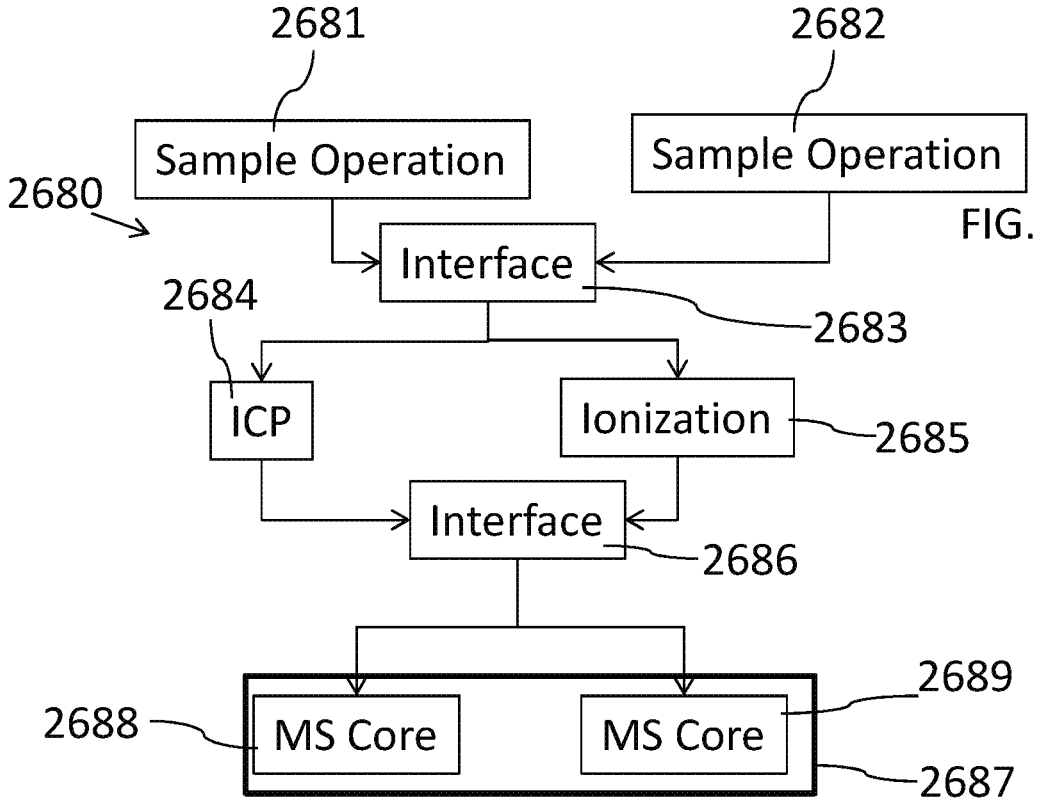
FIG. 26J is a block diagram of a system comprising two sample operation cores, an interface, two ionization cores with one ionization core comprising an ICP, another interface, and two MS cores, in accordance with certain examples.
Figure 26K:
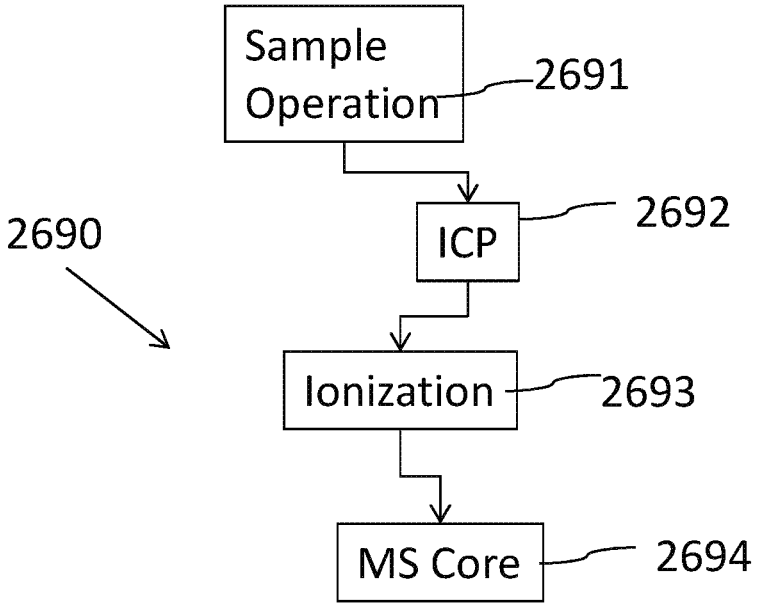
FIG. 26K is a block diagram of a system comprising a sample operation core, two serially arranged ionization cores with one ionization core comprising an ICP, and a MS core, in accordance with certain embodiments.
Figure 26L:
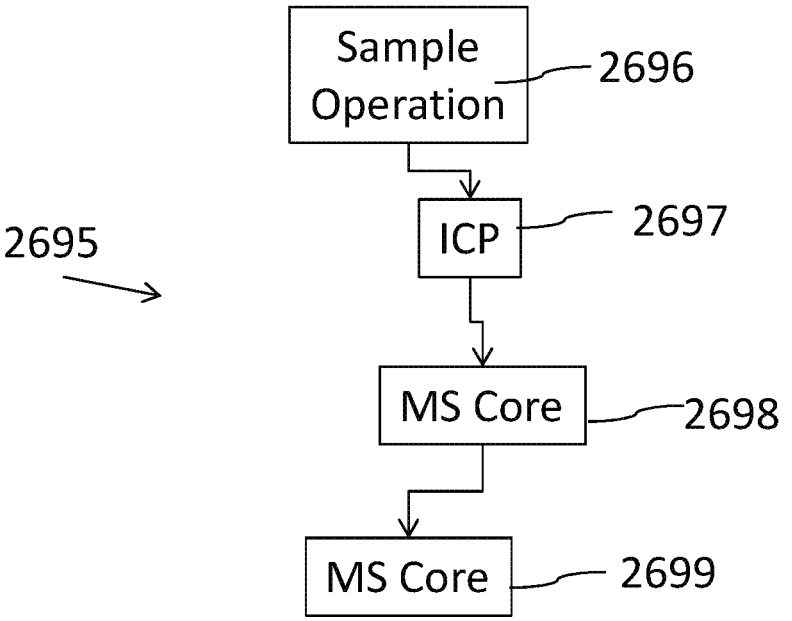
FIG. 26L is a block diagram a system comprising a sample operation core, an ionization core comprising an ICP, and two serially arranged MS cores, in accordance with certain embodiments.

In certain configurations where two or more sample operation cores are present, each sample operation may be fluidically coupled to a respective ionization core through one or more interfaces and each ionization core may be coupled to two or more MS cores through an interface. Referring to FIG. 26J, a system 2680 comprises a first sample operation core 2681, a second sample operation core 2682, an interface 2683, a first ionization core comprising an ICP 2684, and a second ionization core 2685. Each of the ionization cores 2684, 2685 is also fluidically coupled to a mass analyzer 2687 comprising MS cores 2688, 2689 through an interface 2686. In use of the system 2680, a sample can be introduced into the sample operation cores 2681, 2682, and analyte in the sample can be vaporized, separated, reacted, derivatized, sorted, modified or otherwise acted on in some manner prior to providing the analyte species to the ionization cores 2684, 2685. The interface 2683 is fluidically coupled to each of the sample operation cores 2681, 2682 and can be configured to provide sample to either or both of the ionization cores 2684, 2685. In some instances, the ionization cores 2684, 2685 can be configured to ionize analyte in the sample using various but different techniques. For example, in some instances, the ICP 2684 can ionize elemental species, e.g., to ionize inorganic species, prior to providing the elemental ions to the interface 2686. In some examples, the ICP 2684 can be replaced with a CCP or a microwave plasma. In other examples, the ICP 2684 can be replaced with a flame. In further examples, the ICP 2684 can be replaced with an arc. In other examples, the ICP 2684 can be replaced with a spark. In additional examples, the ICP 2684 can be replaced with another inorganic ionization core. In other instances, an ionization source can be present in the ionization core(s) 2685 to produce/ionize molecular species, e.g., to ionize organic species, prior to providing the molecular ions to the interface 2686. In certain configurations as noted herein, the system 2680 may be configured to ionize both inorganic species and organic species using the ionization cores 2684, 2685 prior to providing the ions to the interface 2686. The sample operation cores 2681, 2682 may receive sample from the same source or from different sources. Where different sample sources are present, the interface 2683 can provide analyte from the sample operation core 2681 to either of the ionization cores 2684, 2685. Similarly, the interface 2683 can provide analyte from the sample operation core 2682 to either of the ionization cores 2684, 2685. The interface 2686 can receive ions from either or both of the ionization cores 2684, 2685 and provide the received ions to one or both of the MS cores 2688, 2689. Each of the MS core(s) 2688, 2689 can be configured to filter/detect ions having a particular mass-to-charge. In some examples, either or both of the cores 2688, 2689 can be designed to filter/select/detect inorganic ions and to filter/select/detect organic ions depending on the particular components which are present. In some examples, the cores 2688, 2689 are configured differently with a different filtering device and/or detection device. While not shown, the mass analyzer 2687 typically comprises common components used by the one, two, three or more mass spectrometer cores (MSCs) which may be present in the mass analyzer 2687. For example, common gas controllers, processors, power supplies, detectors and vacuum pumps may be used by different mass MSCs present in the mass analyzer 2687. The system 2680 can be configured to detect low atomic mass unit analytes, e.g., lithium or other elements with a mass down to as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 2680 between any one or more of the cores of the system 2680.

In certain configurations, one or more serially arranged ionization cores can be present and used with a sample operation. For example and referring to FIG. 26K, a system 2690 is shown that comprise a sample operation core 2691 fluidically coupled to a first ionization core 2692. The first ionization core comprising an ICP 2692 is fluidically coupled to a second ionization core 2693, which itself is fluidically coupled to a mass analyzer comprising a MS core 2694. While not shown, a bypass line may also be present to directly couple the ionization core 2692 to the MS core 2694 if desired to permit ions to be provided directly from the core 2692 to the MS core 2694 in situations where the second ionization core 2693 is not used. Similarly, a bypass line can be present to directly couple the sample operation core 2691 to the ionization core 2693 in situations where it is not desirable to use the ionization core 2692. In use of the system 2690, a sample can be introduced into the sample operation core 2691, and analyte in the sample can be vaporized, separated, reacted, derivatized, sorted, modified or otherwise acted on in some manner prior to providing the analyte species to the ICP 2692. The ionization core 2692 can be configured to ionize analyte in the sample using various techniques. For example, in some instances, the ICP 2692 can ionize elemental species, e.g., to ionize inorganic species, prior to providing the elemental ions to the core 2693 or the MS core 2694. In some examples, the ICP 2692 can be replaced with a CCP or a microwave plasma. In other examples, the ICP 2692 can be replaced with a flame. In further examples, the ICP 2692 can be replaced with an arc. In other examples, the ICP 2692 can be replaced with a spark. In additional examples, the ICP 2692 can be replaced with another inorganic ionization core. In other instances, another ionization source can be present in the ionization core 2692 to produce/ionize molecular species, e.g., to ionize organic species, prior to providing the molecular ions to the core 2693 or the MS core 2694. The ionization core 2693 can be configured to ionize analyte in the sample using various techniques, which may be the same of different from those used by the core 2692. For example, in some instances, an ionization source can be present in the ionization core 2693 to ionize elemental species, e.g., to ionize inorganic species, prior to providing the elemental ions to the MS core 2694. In other instances, an ionization source can be present in the ionization core 2693 to produce/ionize molecular species, e.g., to ionize organic species, prior to providing the molecular ions to the MS core 2694. In certain configurations as noted herein, the system 2690 may be configured to ionize inorganic species and organic species prior to providing the ions to the MS core 2694. The MS core 2694 can be configured to filter/detect ions having a particular mass-to-charge. In some examples, the MS core 2694 can be designed to filter/select/detect inorganic ions and to filter/select/detect organic ions depending on the particular components which are present. While not shown, the mass analyzer comprising the MS core 2694 typically comprises common components used by the one, two, three or more mass spectrometer cores (MSCs) which may be present in the mass analyzer. For example, common gas controllers, processors, power supplies, detectors and vacuum pumps may be used by different mass MSCs present in the mass analyzer. The system 2690 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 2690 between any one or more of the cores of the system 2690. In some instances, any of the systems described and shown in FIGS. 26A-26J may comprise a serial arrangement of ionization cores similar to the cores 2692, 2693 shown in FIG. 26K.

In certain configurations, one or more serially arranged MS cores can be present in the systems described herein. For example and referring to FIG. 26L, a system 2695 is shown that comprise a sample operation core 2696 fluidically coupled to an ionization core comprising an ICP 2697. The ionization core 2697 is fluidically coupled to a mass analyzer comprising a first MS core 2698, which itself is fluidically coupled to a second MS core 2699 of the mass analyzer. While not shown, a bypass line may also be present to directly couple the ionization core 2697 to the MS core 2699 if desired to permit ions to be provided directly from the core 2697 to the MS core 2699 in situations where the first MS core 2698 is not used. In use of the system 2695, a sample can be introduced into the sample operation core 2696, and analyte in the sample can be vaporized, separated, reacted, derivatized, sorted, modified or otherwise acted on in some manner prior to providing the analyte species to the ionization core 2697. The ionization core 2697 can be configured to ionize analyte in the sample using various techniques. For example, in some instances, the ICP 2697 can ionize elemental species, e.g., to ionize inorganic species, prior to providing the elemental ions to the MS core 2698. In other instances, another ionization source can be present in the ionization core 2697 to produce/ionize molecular species, e.g., to ionize organic species, prior to providing the molecular ions to the MS core 2698. In certain configurations as noted herein, the system 2695 may be configured to ionize inorganic species and organic species prior to providing the ions to the MS core 2698. The MS core 2698 can be configured to filter/detect ions having a particular mass-to-charge. In some examples, the MS core 2698 can be designed to filter/select/detect inorganic ions and to filter/select/detect organic ions depending on the particular components which are present. Similarly, the MS core 2699 can be configured to filter/detect ions having a particular mass-to-charge. In some examples, the MS core 2699 can be designed to filter/select/detect inorganic ions and to filter/select/detect organic ions depending on the particular components which are present. While not shown, the mass analyzer comprising the MS cores 2698, 2699 typically comprises common components used by the one, two, three or more mass spectrometer cores (MSCs) which may be present in the mass analyzer. For example, common gas controllers, processors, power supplies, detectors and vacuum pumps may be used by different mass MSCs present in the mass analyzer. The system 2695 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 2695 between any one or more of the cores of the system 2695. In some instances, any of the systems described and shown in FIGS. 26A-26K may comprise a serial arrangement of MS cores similar to the cores 2698, 2699 shown in FIG. 26L.

In certain configurations, the ionization core may comprise one or more devices or systems which can ionize organic ions, e.g., provide molecular ions to a downstream core. Such ionization cores are referred to in certain instances herein as organic ionization cores or ionization cores which can provide organic ions. An organic ionization core typically comprises an organic ion source configured to provide the organic ions. The exact technique used to provide the organic ions can vary, and generally, the organic ions are provided using "softer" ionization techniques than those used to provide the inorganic ions. In one configuration, the ionization core may comprise a device or system configured to perform fast atom bombardment. Fast atom bombardment sources (FAB) can provide organic ions of high mass, e.g., 2000 amu's or more. While not wishing to be bound by any particular theory, FAB sources can ionize samples in a condensed state, e.g., in a solution or solvent such as a glycerol solution matrix, by bombarding the condensed sample with energetic Xenon or Argon atoms. Both positive and negative organic ions can be produced in the sample desorption process. The rapid heating which results from atom bombardment of the sample can provide ions while reducing sample fragmentation. The liquid matrix can reduce the lattice energy and can permit repair of any damage induced by the bombardment. To obtain the atoms, a beam of Xenon or Argon may be accelerated through a vacuum chamber comprising other Xenon or Argon atoms. The accelerated ions undergo resonant electron exchange with other atoms without substantial loss of energy. Lower energy ions can be removed with a deflector and/or lenses, and the fast atoms can be focused using a gun or other devices. FAB can provide formation of molecular ions with a molecular weight up to about 3,000 or even 10,000.

In certain examples, the ionization core may comprise an electrospray ionization (ESI) source to provide the molecular ions. In an ESI source, a sample is provided into an electric field (typically at atmospheric pressure) in the presence of a gas to assist desolvation. Aerosol droplets form in a vacuum region causing the charge to increase on the analyte droplets. The resulting ions can be provided to a MS stage. In certain examples, the systems described herein may comprise an ionization core comprising an ESI source to provide the molecular ions. ESI can be used in combination with desorption ionization (DESI) where the electrospray droplets care directed toward a sample to provide ions. Examples below which describe the use of ESI could instead use DESI if desired.

In certain embodiments, the ionization core may comprise an electron impact (EI) source to provide the organic ions. In a typical EI source, electrons emitted from a metal wire can be accelerated toward an anode. As the electrons impact the molecules (generally at a ninety degree angle), the primary species formed are singly charged positive ions as the impacting electrons can cause the molecules to lose electrons due to electron repulsion effects. In certain examples, the systems described herein may comprise an ionization core comprising an EI source to provide the molecular ions.

In certain examples, the ionization core may comprise a matrix assisted laser desorption/ionization (MALDI) source to provide the organic ions. In one configuration of a MALDI source, sample comprising analyte can be mixed with a suitable matrix material and disposed on a substrate, e.g., a metal plate. Laser pulses, e.g., UV laser pulses, can then be provided to the disposed sample/matrix material. The laser pulses are absorbed by the matrix which causes rapid heating, ablation and desorption of the analytes (and some matrix material) from the substrate. The desorbed analytes can then be provided or exposed to ablated gases to ionize the analytes. In certain examples, the systems described herein may comprise an ionization core comprising a MALDI source to provide the molecular ions.

In certain examples, the ionization core may comprise a chemical ionization source (CI). CI sources can be used alone or in combination with other ionization sources, e.g., EI sources. In CI sources, gaseous sample atoms are ionized by collision with ions produced by electron bombardment of excess reagent gas. Positive ions are typically produced, but negative ions can also be produced depending on the sample and gas which are used. In certain examples, the systems described herein may comprise an ionization core comprising an EI source to provide the molecular ions.

In certain embodiments, the ionization core may comprise a field ionization source (FI). FI sources form ions under the influence of a large electric field, e.g., $10^8$ V/cm or more. High voltages can be provided to emitter, e.g., tungsten wires comprising carbon or other materials. Gaseous sample from a sample operation core can be provided to or near the emitter, and electron transfer from the analyte of the sample to the emitter can occur. Little energy is imparted to the analyte, which results in little or no sample fragmentation. In certain examples, the systems described herein may comprise an ionization core comprising an FI source to provide the molecular ions.

In certain instances, an ionization core comprising a field desorption (FD) source can be used to provide organic ions. In FD sources, an emitter similar to those of FI sources can be mounted on a probe that can be coated with the sample. Ionization takes place by application of a potential to the probe. Heating of the probe may also be performed to enhance ion formation. In some instances, the ionization cores described herein may comprise a FD source. In certain examples, the systems described herein may comprise an ionization core comprising an FD source to provide the organic ions.

In certain examples, the ionization core may comprise a secondary ion (SI) source. SI sources can be used to analyze solid surfaces, films and coatings by exposing the surface to an ion beam. Secondary ions ejected from the surface can then be provided to MS core as described herein. In certain examples, the systems described herein may comprise an ionization core comprising an SI source to provide the organic ions.

In certain configurations, the ionization core may comprise a plasma desorption (PD) source. In PD sources, a solid sample is bombarded with ionic or neutral atoms formed from fission of nuclear or unstable materials. The resulting ions can be provided to a MS core as described herein. In certain examples, the systems described herein may comprise an ionization core comprising a PD source to provide the organic ions.

In some examples, the ionization core may comprise a thermal ionization (TI) source. A TI source can provide vaporized neutral atoms to a heated surface to promote re-evaporation of the atoms in ionic form. This technique is commonly used on surfaces with a low ionization energy, e.g., surfaces comprising lithium, sodium, potassium, etc.) Both positive and negative ions can be provided depending on the nature of the atoms which are used to spray the surface. In certain examples, the systems described herein may comprise an ionization core comprising a TI source to provide the organic ions.

In some examples, the ionization core may comprise an electrohydrodynamic ionization (EHI) source. In an EHI source, charged droplets/ions are produced from a liquid surface by applying an electric field. EHI sources may be particularly useful for analyzing liquid analyte which elutes from a sample operation core comprising a LC. In certain examples, the systems described herein may comprise an ionization core comprising an EHI source to provide the organic ions.

In other examples, the ionization core may comprise a thermospray (TS) source. In TS sources, a liquid comprising the sample and a solvent is forced through a small, charged orifice, e.g., in a metal capillary. The analyte exits in an ionized form. The liquid exits the orifice in an aerosol form. As the solvent evaporates, the analyte ions repel each other and cause the droplets to break up. Eventually, the analyte ions are solvent free and can be provided to a MS core as described herein. In certain configurations, the systems described herein may comprise an ionization core comprising a TS source to provide the organic ions.

In some embodiments, the ionization core may comprise an atmospheric pressure chemical ionization (APCI) source. In an APCI source, a heated solvent comprising a sample is sprayed at atmospheric pressure and sprayed with high flow rates of nitrogen or other gas to provide an aerosol. The resulting aerosol is exposed to a corona discharge that permits the solvent to function as a reagent gas to ionize the analyte in the sample. The solvent-evaporation step generally is separate from the ion-formation step in APCI, which permits the use of low polarity solvents with APCI sources. APCI sources may be particularly desirable for use when a sample operation core comprising an LC device is present. In certain configurations, the systems described herein may comprise an ionization core comprising an APCI source to provide the organic ions. In other instances, other atmospheric pressurization devices can be used to provide the organic ions.

In some examples, the ionization core may comprise a photoionization (PI) source. The PI source exposes the sample to light to produce ions. Single or multi-photon ionization techniques can be implemented. Further, the light can be provided to aerosolized solvent sprays to provide the ions. In certain examples, the systems described herein may comprise an ionization core comprising a PI source to provide the organic ions.

In some configurations, the ionization core may comprise a desorption ionization on silicon (DiOS) source. In a DiOS source, a laser is used to desorb/ionize a sample deposited on a generally inert, porous silicon based surface. DiOS sources are typically used with small or large analytes molecules where little or no fragmentation is desired. DiOS source can be preferable to MALDI sources as no interfering matrix ions are produced using DiOS sources, which permits the use of DiOS with small molecules. In certain examples, the systems described herein may comprise an ionization core comprising a DiOS source to provide the organic ions.

In certain embodiments, the ionization core may comprise a direct analysis in real time (DART) source. The DART source is an atmosphere pressure ion source that can simultaneously ionize, gases, liquids and solids under atmospheric conditions. Ionization typically occurs directly on a sample surface by exposing the analyte molecules to electronically excited atoms or metastable species. Collisions between the analyte molecules and the excited atoms can result in electron transfer/release and provide analyte ions. A carrier gas is typically present to provide the resulting analyte ions to a MS core. In certain examples, the systems described herein may comprise an ionization core comprising a DART source to provide the organic ions.

Figure 27:
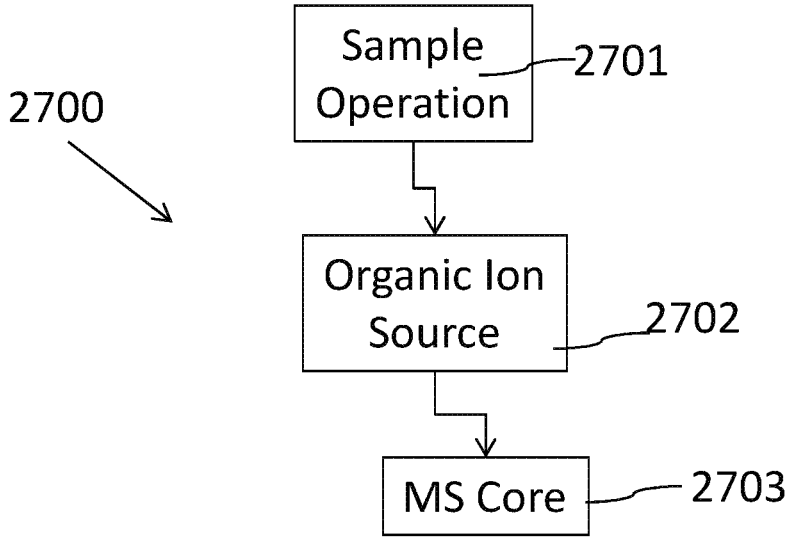
FIG. 27 is a block diagram of a system comprising a sample operation core, an ionization core comprising an organic ion source and a MS core, in accordance with certain embodiments.

Referring to FIG. 27, a system 2700 comprises a sample operation core 2701 fluidically coupled to an ionization core(s) comprising an organic ion source 2702, which itself is fluidically coupled to a mass analyzer comprising a MS core 2703. In use of the system 2700, a sample can be introduced into the sample operation core 2701, and analyte in the sample can be vaporized, separated, reacted, derivatized, sorted, modified or otherwise acted on in some manner by the sample operation core 2701 prior to providing the analyte species to the organic ion source 2702. The organic ion source 2702 can be configured to ionize analyte in the sample using various techniques. In certain instances, the organic ion source 2702 may comprise a FAB device. In other instances, the organic ion source 2702 may comprise an ESI or DESI device. In certain instances, the organic ion source 2702 may comprise a MALDI device. In other instances, the organic ion source 2702 may comprise an EI device. In certain instances, the organic ion source 2702 may comprise a FI device. In other instances, the organic ion source 2702 may comprise a FD device. In certain instances, the organic ion source 2702 may comprise a SI device. In other instances, the organic ion source 2702 may comprise a PD device. In certain instances, the organic ion source 2702 may comprise a TI device. In other instances, the organic ion source 2702 may comprise an EHI device. In certain instances, the organic ion source 2702 may comprise a TS device. In other instances, the organic ion source 2702 may comprise an ACPI device. In certain instances, the organic ion source 2702 may comprise a PI device. In other instances, the organic ion source 2702 may comprise a DiOS device. In other instances, the organic ion source 2702 may comprise a DART device. In some instances, the source 2702 can ionize molecular species, e.g., ionize organic species, prior to providing the molecular ions to the MS core 2703. In other instances, another ionization source can be present in the ionization core(s) to produce/ionize elemental species, e.g., to ionize inorganic species, prior to providing the molecular ions to the MS core 2703. In certain configurations as noted herein, the system 2700 may be configured to ionize inorganic species and organic species prior to providing the ions to the MS core 2703. The MS core(s) 2703 can be configured to filter/detect ions having a particular mass-to-charge. In some examples, the core 2703 can be designed to filter/select/detect inorganic ions and to filter/select/detect organic ions depending on the particular components which are present. While not shown, the mass analyzer comprising the MS core 2703 typically comprises common components used by the one, two, three or more mass spectrometer cores (MSCs) which may be present in the mass analyzer. For example, common gas controllers, processors, power supplies and vacuum pumps may be used by different mass MSCs present in the mass analyzer. The system 2700 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 2700 between any one or more of the cores of the system 2700.

Figure 28:
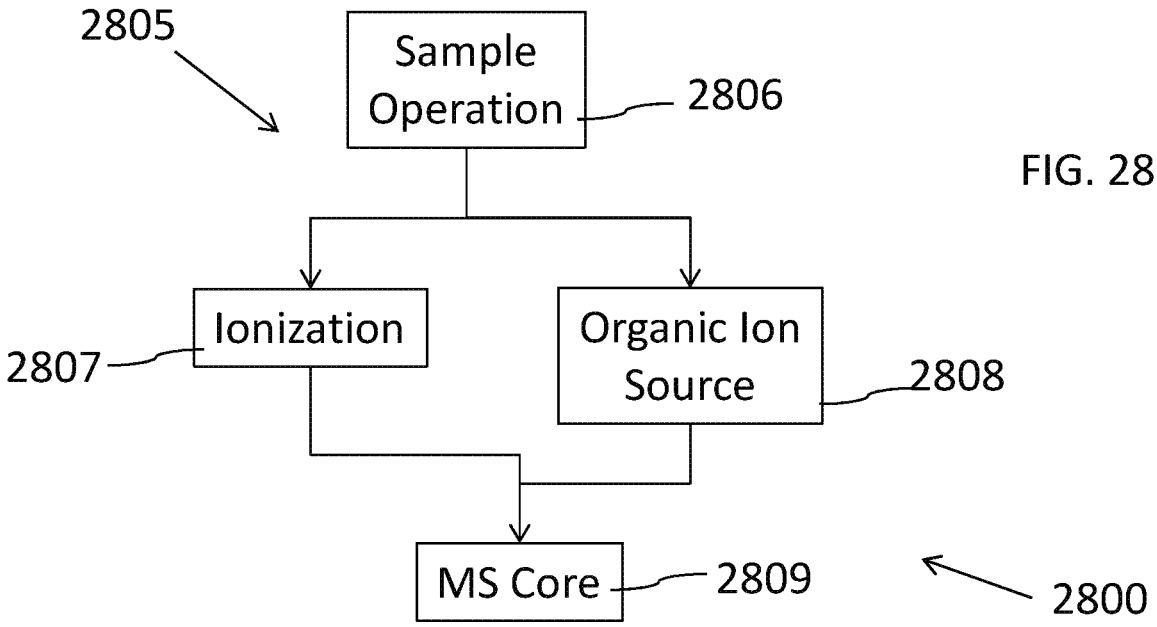
FIG. 28 is a block diagram of a system comprising a sample operation core, two ionization cores with one ionization core comprising an organic ion source, and a MS core, in accordance with certain embodiments.

In certain configurations, any one or more of the cores shown in FIG. 27 can be separated or split into two or more cores. For example and referring to FIG. 28, a system 2800 comprises a sample operation core 2806, an ionization core comprising an organic ion source 2808 fluidically coupled to the sample operation core 2806 and another ionization core 2807 fluidically coupled to the sample operation core 2806. Each of the cores 2807, 2808 is also fluidically coupled to a mass analyzer comprising a MS core 2809. While not shown, an interface, valve, or other device can be present between the sample operation core 2806 and the ionization cores 2807, 2808 to provide species from the sample operation core 2806 to only one of the ionization cores 2807, 2808 at a selected time during use of the system 2805. In other configurations, the interface, valve or device can be configured to provide species from the sample operation core 2806 to the ionization cores 2807, 2808 simultaneously. Similarly, a valve, interface or other device (not shown) can be present between the ionization cores 2807, 2808 and the MS core 2809 to provide species from the one of the ionization cores 2807, 2808 to the MS core 2809 at a selected time during use of the system 2800. In other configurations, the interface, valve or device can be configured to provide species from the ionization cores 2807, 2808 at the same time to the MS core 2809. In use of the system 2800, a sample can be introduced into the sample operation core 2806, and analyte in the sample can be vaporized, separated, reacted, derivatized, sorted, modified or otherwise acted on in some manner by the sample operation core 2806 prior to providing the analyte species to one or both of the ionization core(s) 2807, 2808. In some instances, the ionization cores 2807, 2808 can be configured to ionize analyte in the sample using various but different techniques. In some examples, the core 2807 can comprise an ICP or a CCP or a microwave plasma. In other examples, the core 2807 can comprise a flame. In further examples, the core 2807 can comprise an arc. In other examples, the core 2807 can comprise a spark. In additional examples, the core 2807 can comprise another inorganic ionization core. In some instances, the ionization core(s) 2802 comprises an organic ion source. In certain instances, the organic ion source 2808 may comprise a FAB device. In other instances, the organic ion source 2808 may comprise an ESI or DESI device. In certain instances, the organic ion source 2808 may comprise a MALDI device. In other instances, the organic ion source 2808 may comprise an EI device. In certain instances, the organic ion source 2808 may comprise a FI device. In other instances, the organic ion source 2808 may comprise a FD device. In certain instances, the organic ion source 2808 may comprise a SI device. In other instances, the organic ion source 2808 may comprise a PD device. In certain instances, the organic ion source 2808 may comprise a TI device. In other instances, the organic ion source 2808 may comprise an EHI device. In certain instances, the organic ion source 2808 may comprise a TS device. In other instances, the organic ion source 2808 may comprise an ACPI device. In certain instances, the organic ion source 2808 may comprise a PI device. In other instances, the organic ion source 2808 may comprise a DiOS device. In other instances, the organic ion source 2808 may comprise a DART device. In other instances, another ionization source can be present in the ionization core(s) 2808 to produce/ionize elemental species, e.g., to ionize inorganic species, prior to providing the inorganic ions to the core 2809. In certain configurations as noted herein, the system 2800 may be configured to ionize both inorganic species and organic species using the ionization cores 2807, 2808 prior to providing the ions to the core 2809. The MS core(s) 2809 can be configured to filter/detect ions having a particular mass-to-charge. In some examples, the core 2809 can be designed to filter/select/detect inorganic ions and to filter/select/detect organic ions depending on the particular components which are present. While not shown, the mass analyzer comprising the MS core 2809 typically comprises common components used by the one, two, three or more mass spectrometer cores (MSCs) which may be present in the mass analyzer. For example, common gas controllers, processors, power supplies, detectors and vacuum pumps may be used by different mass MSCs present in the mass analyzer. The system 2800 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 2800 between any one or more of the cores of the system 2800.

Figure 29:
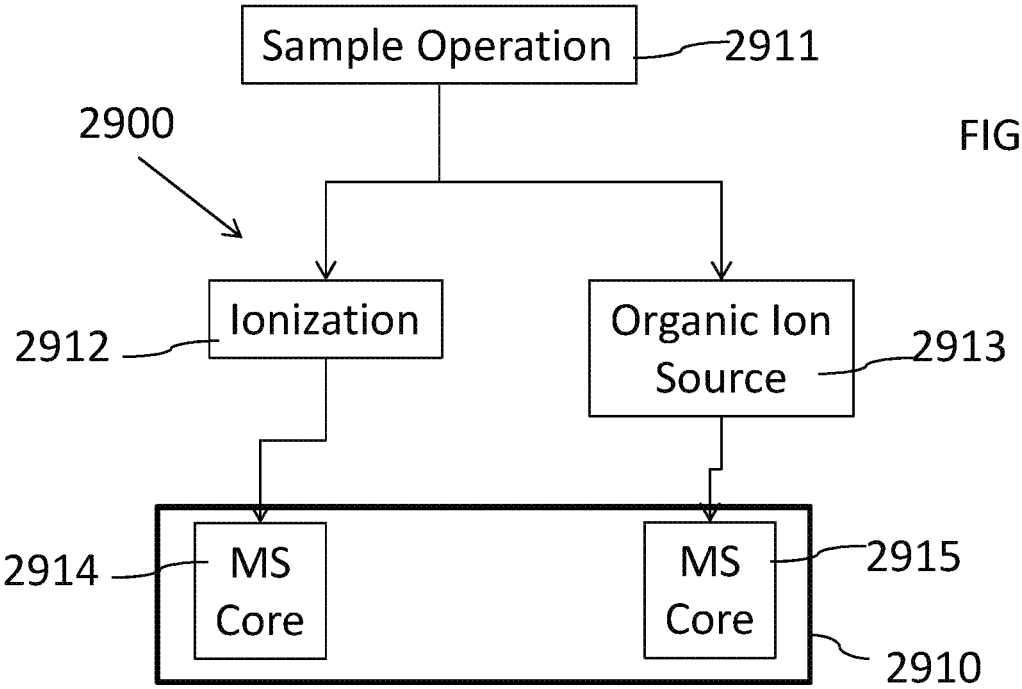
FIG. 29 is a block diagram of a system comprising a sample operation core, two ionization cores with one ionization core comprising an organic ion source, and two MS cores, in accordance with certain configurations.

In other configurations, the MS cores described herein (when used with an organic ion source) may be separated into two or more individual cores. As noted herein, even though the MS cores can be separated, they still can share certain common components including gas controllers, processors, power supplies, and/or vacuum pumps. Referring to FIG. 29, a system 2900 is shown that comprises a sample operation core 2911, a first ionization core comprising an organic ion source 2913, another ionization core 2912, a mass analyzer 2910 comprising a first MS core 2914 and a second MS core 2915. The sample operation core 2911 is fluidically coupled to each of the ionization cores 2912, 2913. While not shown, an interface, valve, or other device (not shown) can be present between the sample operation core 2911 and the ionization cores 2912, 2913 to provide species from the sample operation core 2911 to only one of the ionization cores 2912, 2913 at a selected time during use of the system 2910. In other configurations, the interface, valve or device can be configured to provide species from the sample operation core 2911 to the ionization cores 2912, 2913 simultaneously. The ionization core 2912 is fluidically coupled to the first MS core 2914, and the second ionization core 2913 is fluidically coupled to the second MS core 2915. In use of the system 2910, a sample can be introduced into the sample operation core 2911, and analyte in the sample can be vaporized, separated, reacted, derivatized, sorted, modified or otherwise acted on in some manner prior to providing the analyte species to one or both of the ionization core(s) 2912, 2913. In some instances, the ionization cores 2912, 2913 can be configured to ionize analyte in the sample using various but different techniques. For example, in some instances, the organic ion source 2913 can ionize molecular species, e.g., to ionize organic species, prior to providing the molecular ions to the core 2914. In some examples, the core 2912 may comprise an ICP or a CCP or a microwave plasma. In other examples, the core 2912 can comprise a flame. In further examples, the core 2912 can comprise an arc. In other examples, the core 2912 can comprise a spark. In certain instances, the organic ion source 2913 may comprise a FAB device. In other instances, the organic ion source 2913 may comprise an ESI or DESI device. In certain instances, the organic ion source 2913 may comprise a MALDI device. In other instances, the organic ion source 2913 may comprise an EI device. In certain instances, the organic ion source 2913 may comprise a FI device. In other instances, the organic ion source 2913 may comprise a FD device. In certain instances, the organic ion source 2913 may comprise a SI device. In other instances, the organic ion source 2913 may comprise a PD device. In certain instances, the organic ion source 2913 may comprise a TI device. In other instances, the organic ion source 2913 may comprise an EHI device. In certain instances, the organic ion source 2913 may comprise a TS device. In other instances, the organic ion source 2913 may comprise an ACPI device. In certain instances, the organic ion source 2913 may comprise a PI device. In other instances, the organic ion source 2913 may comprise a DiOS device. In other instances, the organic ion source 2913 may comprise a DART device. In other instances, another ionization source can be present in the ionization core(s) 2913 to produce/ionize molecular species, e.g., to ionize inorganic species, prior to providing the elemental ions to the MS core 2915. In certain configurations as noted herein, the system 2900 may be configured to ionize both inorganic species and organic species using the ionization cores 2912, 2913 prior to providing the ions to the cores 2914, 2915. The MS core(s) 2914, 2915 can be configured to filter/detect ions having a particular mass-to-charge. In some examples, the MS core 2914 can be designed to filter/select/detect inorganic ions, and the MS core 2915 can be designed to filter/select/detect organic ions depending on the particular components which are present. While not shown, the mass analyzer 2910 typically comprises common components used by the one, two, three or more mass spectrometer cores (MSCs) which may independently be present in the mass analyzer 2910. For example, common gas controllers, processors, power supplies, detectors and vacuum pumps may be used by different mass MSCs present in the mass analyzer 2910, though each of the cores 2914, 2915 may comprise its own gas controllers, processors, power supplies, detectors and/or vacuum pumps if desired. The system 2900 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 2900 between any one or more of the cores of the system 2900.

Figure 30:
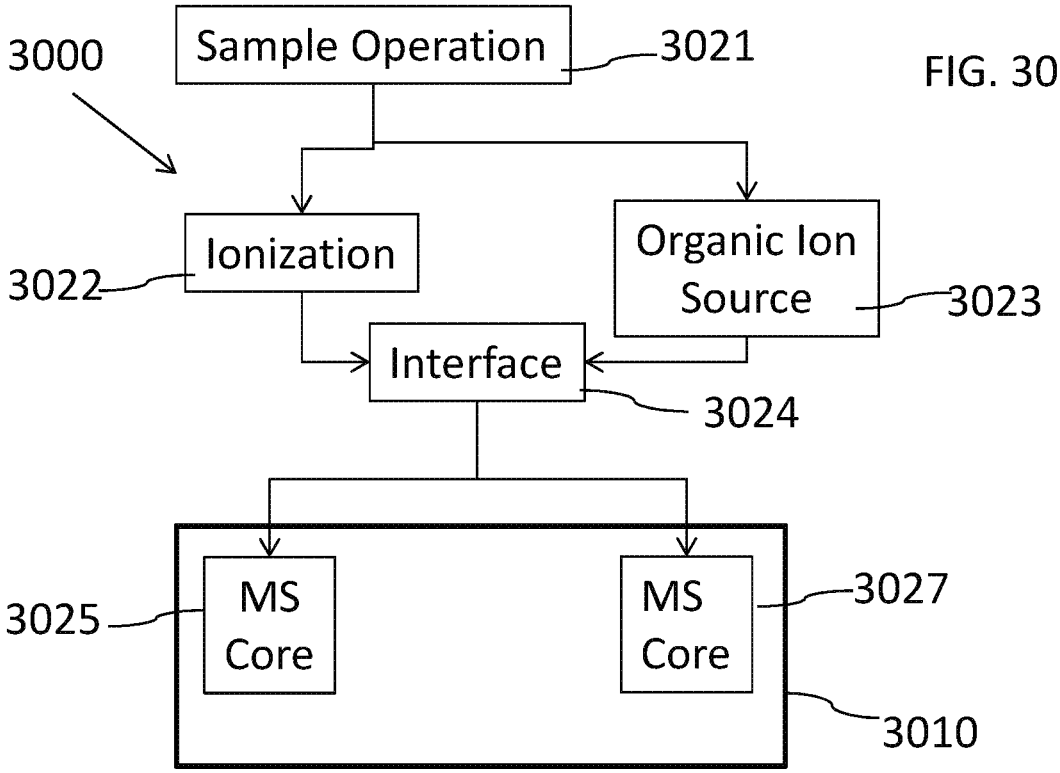
FIG. 30 is a block diagram of a system comprising a sample operation core, two ionization cores with one ionization core comprising an organic ion source, an interface and two MS cores, in accordance with certain configurations.

In some instances where a sample operation, two ionization cores and two MS cores are present, it may be desirable to provide ions from different ionization cores to different MS cores. For example and referring to FIG. 30, a system 3000 is shown that comprises a sample operation core 3021, an ionization core comprising an organic ion source 3023, another ionization core 3022, an interface 3024, a mass analyzer 3010 comprising a first MS core 3025 and a second MS core 3027. The sample operation core 3021 is fluidically coupled to each of the ionization cores 3022, 3023. While not shown, an interface, valve, or other device (not shown) can be present between the sample operation core 3021 and the ionization cores 3022, 3023 to provide species from the sample operation core 3021 to only one of the ionization cores 3022, 3023 at a selected time during use of the system 3000. In other configurations, the interface, valve or device can be configured to provide species from the sample operation core 3021 to the ionization cores 3022, 3023 simultaneously. The ionization core 3022 is fluidically coupled to the interface 3024, and the ionization core 3023 is fluidically coupled to the interface 3024. The interface 3024 is fluidically coupled to each of a first MS core 3025 and a second MS core 3027. In use of the system 3000, a sample can be introduced into the sample operation core 3021, and analyte in the sample can be vaporized, separated, reacted, derivatized, sorted, modified or otherwise acted on in some manner prior to providing the analyte species to one or both of the ionization core(s) 3022, 3023. In some instances, the ionization cores 3022, 3023 can be configured to ionize analyte in the sample using various but different techniques. For example, in some instances, the organic ion source 3023 can ionize molecular species, e.g., to ionize organic species, prior to providing the organic ions to the interface 3024. In some examples, the core 3022 can comprise an ICP or a CCP or a microwave plasma. In other examples, the core 3022 can comprise a flame. In further examples, the core 3022 can comprise an arc. In other examples, the core 3022 can comprise a spark. In certain instances, the organic ion source 3023 may comprise a FAB device. In other instances, the organic ion source 3023 may comprise an ESI or DESI device. In certain instances, the organic ion source 3023 may comprise a MALDI device. In other instances, the organic ion source 3023 may comprise an EI device. In certain instances, the organic ion source 3023 may comprise a FI device. In other instances, the organic ion source 3023 may comprise a FD device. In certain instances, the organic ion source 3023 may comprise a SI device. In other instances, the organic ion source 3023 may comprise a PD device. In certain instances, the organic ion source 3023 may comprise a TI device. In other instances, the organic ion source 3023 may comprise an EHI device. In certain instances, the organic ion source 3023 may comprise a TS device. In other instances, the organic ion source 3023 may comprise an ACPI device. In certain instances, the organic ion source 3023 may comprise a PI device. In other instances, the organic ion source 3023 may comprise a DiOS device. In other instances, the organic ion source 3023 may comprise a DART device. In other instances, another ionization source can be present in the ionization core(s) 3023 to produce/ionize elemental species, e.g., to ionize inorganic species, prior to providing the ions to the interface 3024. In certain configurations as noted herein, the system 3000 may be configured to ionize both inorganic species and organic species using the ionization cores 3022, 3023 prior to providing the ions to the interface 3024. The interface 3024 can be configured to provide ions to either or both of the MS core(s) 3025, 3027 each of which can be configured to filter/detect ions having a particular mass-to-charge. In some examples, the MS core 3025 can be designed to filter/select/detect inorganic ions, and the MS core 3027 can be designed to filter/select/detect organic ions depending on the particular components which are present. In some examples, the MS cores 3025, 3027 are configured differently with a different filtering device and/or detection device. While not shown, the mass analyzer 3010 typically comprises common components used by the one, two, three or more mass spectrometer cores (MSCs) which may independently be present in the mass analyzer 3010. For example, common gas controllers, processors, power supplies, detectors and vacuum pumps may be used by different mass MSCs present in the mass analyzer 3010, though each of the MS cores 3025, 3027 may comprise its own gas controllers, processors, power supplies, detectors and/or vacuum pumps if desired. The system 3000 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 3000 between any one or more of the cores of the system 3000.

Figure 31:
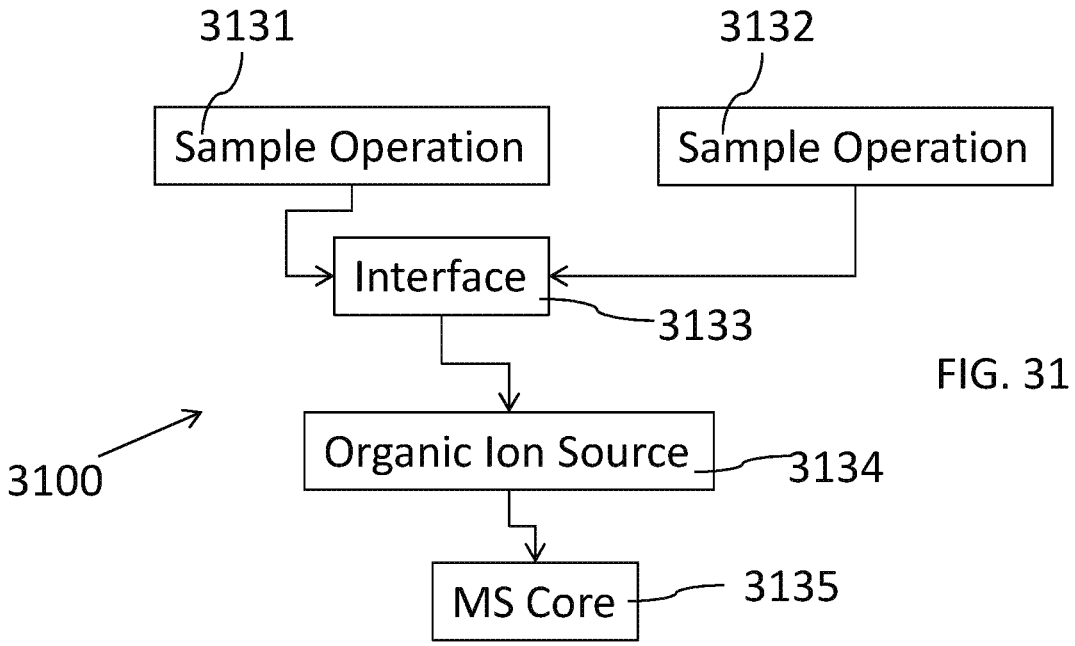
FIG. 31 is a block diagram of a system comprising two sample operation cores, an interface, an ionization core comprising an organic ion source, and a MS core, in accordance with certain examples.

In certain examples, the sample operation core can be split into two or more cores if desired. For example, it may be desirable to perform different operations when inorganic ions are to be provided to an ionization core or MS core compared to when organic ions are to be provided to an ionization core or MS core. Referring to FIG. 31, a system 3100 is shown that comprises a first sample operation core 3131 and a second sample operation core 3132. Each of the sample operation cores 3131, 3132 is fluidically coupled to an interface 3133. The interface 3133 is fluidically coupled to an ionization core comprising an organic ion source 3134, which itself is fluidically coupled to a mass analyzer comprising a MS core 3135. In use of the system 3100, a sample can be introduced into one or both of the sample operation cores 3131, 3132, and analyte in the sample can be vaporized, separated, reacted, derivatized, sorted, modified or otherwise acted on in some manner prior to providing the analyte species to the interface 3133. The different sample operation cores 3131, 3132 can be configured to perform different separations, use different separation conditions, use different carrier gases or include different components. The interface 3133 can be configured to permit passage of sample from one or both of the sample operation cores 3131, 3132 to the ionization core 3134. The ionization cores(s) 3134 can be configured to ionize analyte in the sample using various techniques. In certain instances, the organic ion source 3134 may comprise a FAB device. In other instances, the organic ion source 3134 may comprise an ESI or DESI device. In certain instances, the organic ion source 3134 may comprise a MALDI device. In other instances, the organic ion source 3134 may comprise an EI device. In certain instances, the organic ion source 3134 may comprise a FI device. In other instances, the organic ion source 3134 may comprise a FD device. In certain instances, the organic ion source 3134 may comprise a SI device. In other instances, the organic ion source 3134 may comprise a PD device. In certain instances, the organic ion source 3134 may comprise a TI device. In other instances, the organic ion source 3134 may comprise an EHI device. In certain instances, the organic ion source 3134 may comprise a TS device. In other instances, the organic ion source 3134 may comprise an ACPI device. In certain instances, the organic ion source 3134 may comprise a PI device. In other instances, the organic ion source 3134 may comprise a DiOS device. In other instances, the organic ion source 3134 may comprise a DART device. In other instances, another ionization source can be present in the ionization core(s) 3134 to produce/ionize elemental species, e.g., to ionize inorganic species, prior to providing the inorganic ions to the MS core 3135. In certain configurations as noted herein, the system 3100 may be configured to ionize inorganic species and organic species prior to providing the ions to the MS core 3135. The MS core(s) 3135 can be configured to filter/detect ions having a particular mass-to-charge. In some examples, the MS core 3135 can be designed to filter/select/detect inorganic ions and to filter/select/detect organic ions depending on the particular components which are present. While not shown, the mass analyzer comprising the MS core 3135 typically comprises common components used by the one, two, three or more mass spectrometer cores (MSCs) which may be present in the mass analyzer. For example, common gas controllers, processors, power supplies, detectors and vacuum pumps may be used by different mass MSCs present in the mass analyzer. The system 3100 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 3100 between any one or more of the cores of the system 3100.

Figure 32:
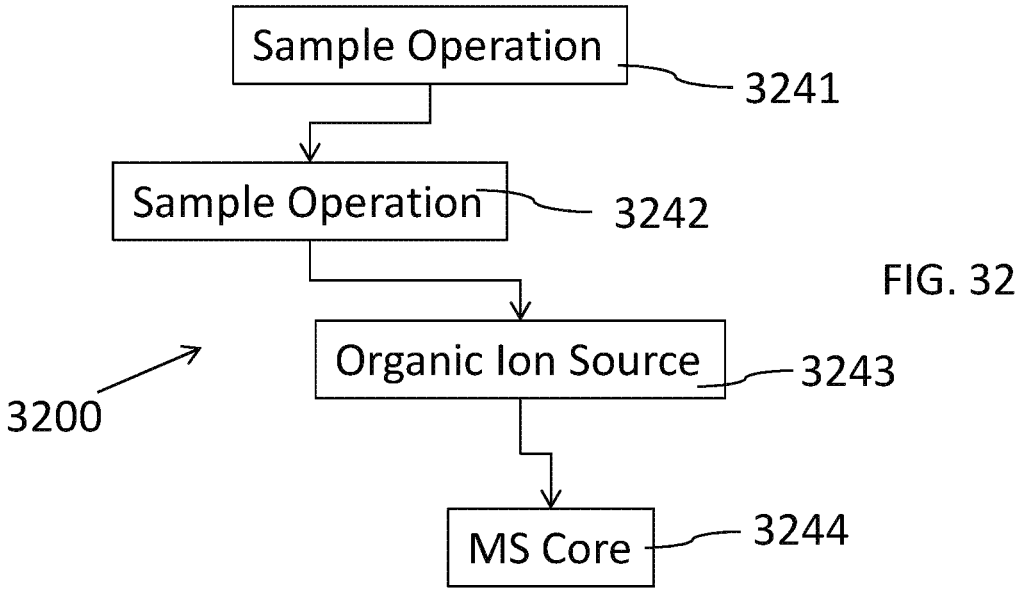
FIG. 32 is a block diagram of a system comprising two serially arranged sample operation cores, an ionization core comprising an organic ion source, and a MS core, in accordance with certain configurations.

In certain configurations, the sample operation cores can be serially coupled to each other if desired. For example, it may be desirable to perform separate analytes in a sample using sample operation's configured for different separation conditions. Referring to FIG. 32, a system 3200 is shown that comprises a first sample operation core 3241 fluidically coupled to a second sample operation core 3242. Depending on the nature of the analyte sample, one of the sample operation cores 3241, 3242 may be present in a passive configuration and generally pass sample without performing any operations on the sample, whereas in other instances each of the sample operation cores 3241, 3242 performs one or more sample operations including, but not limited to, vaporization, separation, reaction, derivatization, sorting, modification or otherwise acting on the sample in some manner prior to providing the analyte species to the ionization core 3243. In certain instances, the organic ion source 3243 may comprise a FAB device. In other instances, the organic ion source 3243 may comprise an ESI or DESI device. In certain instances, the organic ion source 3243 may comprise a MALDI device. In other instances, the organic ion source 3243 may comprise an EI device. In certain instances, the organic ion source 3243 may comprise a FI device. In other instances, the organic ion source 3243 may comprise a FD device. In certain instances, the organic ion source 3243 may comprise a SI device. In other instances, the organic ion source 3243 may comprise a PD device. In certain instances, the organic ion source 3243 may comprise a TI device. In other instances, the organic ion source 3243 may comprise an EHI device. In certain instances, the organic ion source 3243 may comprise a TS device. In other instances, the organic ion source 3243 may comprise an ACPI device. In certain instances, the organic ion source 3243 may comprise a PI device. In other instances, the organic ion source 3243 may comprise a DiOS device. In other instances, the organic ion source 3243 may comprise a DART device. In other instances, another ionization source can be present in the ionization core(s) 3243 to produce/ionize elemental species, e.g., to ionize inorganic species, prior to providing the inorganic ions to a mass analyzer comprising a MS core 3244. In certain configurations as noted herein, the system 3200 may be configured to ionize inorganic species and organic species prior to providing the ions to the MS core 3244. The MS core(s) 3244 can be configured to filter/detect ions having a particular mass-to-charge. In some examples, the MS core 3244 can be designed to filter/select/detect inorganic ions and to filter/select/detect organic ions depending on the particular components which are present. While not shown, the mass analyzer comprising the MS core 3244 typically comprises common components used by the one, two, three or more mass spectrometer cores (MSCs) which may be present in the mass analyzer. For example, common gas controllers, processors, power supplies, detectors and vacuum pumps may be used by different mass MSCs present in the mass analyzer. The system 3200 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 3200 between any one or more of the cores of the system 3200.

Figure 33:
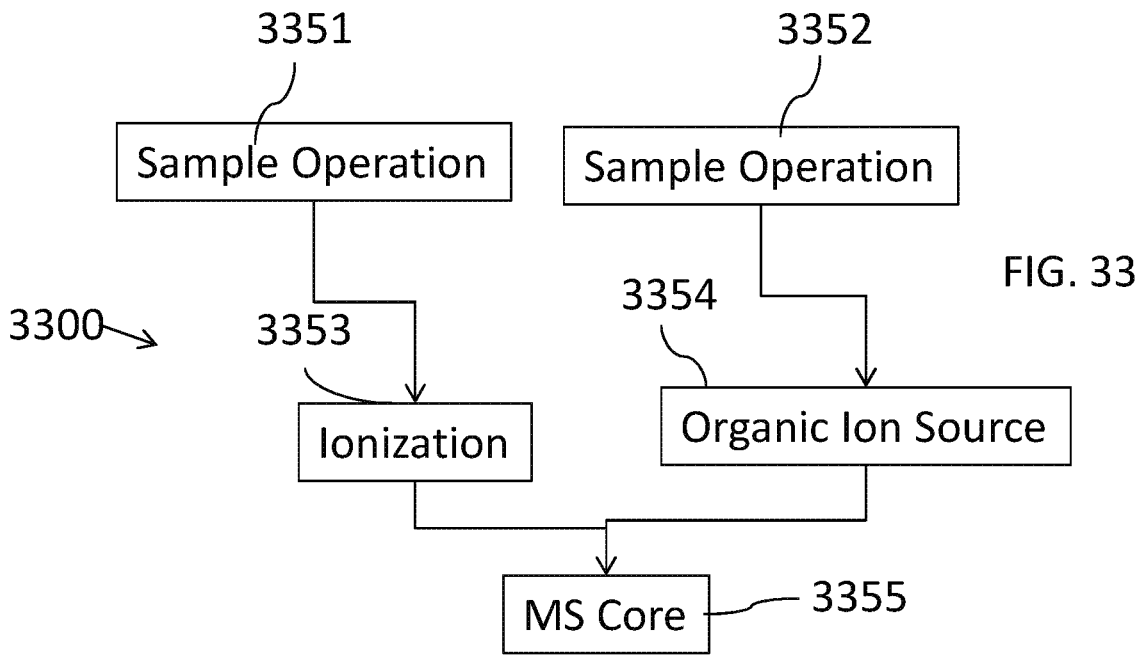
FIG. 33 is a block diagram of a system comprising two sample operation cores, two ionization cores with one ionization core comprising an organic ion source, and a MS core, in accordance with certain examples.

In certain configurations where two or more sample operation cores are present, each sample operation may be fluidically coupled to a respective ionization core. For example and referring to FIG. 33, a system 3300 comprises a first sample operation core 3351, a second sample operation core 3352, an ionization core comprising an organic ion source 3354 fluidically coupled to the second sample operation core 3352, and a second ionization core 3353 fluidically coupled to the first sample operation core 3351. Each of the ionization cores 3353, 3354 is also fluidically coupled to a mass analyzer comprising a MS core 3355. While not shown, a valve, interface or other device can be present between the ionization cores 3353, 3354 and the MS cores 3355 to provide species from the one of the ionization cores 3353, 3354 to the MS core 3355 at a selected time during use of the system 3350. In other configurations, the interface, valve or device can be configured to provide species from the ionization cores 3353, 3354 at the same time to the MS core 3355. In use of the system 3350, a sample can be introduced into the sample operations cores 3351, 3352, and analyte in the sample can be vaporized, separated, reacted, derivatized, sorted, modified or otherwise acted on in some manner prior to providing the analyte species to the ionization cores 3353, 3354. In some instances, the ionization cores 3353, 3354 can be configured to ionize analyte in the sample using various but different techniques. For example, in certain configurations the ionization core 3353 may be configured to ionize inorganic species, e.g., using an ICP, CCP, a microwave plasma, flame, arc, spark, etc. and provide the inorganic ions to the core 3355. In some instances, the organic ion source 3354 can ionize molecular species, e.g., to ionize organic species, prior to providing the organic ions to the MS core 3355. In certain instances, the organic ion source 3354 may comprise a FAB device. In other instances, the organic ion source 3354 may comprise an ESI or DESI device. In certain instances, the organic ion source 3354 may comprise a MALDI device. In other instances, the organic ion source 3354 may comprise an EI device. In certain instances, the organic ion source 3354 may comprise a FI device. In other instances, the organic ion source 3354 may comprise a FD device. In certain instances, the organic ion source 3354 may comprise a SI device. In other instances, the organic ion source 3354 may comprise a PD device. In certain instances, the organic ion source 3354 may comprise a TI device. In other instances, the organic ion source 3354 may comprise an EHI device. In certain instances, the organic ion source 3354 may comprise a TS device. In other instances, the organic ion source 3354 may comprise an ACPI device. In certain instances, the organic ion source 3354 may comprise a PI device. In other instances, the organic ion source 3354 may comprise a DiOS device. In other instances, the organic ion source 3354 may comprise a DART device. In other instances, another ionization source can be present in the ionization core(s) 3354 to produce/ionize elemental species, e.g., to ionize inorganic species, prior to providing the inorganic ions to the MS core 3355. In certain configurations as noted herein, the system 3300 may be configured to ionize both inorganic species and organic species using the ionization cores 3353, 3354 prior to providing the ions to the MS core 3355. The MS core(s) 3355 can be configured to filter/detect ions having a particular mass-to-charge. In some examples, the MS core 3355 can be designed to filter/select/detect inorganic ions and to filter/select/detect organic ions depending on the particular components which are present. While not shown, the mass analyzer comprising the MS core 3355 typically comprises common components used by the one, two, three or more mass spectrometer cores (MSCs) which may be present in the mass analyzer. For example, common gas controllers, processors, power supplies, detectors and vacuum pumps may be used by different mass MSCs present in the mass analyzer. The system 3300 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 3300 between any one or more of the cores of the system 3300.

Figure 34:
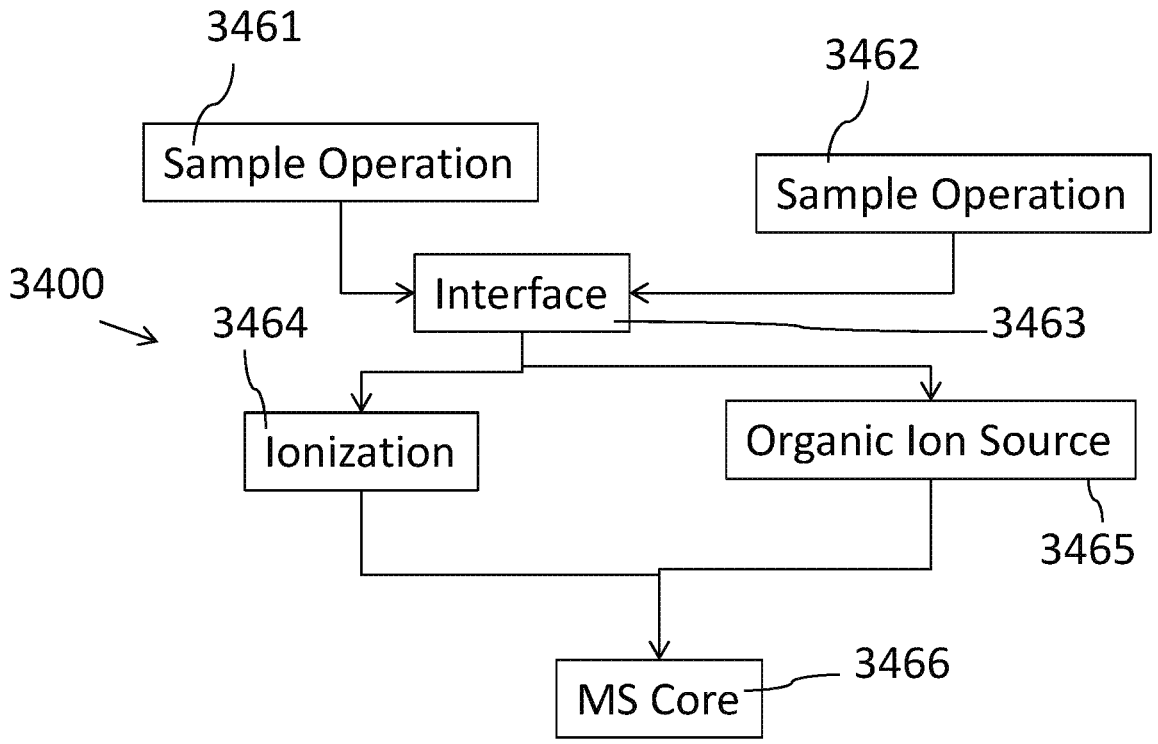
FIG. 34 is a block diagram of a system comprising two sample operation cores, an interface, two ionization cores with one ionization core comprising an organic ion source, and a MS core, in accordance with certain configurations.

In certain configurations where two or more sample operation cores are present, each sample operation may be fluidically coupled to a respective ionization core through one or more interfaces. For example and referring to FIG. 34, a system 3400 comprises a first sample operation core 3461, a second sample operation core 3462, an interface 3463, an ionization core comprising an organic ion source 3465, and a second ionization core 3464. Each of the ionization cores 3464, 3465 is also fluidically coupled to a mass analyzer comprising a MS core 3466. While not shown, a valve, interface or other device can be present between the ionization cores 3464, 3465 and the MS core 3466 to provide species from the one of the ionization cores 3464, 3465 to the MS core 3466 at a selected time during use of the system 3300. In other configurations, the interface, valve or device can be configured to provide species from the ionization cores 3464, 3465 at the same time to the MS core 3466. In use of the system 3400, a sample can be introduced into the sample operation cores 3461, 3462, and analyte in the sample can be vaporized, separated, reacted, derivatized, sorted, modified or otherwise acted on in some manner prior to providing the analyte species to the ionization cores 3464, 3465. The interface 3463 is fluidically coupled to each of the sample operation cores 3461, 3462 and can be configured to provide sample to either or both of the ionization cores 3464, 3465. In some instances, the ionization cores 3464, 3465 can be configured to ionize analyte in the sample using various but different techniques. In some examples, the core 3464 may comprise an ICP or a CCP or a microwave plasma. In other examples, the core 3464 can comprise a flame. In further examples, the core 3464 can comprise an arc. In other examples, the core 3464 can comprise a spark. In other instances, another ionization source can be present in the ionization core(s) 3465 to produce/ionize elemental species, e.g., to ionize inorganic species, prior to providing the inorganic ions to the core 3466. In certain instances, the organic ion source 3465 may comprise a FAB device. In other instances, the organic ion source 3465 may comprise an ESI or DESI device. In certain instances, the organic ion source 3465 may comprise a MALDI device. In other instances, the organic ion source 3465 may comprise an EI device. In certain instances, the organic ion source 3465 may comprise a FI device. In other instances, the organic ion source 3465 may comprise a FD device. In certain instances, the organic ion source 3465 may comprise a SI device. In other instances, the organic ion source 3465 may comprise a PD device. In certain instances, the organic ion source 3465 may comprise a TI device. In other instances, the organic ion source 3465 may comprise an EHI device. In certain instances, the organic ion source 3465 may comprise a TS device. In other instances, the organic ion source 3465 may comprise an ACPI device. In certain instances, the organic ion source 3465 may comprise a PI device. In other instances, the organic ion source 3465 may comprise a DiOS device. In other instances, the organic ion source 3465 may comprise a DART device. In certain configurations as noted herein, the system 3400 may be configured to ionize both inorganic species and organic species using the ionization cores 3464, 3465 prior to providing the ions to the MS core 3466. The sample operation cores 3461, 3462 may receive sample from the same source or from different sources. Where different sample sources are present, the interface 3463 can provide analyte from the sample operation core 3461 to either of the ionization cores 3464, 3465. Similarly, the interface 3463 can provide analyte from the sample operation core 3462 to either of the ionization cores 3464, 3465. The MS core(s) 3466 can be configured to filter/detect ions having a particular mass-to-charge. In some examples, the MS core 3466 can be designed to filter/select/detect inorganic ions and to filter/select/detect organic ions depending on the particular components which are present. While not shown, the mass analyzer comprising the MS core 3466 typically comprises common components used by the one, two, three or more mass spectrometer cores (MSCs) which may be present in the mass analyzer. For example, common gas controllers, processors, power supplies and vacuum pumps may be used by different mass MSCs present in the mass analyzer. The system 3400 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 3400 between any one or more of the cores.

Figure 35:
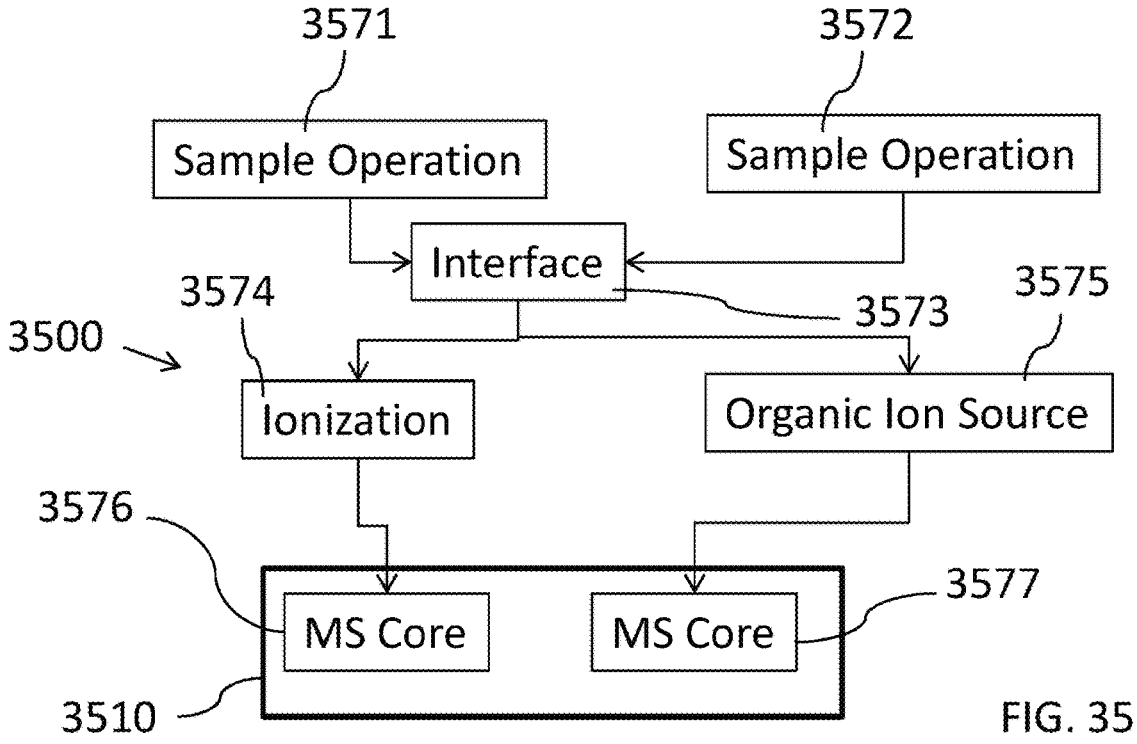
FIG. 35 is a block diagram of a system comprising two sample operation cores, an interface, two ionization cores with one ionization core comprising an organic ion source, and two MS cores, in accordance with certain examples.

In certain configurations where two or more sample operation cores are present, each sample operation may be fluidically coupled to a respective ionization core through one or more interfaces and each ionization core may comprise a respective MS core. For example and referring to FIG. 35, a system 3500 comprises a first sample operation core 3571, a second sample operation core 3572, an interface 3573, an ionization core comprising an organic ion source 3575, and a second ionization core 3574. Each of the ionization cores 3574, 3575 is also fluidically coupled to a mass analyzer 3510 comprising MS cores 3576, 3577. In use of the system 3500, a sample can be introduced into the sample operation cores 3571, 3572, and analyte in the sample can be vaporized, separated, reacted, derivatized, sorted, modified or otherwise acted on in some manner prior to providing the analyte species to the ionization cores 3574, 3575. The interface 3573 is fluidically coupled to each of the sample operation cores 3571, 3572 and can be configured to provide sample to either or both of the ionization cores 3574, 3575. In some instances, the ionization cores 3574, 3575 can be configured to ionize analyte in the sample using various but different techniques. For example, in some instances, the core 3574 can ionize elemental species, e.g., to ionize inorganic species, prior to providing the elemental ions to the core 3576. In some examples, the core 3574 comprises a CCP or a microwave plasma. In other examples, the core 3574 comprises a flame. In further examples, the core 3574 comprises an arc. In other examples, the core 3574 comprises a spark. In additional examples, the core 3574 may comprise other inorganic ionization sources. In other instances, an ionization source can be present in the ionization core(s) 3575 to produce/ionize molecular species, e.g., to ionize organic species, prior to providing the molecular ions to the core 3577. In certain instances, the organic ion source 3575 may comprise a FAB device. In other instances, the organic ion source 3575 may comprise an ESI or DESI device. In certain instances, the organic ion source 3575 may comprise a MALDI device. In other instances, the organic ion source 3577 may comprise an EI device. In certain instances, the organic ion source 3575 may comprise a FI device. In other instances, the organic ion source 3575 may comprise a FD device. In certain instances, the organic ion source 3575 may comprise a SI device. In other instances, the organic ion source 3575 may comprise a PD device. In certain instances, the organic ion source 3575 may comprise a TI device. In other instances, the organic ion source 3575 may comprise an EHI device. In certain instances, the organic ion source 3575 may comprise a TS device. In other instances, the organic ion source 3575 may comprise an ACPI device. In certain instances, the organic ion source 3575 may comprise a PI device. In other instances, the organic ion source 3575 may comprise a DiOS device. In other instances, the organic ion source 3575 may comprise a DART device. In certain configurations as noted herein, the system 3500 may be configured to ionize both inorganic species and organic species using the ionization cores 3574, 3575 prior to providing the ions to the MS cores 3576, 3577. The sample operation cores 3571, 3572 may receive sample from the same source or from different sources. Where different sample sources are present, the interface 3573 can provide analyte from the sample operation core 3571 to either of the ionization cores 3574, 3575. Similarly, the interface 3573 can provide analyte from the sample operation core 3572 to either of the ionization cores 3574, 3575. Each of the MS core(s) 3576, 3577 can be configured to filter/detect ions having a particular mass-to-charge. In some examples, either or both of the MS cores 3576, 3577 can be designed to filter/select/detect inorganic ions and to filter/select/detect organic ions depending on the particular components which are present. In some examples, the cores MS 3576, 3577 are configured differently with a different filtering device and/or detection device. While not shown, the mass analyzer 3510 typically comprises common components used by the one, two, three or more mass spectrometer cores (MSCs) which may be present in the mass analyzer 3510. For example, common gas controllers, processors, power supplies, detectors and vacuum pumps may be used by different mass MSCs present in the mass analyzer 3510. The system 3500 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 3500 between any one or more of the cores of the system 3500.

Figure 36:
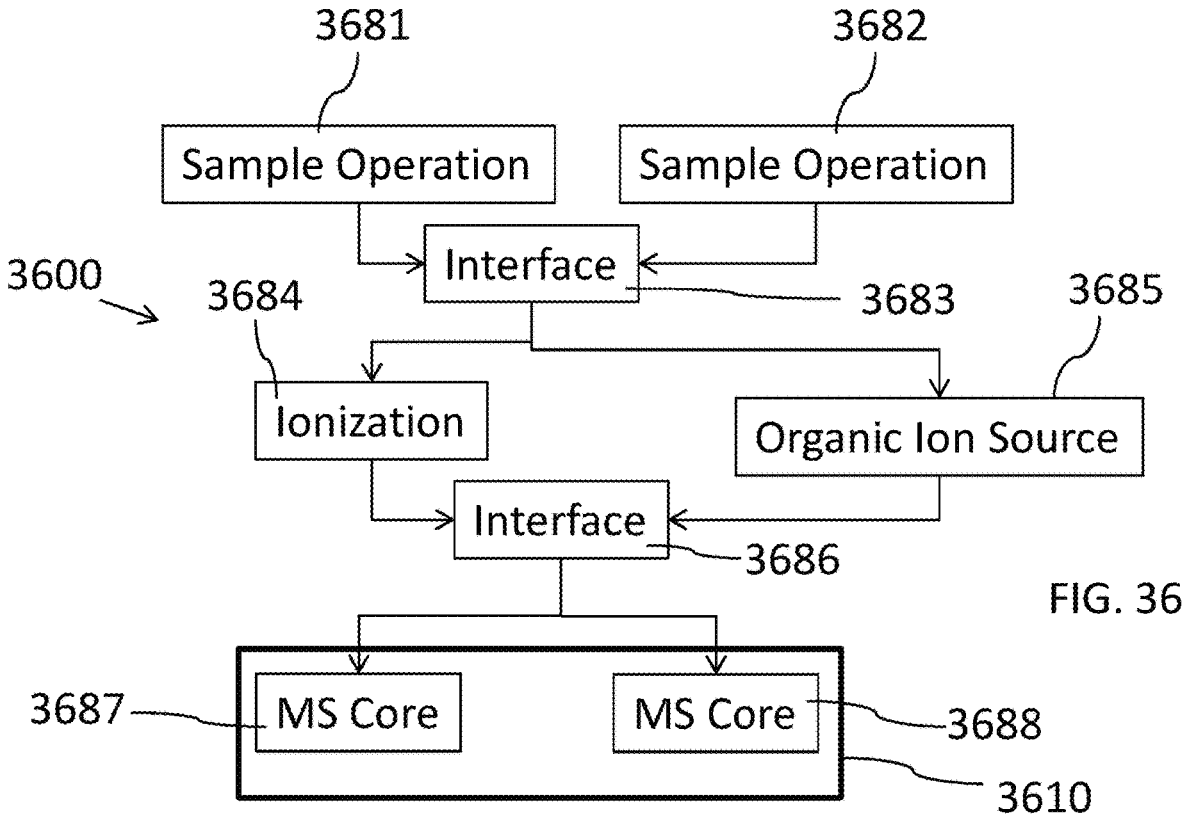
FIG. 36 is a block diagram of a system comprising two sample operation cores, an interface, two ionization cores with one ionization core comprising an organic ion source, another interface, and two MS cores, in accordance with certain examples.

In certain configurations where two or more sample operation cores are present, each sample operation may be fluidically coupled to a respective ionization core through one or more interfaces and each ionization core may be coupled to two or more MS cores through an interface. Referring to FIG. 36, a system 3600 comprises a first sample operation core 3681, a second sample operation core 3682, an interface 3683, an ionization core comprising an organic ion source 3685, and a second ionization core 3684. Each of the ionization cores 3684, 3685 is also fluidically coupled to a mass analyzer 3610 comprising MS cores 3687, 3688 through an interface 3686. In use of the system 3600, a sample can be introduced into the sample operation cores 3681, 3682, and analyte in the sample can be vaporized, separated, reacted, derivatized, sorted, modified or otherwise acted on in some manner prior to providing the analyte species to the ionization cores 3684, 3685. The interface 3683 is fluidically coupled to each of the sample operation cores 3681, 3682 and can be configured to provide sample to either or both of the ionization cores 3684, 3685. In some instances, the ionization cores 3684, 3685 can be configured to ionize analyte in the sample using various but different techniques. For example, in some instances, the core 3684 can ionize elemental species, e.g., to ionize inorganic species, prior to providing the elemental ions to the interface 3686. In some examples, the core 3684 can comprise an ICP or a CCP or a microwave plasma. In other examples, the core 3684 can comprise a flame. In further examples, the core 3684 can comprise an arc. In other examples, the core 3684 can comprise a spark. In additional examples, the core 3684 can be replaced with another inorganic ionization source. In other instances, the organic ion source 3685 can be present in the ionization core(s) 3685 to produce/ionize molecular species, e.g., to ionize organic species, prior to providing the molecular ions to the interface 3686. In certain instances, the organic ion source 3685 may comprise a FAB device. In other instances, the organic ion source 3685 may comprise an ESI or DESI device. In certain instances, the organic ion source 3685 may comprise a MALDI device. In other instances, the organic ion source 3685 may comprise an EI device. In certain instances, the organic ion source 3685 may comprise a FI device. In other instances, the organic ion source 3685 may comprise a FD device. In certain instances, the organic ion source 3685 may comprise a SI device. In other instances, the organic ion source 3685 may comprise a PD device. In certain instances, the organic ion source 3685 may comprise a TI device. In other instances, the organic ion source 3685 may comprise an EHI device. In certain instances, the organic ion source 3685 may comprise a TS device. In other instances, the organic ion source 3685 may comprise an ACPI device. In certain instances, the organic ion source 3685 may comprise a PI device. In other instances, the organic ion source 3685 may comprise a DiOS device. In other instances, the organic ion source 3685 may comprise a DART device. In certain configurations as noted herein, the system 3600 may be configured to ionize both inorganic species and organic species using the ionization cores 3684, 3685 prior to providing the ions to the interface 3686. The sample operation cores 3681, 3682 may receive sample from the same source or from different sources. Where different sample sources are present, the interface 3683 can provide analyte from the sample operation core 3681 to either of the ionization cores 3684, 3685. Similarly, the interface 3683 can provide analyte from the sample operation core 3682 to either of the ionization cores 3684, 3685. The interface 3686 can receive ions from either or both of the ionization cores 3684, 3685 and provide the received ions to one or both of the MS cores 3687, 3688. Each of the MS core(s) 3687, 3688 can be configured to filter/detect ions having a particular mass-to-charge. In some examples, either or both of the MS cores 3687, 3688 can be designed to filter/select/detect inorganic ions and to filter/ select/detect organic ions depending on the particular components which are present. In some examples, the MS cores 3687, 3688 are configured differently with a different filtering device and/or detection device. While not shown, the mass analyzer 3610 typically comprises common components used by the one, two, three or more mass spectrometer cores (MSCs) which may be present in the mass analyzer 3610. For example, common gas controllers, processors, power supplies, detectors and vacuum pumps may be used by different mass MSCs present in the mass analyzer 3610. The system 3600 can be configured to detect low atomic mass unit analytes, e.g., lithium or other elements with a mass down to as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 3600 between any one or more of the cores of the system 3600.

Figure 37:
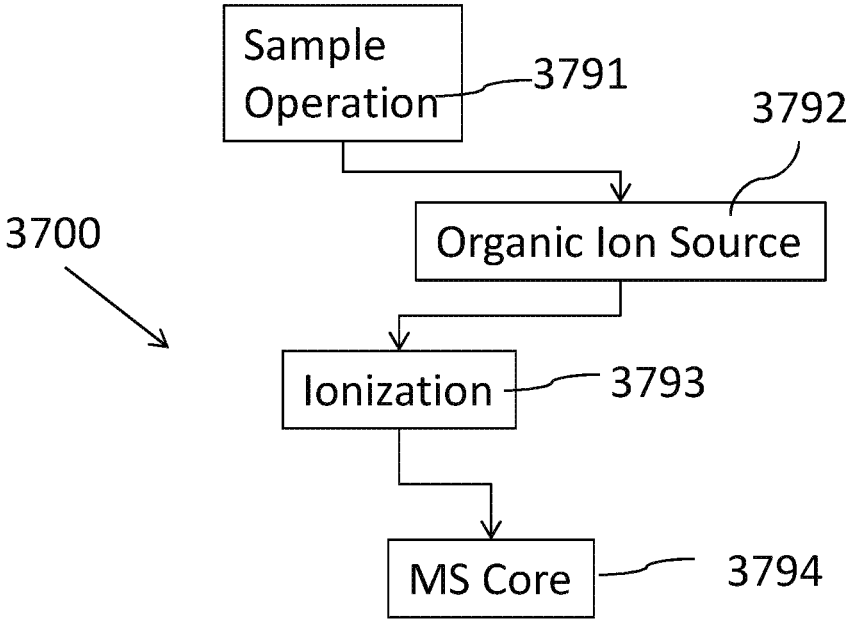
FIG. 37 is a block diagram of a system comprising a sample operation core, two serially arranged ionization cores with one ionization core comprising an organic ion source, and a MS core, in accordance with certain embodiments.

In certain configurations, one or more serially arranged ionization cores can be present and used with a sample operation. For example and referring to FIG. 37, a system 3700 is shown that comprise a sample operation core 3791 fluidically coupled to a first ionization core 3792 comprising an organic ion source. The ionization core 3792 is fluidically coupled to a second ionization core 3793, which itself is fluidically coupled to a mass analyzer comprising a MS core 3794. While not shown, a bypass line may also be present to directly couple the ionization core 3792 to the MS core 3794 if desired to permit ions to be provided directly from the core 3792 to the MS core 3794 in situations where the second ionization core 3793 is not used. Similarly, a bypass line can be present to directly couple the sample operation core 3791 to the ionization core 3793 in situations where it is not desirable to use the ionization core 3792. In use of the system 3700, a sample can be introduced into the sample operation core 3791, and analyte in the sample can be vaporized, separated, reacted, derivatized, sorted, modified or otherwise acted on in some manner prior to providing the analyte species to the core 3792. The ionization core 3792 can be configured to ionize analyte in the sample using various techniques. For example, in some instances, the organic ion source 3792 can ionize molecular species, e.g., to ionize organic species, prior to providing the organic ions to the core 3793 or the MS core 3794. In certain instances, the organic ion source 3792 may comprise a FAB device. In other instances, the organic ion source 3792 may comprise an ESI or DESI device. In certain instances, the organic ion source 3792 may comprise a MALDI device. In other instances, the organic ion source 3792 may comprise an EI device. In certain instances, the organic ion source 3792 may comprise a FI device. In other instances, the organic ion source 3792 may comprise a FD device. In certain instances, the organic ion source 3792 may comprise a SI device. In other instances, the organic ion source 3792 may comprise a PD device. In certain instances, the organic ion source 3792 may comprise a TI device. In other instances, the organic ion source 3792 may comprise an EHI device. In certain instances, the organic ion source 3792 may comprise a TS device. In other instances, the organic ion source 3792 may comprise an ACPI device. In certain instances, the organic ion source 3792 may comprise a PI device. In other instances, the organic ion source 3792 may comprise a DiOS device. In other instances, the organic ion source 3792 may comprise a DART device. In other instances, another ionization source can be present in the ionization core 3792 to produce/ionize elemental species, e.g., to ionize inorganic species, prior to providing the inorganic ions to the core 3793 or the core 3794. The ionization core 3793 can be configured to ionize analyte in the sample using various techniques, which may be the same of different from those used by the core 3792. For example, in some instances, an ionization source can be present in the ionization core 3793 to ionize elemental species, e.g., to ionize inorganic species, prior to providing the elemental ions to the MS core 3794. In other instances, an ionization source can be present in the ionization core 3793 to produce/ionize molecular species, e.g., to ionize organic species, prior to providing the molecular ions to the MS core 3794. In certain configurations as noted herein, the system 3700 may be configured to ionize inorganic species and organic species prior to providing the ions to the MS core 3794. The MS core(s) 3794 can be configured to filter/detect ions having a particular mass-to-charge. In some examples, the MS core 3794 can be designed to filter/select/detect inorganic ions and to filter/select/detect organic ions depending on the particular components which are present. While not shown, the mass analyzer comprising the MS core 3794 typically comprises common components used by the one, two, three or more mass spectrometer cores (MSCs) which may be present in the mass analyzer. For example, common gas controllers, processors, power supplies, detectors and vacuum pumps may be used by different mass MSCs present in the mass analyzer. The system 3700 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 3700 between any one or more of the cores of the system 3700. In some instances, any of the systems described and shown in FIGS. 27-36 may comprise a serial arrangement of ionization cores similar to the cores 3792, 3793 shown in FIG. 37.

Figure 38:
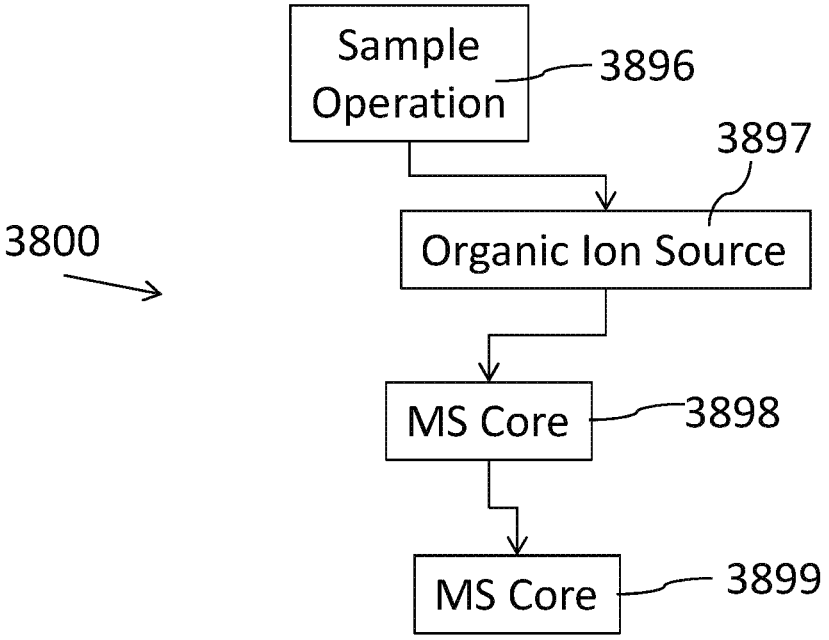
FIG. 38 is a block diagram a system comprising a sample operation core, an ionization core comprising an organic ion source, and two serially arranged MS cores, in accordance with certain embodiments.

In certain configurations, one or more serially arranged MS cores can be present in the systems described herein. For example and referring to FIG. 38, a system 3800 is shown that comprises a sample operation core 3896 fluidically coupled to an ionization core comprising an organic ion source 3897. The ionization core 3897 is fluidically coupled to a mass analyzer comprising a first MS core 3898, which itself is fluidically coupled to a second MS core 3899 of the mass analyzer. While not shown, a bypass line may also be present to directly couple the ionization core 3897 to the MS core 3899 if desired to permit ions to be provided directly from the core 3897 to the MS core 3899 in situations where the first MS core 3898 is not used. In use of the system 3800, a sample can be introduced into the sample operation core 3896, and analyte in the sample can be vaporized, separated, reacted, derivatized, sorted, modified or otherwise acted on in some manner prior to providing the analyte species to the ionization core 3897. The ionization core 3897 can be configured to ionize analyte in the sample using various techniques. For example, in some instances, the organic ion source 3897 can ionize molecular species, e.g., ionize organic species, prior to providing the organic ions to the core 3898. In certain instances, the organic ion source 3897 may comprise a FAB device. In other instances, the organic ion source 3897 may comprise an ESI or DESI device. In certain instances, the organic ion source 3897 may comprise a MALDI device. In other instances, the organic ion source 3897 may comprise an EI device. In certain instances, the organic ion source 3897 may comprise a FI device. In other instances, the organic ion source 3897 may comprise a FD device. In certain instances, the organic ion source 3897 may comprise a SI device. In other instances, the organic ion source 3897 may comprise a PD device. In certain instances, the organic ion source 3897 may comprise a TI device. In other instances, the organic ion source 3897 may comprise an EHI device. In certain instances, the organic ion source 3897 may comprise a TS device. In other instances, the organic ion source 3897 may comprise an ACPI device. In certain instances, the organic ion source 3897 may comprise a PI device. In other instances, the organic ion source 3897 may comprise a DiOS device. In other instances, the organic ion source 3897 may comprise a DART device. In other instances, another ionization source can be present in the ionization core 3897 to produce/ionize elemental species, e.g., ionize inorganic species, prior to providing the inorganic ions to the MS core 3898. In certain configurations as noted herein, the system 3800 may be configured to ionize inorganic species and organic species prior to providing the ions to the MS core 3898. The MS core 3898 can be configured to filter/detect ions having a particular mass-to-charge. In some examples, the core 3898 can be designed to filter/select/detect inorganic ions and to filter/select/detect organic ions depending on the particular components which are present. Similarly, the MS core 3899 can be configured to filter/detect ions having a particular mass-to-charge. In some examples, the MS core 3899 can be designed to filter/select/detect inorganic ions and to filter/select/detect organic ions depending on the particular components which are present. While not shown, the mass analyzer comprising the MS cores 3898, 3899 typically comprises common components used by the one, two, three or more mass spectrometer cores (MSCs) which may be present in the mass analyzer. For example, common gas controllers, processors, power supplies, detectors and vacuum pumps may be used by different mass MSCs present in the mass analyzer. The system 3800 can be configured to detect low atomic mass unit analytes, e.g., lithium or other elements with a mass as low as three, four or five amu's, and/or to detect high atomic mass unit analytes, e.g., molecular ion species with a mass up to about 2000 amu's. While not shown, various other components such as sample introduction devices, ovens, pumps, etc. may also be present in the system 3800 between any one or more of the cores of the system 3800. In some instances, any of the systems described and shown in FIGS. 27-37 may comprise a serial arrangement of MS cores similar to the cores 3898, 3899 shown in FIG. 38.

Figure 39:
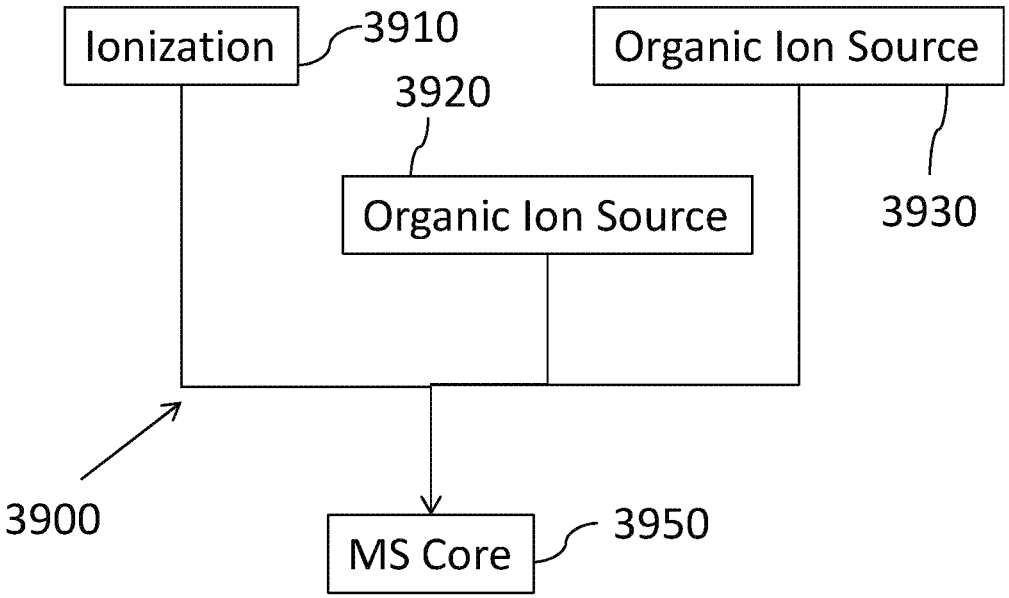
FIG. 39 is a block diagram of a system comprising three ionization cores, in accordance with certain examples.

In certain examples, the systems described herein may comprise more than two ionization cores. Referring to FIG. 39, a system 3900 is shown comprising ionization cores 3910, 3920, and 3930 each fluidically coupled to a mass analyzer comprising a MS core 3950. The ionization core 3910 may be configured to provide inorganic ions to the core 3950. In some examples, the core 3910 can comprise an ICP or a CCP or a microwave plasma. In other examples, the core 3910 can comprise a flame. In further examples, the core 3910 can comprise an arc. In other examples, the core 3910 can comprise a spark. In additional examples, the core 3910 can be replaced with another inorganic ionization source. In other instances, each of the organic ion sources 3920, 3930 can be present in the ionization core(s) to produce/ionize molecular species, e.g., to ionize organic species, prior to providing the molecular ions to the interface 3686. In certain instances, the organic ion sources 3920, 3930 may independently comprise a FAB device. In other instances, the organic ion sources 3920, 3930 may independently comprise an ESI or DESI device. In certain instances, the organic ion sources 3920, 3930 may independently comprise a MALDI device. In other instances, the organic ion sources 3920, 3930 may independently comprise an EI device. In certain instances, the organic ion sources 3920, 3930 may independently comprise a FI device. In other instances, the organic ion sources 3920, 3930 may independently comprise a FD device. In certain instances, the organic ion sources 3920, 3930 may independently comprise a SI device. In other instances, the organic ion sources 3920, 3930 may independently comprise a PD device. In certain instances, the organic ion sources 3920, 3930 may independently comprise a TI device. In other instances, the organic ion sources 3920, 3930 may independently comprise an EHI device. In certain instances, the organic ion sources 3920, 3930 may independently comprise a TS device. In other instances, the organic ion sources 3920, 3930 may independently comprise an ACPI device. In certain instances, the organic ion sources 3920, 3930 may independently comprise a PI device. In other instances, the organic ion sources 3920, 3930 may independently comprise a DiOS device. In other instances, the organic ion sources 3920, 3930 may independently comprise a DART device. The MS core 3950 may take the form of any of the MSCs described herein. While not shown, the mass analyzer comprising the MS core 3950 typically comprises common components used by the one, two, three or more mass spectrometer cores (MSCs) which may be present in the mass analyzer. For example, common gas controllers, processors, power supplies, detectors and vacuum pumps may be used by different mass MSCs present in the mass analyzer. The system 3900 can be configured to detect low atomic mass unit analytes, e.g., lithium or other elements with a mass as low as three, four or five amu's, and/or to detect high atomic mass unit analytes, e.g., molecular ion species with a mass up to about 2000 amu's.

Figure 40:
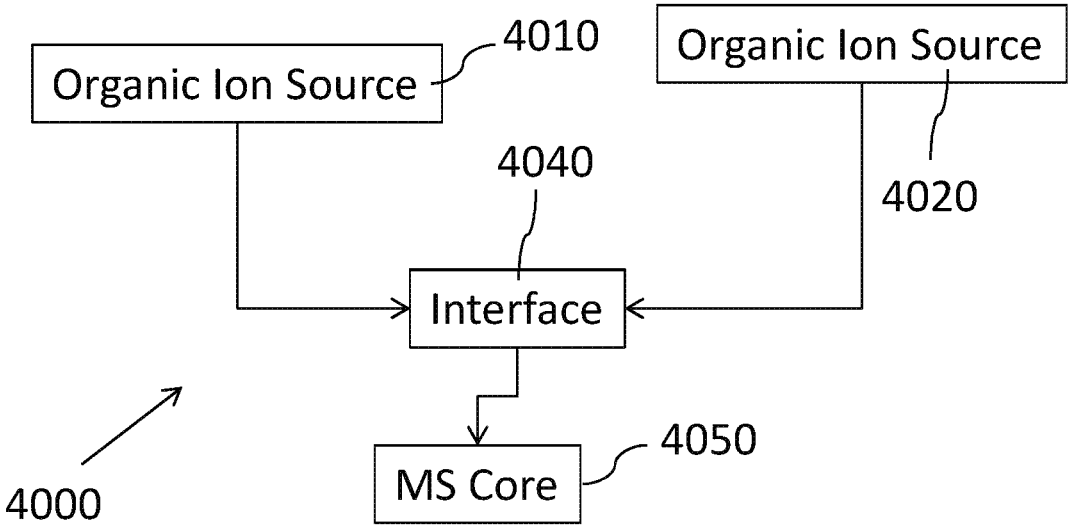
FIG. 40 is a block diagram of a system comprising two organic ion sources, in accordance with certain examples.

In certain examples, the systems described herein may comprise more than two ionization cores. Referring to FIG. 40, a system 400 is shown comprising ionization cores 4010, 4020 each of which comprises an organic ion source. In certain instances, the organic ion sources 4010, 4020 may independently comprise a FAB device. In other instances, the organic ion sources 4010, 4020 may independently comprise an ESI or DESI device. In certain instances, the organic ion sources 4010, 4020 may independently comprise a MALDI device. In other instances, the organic ion sources 4010, 4020 may independently comprise an EI device. In certain instances, the organic ion sources 4010, 4020 may independently comprise a FI device. In other instances, the organic ion sources 4010, 4020 may independently comprise a FD device. In certain instances, the organic ion sources 4010, 4020 may independently comprise a SI device. In other instances, the organic ion sources 4010, 4020 may independently comprise a PD device. In certain instances, the organic ion sources 4010, 4020 may independently comprise a TI device. In other instances, the organic ion sources 4010, 4020 may independently comprise an EHI device. In certain instances, the organic ion sources 4010, 4020 may independently comprise a TS device. In other instances, the organic ion sources 4010, 4020 may independently comprise an ACPI device. In certain instances, the organic ion sources 4010, 4020 may independently comprise a PI device. In other instances, the organic ion sources 4010, 4020 may independently comprise a DiOS device. In other instances, the organic ion sources 4010, 4020 may independently comprise a DART device. The interface 4030 is configured to receive ions from the two organic ion sources 4010, 4020 and can combine the ions prior to providing them to a mass analyzer comprising a MS core 4050. The MS core 4050 may take the form of any of the MSCs described herein. While not shown, the mass analyzer of the MS core 4050 typically comprises common components used by the one, two, three or more mass spectrometer cores (MSCs) which may be present in the mass analyzer. For example, common gas controllers, processors, power supplies, detectors and vacuum pumps may be used by different mass MSCs present in the mass analyzer. The system 4000 can be configured to detect low atomic mass unit analytes, e.g., lithium or other elements with a mass as low as three, four or five amu's, and/or to detect high atomic mass unit analytes, e.g., molecular ion species with a mass up to about 2000 amu's.

Figure 41:
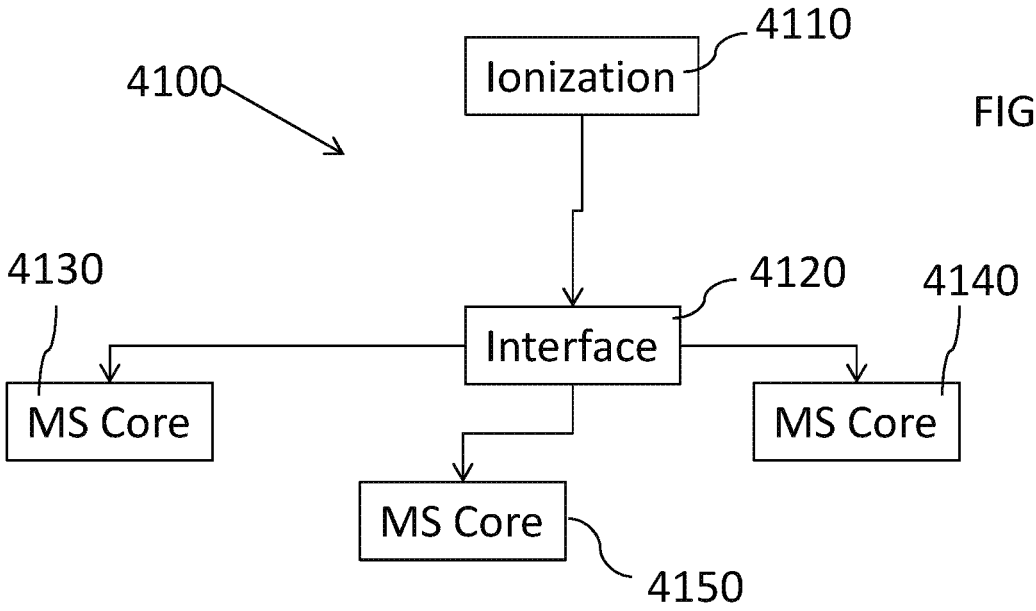
FIG. 41 is a block diagram of a system comprising three mass analyzers, in accordance with certain examples.

In some examples, more than two MS cores can be present in the systems described herein. Referring to FIG. 41, a system 4100 is shown comprising an ionization core 4110, an interface 4120 and a mass analyzer comprising three MS cores 4130, 4140 and 4150. The ionization core 4110 may comprise any of the ionization sources described herein, e.g., inorganic and/or organic ion sources. The interface 4130 can be configured to provide ions to one, two or three of the MS cores 4130, 4140, 4150 during any particular analysis period. Each of the MS cores 4130, 4140, 4150 may independently take the form of any of the MS cores described herein, e.g., single MS cores or a dual core MS. While not shown, the mass analyzer comprising the MS cores 4130, 4140, 4150 typically comprises common components used by the one, two, three or more mass spectrometer cores (MSCs) which may be present in the mass analyzer. For example, common gas controllers, processors, power supplies, detectors and vacuum pumps may be used by different mass MSCs present in the mass analyzer. The system 4100 can be configured to detect low atomic mass unit analytes, e.g., lithium or other elements with a mass as low as three, four or five amu's, and/or to detect high atomic mass unit analytes, e.g., molecular ion species with a mass up to about 2000 amu's.

While certain sources have been described which can provide organic ions, other sources that can provide organic ions, e.g., photoionization sources, desorption ionization sources, spray ionization sources, etc., could instead be used. Further, two or more different organic ionization sources can be present in any single instrument if desired. As noted herein, the organic ionization source can be present in combination with an inorganic ionization source to permit analysis of both inorganic and organic analytes in a sample. In some embodiments where two ionization cores are present, one of the ionization cores comprises a plasma source and the other ionization core comprises a FAB source. In other embodiments where two ionization cores are present, one of the ionization cores comprises a plasma source and the other ionization core comprises an ESI source. In some examples where two ionization cores are present, one of the ionization cores comprises a plasma source and the other ionization core comprises an EI source. In some embodiments where two ionization cores are present, one of the ionization cores comprises a plasma source and the other ionization core comprises a MALDI source. In other embodiments where two ionization cores are present, one of the ionization cores comprises a plasma source and the other ionization core comprises a CI source. In some examples where two ionization cores are present, one of the ionization cores comprises a plasma source and the other ionization core comprises an FI source. In some embodiments where two ionization cores are present, one of the ionization cores comprises a plasma source and the other ionization core comprises a FD source. In other embodiments where two ionization cores are present, one of the ionization cores comprises a plasma source and the other ionization core comprises a SI source. In some examples where two ionization cores are present, one of the ionization cores comprises a plasma source and the other ionization core comprises a PD source. In some embodiments where two ionization cores are present, one of the ionization cores comprises a plasma source and the other ionization core comprises a TI source. In other embodiments where two ionization cores are present, one of the ionization cores comprises a plasma source and the other ionization core comprises an EHI source. In some examples where two ionization cores are present, one of the ionization cores comprises a plasma source and the other ionization core comprises an APCI source. In some embodiments where two ionization cores are present, one of the ionization cores comprises a plasma source and the other ionization core comprises a PI source. In other embodiments where two ionization cores are present, one of the ionization cores comprises a plasma source and the other ionization core comprises a DiOS source. In some examples where two ionization cores are present, one of the ionization cores comprises a plasma source and the other ionization core comprises a DART source.

In some embodiments where two ionization cores are present, one of the ionization cores comprises an ICP source and the other ionization core comprises a FAB source. In other embodiments where two ionization cores are present, one of the ionization cores comprises an ICP source and the other ionization core comprises an ESI source. In some examples where two ionization cores are present, one of the ionization cores comprises an ICP source and the other ionization core comprises an EI source. In some embodiments where two ionization cores are present, one of the ionization cores comprises an ICP source and the other ionization core comprises a MALDI source. In other embodiments where two ionization cores are present, one of the ionization cores comprises an ICP source and the other ionization core comprises a CI source. In some examples where two ionization cores are present, one of the ionization cores comprises an ICP source and the other ionization core comprises an FI source. In some embodiments where two ionization cores are present, one of the ionization cores comprises an ICP source and the other ionization core comprises a FD source. In other embodiments where two ionization cores are present, one of the ionization cores comprises an ICP source and the other ionization core comprises a SI source. In some examples where two ionization cores are present, one of the ionization cores comprises an ICP source and the other ionization core comprises a PD source. In some embodiments where two ionization cores are present, one of the ionization cores comprises an ICP source and the other ionization core comprises a TI source. In other embodiments where two ionization cores are present, one of the ionization cores comprises an ICP source and the other ionization core comprises an EHI source. In some examples where two ionization cores are present, one of the ionization cores comprises an ICP source and the other ionization core comprises an APCI source. In some embodiments where two ionization cores are present, one of the ionization cores comprises an ICP source and the other ionization core comprises a PI source. In other embodiments where two ionization cores are present, one of the ionization cores comprises an ICP source and the other ionization core comprises a DiOS source. In some examples where two ionization cores are present, one of the ionization cores comprises an ICP source and the other ionization core comprises a DART source.

In some embodiments where two ionization cores are present, one of the ionization cores comprises a CCP source or a microwave plasma and the other ionization core comprises a FAB source. In other embodiments where two ionization cores are present, one of the ionization cores comprises a CCP source or a microwave plasma and the other ionization core comprises an ESI source. In some examples where two ionization cores are present, one of the ionization cores comprises a CCP source or a microwave plasma and the other ionization core comprises an EI source. In some embodiments where two ionization cores are present, one of the ionization cores comprises a CCP source or a microwave plasma and the other ionization core comprises a MALDI source. In other embodiments where two ionization cores are present, one of the ionization cores comprises a CCP source or a microwave plasma and the other ionization core comprises a CI source. In some examples where two ionization cores are present, one of the ionization cores comprises a CCP source or a microwave plasma and the other ionization core comprises an FI source. In some embodiments where two ionization cores are present, one of the ionization cores comprises a CCP source or a microwave plasma and the other ionization core comprises a FD source. In other embodiments where two ionization cores are present, one of the ionization cores comprises a CCP source or a microwave plasma and the other ionization core comprises a SI source. In some examples where two ionization cores are present, one of the ionization cores comprises a CCP source or a microwave plasma and the other ionization core comprises a PD source. In some embodiments where two ionization cores are present, one of the ionization cores comprises a CCP source or a microwave plasma and the other ionization core comprises a TI source. In other embodiments where two ionization cores are present, one of the ionization cores comprises a CCP source or a microwave plasma and the other ionization core comprises an EHI source. In some examples where two ionization cores are present, one of the ionization cores comprises a CCP source or a microwave plasma and the other ionization core comprises an APCI source. In some embodiments where two ionization cores are present, one of the ionization cores comprises a CCP source or a microwave plasma and the other ionization core comprises a PI source. In other embodiments where two ionization cores are present, one of the ionization cores comprises a CCP source or a microwave plasma and the other ionization core comprises a DiOS source. In some examples where two ionization cores are present, one of the ionization cores comprises a CCP source or a microwave plasma and the other ionization core comprises a DART source.

In some embodiments where two ionization cores are present, one of the ionization cores comprises a flame source and the other ionization core comprises a FAB source. In other embodiments where two ionization cores are present, one of the ionization cores comprises a flame source and the other ionization core comprises an ESI source. In some examples where two ionization cores are present, one of the ionization cores comprises a flame source and the other ionization core comprises an EI source. In some embodiments where two ionization cores are present, one of the ionization cores comprises a flame source and the other ionization core comprises a MALDI source. In other embodiments where two ionization cores are present, one of the ionization cores comprises a flame source and the other ionization core comprises a CI source. In some examples where two ionization cores are present, one of the ionization cores comprises a flame source and the other ionization core comprises an FI source. In some embodiments where two ionization cores are present, one of the ionization cores comprises a flame source and the other ionization core comprises a FD source. In other embodiments where two ionization cores are present, one of the ionization cores comprises a flame source and the other ionization core comprises a SI source. In some examples where two ionization cores are present, one of the ionization cores comprises a flame source and the other ionization core comprises a PD source. In some embodiments where two ionization cores are present, one of the ionization cores comprises a flame source and the other ionization core comprises a TI source. In other embodiments where two ionization cores are present, one of the ionization cores comprises a flame source and the other ionization core comprises an EHI source. In some examples where two ionization cores are present, one of the ionization cores comprises a flame source and the other ionization core comprises an APCI source. In some embodiments where two ionization cores are present, one of the ionization cores comprises a flame source and the other ionization core comprises a PI source. In other embodiments where two ionization cores are present, one of the ionization cores comprises a flame source and the other ionization core comprises a DiOS source. In some examples where two ionization cores are present, one of the ionization cores comprises a flame source and the other ionization core comprises a DART source.

In some embodiments where two ionization cores are present, one of the ionization cores comprises an arc source and the other ionization core comprises a FAB source. In other embodiments where two ionization cores are present, one of the ionization cores comprises an arc source and the other ionization core comprises an ESI source. In some examples where two ionization cores are present, one of the ionization cores comprises an arc source and the other ionization core comprises an EI source. In some embodiments where two ionization cores are present, one of the ionization cores comprises an arc source and the other ionization core comprises a MALDI source. In other embodiments where two ionization cores are present, one of the ionization cores comprises an arc source and the other ionization core comprises a CI source. In some examples where two ionization cores are present, one of the ionization cores comprises an arc source and the other ionization core comprises an FI source. In some embodiments where two ionization cores are present, one of the ionization cores comprises an arc source and the other ionization core comprises a FD source. In other embodiments where two ionization cores are present, one of the ionization cores comprises an arc source and the other ionization core comprises a SI source. In some examples where two ionization cores are present, one of the ionization cores comprises an arc source and the other ionization core comprises a PD source. In some embodiments where two ionization cores are present, one of the ionization cores comprises an arc source and the other ionization core comprises a TI source. In other embodiments where two ionization cores are present, one of the ionization cores comprises an arc source and the other ionization core comprises an EHI source. In some examples where two ionization cores are present, one of the ionization cores comprises an arc source and the other ionization core comprises an APCI source. In some embodiments where two ionization cores are present, one of the ionization cores comprises an arc source and the other ionization core comprises a PI source. In other embodiments where two ionization cores are present, one of the ionization cores comprises an arc source and the other ionization core comprises a DiOS source. In some examples where two ionization cores are present, one of the ionization cores comprises an arc source and the other ionization core comprises a DART source.

In some embodiments where two ionization cores are present, one of the ionization cores comprises a spark source and the other ionization core comprises a FAB source. In other embodiments where two ionization cores are present, one of the ionization cores comprises a spark source and the other ionization core comprises an ESI source. In some examples where two ionization cores are present, one of the ionization cores comprises a spark source and the other ionization core comprises an EI source. In some embodiments where two ionization cores are present, one of the ionization cores comprises a spark source and the other ionization core comprises a MALDI source. In other embodiments where two ionization cores are present, one of the ionization cores comprises a spark source and the other ionization core comprises a CI source. In some examples where two ionization cores are present, one of the ionization cores comprises a spark source and the other ionization core comprises an FI source. In some embodiments where two ionization cores are present, one of the ionization cores comprises a spark source and the other ionization core comprises a FD source. In other embodiments where two ionization cores are present, one of the ionization cores comprises a spark source and the other ionization core comprises a SI source. In some examples where two ionization cores are present, one of the ionization cores comprises a spark source and the other ionization core comprises a PD source. In some embodiments where two ionization cores are present, one of the ionization cores comprises a spark source and the other ionization core comprises a TI source. In other embodiments where two ionization cores are present, one of the ionization cores comprises a spark source and the other ionization core comprises an EHI source. In some examples where two ionization cores are present, one of the ionization cores comprises a spark source and the other ionization core comprises an APCI source. In some embodiments where two ionization cores are present, one of the ionization cores comprises a spark source and the other ionization core comprises a PI source. In other embodiments where two ionization cores are present, one of the ionization cores comprises a spark source and the other ionization core comprises a DiOS source. In some examples where two ionization cores are present, one of the ionization cores comprises a spark source and the other ionization core comprises a DART source.

Mass Analyzers, Mass Spectrometer Cores and Detectors

Figure 42:
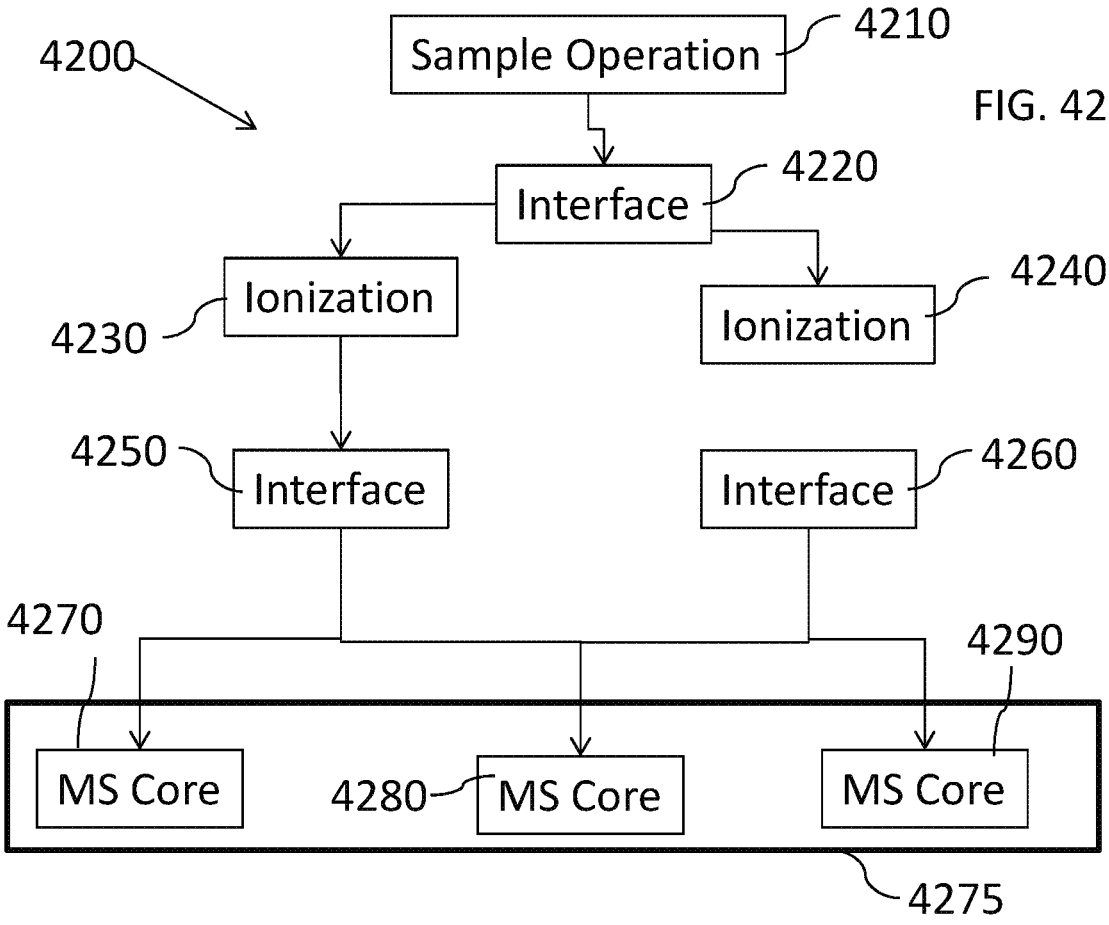
FIG. 42 is a block diagram of a system comprising three or more spectrometer cores, in accordance with certain embodiments.

In certain configurations, the systems described herein may comprise one or more mass spectrometer cores present in a mass analyzer. The mass spectrometer cores may be considered a single core (SC), e.g., can filter inorganic ions or organic ions, or may be considered a dual core (DC), e.g., can filter both inorganic ions and organic ions depending on the conditions used. Referring to FIG. 42, a system 4200 is shown comprising a sample operation core 4210, an interface 4220, a first ionization core 4230, a second ionization core 4240, interfaces 4250 and 4260, and a mass analyzer 4275 comprising MS cores 4270, 4280 and 4290. As discussed in more detail below, the MS cores 4270, 4280 and 4290 may independently comprise a single MS core or a dual core MS. In some examples, the cores 4270, 4290 comprise single MS cores and the core 4280 comprises a dual core MS. The interfaces 4250, 4260 can be configured to provide ions to a respective one of the single MS cores 4270, 4280 or can provide ions to the dual core MS 4280 if desired. In this configuration, use of two single M cores or use of a single, dual core MS can be implemented depending on the particular analyses to be performed. The ionization cores 4230, 4240 can be any of those described herein, and in some instances one of the cores 4230, 4240 comprises an inorganic ion source and the other of the cores 4230, 4240 comprises an organic ion source. The sample operation core 4210 may take numerous forms including an LC, GC, etc. as desired. The interfaces 4220 and 4250, 4260 can take numerous forms as noted herein. In some examples, a single interface may be present and replace the two interfaces 4250, 4260.

Figure 43A:
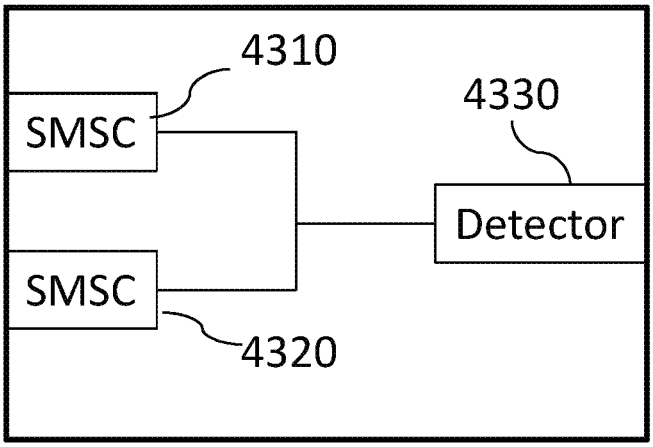
FIGS. 43A and 43B are block diagrams of MS cores comprising two single core mass spectrometers, in accordance with certain examples.
Figure 43B:
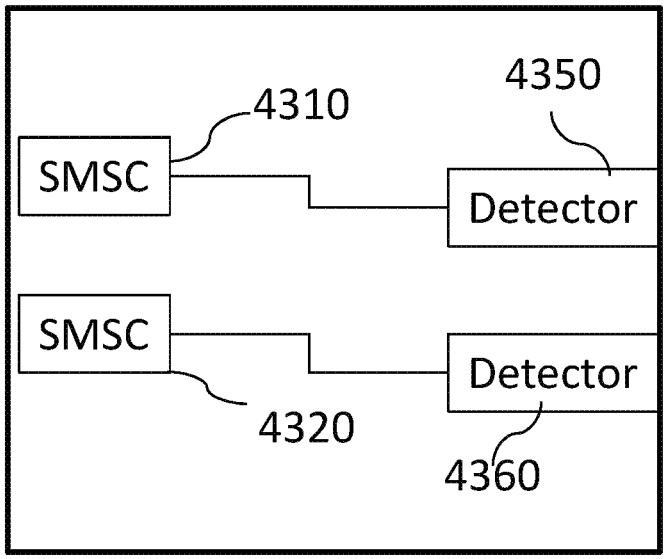

In some examples and referring to FIG. 43A, a mass analyzer may comprise a first single MS core 4310 and a second single MS core 4320. Each of the single MS cores (SMSC) devices 4310, 4320 may be fluidically coupled to a respective ionization core (not shown) to receive ions. The SMSC's 4310, 4320 may be fluidically coupled to a common detector 4330 or can be fluidically coupled to a respective detector 4350, 4360 as shown in FIG. 43B. For example, one of the SMSC's 4310, 4320 can provide ions to the detector 4330 during any particular analysis period. In some configurations, the SMSC 4310 can be configured to receive and select inorganic ions, and the SMSC 4320 can be configured to receive and select organic ions. Where a common detector 4330 is present, the ions from the different SMSC's 4310, 4320 can be sequentially provided to the detector 4330. For example, an interface can be present between the SMSC's 4310, 4320 and the detector 4330 to control the flow of ions in the system. Illustrative interfaces are described in more detail below. Where the two detectors 4350, 4360 are present (see FIG. 43B), simultaneous detection of the inorganic ions and the organic ions may occur. The exact configuration of the detectors 4330, 4350 and 4360 may vary as discussed in more detail below.

Figure 44A:
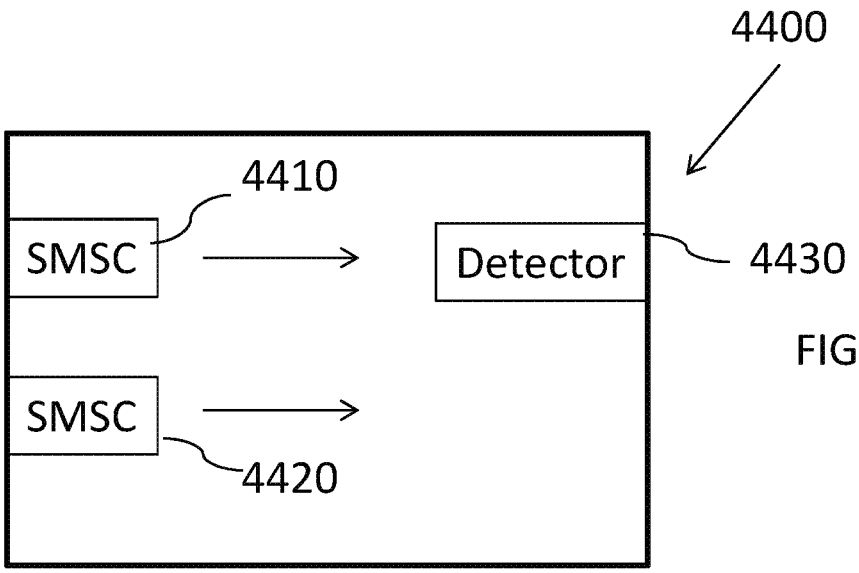
FIGS. 44A and 44B are block diagrams of MS cores comprising two single core mass spectrometers and a detector which can be moved, in accordance with certain examples.
Figure 44B:
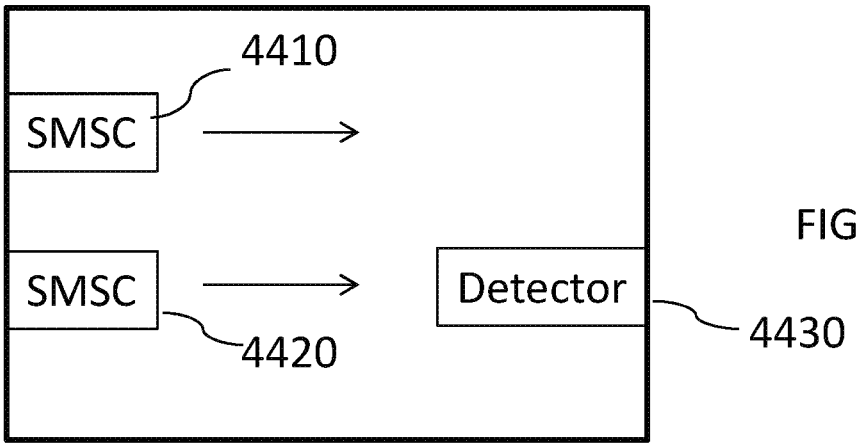

In some examples, one or more of the SMSC's 4310, 4320 or the detector 4330 (or both) can be moved in some direction, e.g., in one, two or three dimensions, to fluidically couple/decouple the SMSC's 4310, 4320 to the detector 4330. For example and referring to FIGS. 44A and 44B, a SMSC 4410 is fluidically coupled to a detector 4430 in a first position of the detector 4430 (see FIG. 44A). The detector 4430 can be moved, e.g., using a stepper motor or other device, to a second position as shown in FIG. 44B. When in the second position, the detector 4430 is fluidically coupled to the SMSC 4420 and fluidically decoupled from the SMSC 4410. In use of the system 4400, the SMSC 4410 can be configured to select/filter inorganic ions and provide them to the detector 4430 when the detector is present in the first position as shown in FIG. 44A. The SMSC 4420 can be configured to select/filter organic ions and provide them to the detector 4430 when the detector is present in the second position as shown in FIG. 44B. Alternatively, the SMSC's 4410, 4420 could each be configured to select inorganic ions or organic ions as desired. In some examples, one of the SMSC's 4410, 4420 comprises a single multipole, a double multipole, a triple multipole or other arrangements of poles as discussed in more detail below. In other examples, each of the SMSC's 4410, 4420 independently comprises a single multipole, a double multipole, a triple multipole or other arrangements of poles as discussed herein. The exact configuration of the detector 4430 may vary as discussed in more detail below.

Figure 45A:
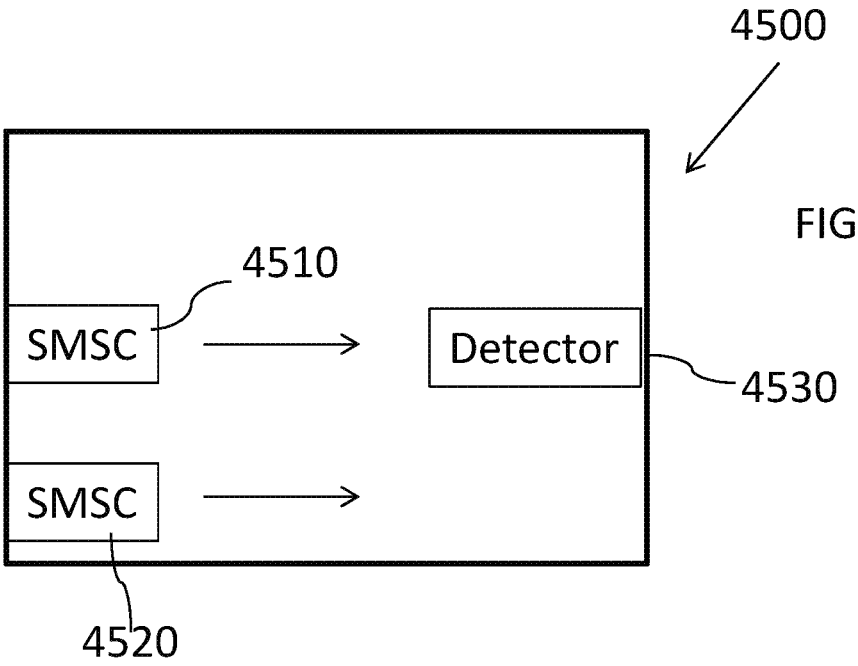
FIGS. 45A and 45B are block diagrams of MS cores comprising two single core mass spectrometers which can be moved, in accordance with certain embodiments.
Figure 45B:
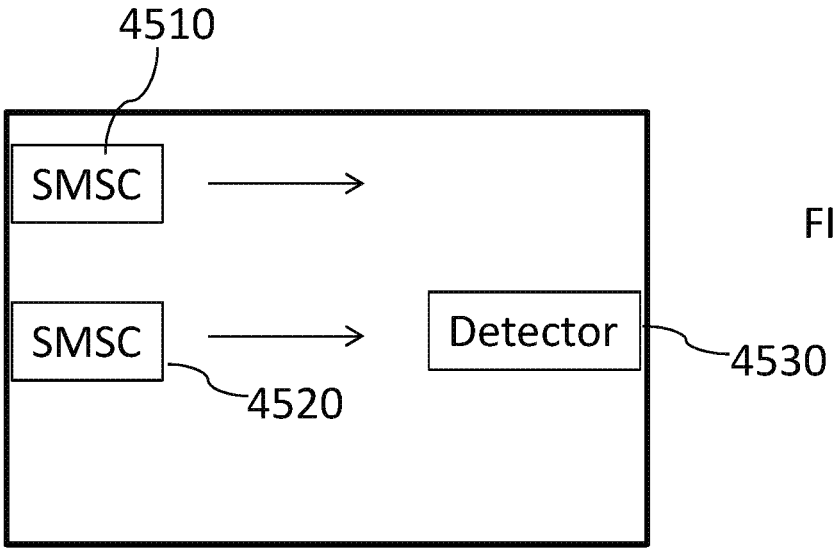

In another configuration, the MS core may comprise a single detector and two or more SMSC's which can be moved. Referring to FIGS. 45A and 45B, a system 4500, e.g. mass analyzer, comprises a first SMSC 4510 and a second SMSC 4520. A detector 4530 is shown in a first position in FIG. 45A, where it is fluidically coupled to the SMSC 4510 and fluidically decoupled from the SMSC 4520. The SMSC's 4510, 4520 can be moved to a second position as shown in FIG. 45B so that the SMSC 4520 is fluidically coupled to the detector 4530 and the SMSC 4510 is fluidically decoupled from the detector 4530. The exact configuration of the detector 4530 may vary as discussed in more detail below. In some instances as noted herein, the various components can be present on a carousel such that circumferential rotation of the components can fluidically couple or decouple the components as desired. For example, circumferential rotation by ninety degrees can align a first SMSC with a detector, and circumferential rotation by another ninety degrees can align a second SMSC with the detector. If desired, sample operation cores can also be present on a carousel to permit coupling/decoupling of a particular sample operation core with an ionization core.

Figure 46A:
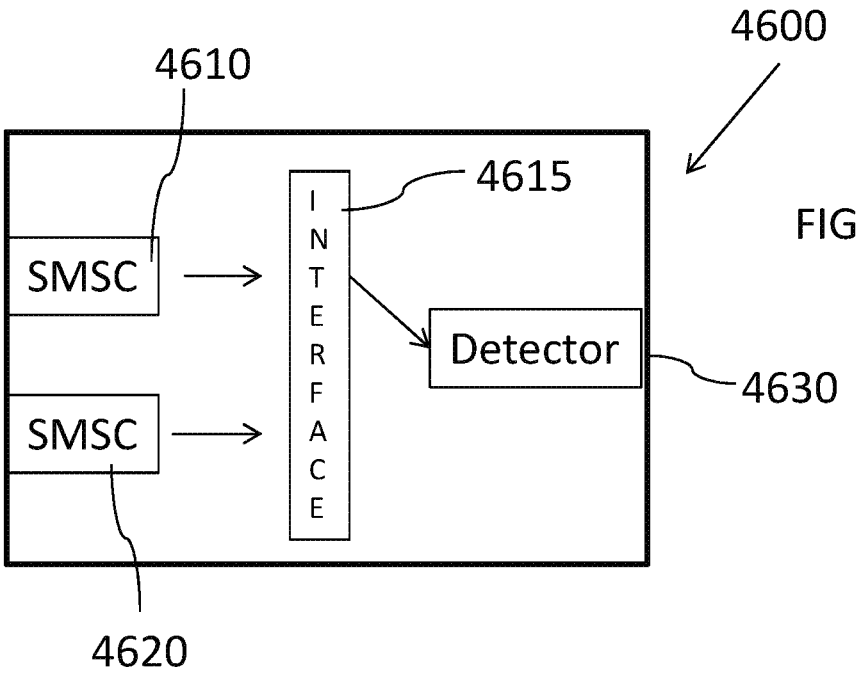
FIGS. 46A and 46B are block diagrams of MS cores comprising two single core mass spectrometers, an interface and a single detector in accordance with certain embodiments.
Figure 46B:
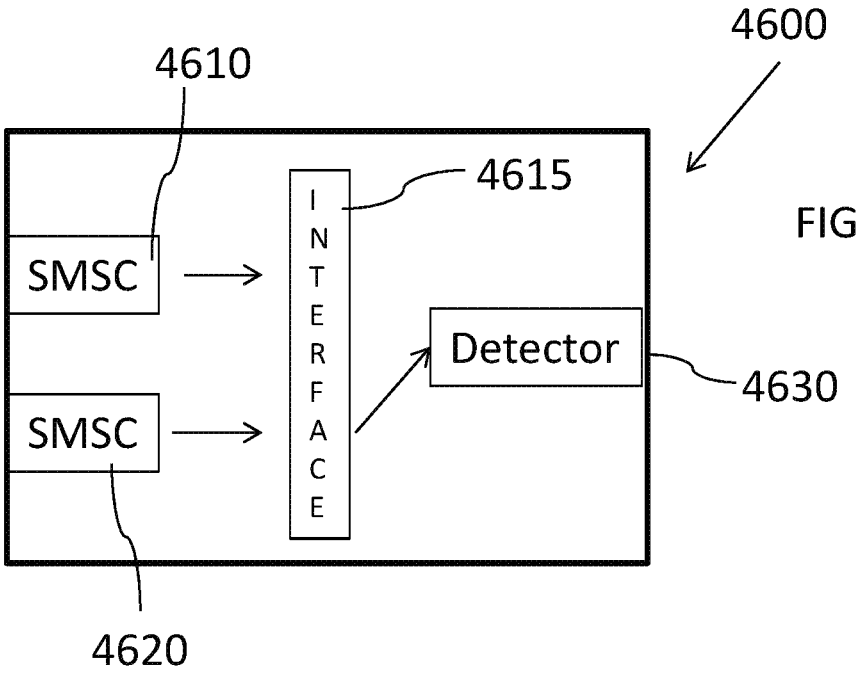

In other instances, an interface comprising a deflector may be present between two or more SMSCs and one or more detectors to guide ions of a particular type or nature toward a desired detector. For example, a deflector can be positioned between two SMSCs and used to deflect ions from a first SMSC toward a first deflector in one configuration and can deflect ions from a second SMSC toward the first deflector in another configuration. Interfaces comprising deflectors are discussed in more detail below. Referring to FIGS. 46A and 46B, a system 4600, e.g., a mass analyzer, comprises a first SMSC 4610 and a second SMSC 4620. An interface 4615 is present between the SMSCs 4610, 4620. A detector 4630 is fluidically coupled to the interface 4615 in FIG. 46A. Depending on the configuration of the deflector in the interface 4615, ions from the SMSC 4610 can be provided to the detector 4630 (FIG. 46A) or ions from the SMSC 4620 can be provided to the detector 4630 (FIG. 46B). In certain configurations, the interface 4615 can be configured to provide ions simultaneously from both of the SMSCs 4610, 4620 to the detector 4630. The exact configuration of the detector 4630 may vary as discussed in more detail below.

Figure 47:
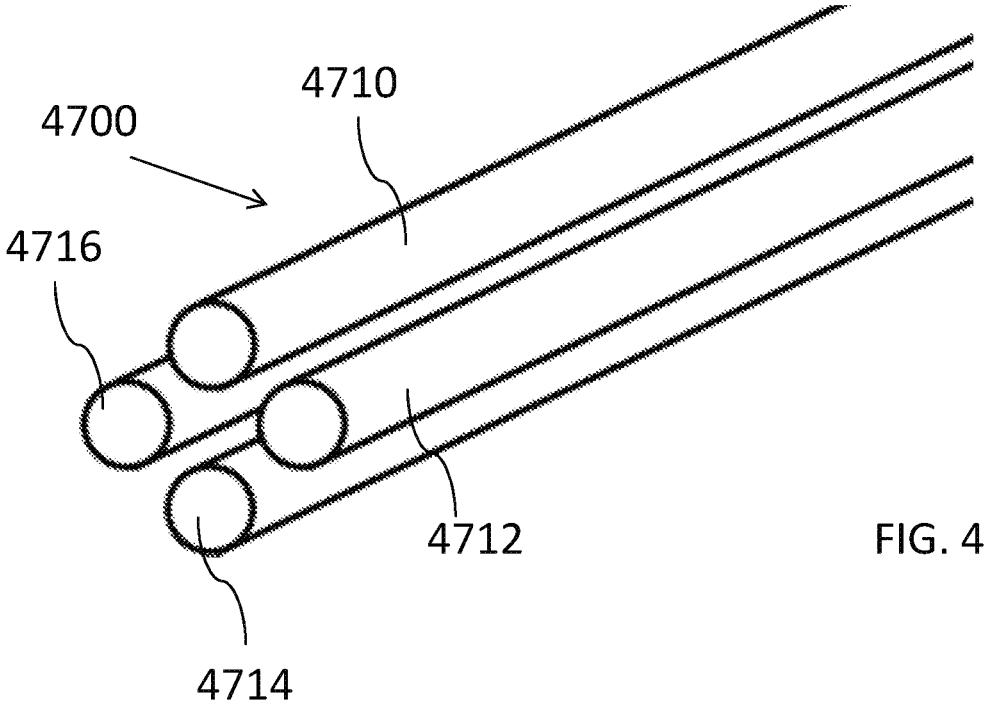
FIG. 47 is an illustration of a quadrupolar rod assembly, in accordance with certain configurations.

In certain embodiments, the various MS cores described herein which are present in a mass analyzer may comprise one or more multipole rod assemblies which can be used to select/filter ions based on the mass-to-charge ratio (m/z) of ions in an ion beam. Referring to FIG. 47A, one illustration of a quadrupole rod assemblies is shown. The quadrupole 4700 comprises rods 4710, 4712, 4714 and 4716. The rods 4710, 4712, 4714 and 4716 can together transmit only ions within a small m/z range. By varying the electrical signals provided to the rods 4710-4716, the m/z range of transmitted ions can be altered. Ions from an ionization core, interface, etc., can enter an interior space formed by positioning of the rods 4710-4716. The entering ions are typically accelerated into the space between the rods 4710-4716, and opposite rods are generally connected electrically with one pair of rods electrically coupled to a positive terminal and the other pair of rods electrically coupled to a negative terminal. For example, rods 4710, 4714 can be positive charged and rods 4712, 4716 can be negatively charged. Variable frequency AC potentials can also be applied to the rods 4710-4716. The voltages applied to the rods 4710-4716 can be altered to scan over a range of m/z to filter the ions and provide the filtered ions to a detector (not shown). In some instances herein, the abbreviation "Q" is used to refer to a quadrupole. For example, a first quadrupole may be referred to as Q1, a second quadrupole can be referred to as Q2, etc. Each quadrupole Q can be considered a sub-core, and one, two, three or more quadrupoles can be assembled to provide a MS core. By fluidically coupling two or more quadrupoles to each other in a particular MS core, ions can be separated, fragmented, etc. to provide better detection of analytes in a complex mixture. If desired, hexapoles, octopoles or multipole structures other than quadrupoles can also be used in a single MS core, dual core MS or multi-MS core.

In some examples, an ion trap can be used to select/filter ions received from one or more ionization cores. In a typical ion trap, gaseous ions can be formed and confined using electric and/or magnetic fields. For example, an ion trap may comprise a central donut-shaped ring electrode and a pair of end-cap electrodes. A variable radio frequency voltage can be applied to the ring electrode, and the end-cap electrodes are electrically coupled to ground. Ions with a suitable m/z ratio travel in a stable orbit within the cavity surrounding by the ring. As the radio frequency voltage is increased, heavier ions become more stabilized and lighter ions become destabilized. The lighter electrodes may then leave their orbit and be provided to an EM. The radio frequency voltage can be scanned and as ions are destabilized and exit the ring electrode area they can be sequentially detected by the EM.

In some examples, an ion trap may be configured as a cyclotron. As the ions enter into a magnetic field then orbit in a circular plane which is perpendicular to the direction of the field. The angular frequency of this motion is referred to as the cyclotron frequency. As radio frequency energy is provided, an ion trapped within the circular path can absorb the RF energy if the frequency matches the cyclotron frequency. Absorption of the energy increases the velocity of the ions. The circular motion of the ions can be detected as an image current which decays over some period. The decay of the signal with time provides a signal representative of the ions. If desired, this decay can be used with Fourier transforms to provide a frequency signal.

In other configurations, the mass analyzers described herein may comprise one or more magnetic sector analyzers. In a typical magnetic sector analyzer, a permanent magnet or electromagnet can induce ions to travel in a circular path of, for example, 180, 90 or 60 degrees. Ions of different mass can be scanned across an exit slit by varying the field strength of the magnet or the accelerating potentials between slits of the detector. The ions which exit through the exit slit are incident on a collector electrode and can be amplified similar to the EMs described herein.

Figure 48A:
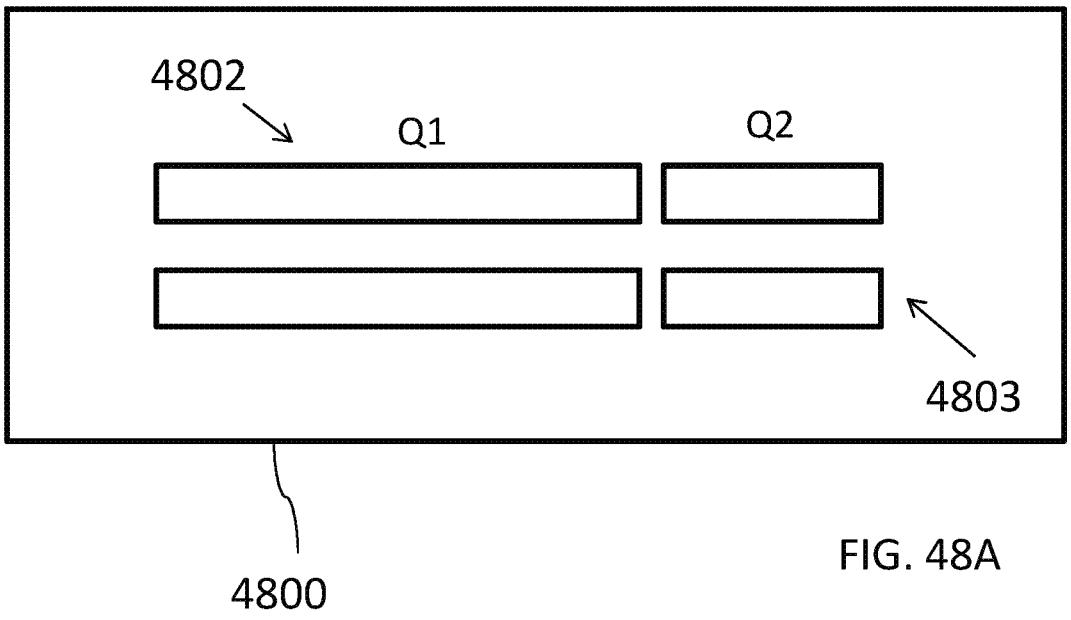
FIG. 48A is an illustration of two fluidically coupled quadrupolar rod assemblies, in accordance with certain examples.

In certain embodiments, two or more quadrupole rod assemblies can be fluidically coupled to each other to provide a single MS core which can be present in a mass analyzer by itself or in combination with another single MS core. Referring to FIG. 48A, one configuration of a single MS core 4800 comprising a first quadrupole assembly Q1 4802 fluidically coupled to a second quadrupole assembly Q2 4803 is shown. The SMSC 4800 can receive ions from an ionization core or interface, filter selected ions and provide them to a detector (not shown). The SMSC 4800 may comprise its own respective detector or can be fluidically coupled to a common detector through an interface as desired. As noted below, depending on the configuration of the mass analyzer, an assembly similar to 4800 can be used in a dual core MS.

Figure 48B:
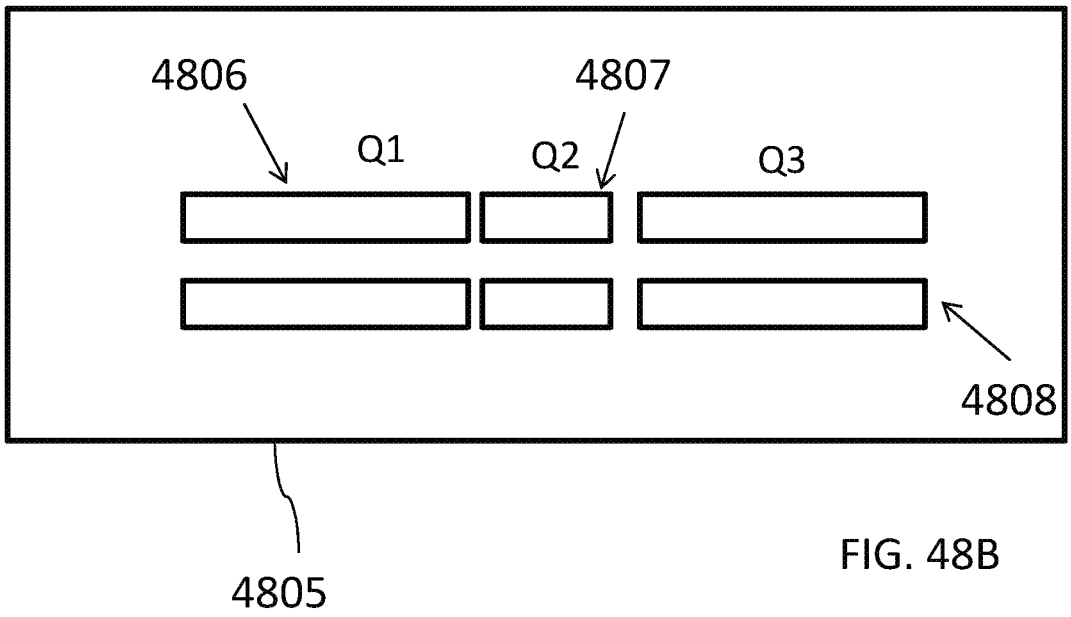
FIG. 48B is an illustration of three fluidically coupled quadrupolar rod assemblies, in accordance with certain examples.

In other configurations, a SMSC may comprise three or more quadrupole rod assemblies fluidically coupled to each other. Referring to FIG. 48B, one configuration of a single MS core 4805 comprising a first quadrupole assembly Q1 4806 fluidically coupled to a second quadrupole assembly Q2 4807 which is fluidically coupled to a third quadrupole assembly Q3 is shown. The SMSC 4805 can receive ions from an ionization core or interface, filter selected ions and provide them to a detector (not shown). The SMSC 4805 may comprise its own respective detector or can be fluidically coupled to a common detector through an interface as desired. As noted below, depending on the configuration of the mass analyzer, an assembly similar to 4805 can be used in a dual core MS.

Figure 48C:
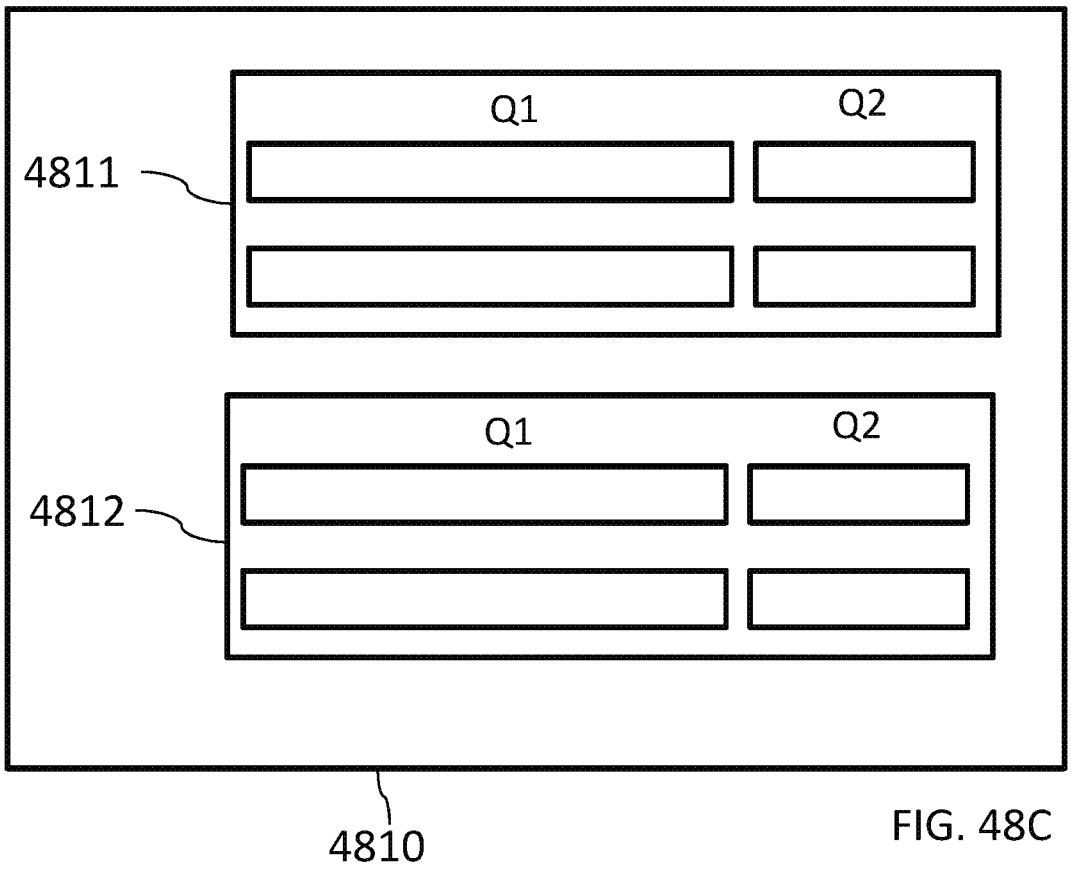
FIG. 48C is an illustration of two single core MSs each comprising two quadrupolar rod assemblies, in accordance with certain examples.

In some instances, it may be desirable to configure the mass analyzer with two or more single MS cores. Referring to FIG. 48C, a mass analyzer 4810 is shown that comprise a first single MS core comprising a double quadrupole rod assembly 4811 and a second single MS core comprising a double quadrupole rod assembly 4812. The single MS core assemblies 4811, 4812 can be present in the same housing but may be fluidically decoupled from each other to permit ions from one ionization core to be provided to the SMSC 4811 and to permit ions from a different ionization core to be provided to the SMSC 4812. For example, the SMSC 4811 can be configured to select inorganic ions from an ionization core comprising an inorganic ion source by using, for example, 2.5 MHz frequencies from a RF frequency source (not shown). The SMSC 4812 can be configured to select organic ions from an ionization core comprising an organic ion source by using, for example, 1.0 MHz frequencies from a RF frequency source (not shown). It will be recognized by the person of ordinary skill in the art, given the benefit of this disclosure, that other frequencies can also be used. As noted herein, the SMSCs 4811, 4812 can desirably share common MS components including, but not limited to, gas controllers, processors, power supplies, detectors and vacuum pumps. Further, the SMSCs 4811, 4812 may comprise their own respective detector or can be fluidically coupled to a common detector through an interface as desired. As noted below, one or both of the SMSCs 4811, 4812 could instead be configured as a dual core MS.

Figure 48D:
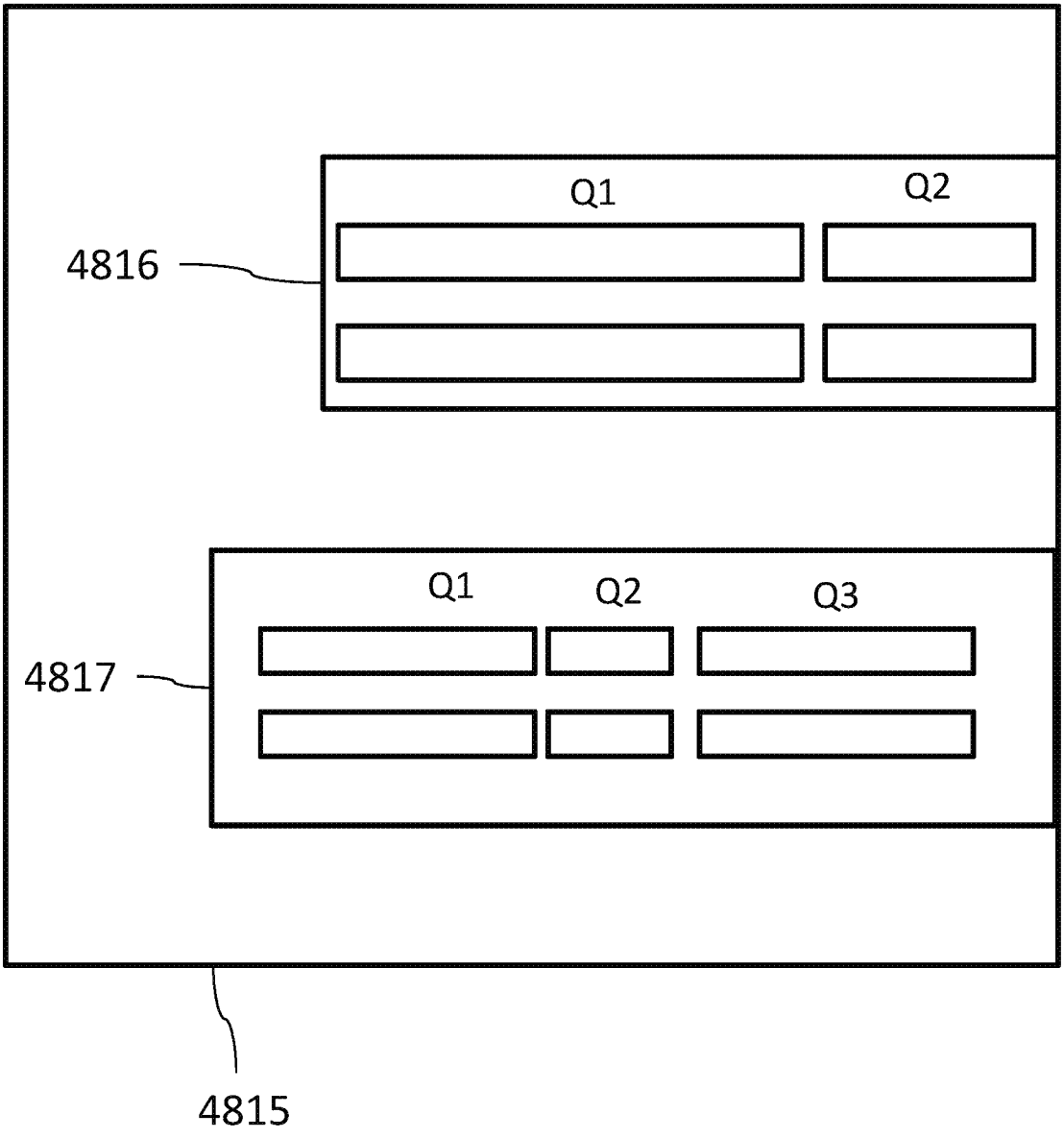
FIG. 48D is an illustration of two single core MSs with one SMSC comprising two quadrupolar rod assemblies and the other SMSC comprising two quadrupolar rod assemblies, in accordance with certain examples.

In some examples, it may be desirable to configure the mass analyzer with two or more single MS cores with different rod assembly structures. Referring to FIG. 48D, a mass analyzer 4815 is shown that comprises a first single MS core comprising a double quadrupole rod assembly 4816 and a second single MS core comprising a triple quadrupole rod assembly 4817. The single MS core rod assemblies 4816, 4817 can be present in the same housing but may be fluidically decoupled from each other to permit ions from one ionization core to be provided to the SMSC 4816 and to permit ions from a different ionization core to be provided to the SMSC 4817. For example, the SMSC 4816 can be configured to select inorganic ions from an ionization core comprising an inorganic ion source by using, for example, 2.5 MHz frequencies from a RF frequency source (not shown). The SMSC 4817 can be configured to select organic ions from an ionization core comprising an organic ion source by using, for example, 1.0 MHz frequencies from a RF frequency source (not shown). Alternatively, the SMSC 4817 can be configured to select inorganic ions from an ionization core comprising an inorganic ion source by using, for example, 2.5 MHz frequencies from a RF frequency source (not shown), and the SMSC 4816 can be configured to select organic ions from an ionization core comprising an organic ion source by using, for example, 1.0 MHz frequencies from a RF frequency source (not shown). It will be recognized by the person of ordinary skill in the art, given the benefit of this disclosure, that other frequencies can also be used. As noted herein, the SMSCs 4816, 4817 can desirably share common MS components including, but not limited to, gas controllers, processors, power supplies and vacuum pumps. Further, the SMSCs 4816, 4817 may comprise their own respective detector or can be fluidically coupled to a common detector through an interface as desired. As noted below, one or both of the SMSCs 4816, 4817 could instead be configured as a dual core MS.

Figure 48E:
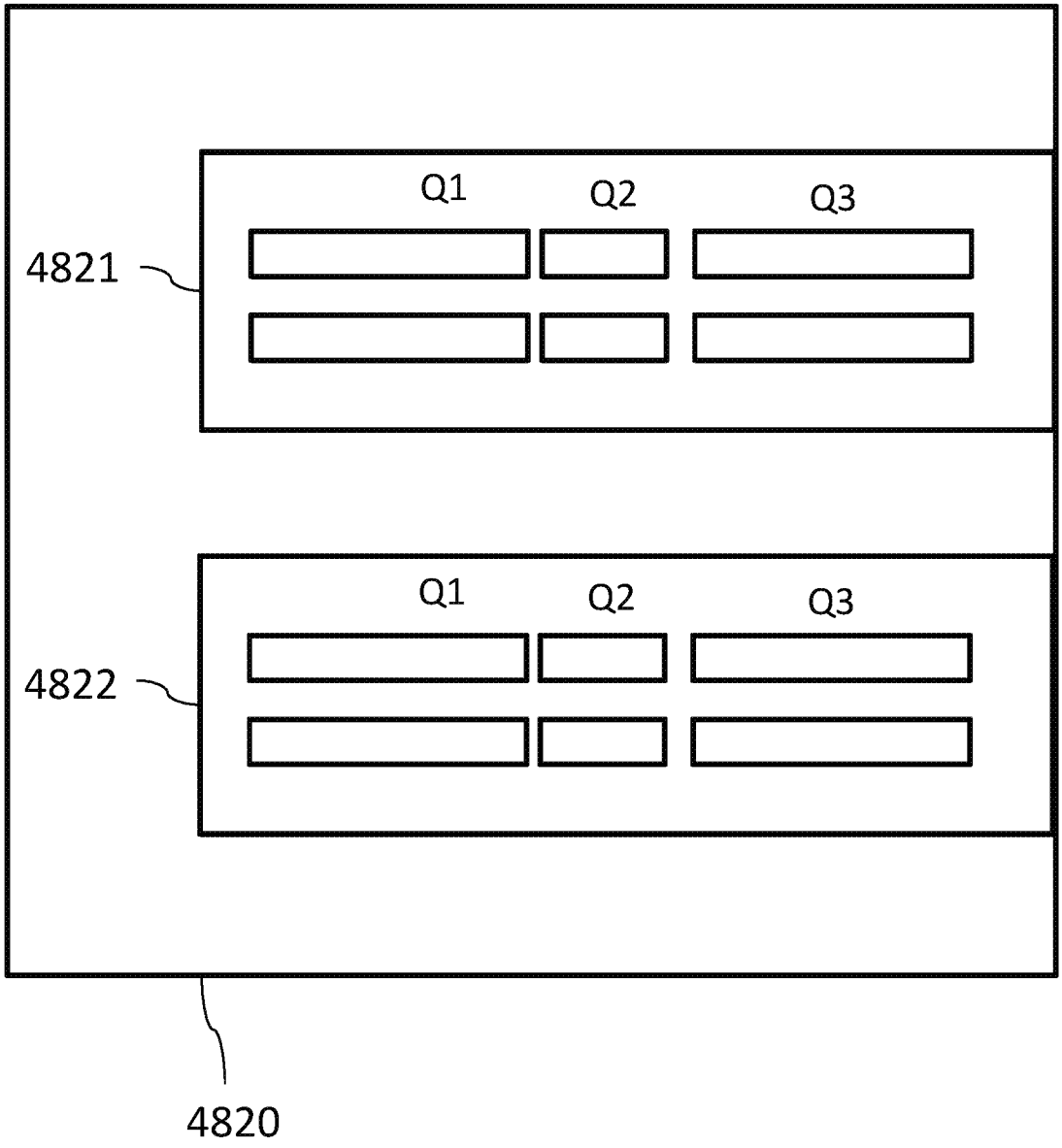
FIG. 48E is an illustration of two single core MSs each comprising three quadrupolar rod assemblies, in accordance with certain examples.

In certain configurations, it may be desirable to configure the mass analyzer with two or more single MS cores with triple rod structures. Referring to FIG. 48E, a mass analyzer 4820 is shown that comprises a first single MS core comprising a triple quadrupole rod assembly 4821 and a second single MS core comprising a triple quadrupole rod assembly 4822. The single MS core rod assemblies 4821, 4822 can be present in the same housing but may be fluidically decoupled from each other to permit ions from one ionization core to be provided to the SMSC 4821 and to permit ions from a different ionization core to be provided to the SMSC 4822. For example, the SMSC 4821 can be configured to select inorganic ions from an ionization core comprising an inorganic ion source by using, for example, 2.5 MHz frequencies from a RF frequency source (not shown). The SMSC 4822 can be configured to select organic ions from an ionization core comprising an organic ion source by using, for example, 1.0 MHz frequencies from a RF frequency source (not shown). Alternatively, the SMSC 4822 can be configured to select inorganic ions from an ionization core comprising an inorganic ion source by using, for example, 2.5 MHz frequencies from a RF frequency source (not shown), and the SMSC 4821 can be configured to select organic ions from an ionization core comprising an organic ion source by using, for example, 1.0 MHz frequencies from a RF frequency source (not shown). It will be recognized by the person of ordinary skill in the art, given the benefit of this disclosure, that other frequencies can also be used. As noted herein, the SMSCs 4821, 4822 can desirably share common MS components including, but not limited to, gas controllers, processors, power supplies and vacuum pumps. Further, the SMSCs 4821, 4822 may comprise their own respective detector or can be fluidically coupled to a common detector through an interface as desired. As noted below, one or both of the SMSCs 4821, 4822 could instead be configured as a dual core MS.

In certain configurations, more than two single MS cores may be present in a mass analyzer. For example, three, four, five or more SMSCs can be present in a mass analyzer and used to detect ions. In addition, the single MS cores can also be used in combination with a dual core MS or dual core MSs as noted in more detail herein.

Figure 49A:
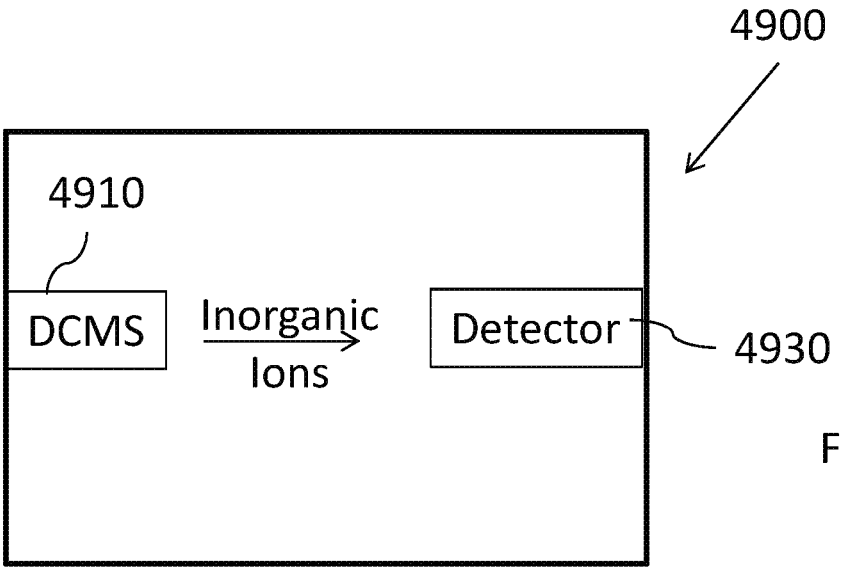
FIGS. 49A and 49B are illustrations of a dual core mass spectrometer which can provide ions to a detector, in accordance with certain examples.
Figure 49B:
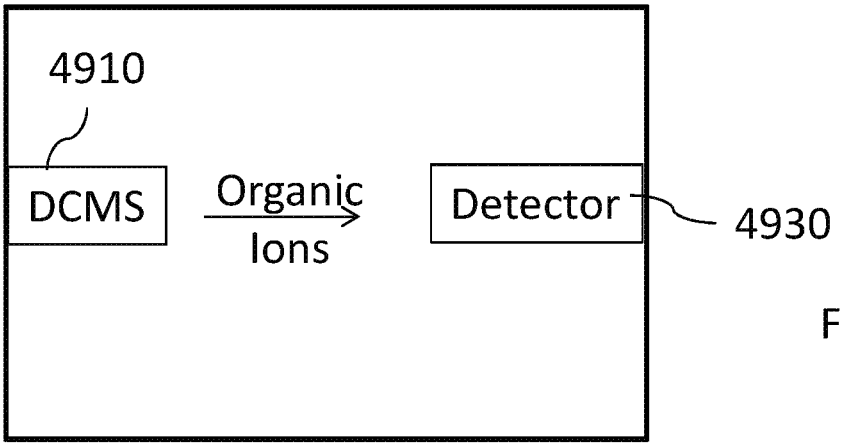

In certain configurations, the systems described herein may comprise one or more dual core mass spectrometers (DCMSs) present in a mass analyzer. The DCMS can be configured to filter/select both inorganic and organic ions depending on the conditions used. For example, in one instance, the dual core MS comprises the same physical components but may be operated using different frequencies to select different types of ions, e.g., the DCMS can provide both inorganic ion and/or organic ions depending on the configuration of the DCMS using common hardware such as common multipole rod assemblies. In some instances, the DCMS can be operated using a frequency of about 2.5 MHz to select/filter inorganic ions, e.g., ions with a mass up to about 300 amu's, and can be operated at a frequency of about 1 MHz to select/filter organic ions, e.g., ions with a mass greater than 300 amu's to about 2000 amu's. The DCMS can be binary in that it alternates between the two frequencies or additional frequencies can be used if desired. A SMSC is typically unitary in that is designed to provide either inorganic ions or organic ions. Referring to FIG. 49A, a mass analyzer 4900 comprising a DCMS 4910 may be configured to receive ions from an ionization core (not shown) configured to provide inorganic ions and then select/filter the inorganic ions for detection using the detector 4930. In another instance, a mass analyzer core comprising the DCMS 4910 may be configured to receive ions from an ionization core configured to provide organic ions and then select/filter the ions for detection using the detector 4930 (see FIG. 49B). The mass analyzer 4900 can switch back and forth to detect both inorganic and organic ions in real time, e.g., sequentially, or the system 4900 can be configured to detect the inorganic ions and then switch to detection of the organic ions as desired. In use of the DCMS, the detector 4930 may remain stationary, or if desired, more than a single detector can be used with the various detectors being moved into fluidic coupling with the DCMS. It is a substantial attribute that a DCMS with common hardware components can be used to filter/detect both inorganic and organic ions, e.g., ions with a mass of at least three, four or five amu's up to a mass of about 2000 amu's.

While the exact configuration of a mass analyzer comprising a DCMS can vary, the DCMS typically comprise one or more multipole structures similar to the SMSC. In some instances, the multipole(s) of the DCMS can be electrically coupled to a variable frequency generator to provide desired frequencies to the poles for selection/filtering as noted herein. The DCMS may comprise common optics, lenses, deflectors, etc. and use a dynamic change in the applied frequency to select/filter either the inorganic ions or the organic ions. For example, the system can be configured to switch between frequencies every millisecond or few milliseconds to detect both inorganic and organic ions during sample analysis. Further, the DCMS can be used in combination with an SMSC, another DCMS or other mass spectrometer cores. Where multiple ionization sources are present, an interface can be present between the ionization sources and the DCMS to direct flow of ions from the two ionization sources. The DCMS may comprise a common inlet and a common outlet, or in some instances, more than a single inlet and/or outlet can be present to selectively guide the ions into and/or out of the DCMS. In some examples, the DCMS can be part of a "pluggable" module that can be fluidically coupled to other components of the system as desired. Further, the DCMS can be positioned on a carousel or other circumferentially rotating table to fluidically couple and decouple the DCMS to desired cores of the system.

In certain embodiments, any one or more of the quadrupole rod assemblies shown herein could be replaced with a magnetic sector analyzer, an ion trap or other suitable types of mass analyzers. Further, ion traps can be used with multipole rod assemblies to trap and/or detect ions if desired.

Figure 50:
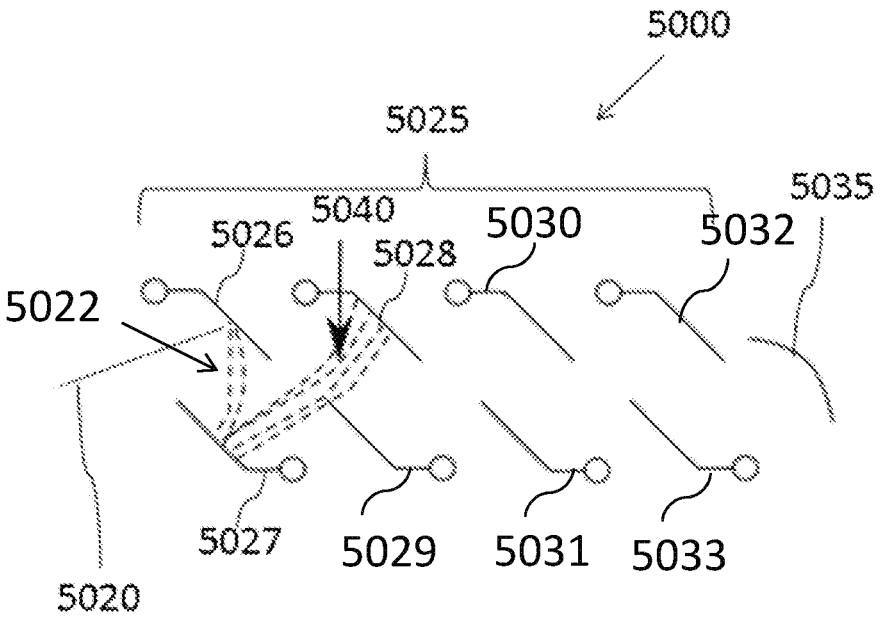
FIG. 50 is an illustration of an electron multiplier, in accordance with certain examples.

In certain embodiments, the MS cores described herein may comprise or be fluidically coupled to one or more detectors to detect the inorganic and organic ions. The exact nature of the detector used can depend on the sample, the desired sensitivity and other considerations. In some examples, the MS core comprises or is fluidically coupled to at least one electron multiplier (EM). Without wishing to be bound by any particular theory, an electron multiplier generally receives incident ions, amplifies a signal corresponding to the ions and provides a resulting current or voltage as an indicator of the ions detected. The signal can be amplified using a series of dynodes with offset voltages which emit electrons when struck by the ions. Electron multipliers with 10-20 dynodes are common with a current gain of $10^7$ or more. Both discrete and continuous dynode electron multipliers can be used with the cores described herein. Referring to FIG. 50, a simplified illustration of an electron multiplier is shown. The EM 5000 comprises a collector (or anode) 5035 and a plurality of dynodes (collectively 5025 and individually 5026-5033) upstream of the collector 5035. While not shown, the components of the detector 5000 would typically be positioned within a tube or housing (under vacuum) and may also include a focusing lenses or other components to provide the ion beam 5020 to the first dynode 5026 at a suitable angle. In use of the detector 5000, the ion beam 5020 is incident on the first dynode 5026, which converts the ion signal into an electrical signal shown as beam 5022. In some embodiments, the dynode 526 (and dynodes 5027-5033) can include a thin film of material on an incident surface that can receive ions and cause a corresponding ejection of electrons from the surface. The energy from the ion beam 5020 is converted by the dynode 526 into an electrical signal by emission of electrons. The exact number of electrons ejected per ion depends, at least in part, on the work function of the material and the energy of the incident ion. The secondary electrons emitted by the dynode 5026 are emitted in the general direction of downstream dynode 5027. For example, a voltage-divider circuit, resistor ladder, or other suitable circuitry, can be used to provide a more positive voltage for each downstream dynode. The potential difference between the dynode 5026 and the dynode 5027 causes electrons ejected from the dynode 5026 to be accelerated toward the dynode 5027. The exact level of acceleration depends, at least in part, on the gain used. Dynode 5027 is typically held at a more positive voltage than dynode 5026, e.g., 100 to 200 Volts more positive, to cause acceleration of electrons emitted by dynode 5026 toward dynode 5027. As electrons are emitted from the dynode 5027, they are accelerated toward downstream dynode 5028 as shown by beams 5040. A cascade mechanism is provided where each successive dynode stage emits more electrons than the number of electrons emitted by an upstream dynode. The resulting amplified signal can provided to the optional collector 5035, which typically outputs the current to an external circuit through one or more electrical couplers of the EM detector 5000. The current measured at the collector 5035 can be used to determine the amount of ions that arrive per second, the amount of a particular ion, e.g., a particular ion with a selected mass-to-charge ratio, that is present in the sample or other attributes of the ions. If desired, the measured current can be used to quantitate the concentration or amount of ions using conventional standard curve techniques. In general, the detected current depends on the number of electrons ejected from the dynode 5026, which is proportional to the number of incident ions and the gain of the device 5000. Illustrative EM devices and devices which are based on EM's are commercially available from PerkinElmer Health Sciences, Inc. (Waltham, Mass.) and are described, for example in commonly assigned U.S. Pat. Nos. 9,269,552 and 9,396,914.

Figure 51:
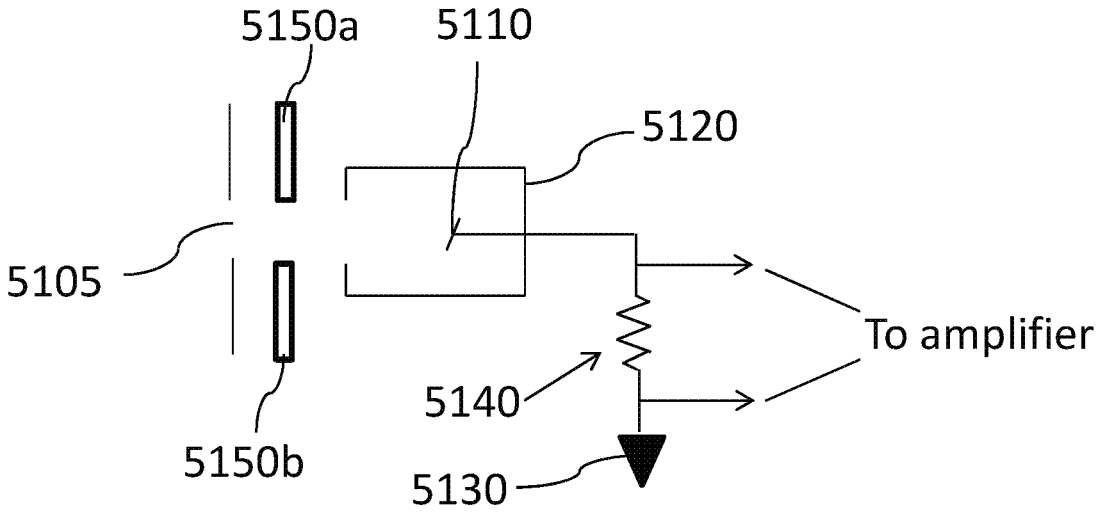
FIG. 51 is an illustration of a Faraday cage, in accordance with certain embodiments.

In other examples, a Faraday cup can be used as a detector with the cores described herein. Ions exiting the MS core can strike a collector electrode positioned within a cage. The charge of positive ions is neutralized by a flow of electrons from ground a resistor. The resulting potential drop across the resistor can be amplified by a high-impedance amplifier. One or more Faraday cups can be used in the systems described herein. Further, a Faraday cup can be used in combination with an EM or other types of detectors. One illustration of a Faraday cup 5100 is shown in FIG. 51. The cup 5100 comprises an inlet 5105 which can receive ions from a mass analyzer (not shown). The ions strike a collector electrode 5110 surrounded by a cage 5120. The cage 5120 is configured to prevent escape of reflected ions and secondary electrons. The collector electrode 5110 is generally angled with respect to the incident angle of the incoming ions so that particles incident on the electrode 5110 or leaving the electrode 5110 are reflected away from the entrance of the cage 5120. The collector electrode 5110 and the cage 5120 are electrically coupled to ground 5130 through a resistor 5140. The charge of ions striking the electrode 5110 is neutralized by a flow of electrons through the resistor 5140. The potential drop across the resistor 5140 can be amplified by a high-impedance amplifier. Ion suppressors 5150*a, b* may also be present to reduce background noise.

In some examples, the systems described herein may comprise a scintillation detector. A scintillation detector comprises a crystalline phosphor material disposed on a metal sheet. The metal sheet can be mounted or function as a window of a photomultiplier tube. Incidence ions impinge on the phosphor causing the phosphors to scintillate. This signal can be amplified and detected using a dynode arrangement similar to that of an EM.

In certain embodiments, the detector used with the systems described herein may comprise an imager. The exact type of ionization core used with an imager can vary and common ionization cores used with an imager include, but are not limited to, MALDI sources and SI sources. The imager may comprise one or more other detectors, e.g., an EM, TOF or combinations thereof, which can be used along with software to provide a two-dimensional or three dimensional map of the surface, tissue, etc. which is analyzed. In some embodiments, individual pixels can be produced, e.g., color coded if desired, using the detected ions at particular coordinate sites to provide a visual image of the analyte surface or material being analyzed. The systems described herein can detect inorganic and organic ions on surfaces, tissues, coatings, etc. using the systems described herein and use the detected ions to provide an image map using a single MS system.

In other configurations, the detector used with the systems described herein may comprise microchannel plate (MCP) detector. While the exact configuration may vary, a microchannel plate typically comprises a plurality of channels each of which can receive ions and amplify a signal representative of the ions. The MCP detector may comprise many tubes or slots separated from each other such that each tube or slot functions similar to an electron multiplier. Many MCP's have a Chevron configuration with two MCPs forming a V-shaped structure with the signal being amplified using both of the two MCPs. Alternatively, a Z-stack of MCP's can be formed using three MCPs. Additional configurations using MCPs are also possible.

Figure 52A:
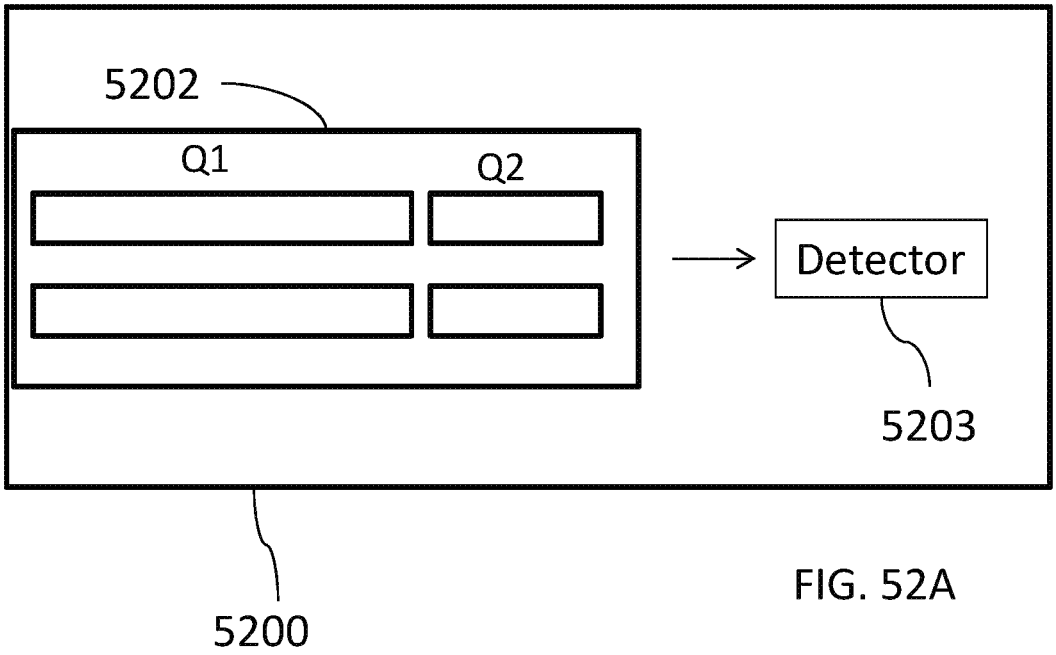
FIGS. 52A, 52B, 52C, 52D and 52E are illustration of a single core MS used with one or more detectors, in accordance with certain examples.

In certain examples, various configurations of systems comprising a detector fluidically coupled to a mass analyzer comprising a single core MS are shown in FIGS. 52A-52E. Referring to FIG. 52A, a system 5200 comprises a single MS core 5202 comprising quadrupole rod assemblies Q1 and Q2. The two quad SMSC 5202 is fluidically coupled to a detector 5203. In some examples, the detector 5203 comprises an electron multiplier. In other examples, the detector 5203 comprises a Faraday cup. In further examples, the detector 5203 comprises a MCP. In additional examples, the detector 5203 comprises an imager. In other examples, the detector 5203 comprises a scintillation detector. Ions can be provided to the SMSC 5202, and selected ions can be provided to the detector 5203 for detection. In some instances, the SMSC 5202 is configured to receive ions from an ionization core comprising an inorganic ion source. In other configurations, the SMSC 5202 is configured to receive ions from an ionization core comprising an organic ion source. If desired, the SMSC 5202 could instead be configured as a dual core MS.

Figure 52B:
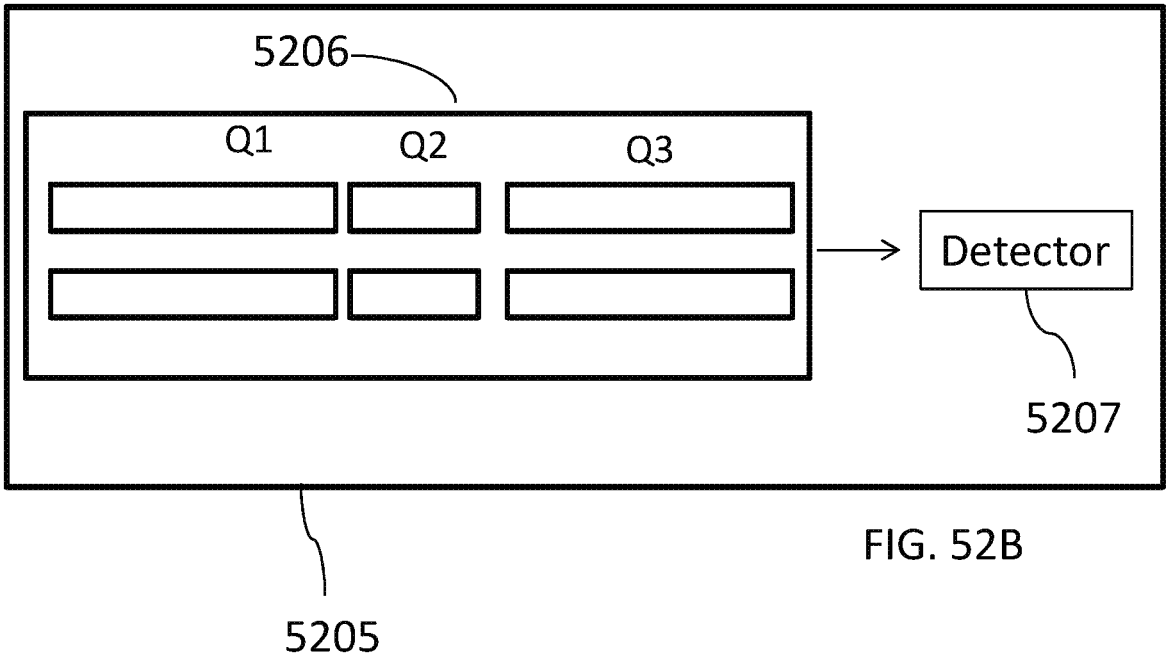

In some examples, a SMSC comprising three quadrupole rod assemblies can be used with the detectors described herein. Referring to FIG. 52B, a system 5205 comprises a single MS core 5206 comprising quadrupole rod assemblies Q1, Q2 and Q3. The three quad SMSC 5206 is fluidically coupled to a detector 5207. In some examples, the detector 5207 comprises an electron multiplier. In other examples, the detector 5207 comprises a Faraday cup. In further examples, the detector 5207 comprises a MCP. In additional examples, the detector 5207 comprises an imager. In other examples, the detector 5207 comprises a scintillation detector. Ions can be provided to the SMSC 5206, and selected ions can be provided to the detector 5207 for detection. In some instances, the SMSC 5206 is configured to receive ions from an ionization core comprising an inorganic ion source. In other configurations, the SMSC 5206 is configured to receive ions from an ionization core comprising an organic ion source. If desired, the SMSC 5206 could instead be configured as a dual core MS.

Figure 52C:
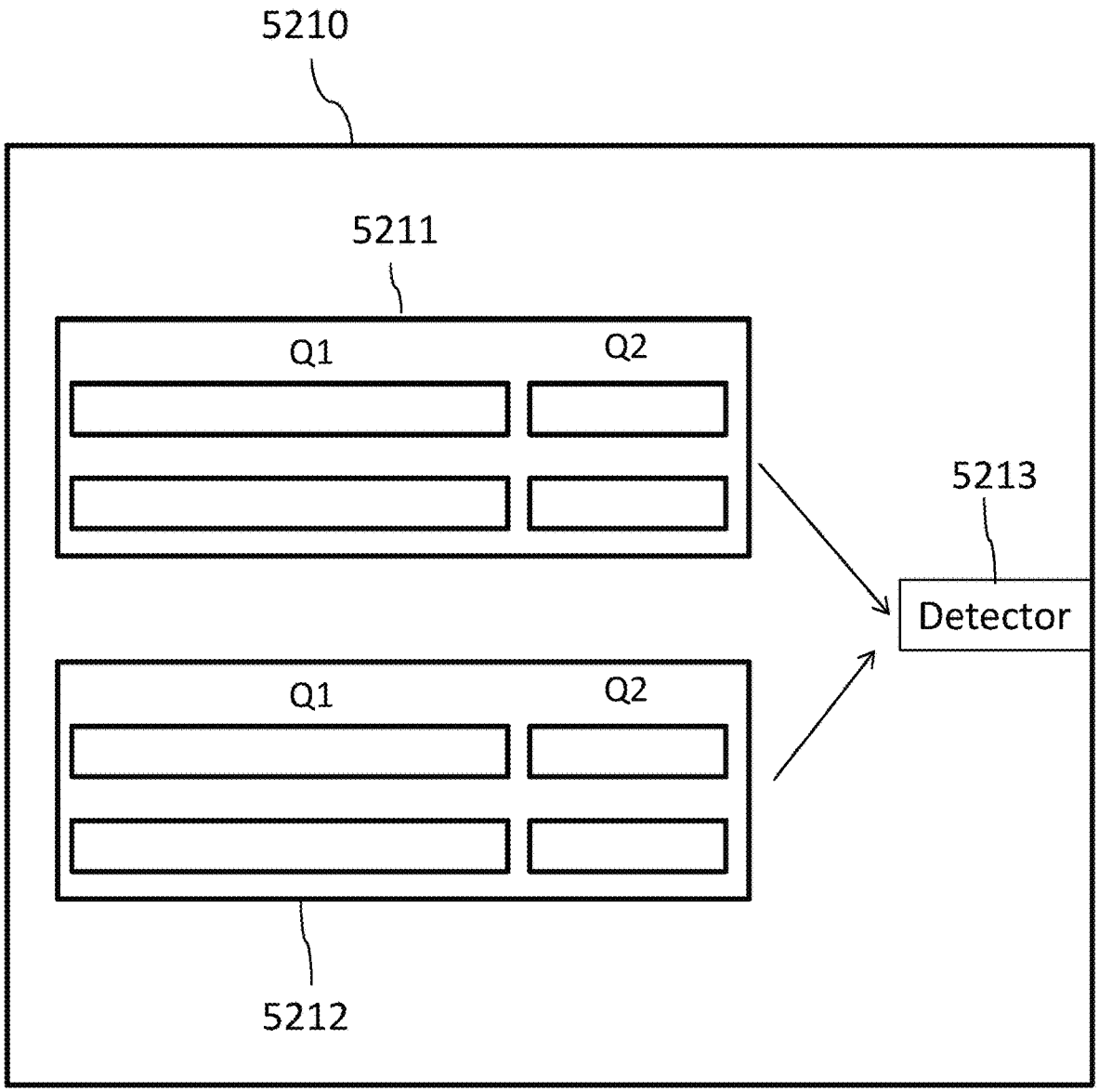

In some examples, two SMSCs can be used with a single detector. Referring to FIG. 52C, a system 5210 comprises a single MS core 5211 comprising quadrupole rod assemblies Q1 and Q2 and a single MS core 5212 comprising quadrupole rod assemblies Q1 and Q2. The two quad SMSCs 5211, 5212 can be fluidically coupled to a detector 5213. In some examples, the detector 5213 comprises an electron multiplier. In other examples, the detector 5213 comprises a Faraday cup. In further examples, the detector 5213 comprises a MCP. In additional examples, the detector 5213 comprises an imager. In other examples, the detector 5213 comprises a scintillation detector. Ions can be provided to the SMSCs 5211, 5212, and selected ions can be provided to the detector 5213 for detection. In some configurations, the SMSCs 5211, 5212 can be fluidically coupled to the detector 5213 through an interface (not shown) configured to provide ions to the detector 5213 during any selected analysis period. For example, the SMSC 5211 can be configured to receive inorganic ions from an ionization core, select inorganic ions and provide the selected inorganic ions to the detector 5213. The SMSC 5212 can be configured to receive organic ions from an ionization core, select organic ions and provide the selected organic ions to the detector 5213. As noted herein, the SMSCs 5211, 5212 can desirably share common MS components including, but not limited to, gas controllers, processors, power supplies and vacuum pumps. If desired, one or both of the SMSCs 5211, 5212 could instead be configured as a dual core MS.

Figure 52D:
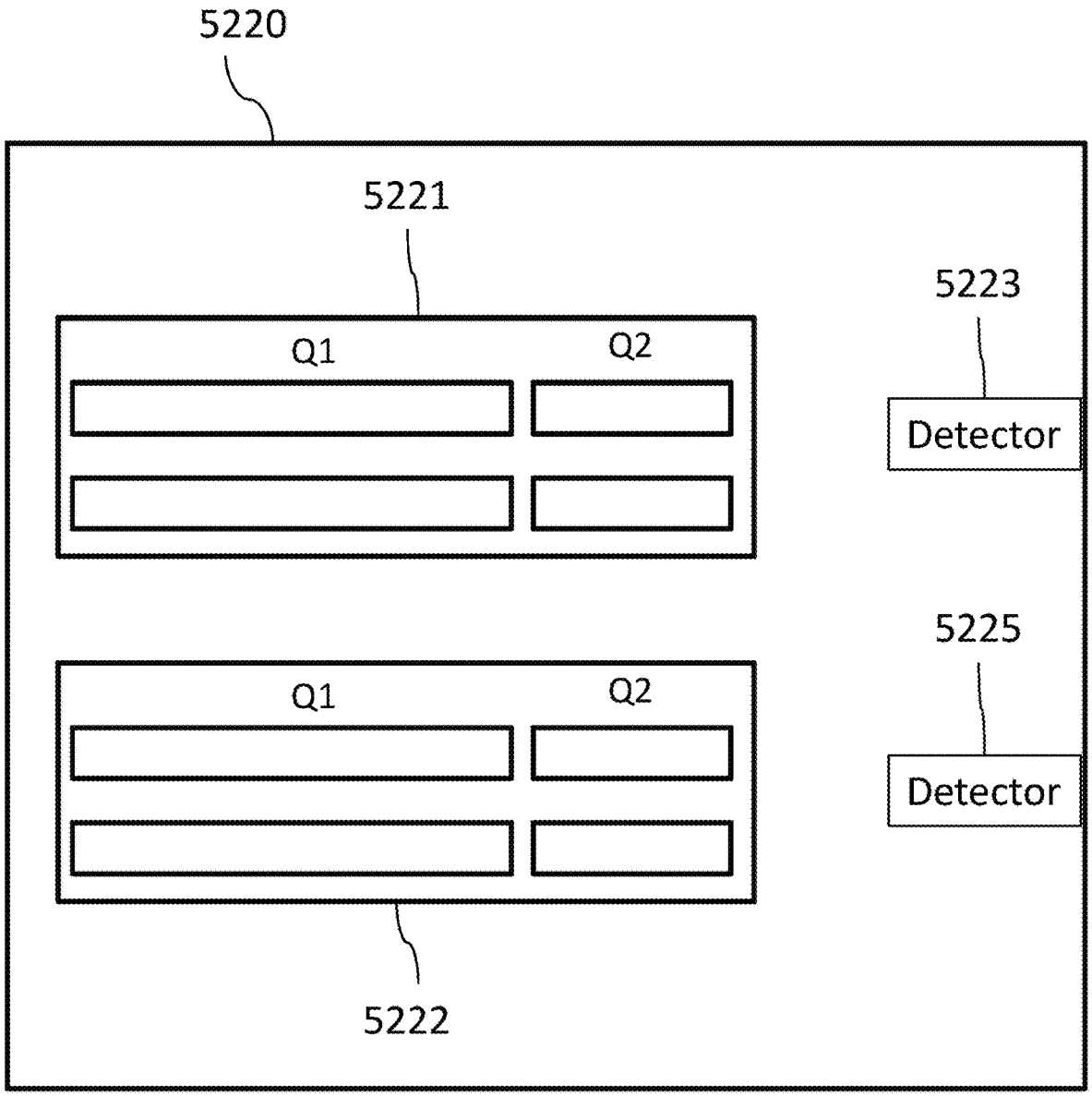

In some examples, two SMSCs with can be used with two detectors. Referring to FIG. 52D, a system 5220 comprises a single MS core 5221 comprising quadrupole rod assemblies Q1 and Q2 and a single MS core 5222 comprising quadrupole rod assemblies Q1 and Q2. The two quad SMSCs 5221, 5222 can be fluidically coupled to a respective detector 5223, 5225. In some examples, the detector 5223 comprises an electron multiplier. In other examples, the detector 5223 comprises a Faraday cup. In further examples, the detector 5223 comprises a MCP. In additional examples, the detector 5223 comprises an imager. In other examples, the detector 5223 comprises a scintillation detector. In some examples, the detector 5225 comprises an electron multiplier. In other examples, the detector 5225 comprises a Faraday cup. In further examples, the detector 5225 comprises a MCP. In additional examples, the detector 5225 comprises an imager. In other examples, the detector 5225 comprises a scintillation detector. Ions can be provided to the SMSCs 5221, 5222, and selected ions can be provided to the detectors 5223, 5225 for detection. For example, the SMSC 5221 can be configured to receive inorganic ions from an ionization core, select inorganic ions and provide the selected inorganic ions to the detector 5223. The SMSC 5222 can be configured to receive organic ions from an ionization core, select organic ions and provide the selected organic ions to the detector 5225. As noted herein, the SMSCs 5221, 5222 can desirably share common MS components including, but not limited to, gas controllers, processors, power supplies and vacuum pumps. If desired, one or both of the SMSCs 5221, 5222 could instead be configured as a dual core MS.

Figure 52E:
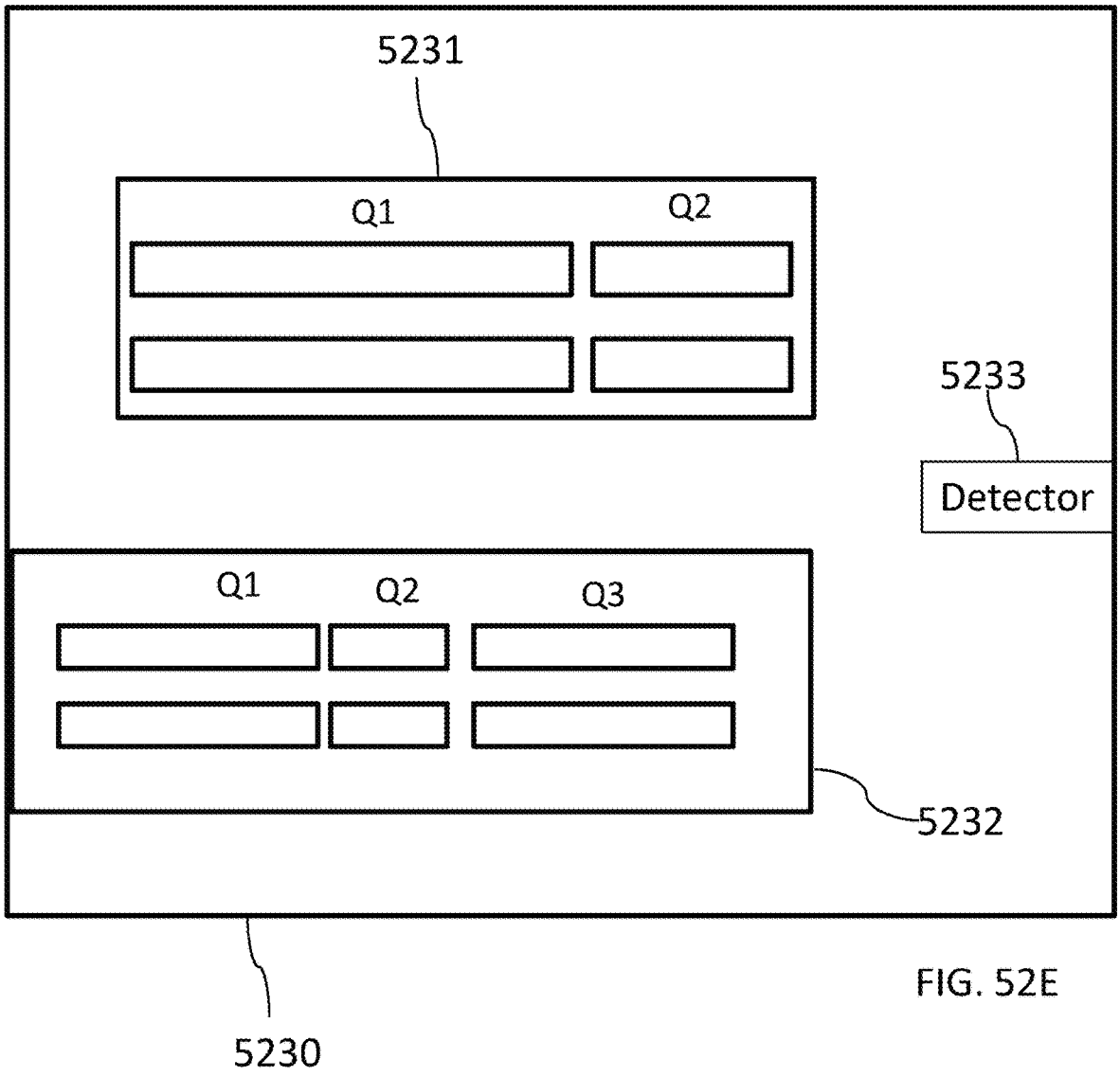

In some examples, two SMSCs of different configurations can be used with a single detector or two detectors. Referring to FIG. 52E, a system 5230 comprises a single MS core 5231 comprising quadrupole rod assemblies Q1 and Q2 and a single MS core 5232 comprising quadrupole rod assemblies Q1, Q2 and Q3. The SMSCs 5231, 5232 can be fluidically coupled to a detector 5233. In some examples, the detector 5233 comprises an electron multiplier. In other examples, the detector 5233 comprises a Faraday cup. In further examples, the detector 5233 comprises a MCP. In additional examples, the detector 5233 comprises an imager. In other examples, the detector 5233 comprises a scintillation detector. Ions can be provided to the SMSCs 5231, 5232, and selected ions can be provided to the detector 5233 for detection. In some configurations, the SMSCs 5231, 5232 can be fluidically coupled to the detector 5233 through an interface (not shown) configured to provide ions to the detector 5213 during any selected analysis period. In other instances, a second detector can be present with one detector being fluidically coupled to one of the SMSCs 5231, 5232. In some instances, the SMSC 5231 can be configured to receive inorganic ions from an ionization core, select inorganic ions and provide the selected inorganic ions to the detector 5233. The SMSC 5232 can be configured to receive organic ions from an ionization core, select organic ions and provide the selected organic ions to the detector 5233. In other instances, the SMSC 5232 can be configured to receive inorganic ions from an ionization core, select inorganic ions and provide the selected inorganic ions to the detector 5233. The SMSC 5231 can be configured to receive organic ions from an ionization core, select organic ions and provide the selected organic ions to the detector 5233. As noted herein, the SMSCs 5211, 5212 can desirably share common MS components including, but not limited to, gas controllers, processors, power supplies and vacuum pumps. If desired, one or both of the SMSCs 5231, 5232 could instead be configured as a dual core MS.

Figure 53A:
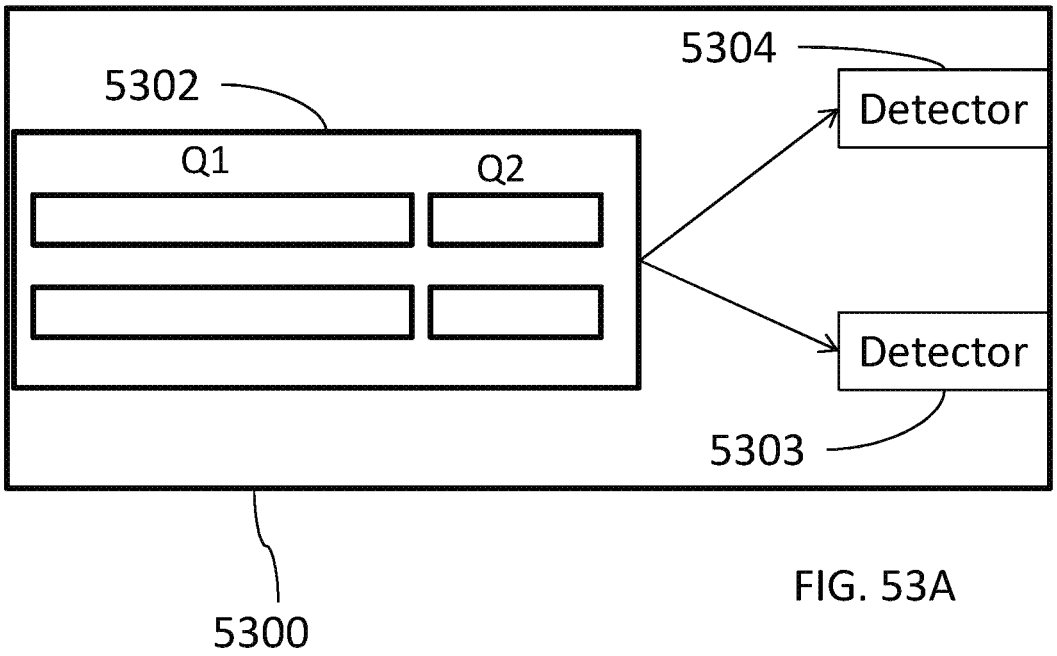
FIGS. 53A and 53B are illustrations of dual core MS's used with two detectors, in accordance with certain embodiments.

In certain embodiments, a dual core MS can be used with the detectors described herein. Referring to FIG. 53A, a dual core MS 5302 comprises quadrupolar rod assemblies Q1 and Q2. The DCMS 5302 can be fluidically coupled to one or more of the detectors 5303, 5304, e.g., through an interface or by moving the DCMS 5302 or the detectors 5303, 5304. In some examples, the detector 5303 comprises an electron multiplier. In other examples, the detector 5303 comprises a Faraday cup. In further examples, the detector 5303 comprises a MCP. In additional examples, the detector 5303 comprises an imager. In other examples, the detector 5303 comprises a scintillation detector. In some examples, the detector 5304 comprises an electron multiplier. In other examples, the detector 5304 comprises a Faraday cup. In further examples, the detector 5304 comprises a MCP. In additional examples, the detector 5304 comprises an imager. In other examples, the detector 5304 comprises a scintillation detector. In some examples, the DCMS 5302 is configured to select inorganic ions from an inorganic ions source, e.g., by using radio frequencies of about 2.5 MHz, and then can provide the selected inorganic ions to the detector 5303. In other examples, the DCMS 5302 is configured to select organic ions from an organic ions source, e.g., by using radio frequencies of about 1.0 MHz and then can provide the selected organic ions to the detector 5304. An interface (not shown) can be present to direct the ions to a particular one of the detectors 5303, 5304 as desired.

Figure 53B:
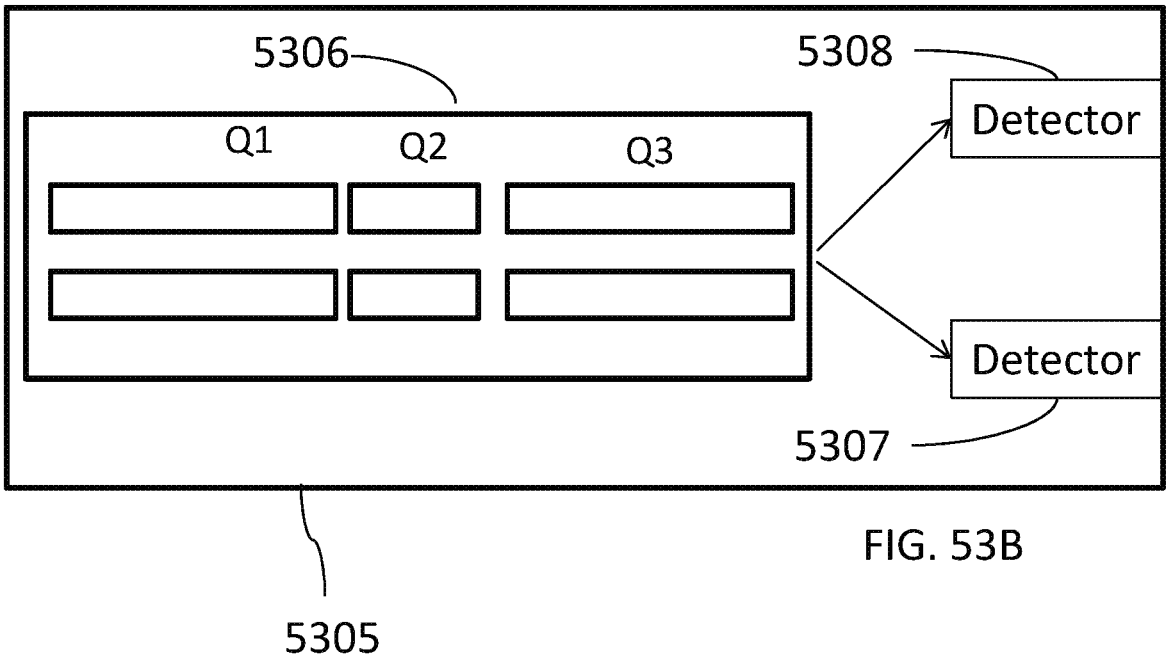

In other configurations and referring to FIG. 53B, a dual core MS 5304 comprises quadrupolar rod assemblies Q1, Q2 and Q3. The three quad DCMS 5305 can be fluidically coupled to one or more of the detectors 5307, 5308, e.g., through an interface or by moving the DCMS 5306 or the detectors 5307, 5308. In some examples, the detector 5307 comprises an electron multiplier. In other examples, the detector 5307 comprises a Faraday cup. In further examples, the detector 5307 comprises a MCP. In additional examples, the detector 5307 comprises an imager. In other examples, the detector 5307 comprises a scintillation detector. In some examples, the detector 5308 comprises an electron multiplier. In other examples, the detector 5308 comprises a Faraday cup. In further examples, the detector 5308 comprises a MCP. In additional examples, the detector 5308 comprises an imager. In other examples, the detector 5308 comprises a scintillation detector. In some examples, the DCMS 5305 is configured to select inorganic ions from an inorganic ions source, e.g., by using radio frequencies of about 2.5 MHz, and then can provide the selected inorganic ions to the detector 5307. In other examples, the DCMS 5305 is configured to select organic ions from an organic ions source, e.g., by using radio frequencies of about 1.0 MHz and then can provide the selected organic ions to the detector 5308. An interface (not shown) can be present to direct the ions to a particular one of the detectors 5303, 5304 as desired. If desired, the DCMS 5306 could instead be configured as a single MS core.

Figure 54A:
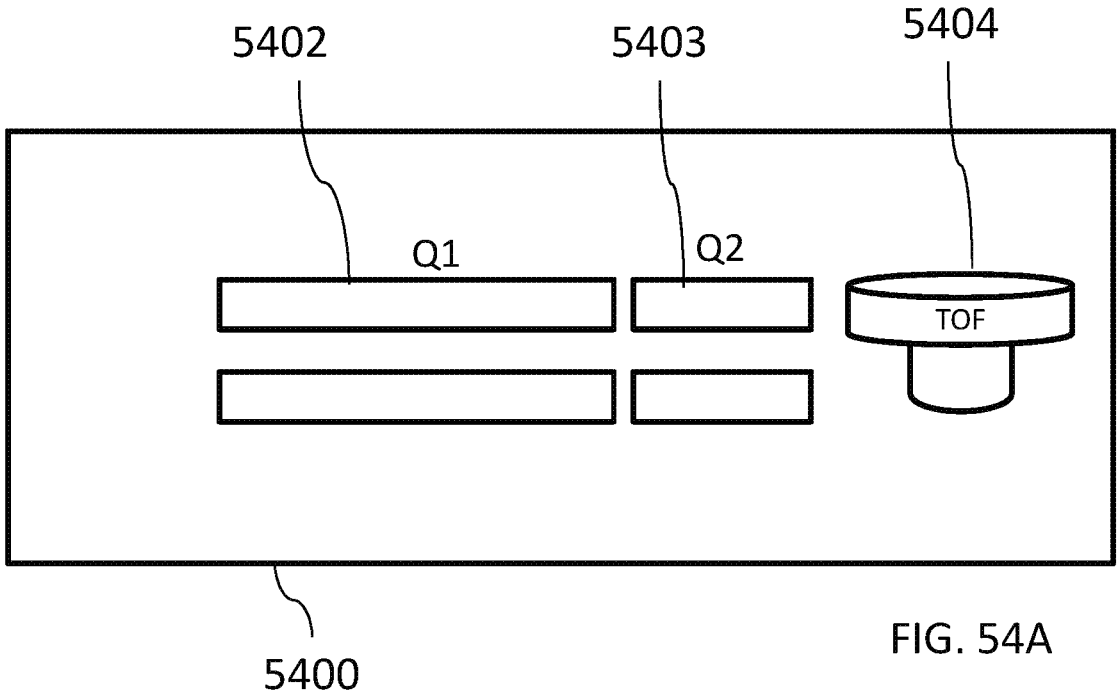
FIGS. 54A-54D are illustrations of mass analyzers/detectors comprising a time of flight device, in accordance with certain examples.
Figure 54B:
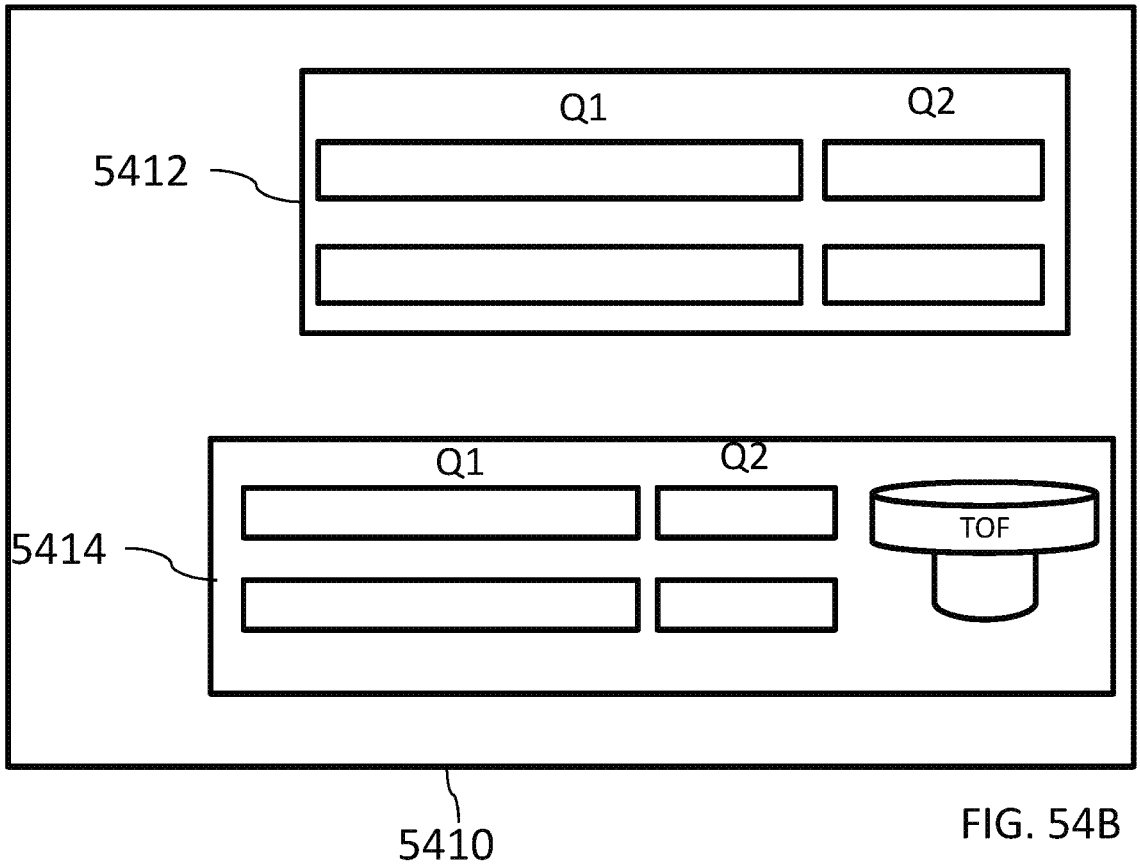
Figure 54C:
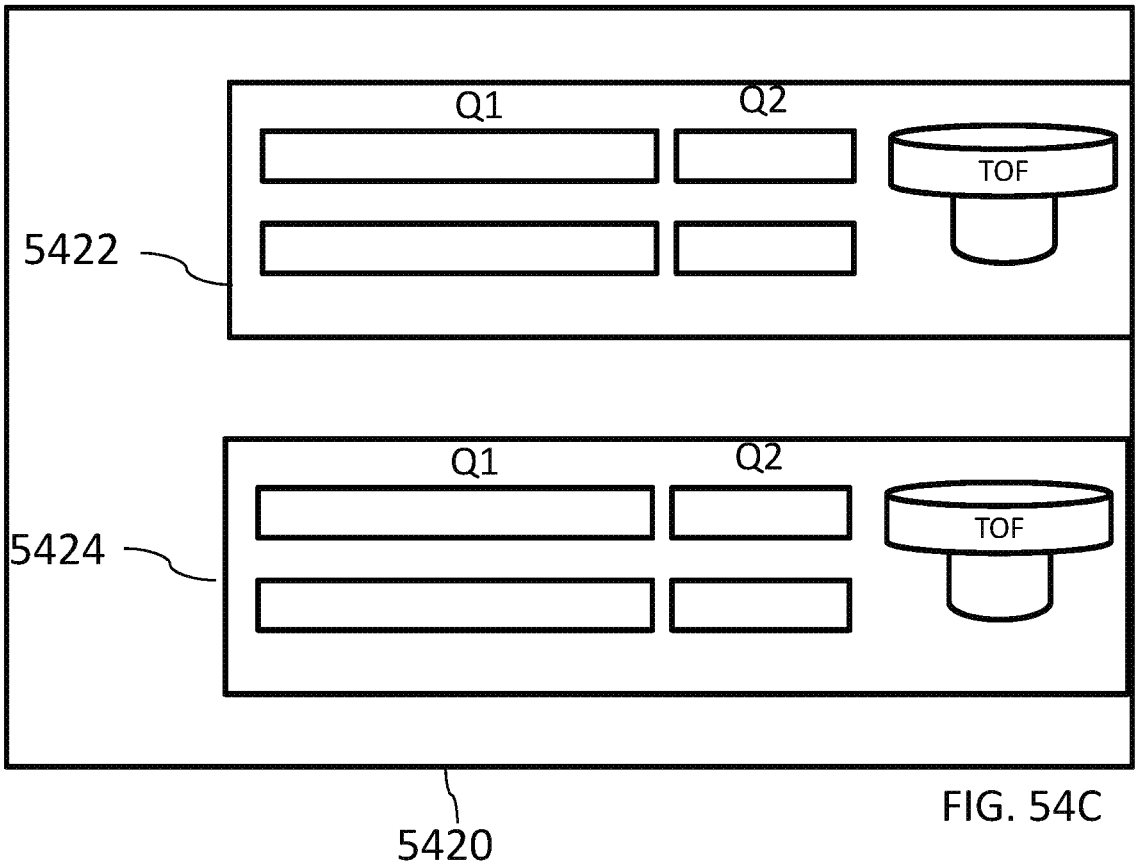
Figure 54D:
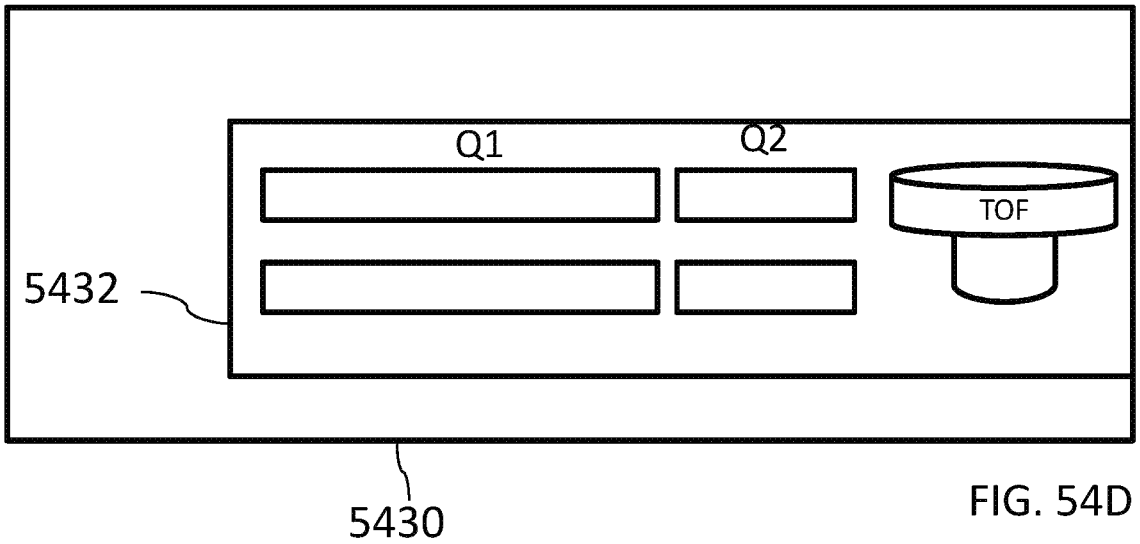

In certain examples, the detector used with the systems described herein may be part of the mass analyzer. For example, a time of flight (TOF) detector may be configured to filter and detect ions from one or more ionization cores. In a typical TOF configuration, positive ions can be produced by bombarding a sample with pulses of electrons, secondary ions or photons. The exact pulse frequency can vary from 10-50 KHz for example. The resulting ions which are produced can be accelerated by an electric field pulse of the same frequency but shifted in time. The accelerated ions can be provided into a field free drift tube. The velocities of the ions vary inversely with their masses with lighter particles arriving at the detector sooner than heavier particles. Typical flight times can vary between one microsecond to thirty microseconds or more. The detector portion of the TOF may be constructed the same as or similar to an EM. Certain illustrations of a mass analyzer/detector are shown in FIGS. 54A-54D. Referring to FIG. 54A, a single MS core mass analyzer/detector 5400 may comprise a first quadrupolar assembly Q1 5402 fluidically coupled to a second quadrupolar assembly Q2 5403. Q2 5403 is fluidically coupled to a TOF 5404. The SMSC/detector 5400 can receive ions from an ionization core or interface, filter selected ions and detect the ions using the TOF 5404. If desired, the SMSC/detector 5400 can be fluidically coupled to two or more ionization cores through an interface so it can receive inorganic ions and/or organic ions. In some examples, the SMSC 5402 could instead be configured as a dual core MS.

In other configurations, the TOF can be used in conjunction with one or more other single MS cores, dual core MSs or multi-MS cores. For example and referring to FIG. 54B, a system 5410 comprising a first single MS core 5412 comprising quadrupole assemblies Q1 and Q2 can be used with a single MS core/detector 5414 comprising quadrupole assemblies Q1, Q2 and a TOF. The different cores 5412, 5414 can be present in the same housing but may be fluidically decoupled from each other to permit ions from one ionization core to be provided to the SMSC 5412 and to permit ions from a different ionization core to be provided to the SMSC/detector 5414. For example, the SMSC 5412 can be configured to select inorganic ions from an ionization core comprising an inorganic ion source by using, for example, 2.5 MHz frequencies from a RF frequency source (not shown). The SMSC/detector 5414 can be configured to select and detect organic ions from an ionization core comprising an organic ion source by using, for example, 1.0 MHz frequencies from a RF frequency source (not shown). In other configurations, the SMSC 5412 can be configured to select organic ions from an ionization core comprising an organic ion source by using, for example, 1 MHz frequencies from a RF frequency source (not shown). The SMSC/detector 5414 can be configured to select and detect inorganic ions from an ionization core comprising an inorganic ion source by using, for example, 2.5 MHz frequencies from a RF frequency source (not shown). It will be recognized by the person of ordinary skill in the art, given the benefit of this disclosure, that other frequencies can also be used. As noted herein, the SMSCs 5412, 5414 can desirably share common MS components including, but not limited to, gas controllers, processors, power supplies and vacuum pumps. The SMSC 5412 is typically fluidically coupled to a detector (not shown). In some examples, the one or both of the SMSCs 5412, 5414 could instead be configured as a dual core MS.

In other configurations, two or more TOFs can be used in conjunction with one or more other single MS cores, dual core MSs or multi-MS cores. For example and referring to FIG. 54C, a system 5420, e.g., a mass analyzer, comprises a first single MS core/detector 5422 comprising quadrupole assemblies Q1 and Q2 and a TOF can be used with a single MS core/detector 5424 comprising quadrupole assemblies Q1, Q2 and a TOF. The different cores 5422, 5424 can be present in the same housing but may be fluidically decoupled from each other to permit ions from one ionization core to be provided to the SMSC/detector 5422 and to permit ions from a different ionization core to be provided to the SMSC/detector 5424. For example, the SMSC/detector 5422 can be configured to select inorganic ions from an ionization core comprising an inorganic ion source by using, for example, 2.5 MHz frequencies from a RF frequency source (not shown). The SMSC/detector 5424 can be configured to select and detect organic ions from an ionization core comprising an organic ion source by using, for example, 1.0 MHz frequencies from a RF frequency source (not shown). In other configurations, the SMSC/detector 5422 can be configured to select organic ions from an ionization core comprising an organic ion source by using, for example, 1 MHz frequencies from a RF frequency source (not shown). The SMSC/detector 5424 can be configured to select and detect inorganic ions from an ionization core comprising an inorganic ion source by using, for example, 2.5 MHz frequencies from a RF frequency source (not shown). It will be recognized by the person of ordinary skill in the art, given the benefit of this disclosure, that other frequencies can also be used. As noted herein, the SMSC/detectors 5422, 5424 can desirably share common MS components including, but not limited to, gas controllers, processors, power supplies and vacuum pumps.

In certain embodiments, a TOF can be used with a dual core MS. For example and referring to FIG. 54D, a dual core MS 5430 comprises quadrupolar assemblies Q1 and Q2 and a TOF. The DCMS/detector 5432 can be configured to select inorganic ions from an ionization core comprising an inorganic ion source by using, for example, 2.5 MHz frequencies from a RF frequency source (not shown) electrically coupled to Q1 and/or Q2. The DCMS/detector 5424 can also be configured to select and detect organic ions from an ionization core comprising an organic ion source by using, for example, 1.0 MHz frequencies from a RF frequency source (not shown). It will be recognized by the person of ordinary skill in the art, given the benefit of this disclosure, that other frequencies can also be used. As noted herein, the DCMS/detector 5432 can desirably share common MS components including, but not limited to, gas controllers, processors, power supplies and vacuum pumps where other MS cores are present in the system 5430.

While not shown in FIGS. 54A-54D, a single MS core comprising a TOF can be used in combination with a dual core MS which may comprise a TOF or may comprise a different types of detector such as, for example, an EM, Faraday cup, scintillation detector, imager or other detectors. Similarly, a dual core MS comprising a TOF can be used with a single MS core comprising a different type of detector such as, for example, an EM, Faraday cup, scintillation detector, imager or other detectors.

Interfaces

Figure 55:
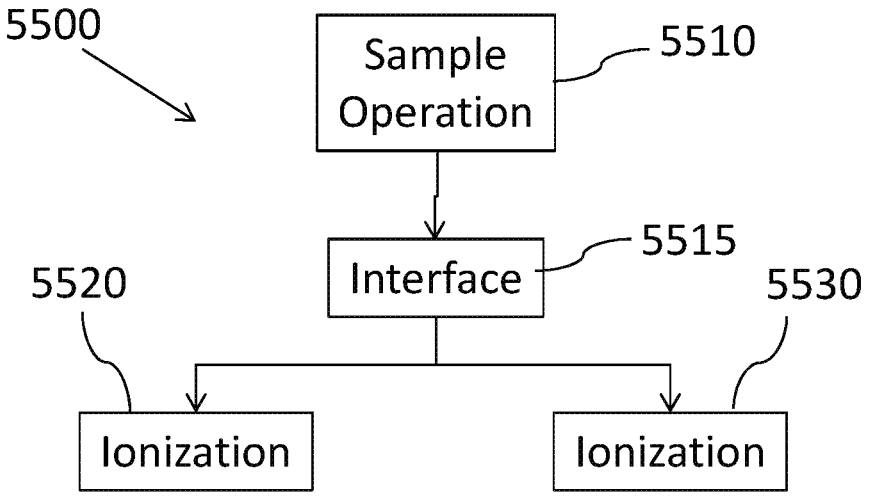
FIG. 55 is an illustration of a system comprising an interface between a sample operation core and two ionization cores, in accordance with certain embodiments.

In certain examples, the various cores described herein can be separated through one or more interfaces. Without wishing to be bound by any particular configuration, the interface generally can provide or direct sample, ions, etc. from one system component to another system component. In some configurations, one or more interfaces can be present between a sample operation core and an ionization core. Referring to FIG. 55, a system 5500 comprising a sample operation core 5510 is shown that is fluidically coupled to a first ionization core 5520 and a second ionization core 5530 through an interface 5510. The sample operation core 5510 may comprise any one or more of the sample operation cores described herein, e.g., an GC, LC, DSA, CE, etc. The ionization cores 5520, 5530 can be an inorganic ion source or an organic ion source, and in some instances, one of the ionization cores 5520, 5530 comprises an inorganic ion source and the other core 5520, 5530 comprises an organic ion source. The interface 5515 can be configured to direct analyte flow from the sample operation core 5510 to one or both of the ionization cores 5520, 5530. In some configurations, the interface 5515 may comprise one or more valves which can be positioned to direct analyte flow to one of the ionization cores 5520, 5530 at any particular analysis period. In other example, the interface 5515 may comprise one or more valves which can be positioned to direct analyte flow to both of the ionization cores 5520, 5530 at any particular analysis period. The exact configuration of the interface 5515 can depend on the particular sample provided from the sample operation core 5510, and illustrative interfaces may comprise 3-way valves, mechanical switches or valves, electrical switches or valves, fluid multiplexers, Swafer devices such as those described in commonly assigned U.S. Pat. Nos. 8,303,694, 8,562,837, and 8,794,053 or other devices which can direct flow of a gas, liquid or other materials from the sample operation core 5510 to one or more of the ionization cores 5520, 5530. In some examples, the interface 5515 may comprise a first outlet and a second outlet. The first outlet can be fluidically coupled to the ionization core 5520, and the second outlet can be fluidically coupled to the ionization core 5530. Flow of analyte through the first and second outlets can be controlled to determine which of the ionization cores 5520, 5530 receives sample from the sample operation core 5510.

Figure 56:
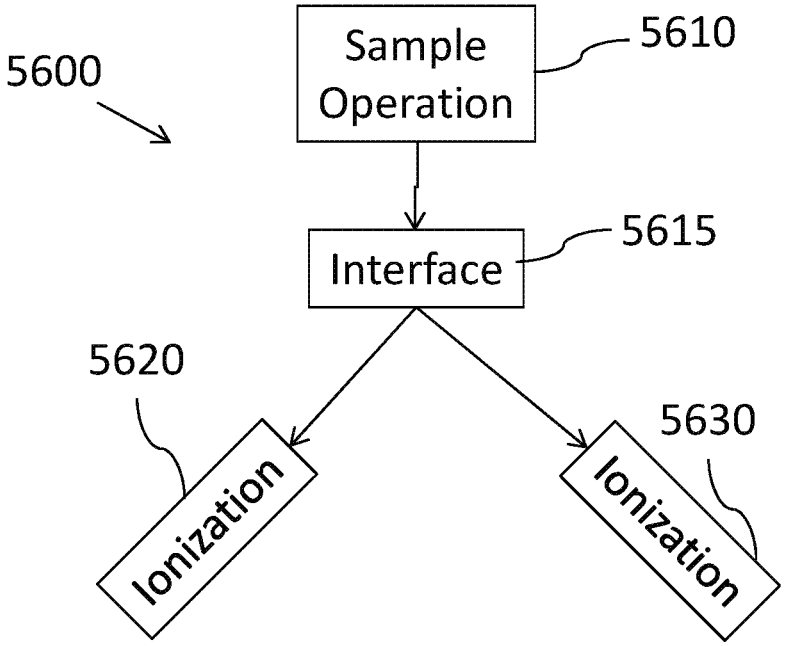
FIG. 56 is another illustration of a system comprising an interface between a sample operation core an two ionization cores, in accordance with certain embodiments.

In some embodiments, an interface between a sample operation core and one or more ionization cores can be configured to direct sample at a particular angle toward the ionization cores. Referring to FIG. 56, an interface 5615 is present between a sample operation core 5610 and two ionization cores 5620, 5630. The interface 5615 may comprise an outlet, nozzle, spray head, etc. which can provide sample to one of the ionization cores 5620, 5630 at any analysis period. The sample operation core 5610 may comprise any one or more of the sample operation cores described herein, e.g., an GC, LC, DSA, CE, etc. Similarly, the ionization cores 5620, 5630 can be an inorganic ion source or an organic ion source, and in some instances, one of the ionization cores 5620, 5630 comprises an inorganic ion source and the other core 5620, 5630 comprises an organic ion source. In some examples, movement of the outlet between two positions permits the system 5600 to provide ions to the ionization core 5620 in a first position and permits the system 5600 to provide ions to the ionization core 5630 in a second position of the outlet. The system 5600 may be configured to alternate the position of the outlet of the interface 5615 continuously so that ions are intermittently and sequentially provided to each of the ionization cores 5620, 5630 during an analysis period. By moving the outlet between the first position and the second position and then back to the first position continuously during an analysis period, inorganic ions and organic ions can be produced for analysis. The exact configuration of the interface 5615 can depend on the particular sample provided from the sample operation core 5610, and illustrative interfaces may comprise 3-way valves, mechanical switches or valves, electrical switches or valves, fluid multiplexers, Swafer devices such as those described in commonly assigned U.S. Pat. Nos. 8,303,694, 8,562,837, and 8,794,053 or other devices which can direct flow of a gas, liquid or other materials from the sample operation core 5610 to one or more of the ionization cores 5620, 5630. As noted in more detail below, the interface 5615 can provide ions to the ionization cores 5620, 5630 in a co-planar or a non-coplanar manner.

Figure 57:
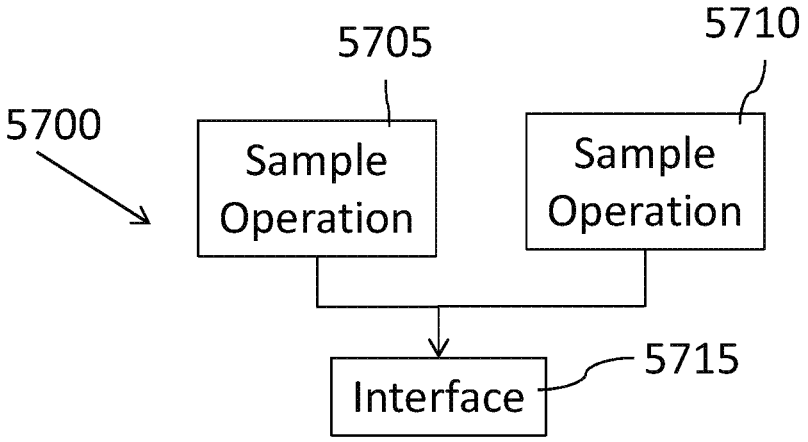
FIG. 57 is an illustration of a system comprising an interface fluidically coupled to two sample operation cores, in accordance with certain embodiments.

In some examples, the interfaces may be fluidically coupled to two or more sample operation cores and can be configured to receive sample from one or both of the sample operation cores depending on the configuration of the interface. Referring to FIG. 57, two sample operation cores 5705, 5710 can be present and fluidically coupled/decoupled to an interface 5715. For example, each of the sample operation cores 5705, 5710 can independently be one or more of a GC, LC, DSA, CE, etc. In some examples, the sample operation cores 5705, 5710 are different to permit analysis of a wider range of analytes and/or different forms of analytes present in a sample, e.g., to analyze liquids and solids present in a sample. The interface 5715 may comprise an inlet which can be configured to receive sample from one or both of the cores 5705, 5710 and may also comprise one or more outlets to provide sample to one or more ionization cores (not shown). The interface 5715 may comprise one or more valves that can be actuated between different positions to direct flow of sample from one of the cores 5705, 5710 through the interface 5715 and onto a downstream core. In some examples, the interface 5715 may comprise separate inlets for each of the cores 5705, 5710, and internal features within the interface 5715 may direct sample flow downstream to one or more other system cores. The exact configuration of the interface 5715 can depend on the particular sample provided from the sample operation cores 5705, 5710, and illustrative interfaces may comprise 3-way valves, mechanical switches or valves, electrical switches or valves, fluid multiplexers, Swafer devices such as those described in commonly assigned U.S. Pat. Nos. 8,303,694, 8,562,837, and 8,794,053 or other devices which can direct flow of a gas, liquid or other materials from the sample operation cores 5705, 5710 to one or more of downstream cores.

Figure 58A:
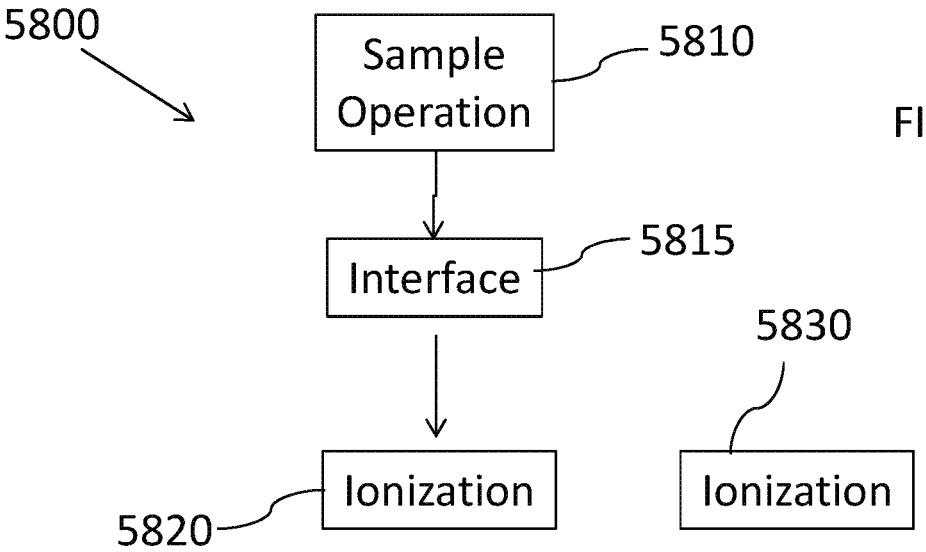
FIGS. 58A and 58B are illustrations of a system comprising an interface that can fluidically couple to two ionization cores, in accordance with certain embodiments.
Figure 58B:
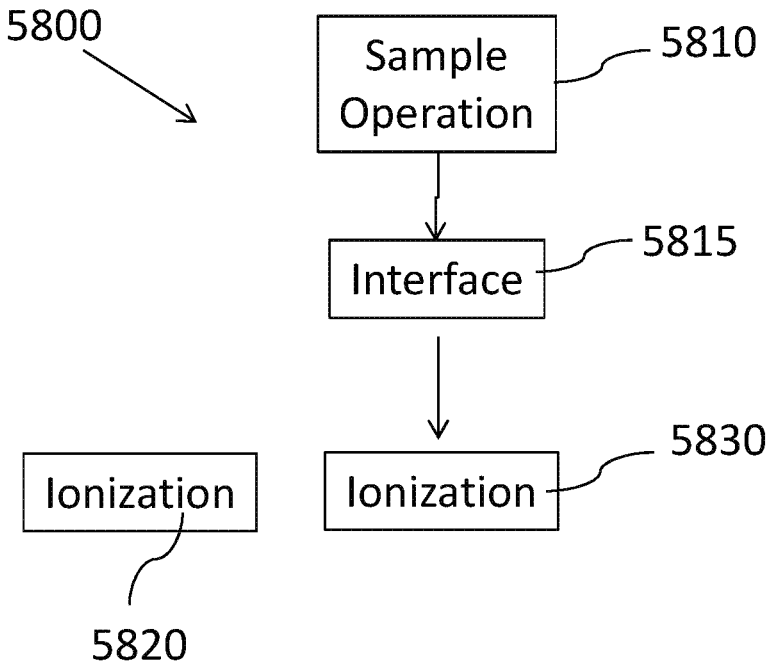

In some instances, the interface may be a fixed or stationary interface and one or more ionization cores can be moved into a particular position to receive analytes from the interface. Referring to FIGS. 58A and 58B, a system 5800 comprises an interface 5815 present between a sample operation core 5810 and two ionization cores 5820, 5830. The sample operation core 5810 may comprise any one or more of the sample operation cores described herein, e.g., a GC, LC, DSA, CE, etc. Similarly, the ionization cores 5820, 5830 can be an inorganic ion source or an organic ion source, and in some instances, one of the ionization cores 5820, 5830 comprises an inorganic ion source and the other core 5820, 5830 comprises an organic ion source. The interface 5815 can provide sample to the ionization core 5820 or the ionization core 5830 depending on the particular position of the ionization cores 5820, 5830. As shown in FIG. 58A, the ionization core 5820 can be positioned and fluidically coupled to the interface 5815 while the ionization core 5830 is fluidically decoupled from the interface 5815. In FIG. 58B, the ionization core 5830 can be positioned and fluidically coupled to the interface 5815 while the ionization core 5820 is fluidically decoupled from the interface 5815. The ionization cores 5820, 5830 can be positioned on a moveable stage which can translate the cores 5820, 5830 using a motor, engine, motive source, etc. as desired. For example, a stepper motor can be coupled to the moveable stage and used to switch the ionization cores 5820, 5830 between positions. As noted herein, the positions of the cores 5820, 5830 need not be one-dimensional. Instead, the height and/or lateral position of the cores 5820, 5830 could be altered to fluidically couple/decouple the cores 5820, 5830 to the interface 5815.

Figure 59A:
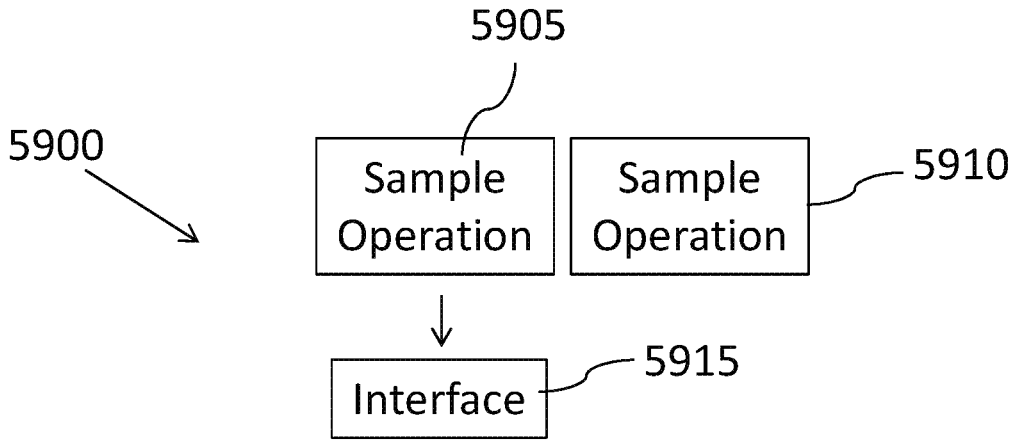
FIGS. 59A and 59B are illustrations of a system comprising an interface that can fluidically couple to two sample operation cores, in accordance with certain embodiments.
Figure 59B:
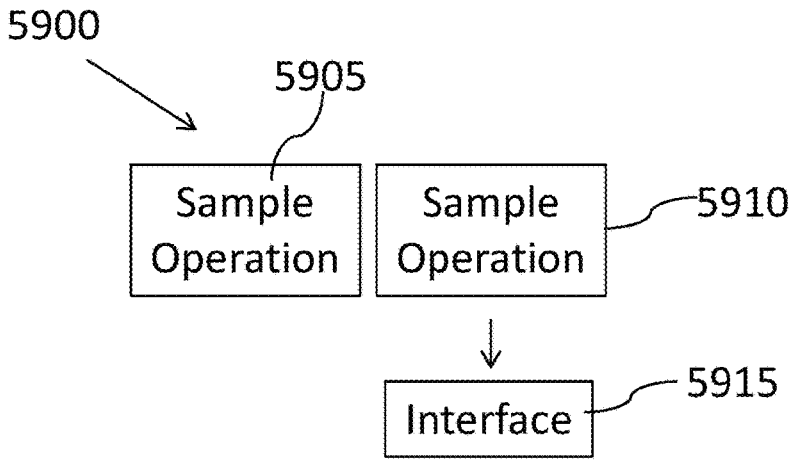

In other instances, the interface may be a fixed or stationary interface and one or more sample operation cores can be moved into a particular position to receive analytes from the interface. Referring to FIGS. 59A and 59B, a system 5900 comprises an interface 5915 that can be fluidically coupled/decoupled to sample operation cores 5905, 5910. For example, each of the sample operation cores 5905, 5910 can independently be one or more of a GC, LC, DSA, CE, etc. In some examples, the sample operation cores 5905, 5910 are different to permit analysis of a wider range of analytes and/or different forms of analytes present in a sample, e.g., to analyze liquids and solids present in a sample. The interface 5915 can receive sample from the sample operation core 5905 or the sample operation core 5910 depending on the particular position of the sample operation cores 5905, 5910. As shown in FIG. 59A, the sample operation core 5905 can be positioned and fluidically coupled to the interface 5915 while the sample operation core 5910 is fluidically decoupled from the interface 5915.

In FIG. 59B, the sample operation core 5910 can be positioned and fluidically coupled to the interface 5915 while the sample operation core 5905 is fluidically decoupled from the interface 5915. The sample operation cores 5905, 5910 can be positioned on a moveable stage which can translate the cores 5905, 5910 using a motor, engine, motive source, etc. as desired. For example, a stepper motor can be coupled to the moveable stage and used to switch the sample operation core 5905, 5910 between positions. As noted herein, the positions of the cores 5905, 5910 need not be one-dimensional. Instead, the height and/or lateral position of the cores 5905, 5910 could be altered to fluidically couple/decouple the cores 5905, 5910 to the interface 5915.

Figure 60:
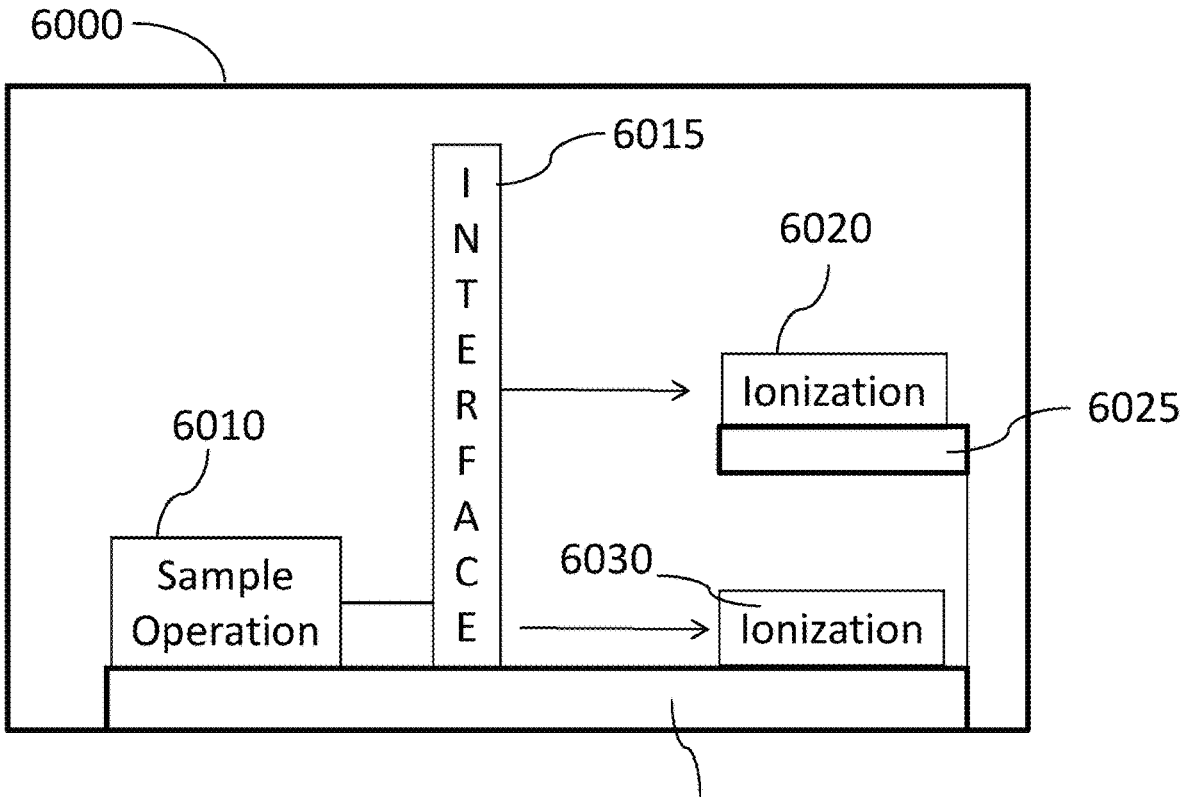
FIG. 60 is an illustration of an interface which can provide sample to two ionization cores at different heights within an instrument, in accordance with certain examples.

In some examples, an interface can be present between a sample operation core and can be used to provide sample to two or more ionization cores which are non-coplanar. For example, two ionization cores can be positioned at different heights within an instrument. Depending on the particular configuration of the interface and/or ionization cores, the sample can be provided to one or both of the ionization cores. A simplified schematic is shown in FIG. 60. The system 6000 comprises a sample operation core 6010 or may comprise more than one sample operation core. For example, the sample operation cores 6010 can be one or more of a GC, LC, DSA, CE, etc. An interface 6015 is present between the sample operation core 6010 and ionization cores 6020, 6030. The ionization cores 6020, 6030 can be an inorganic ion source or an organic ion source, and in some instances, one of the ionization cores 6020, 6030 comprises an inorganic ion source and the other core 6020, 6030 comprises an organic ion source. The ionization core 6020 is elevated and rests on a support 6025 whereas the ionization core 6020 rests on a support 6005. In some examples, the interface 6015 may comprise a first outlet which can provide sample to the ionization core 6020 and a second outlet which can provide sample to the ionization core 6030 simultaneously. In other configurations, the interface can be moved between two positions, e.g., elevated, to provide sample to the ionization core 6020 in a first position and to provide sample to the ionization core 6030 in a second position. For example, a motor, engine or other motive source can be coupled to the interface 6015 and used to move the interface 6015 up and down to the different positions to fluidically couple/decouple the interface 6015 to/from the various ionization cores 6020, 6025

Figure 61A:
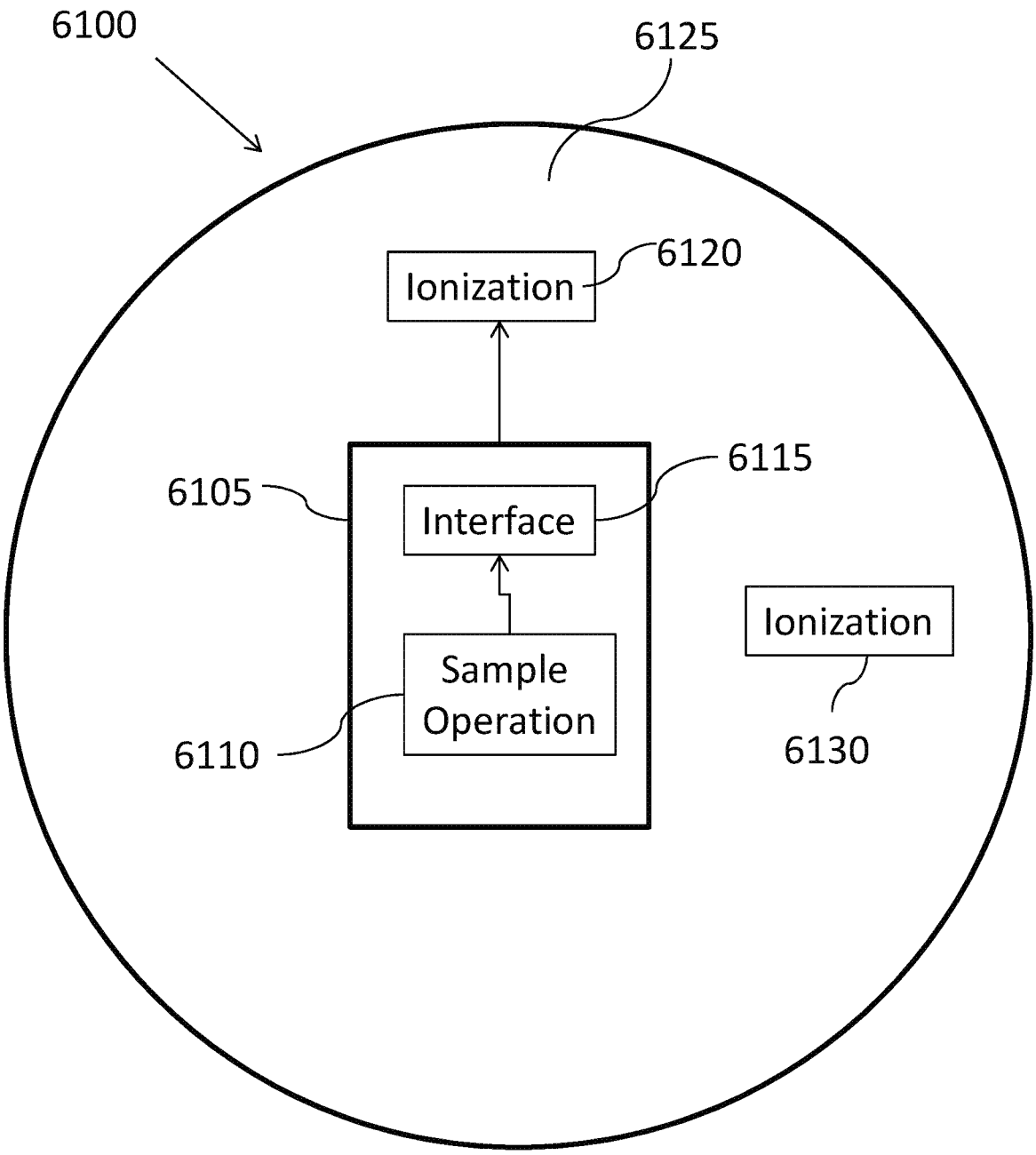
FIGS. 61A, 61B, 61C and 61D are illustrations of a system comprising a rotatable stage with one or more ionization cores, in accordance with certain configurations.
Figure 61B:
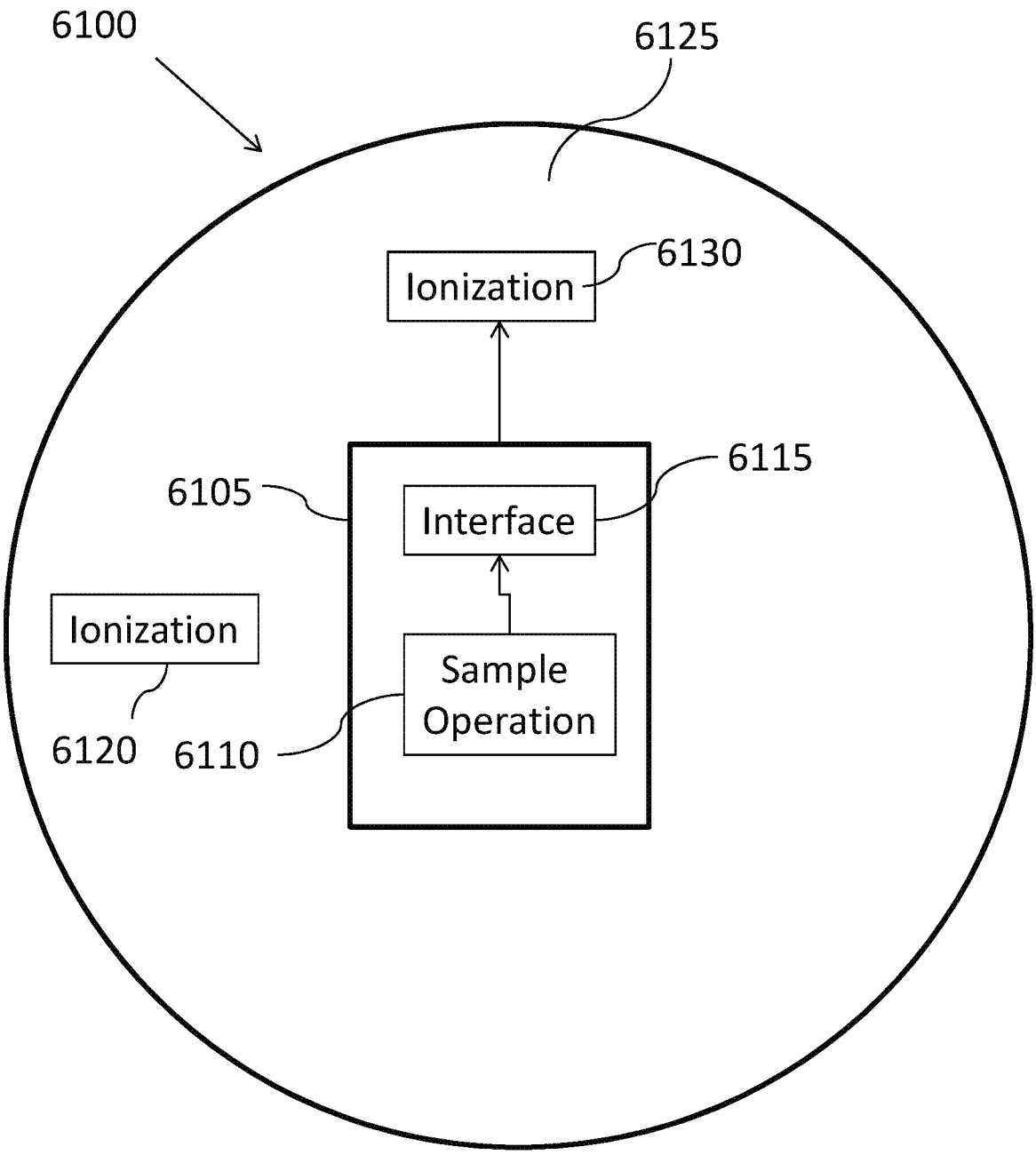
Figure 61C:
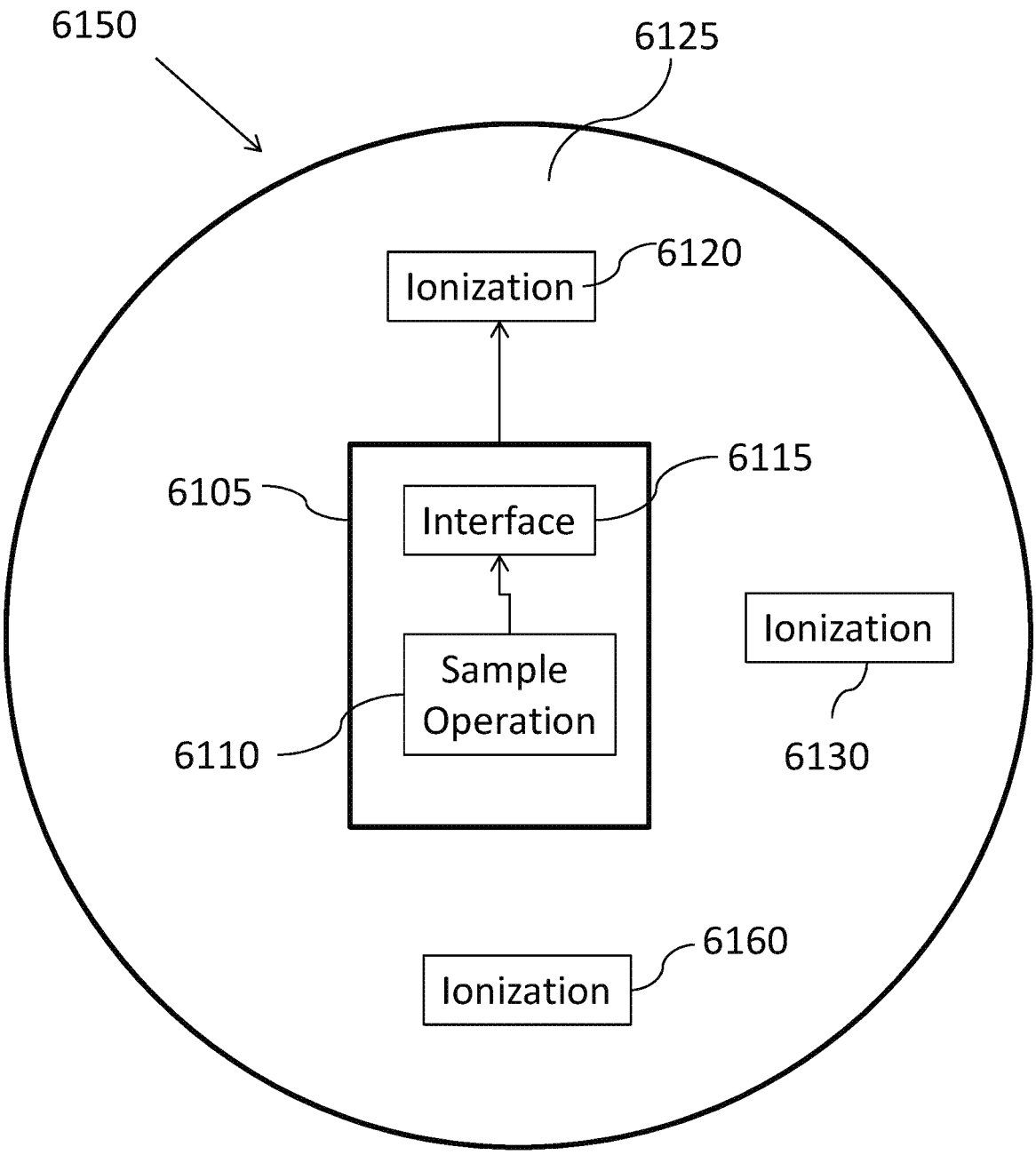
Figure 61D:
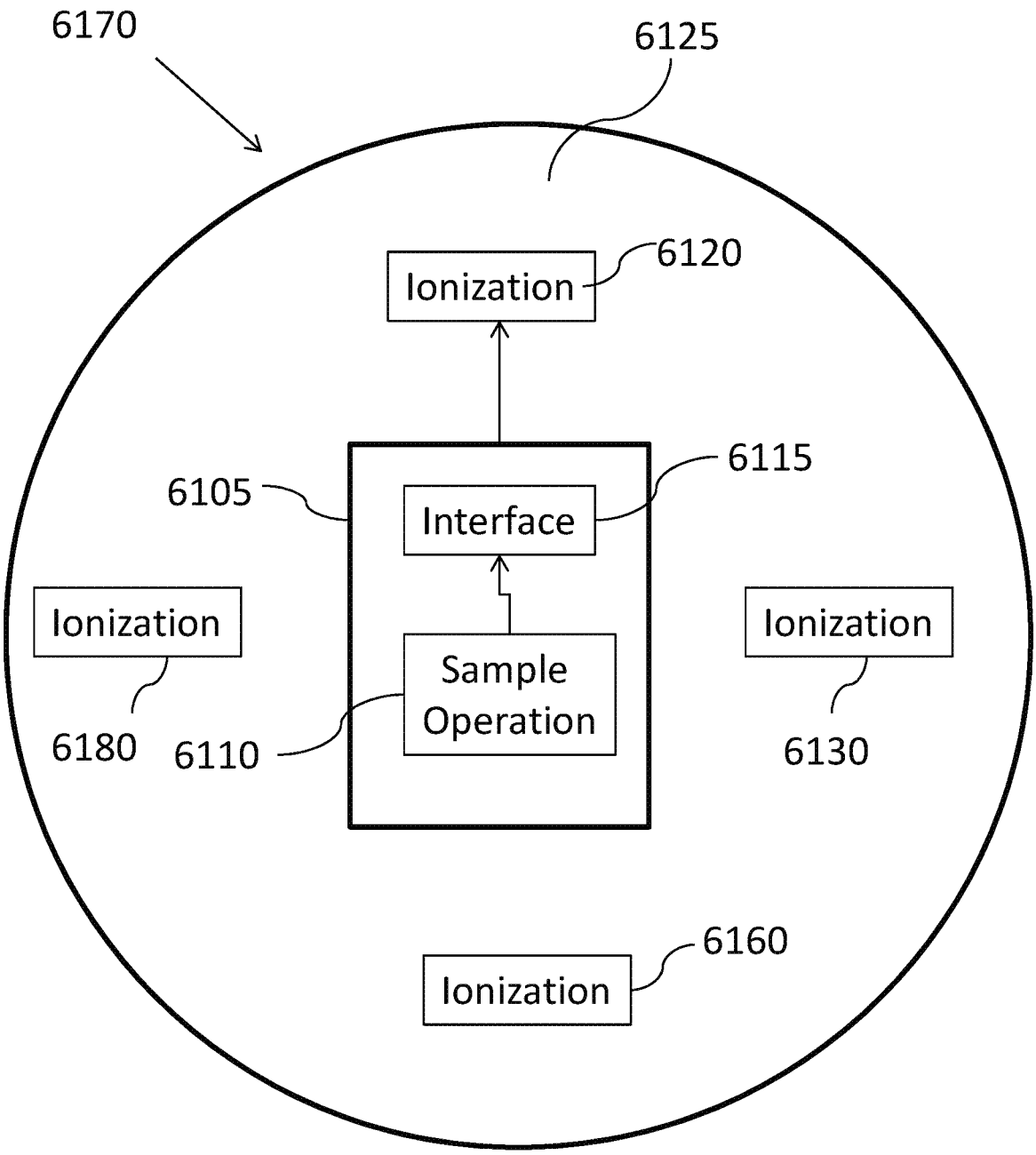

In certain embodiments, the ionization cores can be present on a rotatable disk or stage and circumferential rotation can be implemented to fluidically couple/decouple the interfaces to the various ionization cores. Referring to FIG. 61A, a system 6100 comprises a sample operation core 6110, an interface 6115, and two ionization cores 6120, 6130. The sample operation core 6110 may comprise any one or more of the sample operation cores described herein, e.g., a GC, LC, DSA, CE, etc. Similarly, the ionization cores 6120, 6130 can be an inorganic ion source or an organic ion source, and in some instances, one of the ionization cores 6120, 6130 comprises an inorganic ion source and the other core 6120, 6130 comprises an organic ion source. In use of the system 6100, the sample operation core 6110 and interface 6115 can be centrally positioned in a housing 6105. The ionization cores 6120, 6130 can circumferentially rotate between various positions using a platform or stage 6125. For example, as shown in FIG. 61A, ionization core 6120 can be present in a first position which fluidically couples the ionization core 6120 to the interface 6115. Ionization core 6130 is fluidically decoupled from the interface 6115 in FIG. 61A. Circumferential rotation of the stage 6125 by about ninety degrees counterclockwise can fluidically decouple the ionization core 6120 from the interface 6115 and fluidically couple the ionization core 6130 to the interface 6115 as shown in FIG. 61B. While a ninety degree rotation is used in FIG. 61B, the exact number of degrees the platform 6125 rotates can vary from about five degrees to about ninety degrees, for example. In some instances, another ionization core can be present. Referring to FIG. 61C, a system 6150 is shown which comprises an additional ionization core 6160. Referring to FIG. 61D, a system 6170 is shown which comprises a fourth ionization core 6180. The additional ionization cores 6160, 6180 are typically different from each other and also different from the cores 6120, 6130 to expand the possible types of ionization sources which may be present in a particular system. In FIG. 61C, rotation of the platform 6125 by about 180 degrees can fluidically couple the ionization core 6160 and the interface 6115. In FIG. 61D, rotation of the platform 6125 by about 90 degrees clockwise or 270 degrees counterclockwise can fluidically couple the ionization core 6180 and the interface 6115.

Figure 62A:
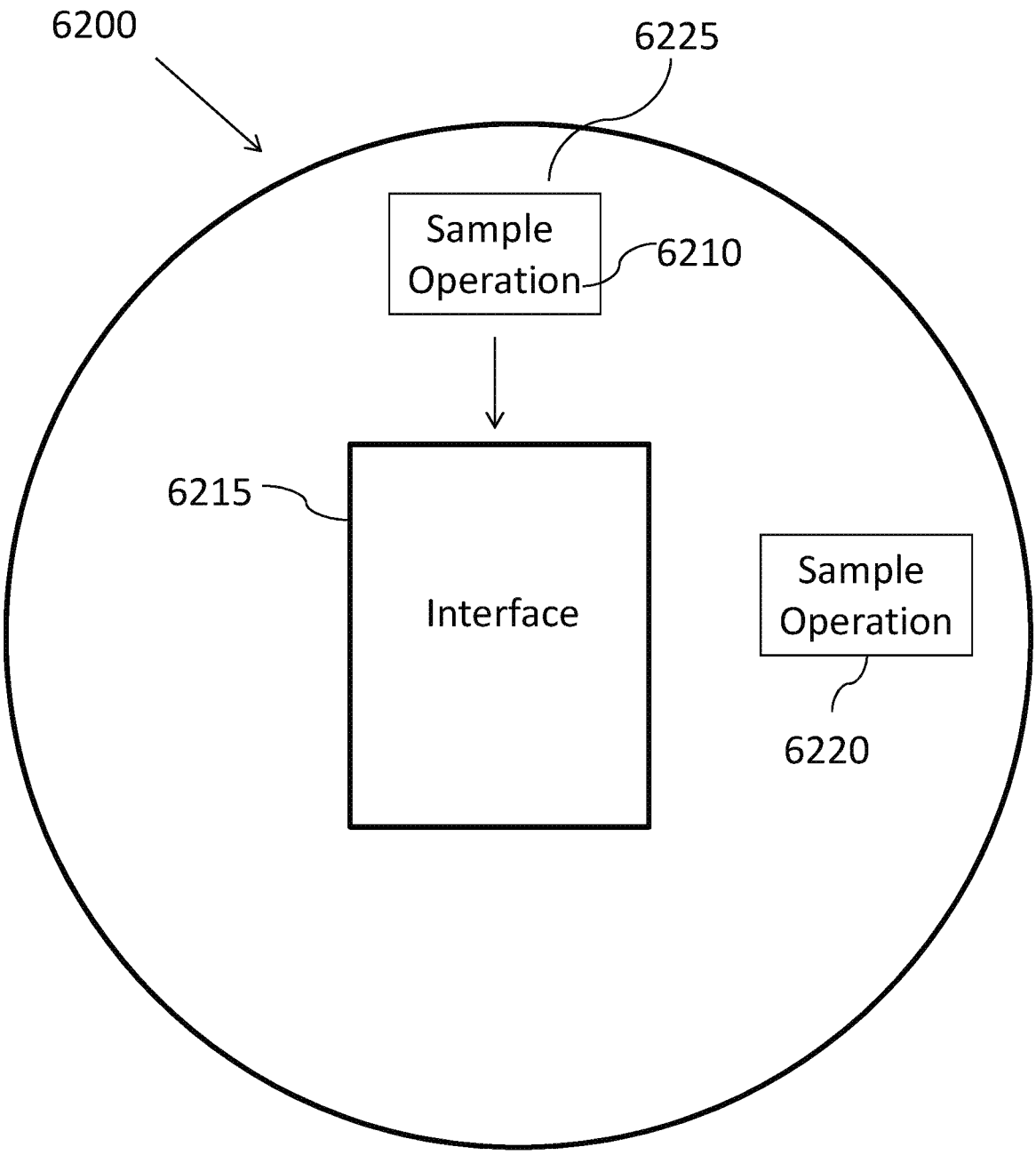
FIGS. 62A, 62B, 62C and 62D are illustrations of a system comprising a rotatable stage with one or more sample operation cores, in accordance with certain configurations.
Figure 62B:
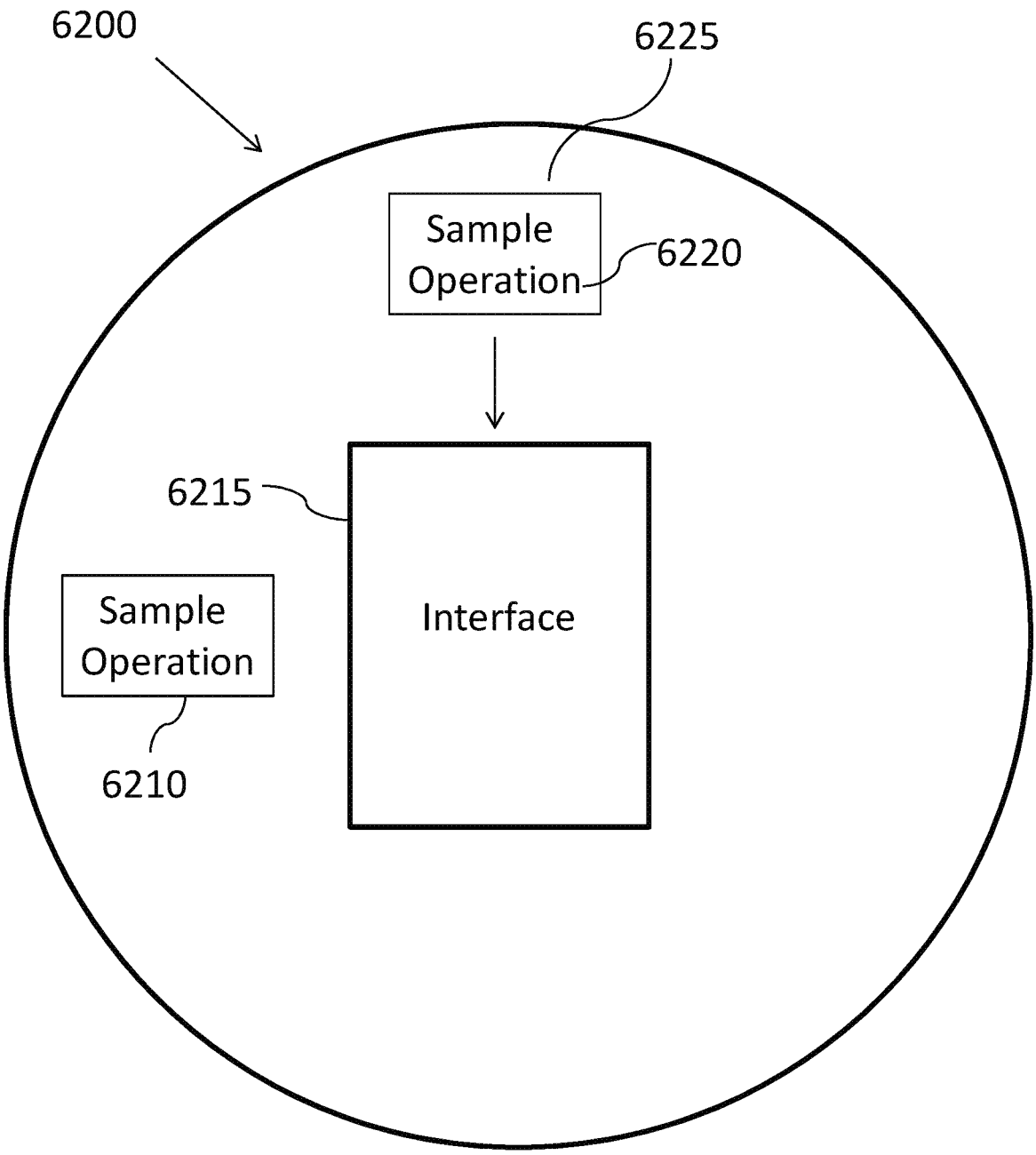
Figure 62C:
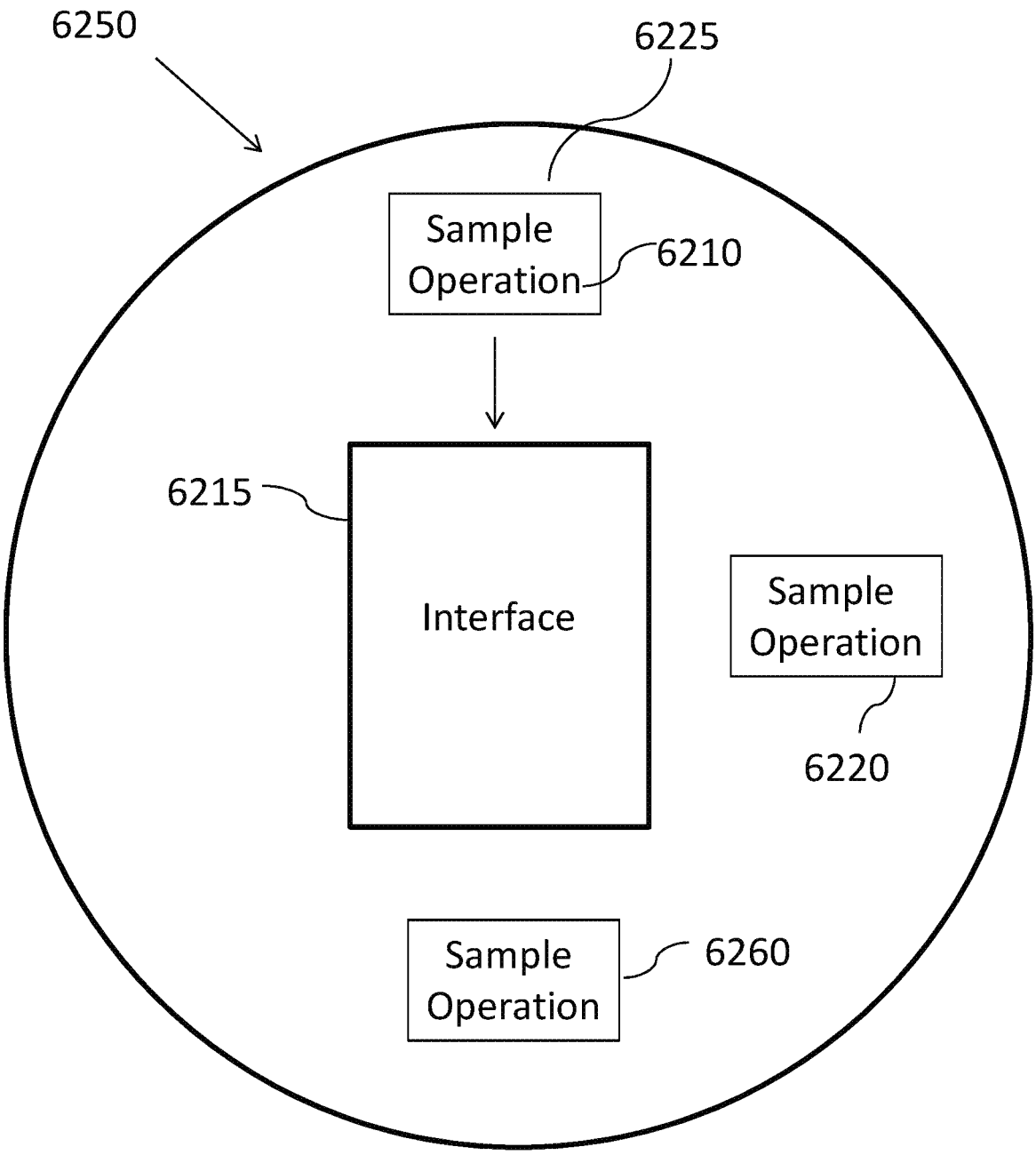
Figure 62C:
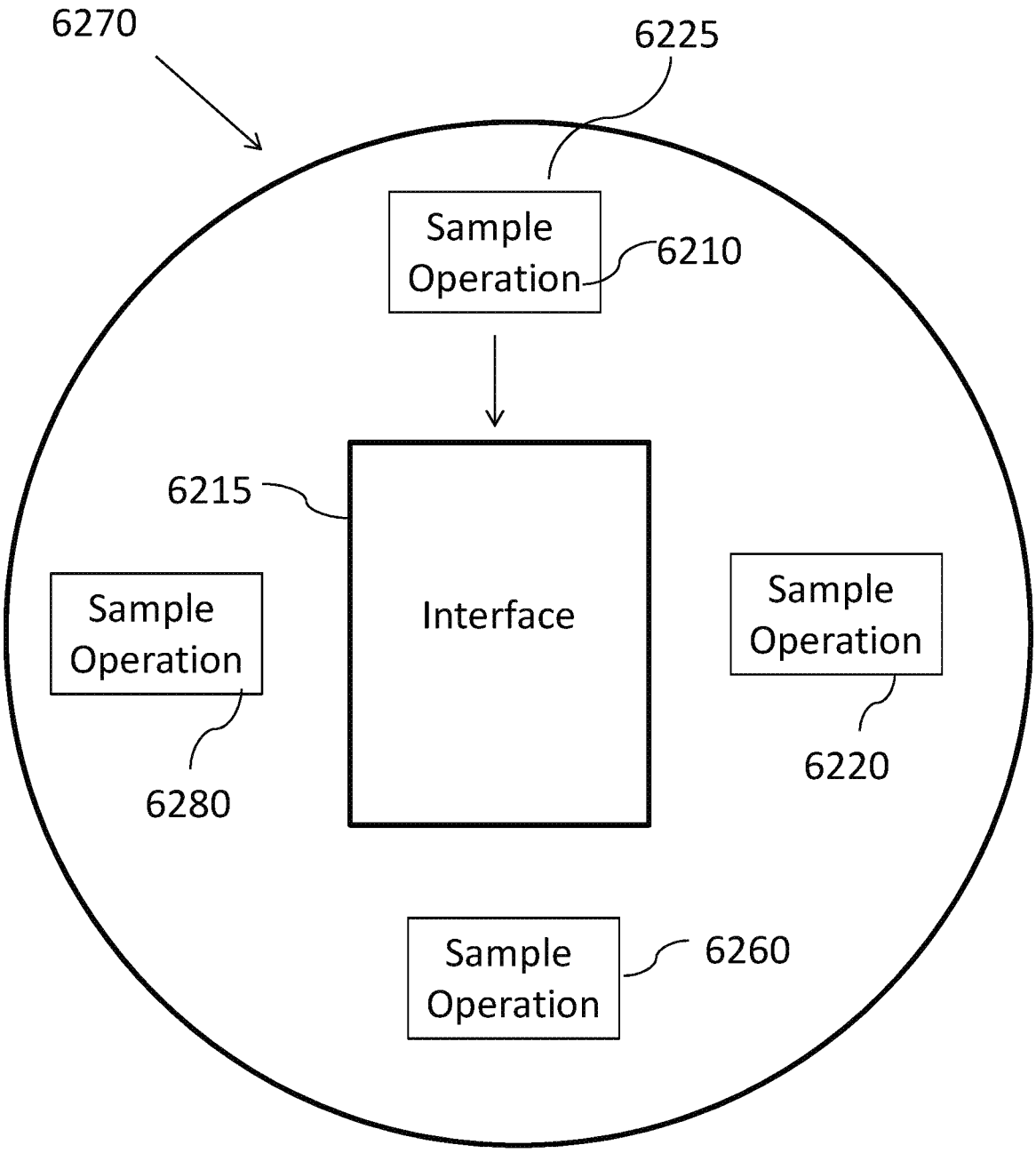
Figure 62D:
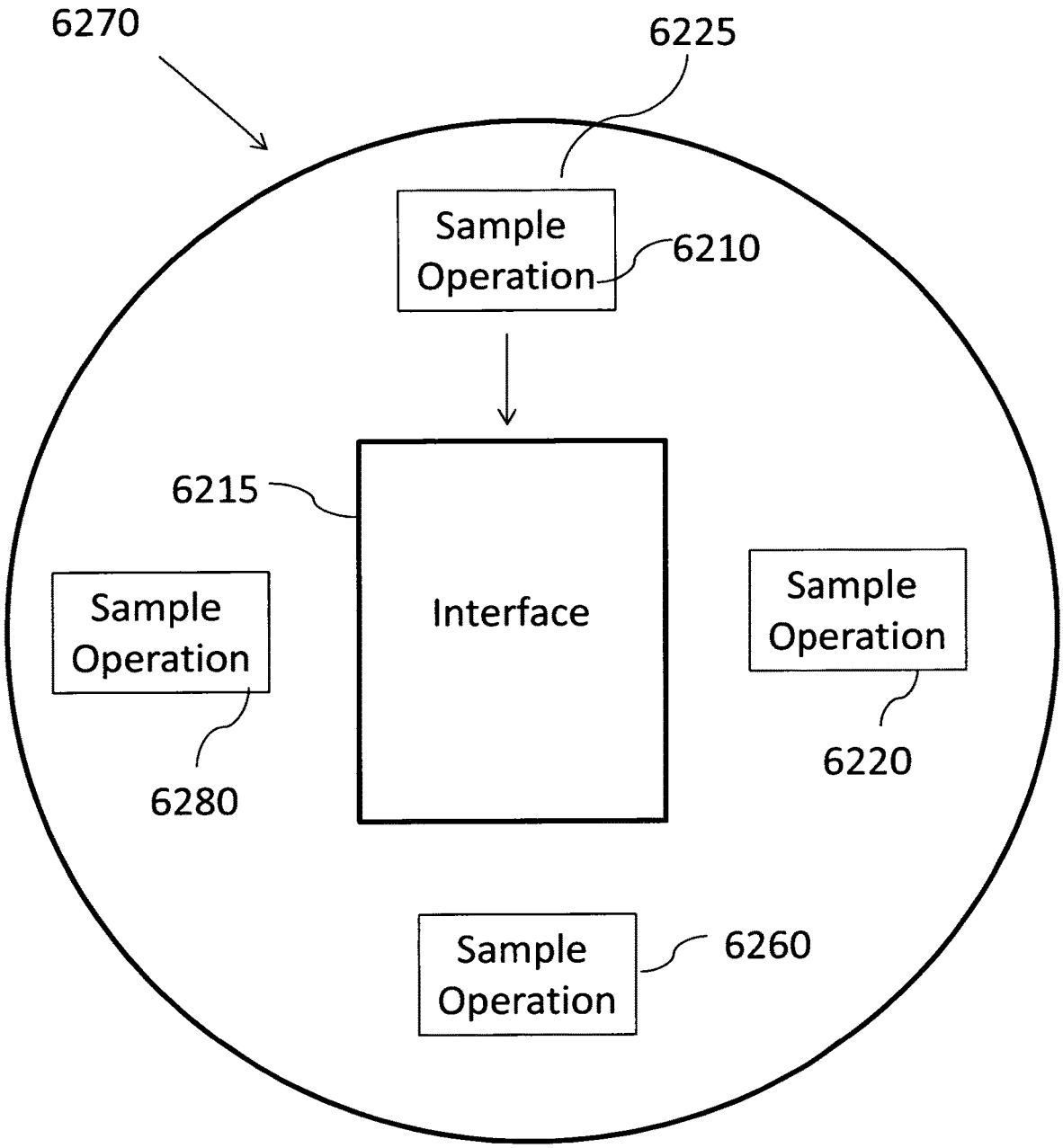

In certain examples, one or more sample operation cores can be present on a rotatable disk or stage and circumferential rotation can be implemented to fluidically couple/decouple the sample operation cores to an interface. Referring to FIG. 62A, a system 6200 comprises sample operation cores 6210, 6220 and an interface 6215. The sample operation cores 6210, 6215 may independently comprise any one or more of the sample operation cores described herein, e.g., a GC, LC, DSA, CE, etc. In some examples, the sample operation cores 6210, 6210 are different to permit analysis of a wider range of analytes and/or different forms of analytes present in a sample, e.g., to analyze liquids and solids present in a sample. In use of the system 6200, the interface 6215 can be centrally positioned and ionization cores (not shown) can be positioned above/below or in other manners relative to the position of the interface 6215. The sample operation cores 6210, 6220 can circumferentially rotate between various positions using a platform or stage 6225. For example, as shown in FIG. 62A, sample operation core 6210 can be present in a first position which fluidically couples the sample operation core 6210 to the interface 6215. The sample operation core 6230 is fluidically decoupled from the interface 6215 in FIG. 61A. Circumferential rotation of the stage 6225 by about ninety degrees counterclockwise can fluidically decouple the sample operation core 6220 from the interface 6215 and fluidically couple the sample operation core 6230 to the interface 6115 as shown in FIG. 61B. While a ninety degree rotation is used in FIG. 62B, the exact number of degrees the platform 6225 rotates can vary from about five degrees to about ninety degrees, for example. In some instances, another sample operation core can be present. Referring to FIG. 61C, a system 6260 is shown which comprises an additional sample operation core 6260. Referring to FIG. 61D, a system 6270 is shown which comprises a fourth sample operation core 6280. The additional sample operation cores 6260, 6280 are typically different from each other and also different from the cores 6220, 6230 to expand the possible types of sample operation devices which may be present in a particular system. In FIG. 62C, rotation of the platform 6225 by about 180 degrees can fluidically couple the sample operation core 6260 and the interface 6115. In FIG. 62D, rotation of the platform 6225 by about 90 degrees clockwise or 270 degrees counterclockwise can fluidically couple the sample operation core 6280 and the interface 6215.

In certain examples, the ionization cores and the MS cores can be separated/coupled through one or more interfaces.

Figure 63:
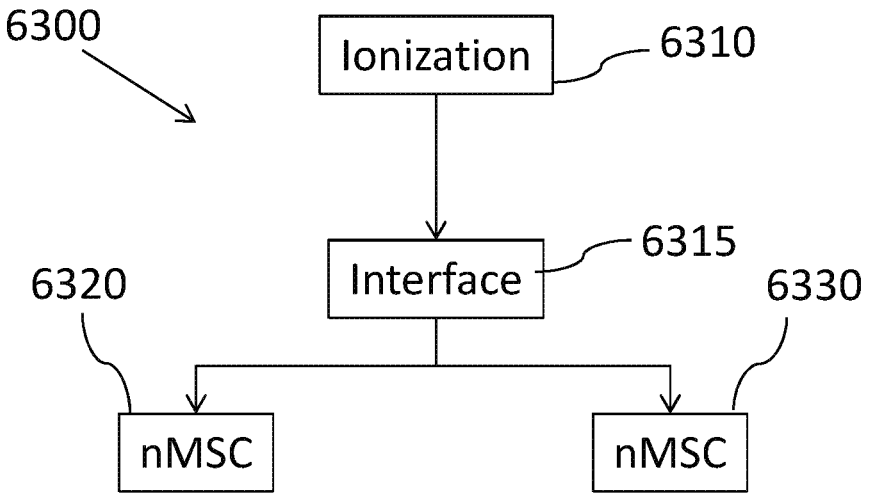
FIG. 63 is an illustration of a system comprising an interface between an ionization core and two single core, dual core or multi-core mass spectrometers, in accordance with certain embodiments.

Referring to FIG. 63, a system 6300 comprises an ionization 6310 that is fluidically coupled to an interface 6315. The interface 6315 can fluidically coupled/decouple to a first nMSC 6320 (where nMSC is at least one single MS core or at least one dual core MS) and a second nMSC 6330. The nMSCs 6320, 6330 can be the same or different, but they typically are different so that one of the nMSCs 6320, 6330 can select inorganic ions and the other of the nMSCs 6320, 6330 can select organic ions. While not shown, the nMSC 6320, 6330 may be fluidically coupled to a common detector or each of the nMSCs 6320, 6330 may be fluidically coupled to a respective detector. The interface 6315 can be configured to direct ion flow from the interface 6315 to one or both of the nMSCs 6320, 6330. In some configurations, the interface 6315 may comprise one or more valves, lenses, deflectors, etc. which can be positioned to direct ion flow to one of the nMSC 6320, 6330 at any particular analysis period. In other examples, the interface 6315 may comprise one or more valves, lenses, deflectors, etc. which can be positioned to direct analyte flow to both of the nMSCs 6320, 6330 at any particular analysis period. The exact configuration of the interface 6315 can depend on the particular sample provided from the ionization core 6310, and illustrative interfaces may comprise multipole deflectors which can receive/deflect ions in a co-planar manner or in a non-coplanar manner. Illustrative deflectors are described for example in commonly assigned U.S. Patent Publication Nos. 20140117248, 20150136966 and 20160172176, and certain specific types of deflectors are described in more detail herein. In some examples, the interface 6315 may comprise a first outlet and a second outlet. The first outlet can be fluidically coupled to the nMSC 6320, and the second outlet can be fluidically coupled to the nMSC 6330. Flow of ions through the first and second outlets can be controlled to determine which of the nMSC 6320, 6330 receives sample from the interface 6315. Similarly, flow of ions into the interface 6315 can be controlled to determine the nature and/or type of ions which are provided from the interface 6315 to a downstream nMSC.

Figure 64:
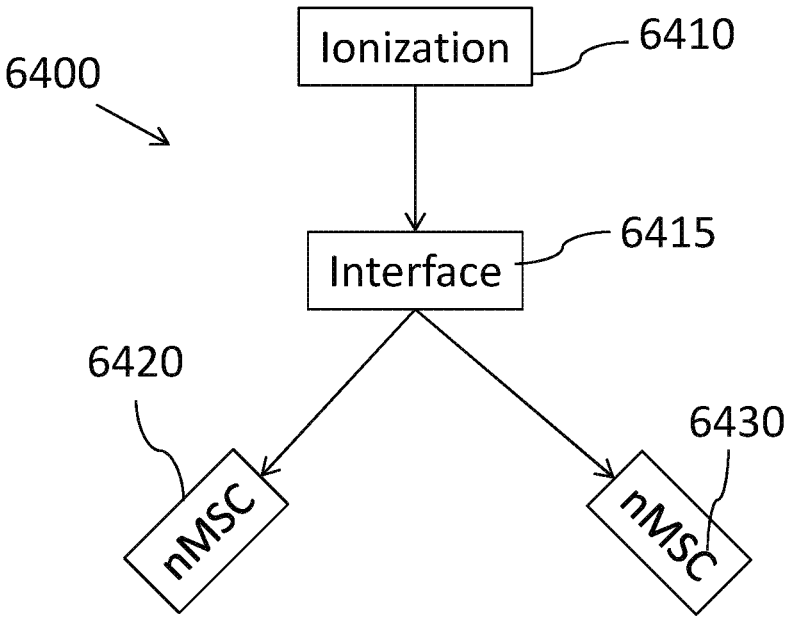
FIG. 64 is another illustration of a system comprising an interface between an ionization core and two single core, dual core or multi-core mass spectrometers, in accordance with certain embodiments.

In some embodiments, an interface between an ionization core and nMSCs of a mass analyzer can be configured to direct ions at a particular angle toward the nMSCs. Referring to FIG. 64, an interface 6415 is present between an ionization core 6410 and two nMSCs 6420, 6430. The interface 6415 can be configured to direct ion flow from the interface 6415 at a particular angle to one or both of the nMSCs 6420, 6430. In some configurations, the interface 6415 may comprise one or more valves, lenses, deflectors, etc. which can be positioned to direct ion flow to one of the nMSCs 6420, 6430 at any particular analysis period. In other examples, the interface 6415 may comprise one or more valves, lenses, deflectors, etc. which can be positioned to direct analyte flow to both of the nMSCs 6420, 6430 at any particular analysis period. The exact configuration of the interface 6415 can depend on the particular sample provided from the ionization core 6410, and illustrative interfaces may comprise multipole deflectors which can receive/deflect ions in a co-planar manner or in a non-coplanar manner. Illustrative deflectors are described for example in commonly assigned U.S. Patent Publication Nos. 20140117248, 20150136966 and 20160172176, and certain specific types of deflectors are described in more detail herein. The nMSC 6420, 6430 can be the same or different, but they typically are different so that one of the nMSC 6420, 6430 can select inorganic ions and the other of the nMSC 6420, 6430 can select organic ions. While not shown, the nMSCs 6420, 6430 may be fluidically coupled to a common detector or each of the nMSCs 6420, 6430 may be fluidically coupled to a respective detector. The interface 6415 may be configured to provide ions at different angles to one of the nMSCs 6420, 6430 at any analysis period. In some examples, application of a voltage to the interface 6415 permits the system 6400 to provide ions to the nMSC 6420 and application of a different voltage permits the system 6400 to provide ions to the nMSC 6430. The system 6400 may be configured to alternate the angle of the provided ions so that ions are intermittently and sequentially provided to each of the nMSCs 6420, 6430 during an analysis period. By altering the output angle of the ions, ions can sequentially be provided between the nMSCs 6420, 6430 during an analysis period to detect, for example, inorganic ions and organic ions in a sample.

Figure 65:
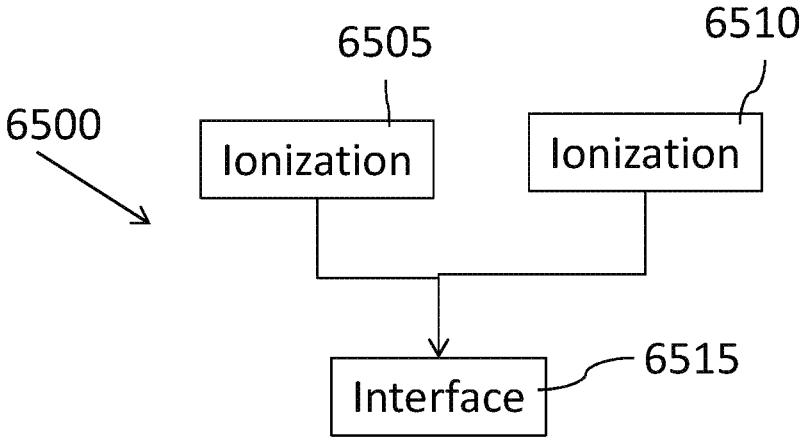
FIG. 65 is an illustration of a system comprising an interface fluidically coupled to two ionization cores, in accordance with certain embodiments.

In some examples, the interfaces may be fluidically coupled to two or more sample ionization cores and can be configured to receive ions from one or both of the ionization cores depending on the configuration of the interface. Referring to FIG. 65, two ionization cores 6505, 6510 can be present and fluidically coupled/decoupled to an interface 6515. The ionization cores 6505, 6510 may comprise an inorganic ion source or an organic ion source, and in some instances, one of the ionization cores 6510, 6520 comprises an inorganic ion source and the other core 6510, 6520 comprises an organic ion source. In certain configurations, the interface 6515 may comprise one or more valves, lenses, deflectors, etc. which can be positioned to receive ions from the ionization cores 6505, 6510 at any particular analysis period. In other examples, the interface 6515 may comprise one or more valves, lenses, deflectors, etc. which can be positioned to receive ions from both of the ionization cores 6505, 6510 at any particular analysis period. The exact configuration of the interface 6515 can depend on the particular sample provided from the ionization cores 6505, 6510, and illustrative interfaces may comprise multipole deflectors which can receive/deflect ions in a co-planar manner or in a non-coplanar manner. Illustrative deflectors are described for example in commonly assigned U.S. Patent Publication Nos. 20140117248, 20150136966 and 20160172176, and certain specific types of deflectors are described in more detail herein. While not shown, the interface 6515 is typically configured to provide ions to one or more downstream mass analyzers for MS and subsequent detection. In some instances, the interface may be a fixed or stationary interface and one or more ionization cores can be moved into a particular position to receive analytes from the interface.

Figure 66A:
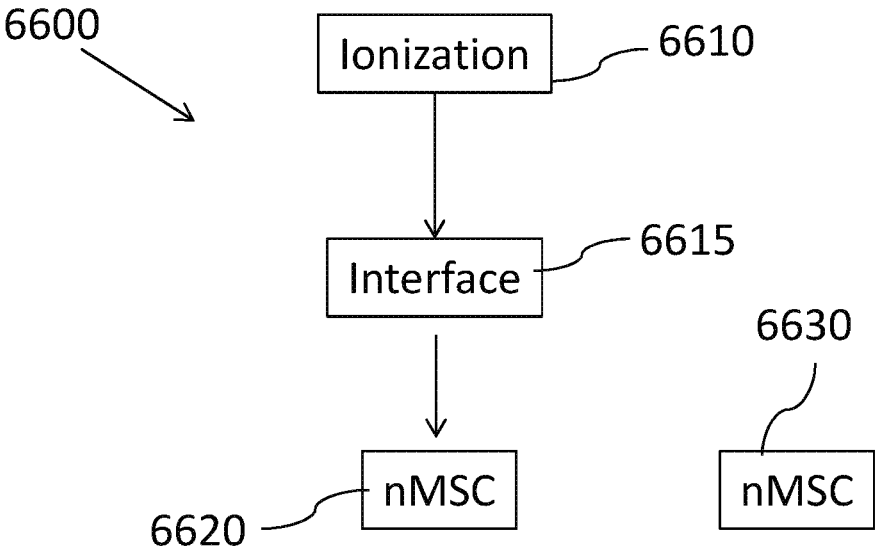
FIGS. 66A and 66B are illustrations of a system comprising an interface that can fluidically couple to two single core, dual core or multi-core mass spectrometers, in accordance with certain embodiments.
Figure 66B:
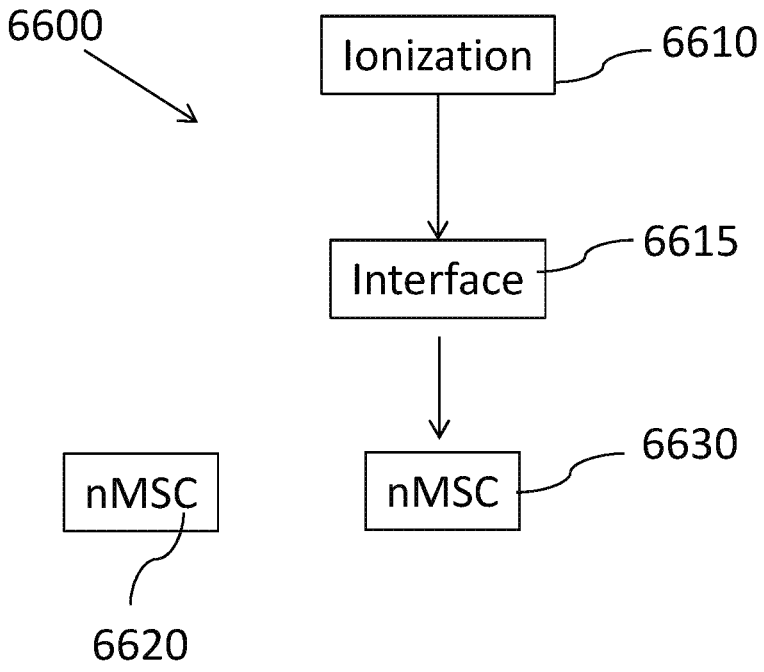

Referring to FIGS. 66A and 66B, a system 6600 comprises an interface 6615 present between an ionization core 6610 and two mass analyzer nMSCs 6620, 6630. The ionization core 6610 may comprise an inorganic ion source and/or an organic ion source. The nMSCs 6620, 6630 can be the same or different, but they typically are different so that one of the nMSCs 6620, 6630 can select inorganic ions and the other of the nMSCs 6620, 6630 can select organic ions. While not shown, the nMSCs 6620, 6630 may be fluidically coupled to a common detector or each of the nMSCs 6620, 6630 may be fluidically coupled to a respective detector. The interface 6615 can provide sample to the nMSC 6620 or the nMSC 6630 depending on the particular position of the nMSCs 6620, 6630. As shown in FIG. 66A, the nMSC 6620 can be positioned and fluidically coupled to the interface 6615 while the nMSC 6630 is fluidically decoupled from the interface 6615. In FIG. 66B, the nMSC 6630 can be positioned and fluidically coupled to the interface 6615 while the nMSC 6620 is fluidically decoupled from the interface 6615.

The nMSCs 6620, 6630 can be positioned on a moveable stage which can translate the cores 6620, 6630 using a motor, engine, motive source, etc. as desired. For example, a stepper motor can be coupled to the moveable stage and used to switch the nMSCs 6620, 6630 between positions. As noted herein, the positions of the nMSCs 6620, 6630 need not be one-dimensional. Instead, the height and/or lateral position of the nMSCs 6620, 6630 could be altered to fluidically couple/decouple the nMSCs 6620, 6630 to the interface 6615.

Figure 67A:
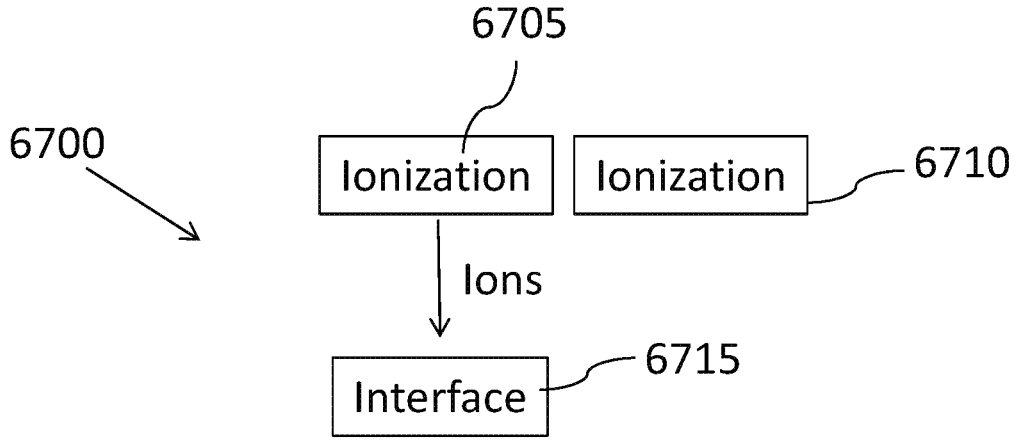
FIGS. 67A and 67B are illustrations of a system comprising an interface that can fluidically couple to two ionization cores, in accordance with certain embodiments.
Figure 67B:
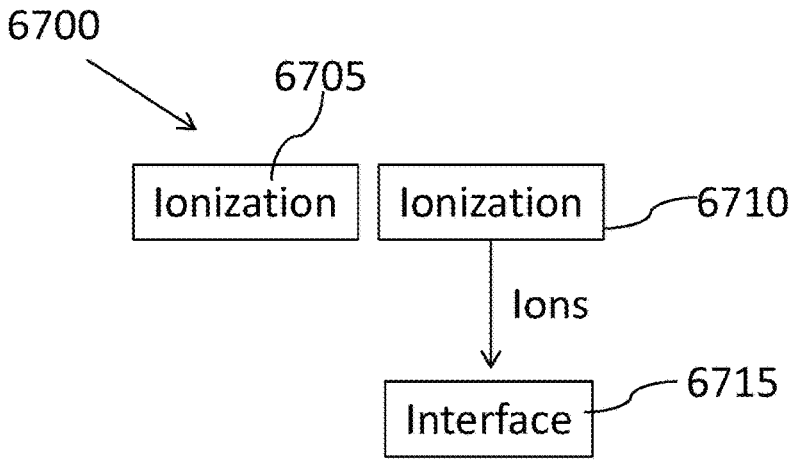

In other instances, the interface may be a fixed or stationary interface and one or more ionization cores can be moved into a particular position to provide ions to the interface. Referring to FIGS. 67A and 67B, a system 6700 comprises an interface 6715 that can be fluidically coupled/decoupled to ionization cores 6705, 6710. The ionization cores 6705, 6710 may comprise an inorganic ion source or an organic ion source, and in some instances, one of the ionization cores 6705, 6710 comprises an inorganic ion source and the other core 6720, 6730 comprises an organic ion source. The interface 6715 can receive ions from the ionization core 6705 or the ionization core 6730 depending on the particular position of the ionization cores 6705, 6710. As shown in FIG. 67A, the ionization core 6705 can be positioned and fluidically coupled to the interface 6715 while the ionization core 6710 is fluidically decoupled from the interface 6715. In FIG. 67B, the ionization core 6710 can be positioned and fluidically coupled to the interface 6715 while the ionization core 6705 is fluidically decoupled from the interface 6715. The ionization cores 6705 6710 can be positioned on a moveable stage which can translate the cores 6705, 6710 using a motor, engine, motive source, etc. as desired. For example, a stepper motor can be coupled to the moveable stage and used to switch the ionization cores 6705, 6710 between positions. As noted herein, the positions of the cores 6705, 6710 need not be one-dimensional. Instead, the height and/or lateral position of the cores 6705, 6710 could be altered to fluidically couple/decouple the cores 6705, 6710 to the interface 6715.

Figure 68:
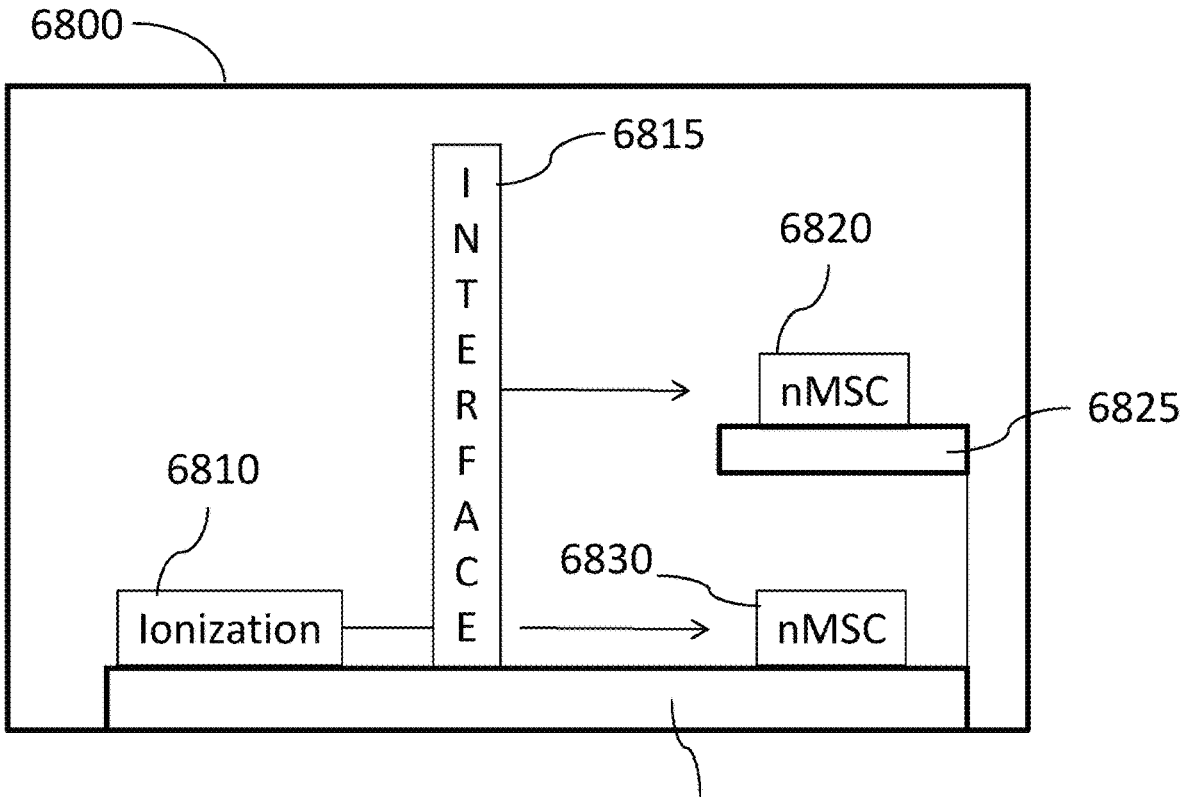
FIG. 68 is an illustration of an interface which can provide sample to two single core, dual core or multi-core mass spectrometers at different heights within an instrument, in accordance with certain examples.

In some examples, an interface can be present and can be used to provide ions to two or more nMSCs which are non-coplanar. For example, two nMSCs can be positioned at different heights within an instrument. Depending on the particular configuration of the interface and/or nMSCs, the ions can be provided to one or both of the nMSCs. One illustration is shown in FIG. 68. The system 6800 comprises an ionization core 6810 or may comprise more than one ionization core. The ionization core 6810 may comprise an inorganic ion source and/or an organic ion source. Then nMSC core 6820 is elevated and rests on a support 6825 whereas the nMSC 6820 rests on a support 6805. In some examples, the interface 6815 may comprise a first outlet which can provide sample to the nMSC 6820 and a second outlet which can provide sample to the nMSC 6830 simultaneously. In other configurations, the interface 6815 can be moved between two positions, e.g., elevated, to provide sample to the nMSC 6820 in a first position and to provide sample to the nMSC 6830 in a second position. For example, a motor, engine or other motive source can be coupled to the interface 6815 and used to move the interface 6815 up and down to the different positions to fluidically couple/decouple the interface 6815 to/from the various nMSC 6820, 6825. Alternatively, the interface 6815 may comprise one or more deflectors which can deflect ions at a desired angle and provide the deflected ions to one of the nMSCs 6820, 6830.

Figure 69A:
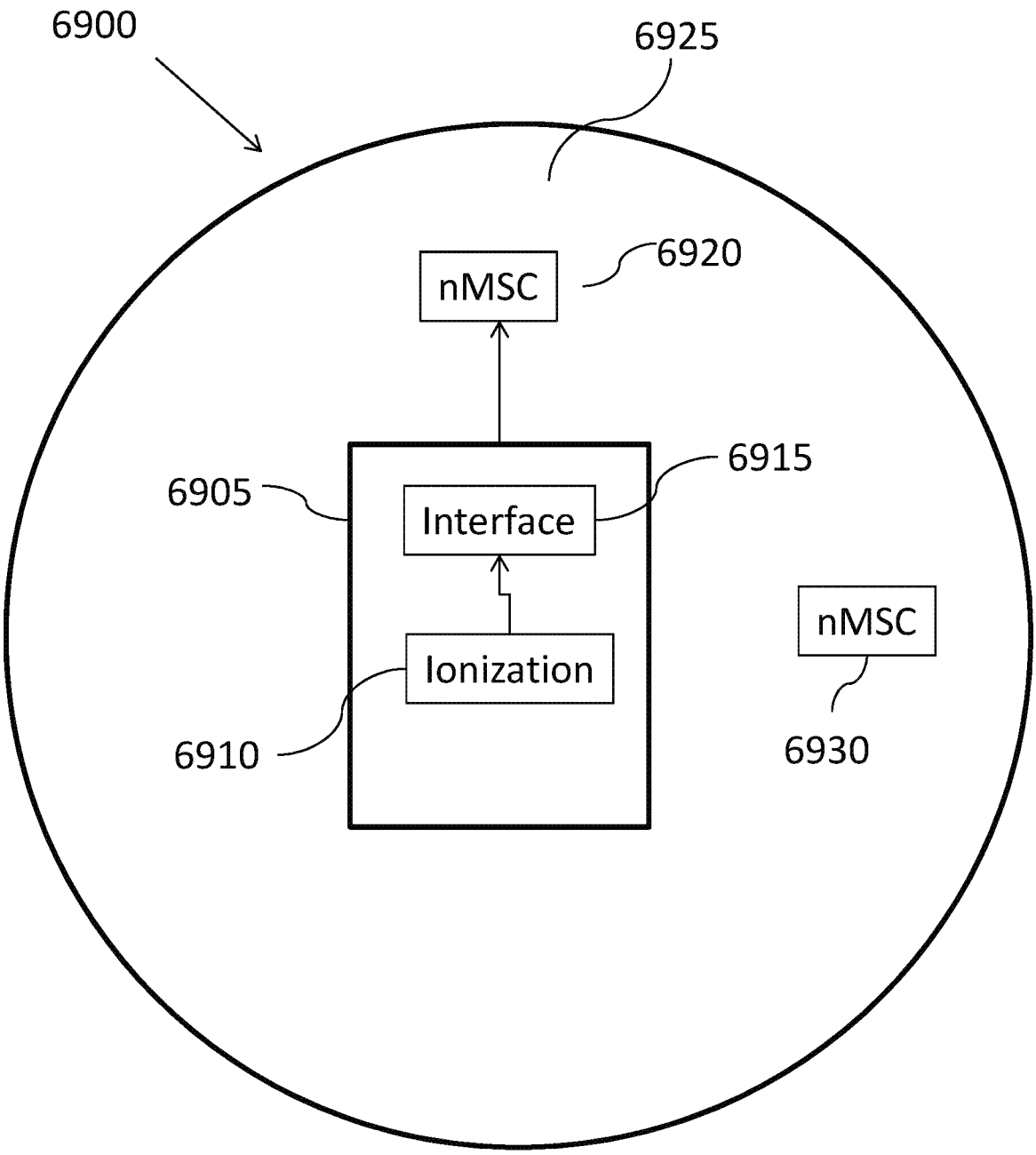
FIGS. 69A, 69B, 69C and 69D are illustrations of a system comprising a rotatable stage with one or more single core, dual core or multi-core mass spectrometers, in accordance with certain configurations.
Figure 69B:
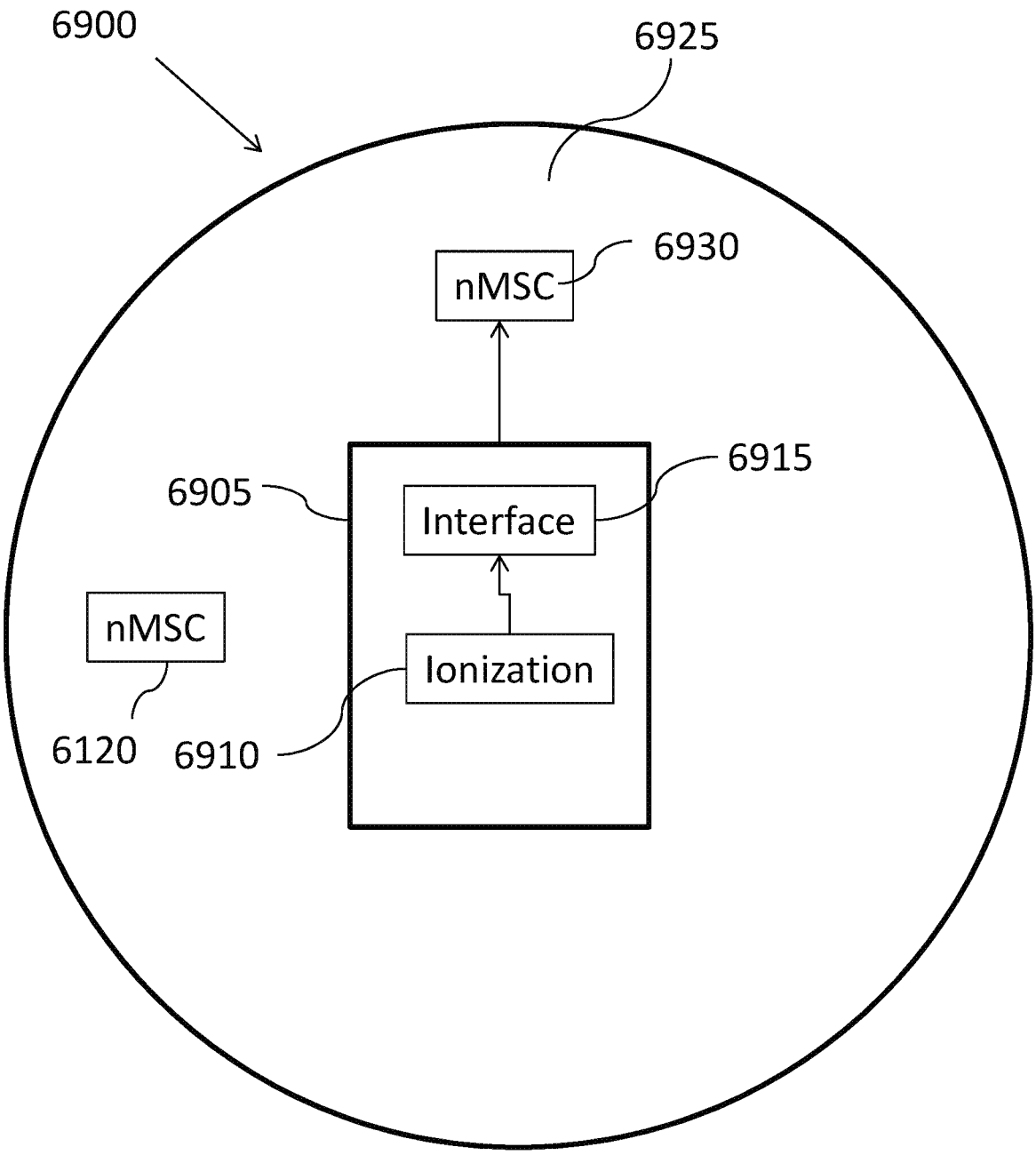
Figure 69C:
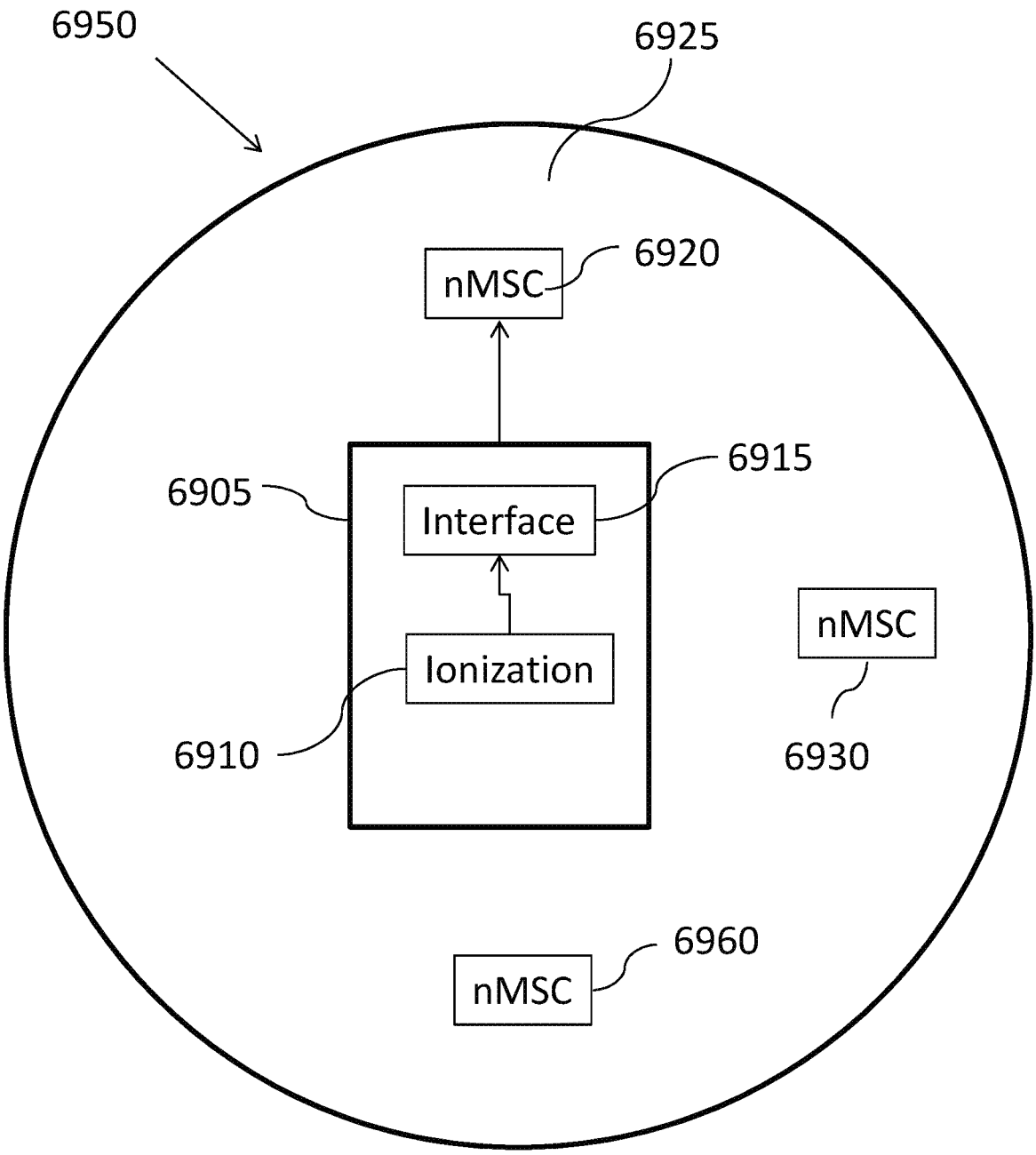
Figure 69D:
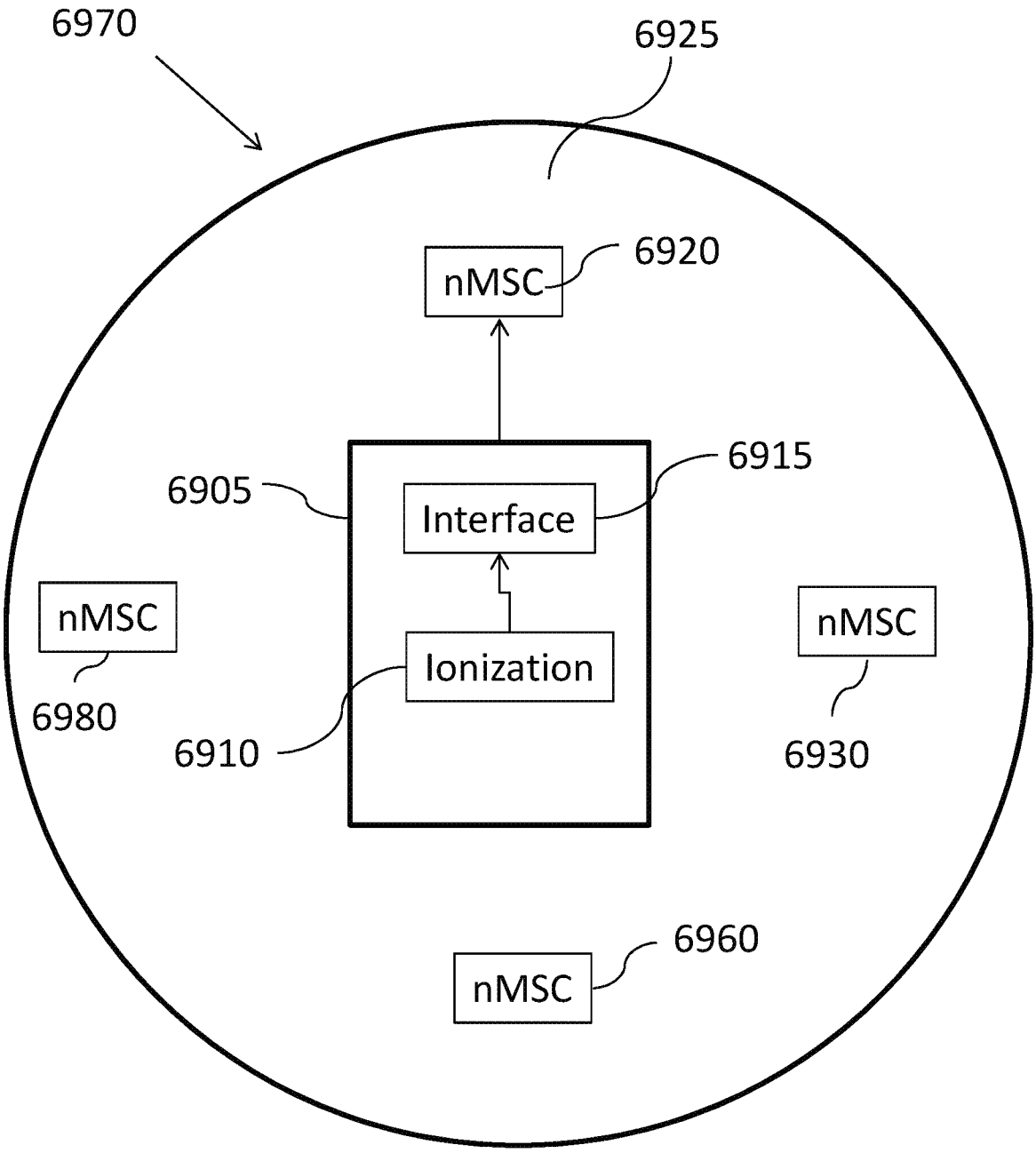

In certain embodiments, the nMSCs can be present on a rotatable disk or stage and circumferential rotation can be implemented to fluidically couple/decouple the interfaces to the various nMSCs. Referring to FIG. 69A, a system 6900 comprises an ionization core 6910, an interface 6915, and two nMSCs 6920, 6930. The ionization cores 6910 may comprise an inorganic ion source and/or an organic ion source. The nMSC 6920, 6930 can be the same or different, but they typically are different so that one of the nMSC 6920, 6930 can select inorganic ions and the other of the nMSC 6920, 6930 can select organic ions. In use of the system 6900, the ionization core 6910 and interface 6915 can be centrally positioned in a housing 6905. The nMSCs 6920, 6930 can circumferentially rotate between various positions using a platform or stage 6925. For example, as shown in FIG. 69A, nMSC 6920 can be present in a first position which fluidically couples the nMSC 6920 to the interface 6915. nMSC 6930 is fluidically decoupled from the interface 6915 in FIG. 69A. Circumferential rotation of the stage 6925 by about ninety degrees counterclockwise can fluidically decouple the nMSC 6920 from the interface 6915 and fluidically couple the nMSC 6930 to the interface 6915 as shown in FIG. 69B. While a ninety degree rotation is used in FIG. 69B, the exact number of degrees the platform 6925 rotates can vary from about five degrees to about ninety degrees, for example. In some instances, another ionization core or nMSC can be present. Referring to FIG. 69C, a system 6950 is shown which comprises an additional nMSC 6960. Referring to FIG. 69D, a system 6970 is shown which comprises a fourth nMSC 6980. The additional nMSCs 6960, 6980 are typically different from each other and also different from the cores 6920, 6930 to expand the possible types of nMSCs which may be present in a particular system. In FIG. 69C, rotation of the platform 6925 by about 180 degrees can fluidically couple the nMSC 6960 and the interface 6915. In FIG. 69D, rotation of the platform 6925 by about 90 degrees clockwise or 270 degrees counterclockwise can fluidically couple the nMSC 6980 and the interface 6915.

Figure 70A:
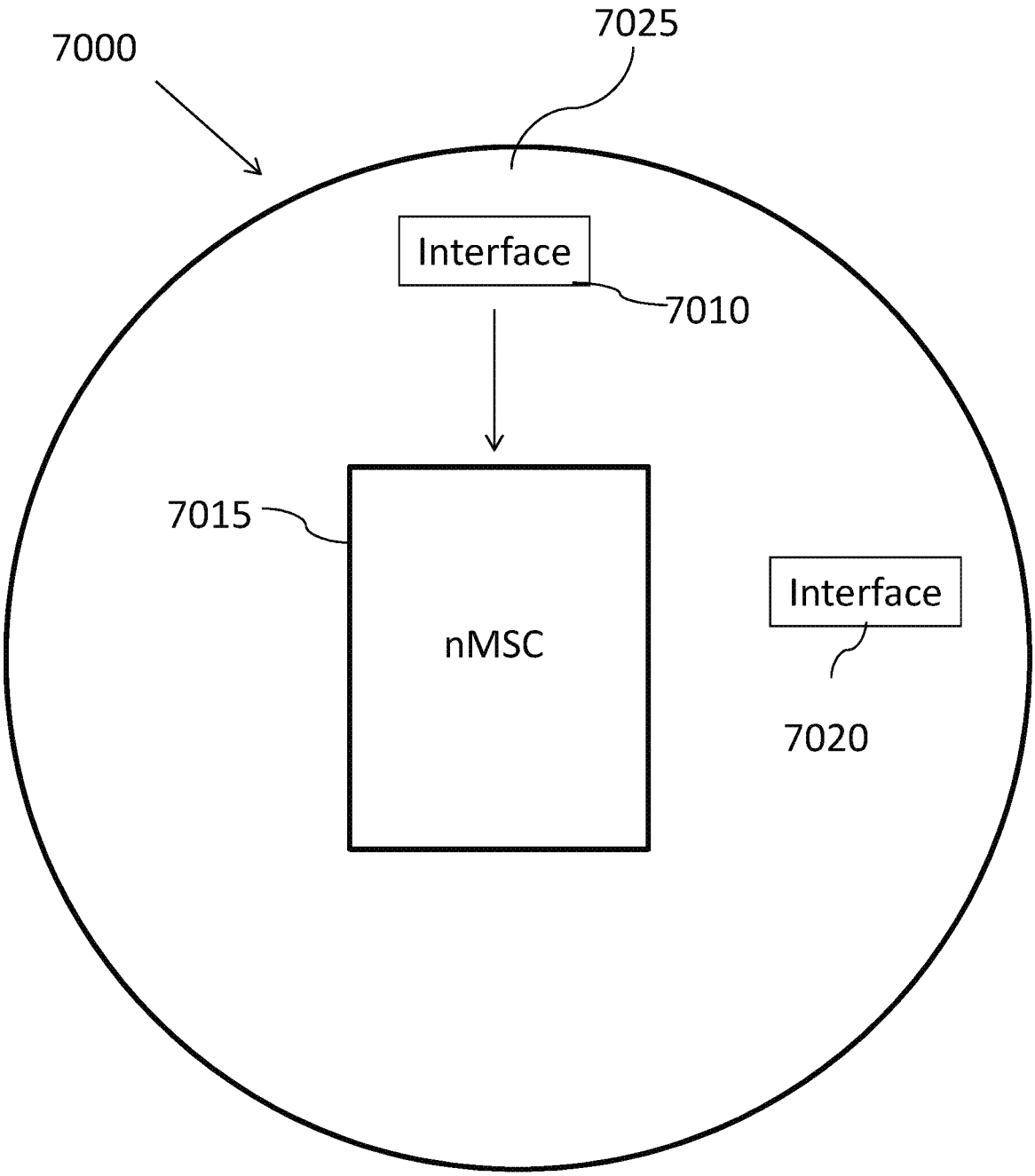
FIGS. 70A, 70B, 70C and 70D are illustrations of a system comprising a rotatable stage with one or more interfaces, in accordance with certain configurations.
Figure 70B:
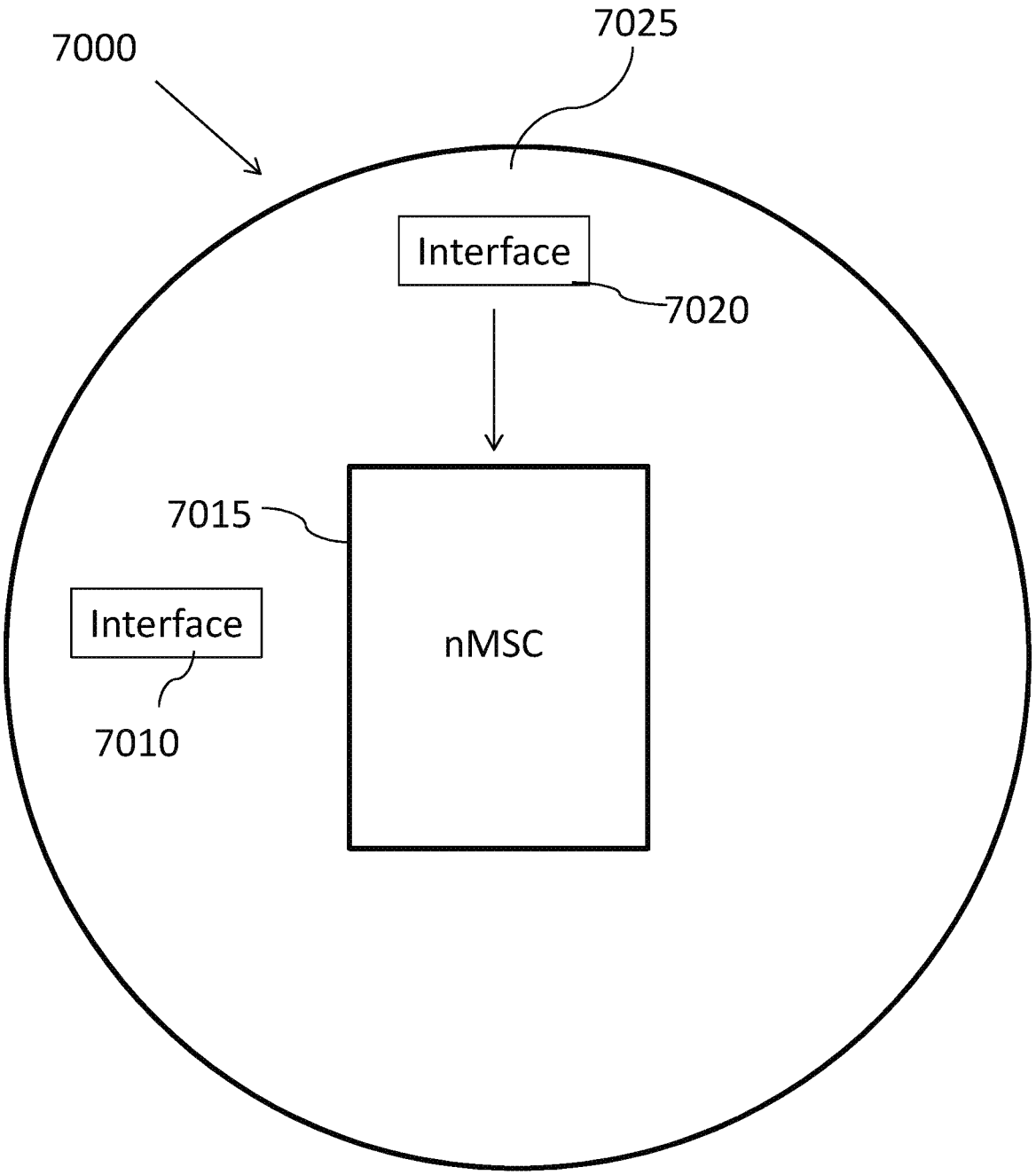
Figure 70C:
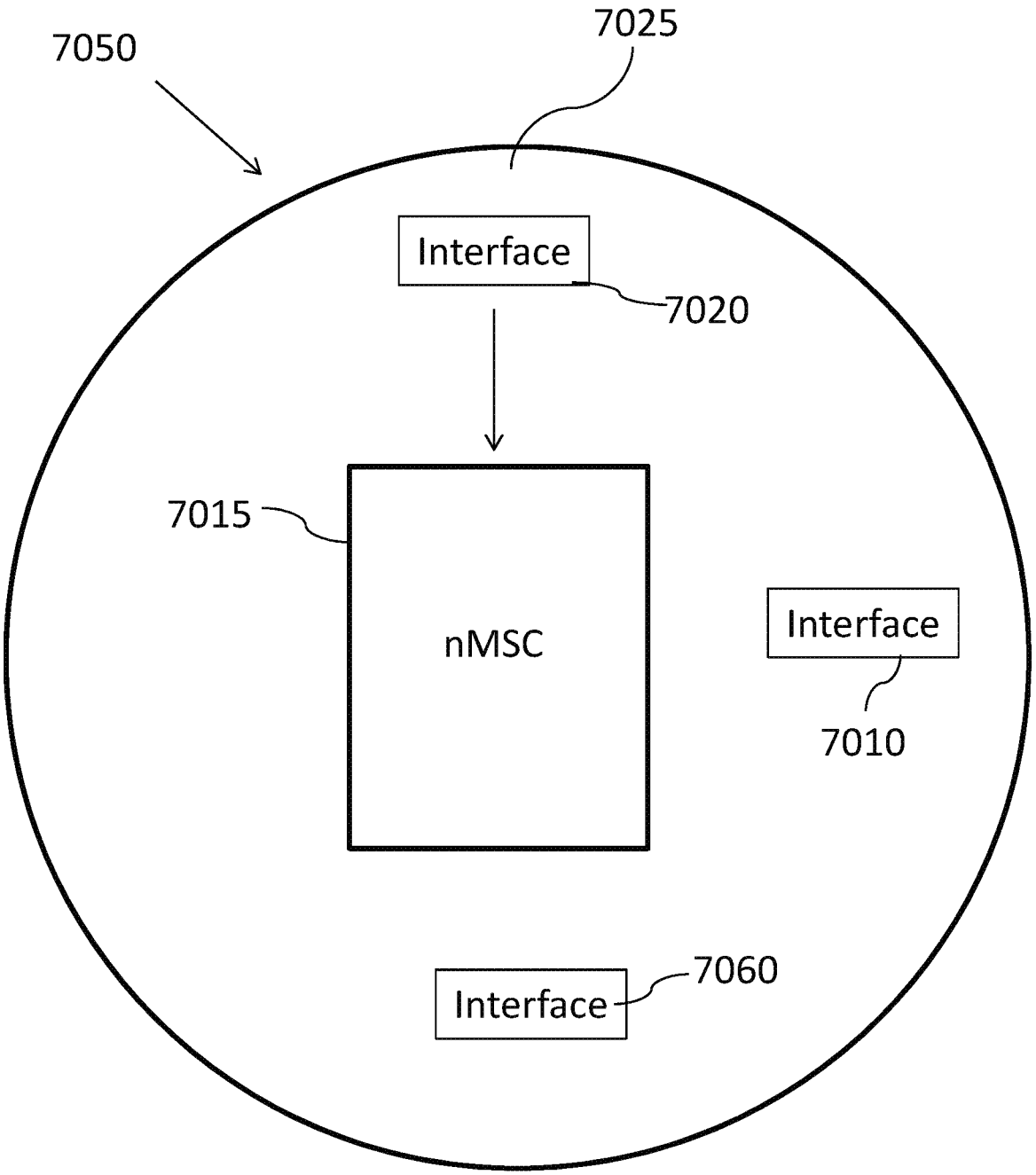
Figure 70D:
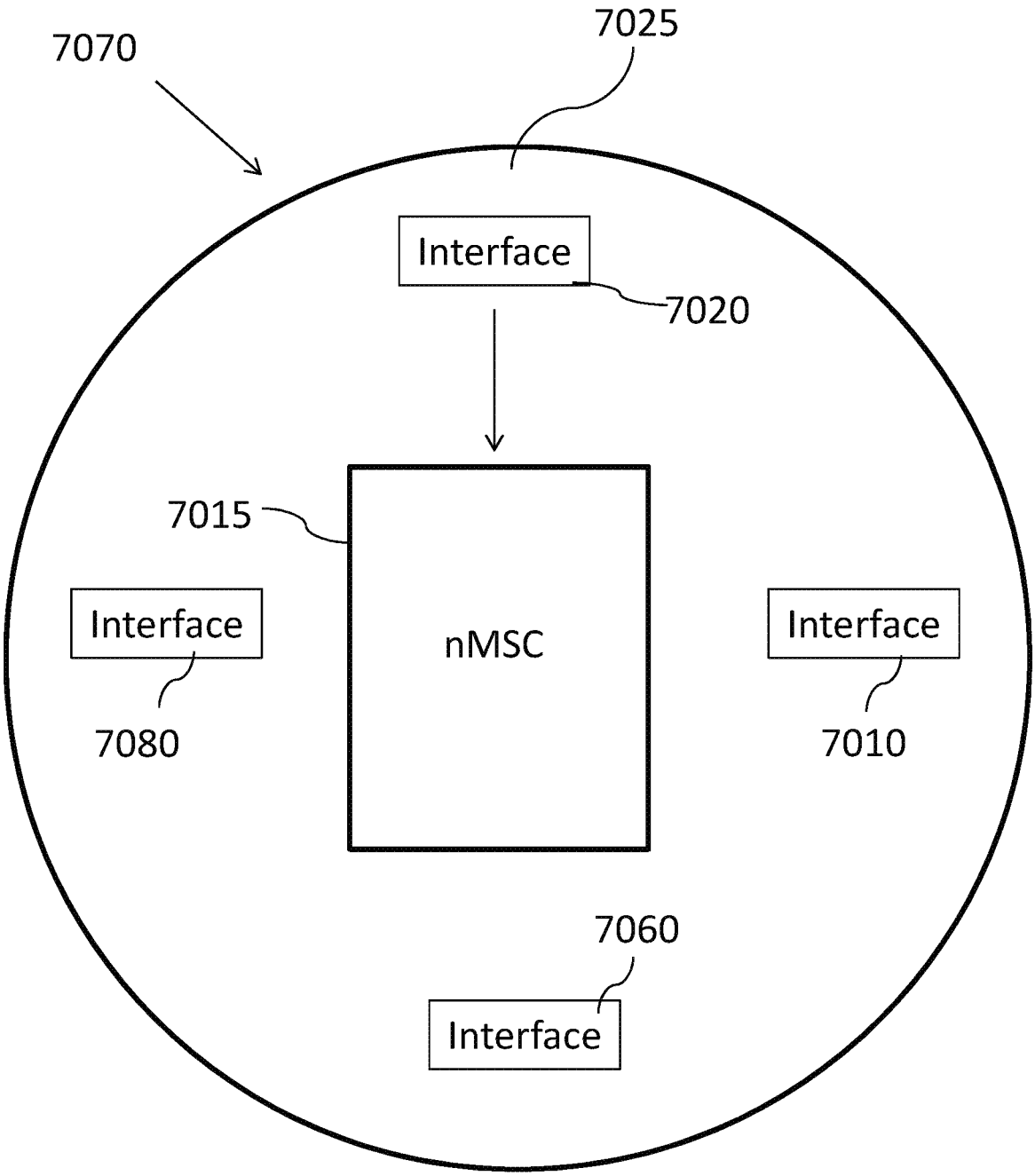

In certain examples, one or more interfaces can be present on a rotatable disk or stage and circumferential rotation can be implemented to fluidically couple/decouple an nMSC to an interface. Referring to FIG. 70A, a system 7000 comprises interfaces 7010, 7020 and a central nMSC 7015. The interfaces 7010, 7015 may independently comprise any one or more of the interfaces described herein. In some instances, one of the interfaces 7010, 7020 is fluidically coupled to ionization core comprising an inorganic ionization source and the other one of one of the interfaces 7010, 7020 is fluidically coupled to ionization core comprising an organic ionization source. In use of the system 7000, the nMSC 7015 can be centrally positioned and the interfaces 7010, 7020 can circumferentially rotate between various positions using a platform or stage 7025. For example, as shown in FIG. 70A, an interface 7010 can be present in a first position which fluidically couples the interface 7010 to the nMSC 7015 to provide ions from the interface 7010 to the nMSC 7015. The interface 7020 is fluidically decoupled from the nMSC 7015 in FIG. 70A. Circumferential rotation of the stage 7025 by about ninety degrees counterclockwise can fluidically decouple the interface 7010 from the nMSC 7015 and fluidically couple the interface 7020 to the nMSC 7015 as shown in FIG. 70B. While a ninety degree rotation is used in FIG. 70B, the exact number of degrees the platform 7025 rotates can vary from about five degrees to about ninety degrees, for example. In some instances, another interface can be present. Referring to FIG. 70C, a system 7050 is shown which comprises an additional interface 7060. Referring to FIG. 70D, a system 7070 is shown which comprises a fourth interface 7080. The additional interfaces 7060, 7080 are typically different from each other and also different from the interfaces 7010, 7020 to expand the possible types of interfaces and/or ionization cores which may be present in a particular system. In FIG. 70C, rotation of the platform 7025 by about 180 degrees can fluidically couple the interface 7060 and the nMSC 7015. In FIG. 70D, rotation of the platform 7025 by about 90 degrees clockwise or 270 degrees counterclockwise can fluidically couple the interface 7080 and the nMSC 7015.

Figure 71A:
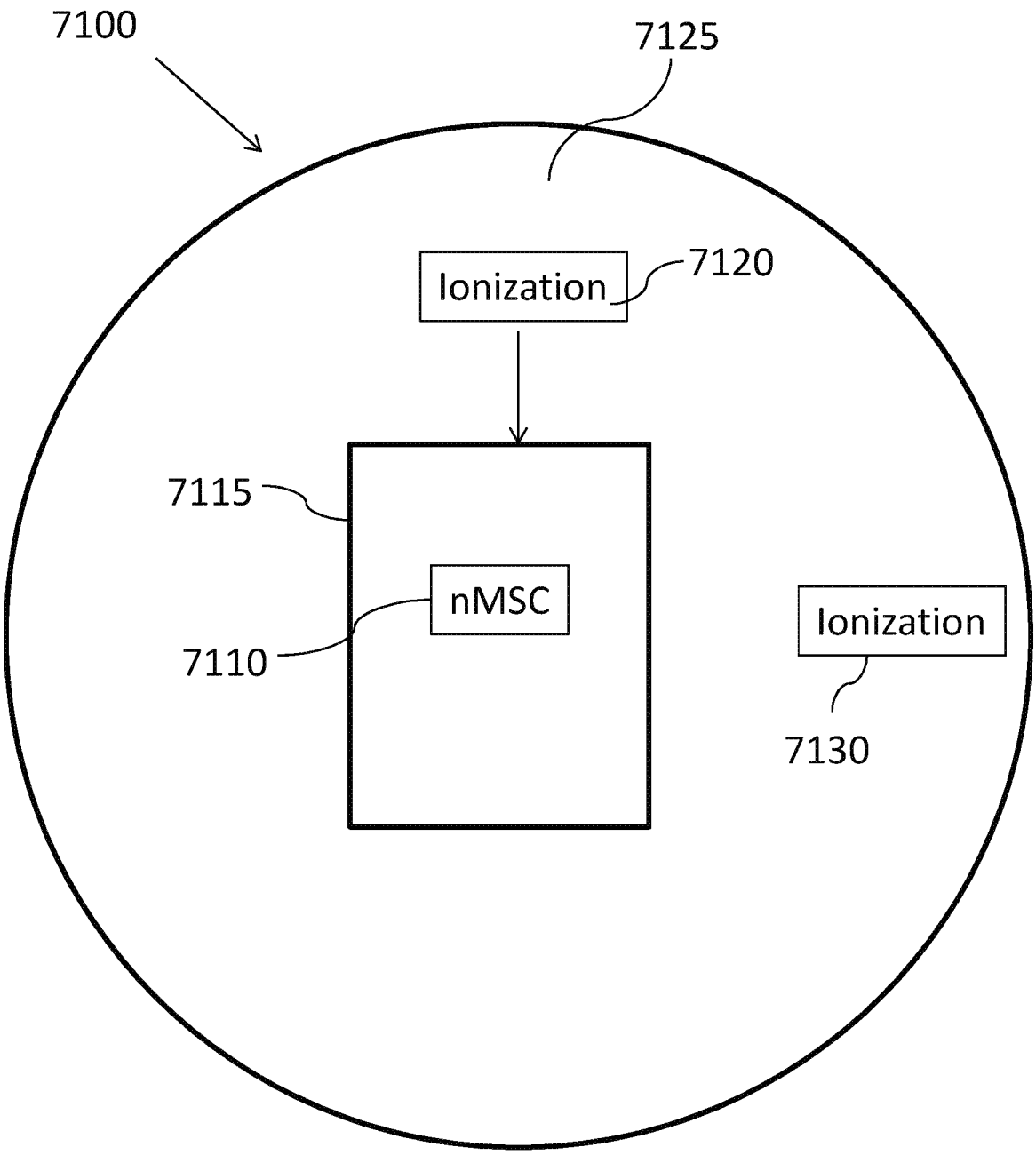
FIGS. 71A, 71B, 71C and 71D are illustrations of a system comprising a rotatable stage with one or more ionization cores, in accordance with certain configurations.
Figure 71B:
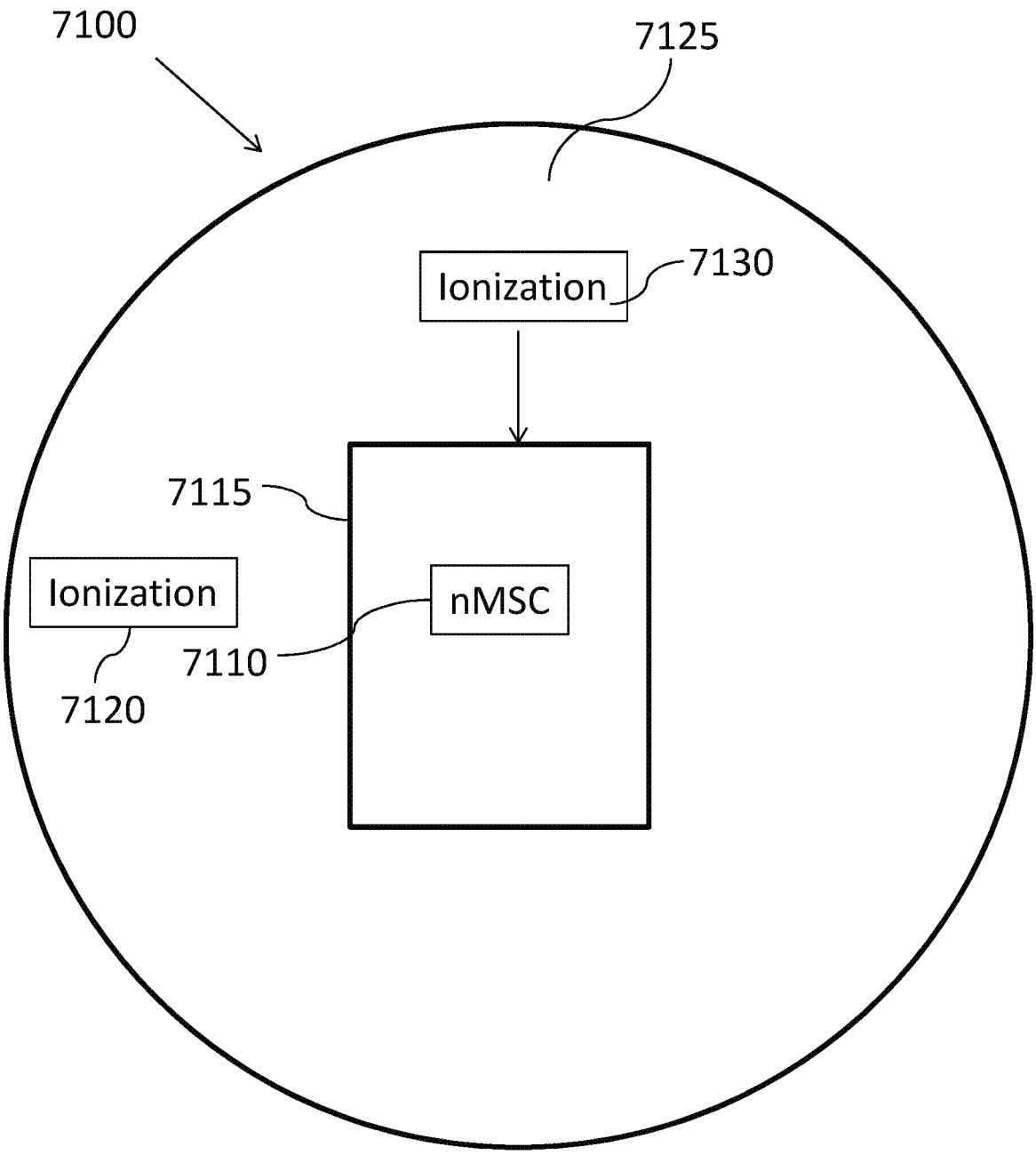
Figure 71C:
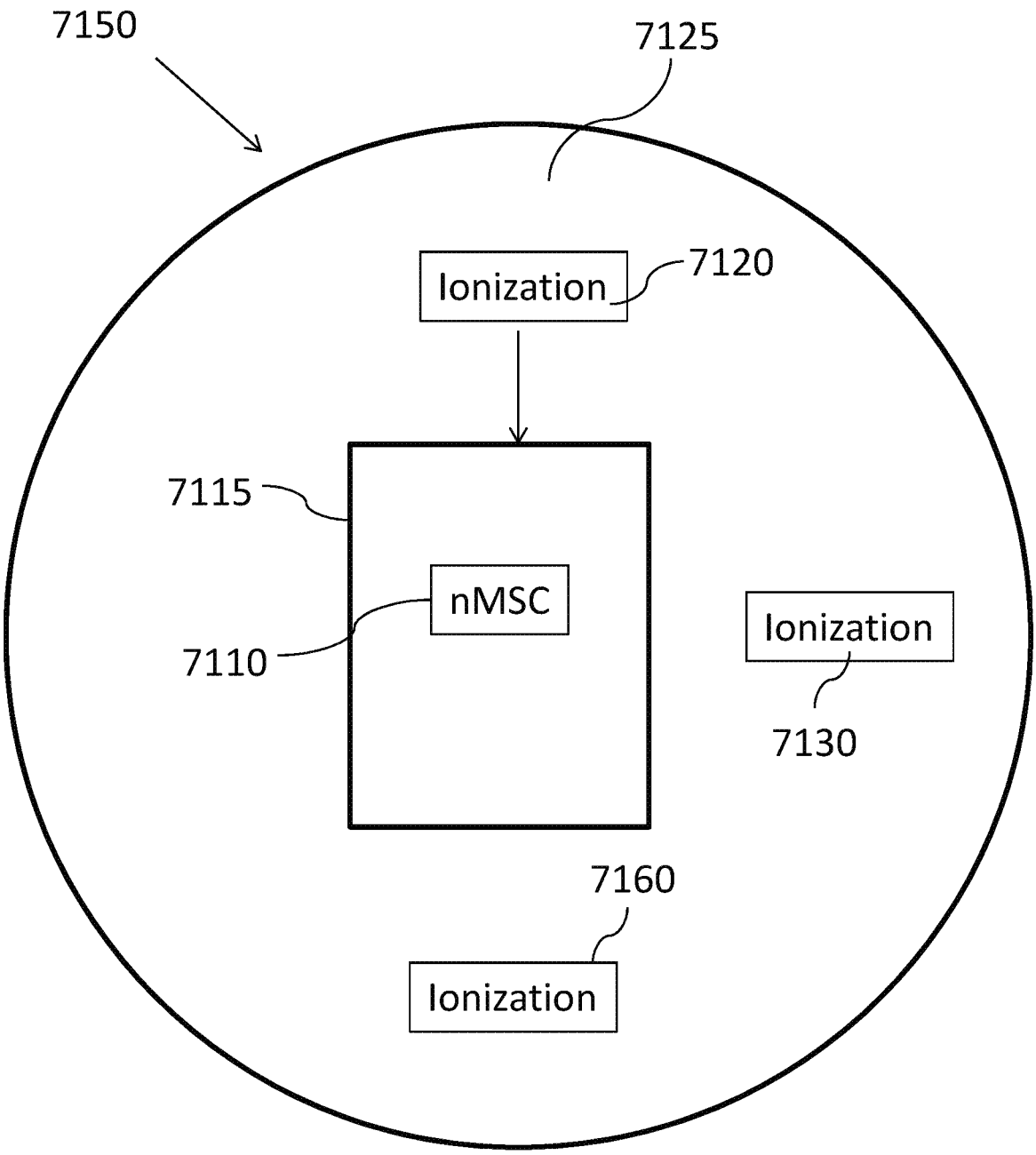
Figure 71D:
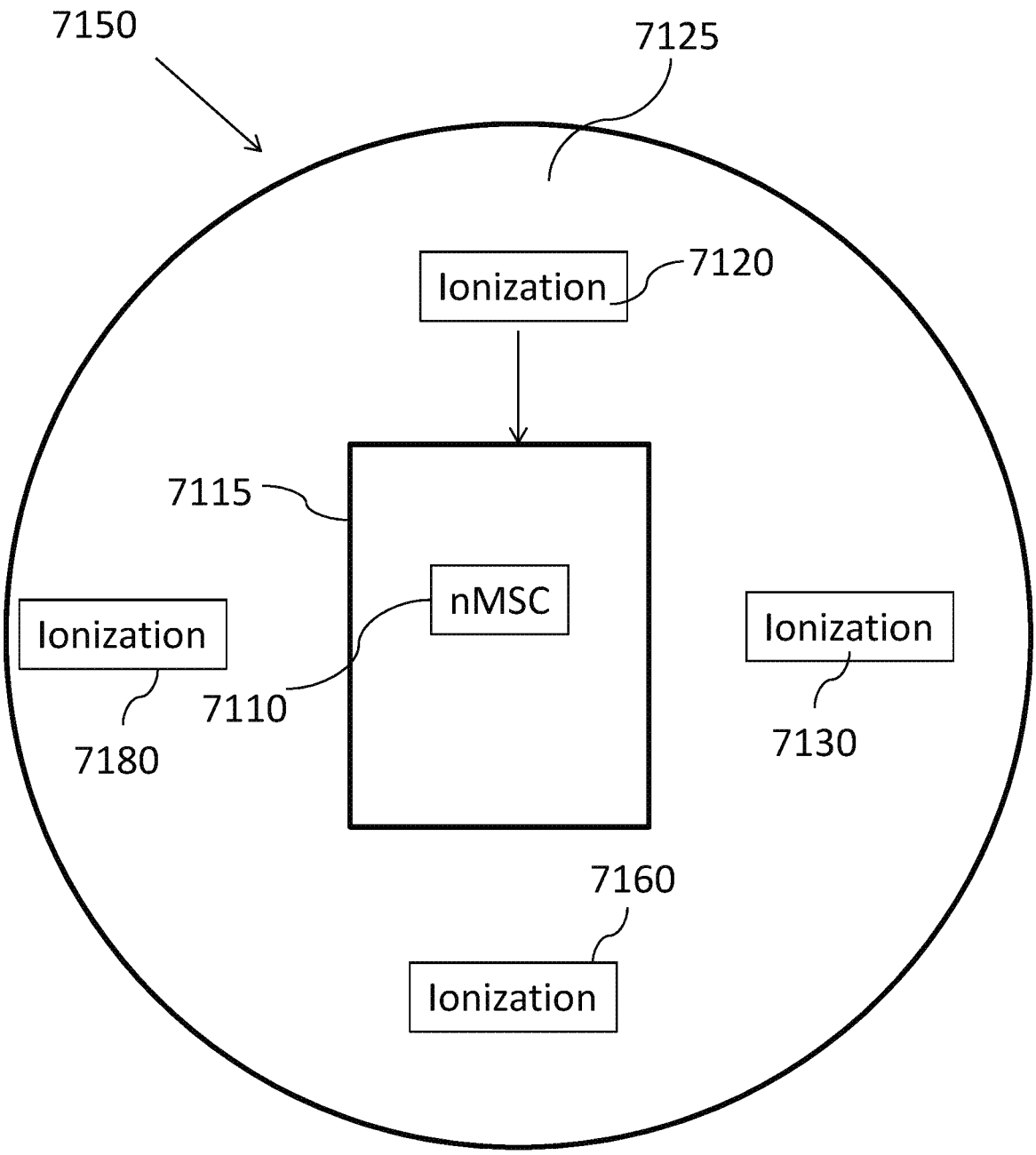

In some examples, two or more ionization cores can be present on a rotatable disk or stage and circumferential rotation can be implemented to fluidically couple/decouple the ionization stages to one or more nMSCs. Referring to FIG. 71A, a system 7100 comprises two ionization cores 7120, 7130 and a nMSC 7110. The ionization cores 7120, 7130 may comprise an inorganic ion source and/or an organic ion source. In some examples, one of the ionization cores 7120, 7130 may comprise an inorganic ion source and the other of the ionization cores 7120, 7130 may comprise an organic ion source. The nMSC 7110 can be designed to select ions, e.g., can select inorganic ions or organic ions or both. In use of the system 7100, the nMSC 7110 is centrally positioned in a mass analyzer housing 7115. The ionization cores 7120, 7130 can circumferentially rotate between various positions using a platform or stage 7125. For example, as shown in FIG. 71A, ionization core 7120 can be present in a first position which fluidically couples the nMSC 7110 to the core 7120. The ionization core 7130 is fluidically decoupled from the nMSC 7110 in FIG. 71A. Circumferential rotation of the stage 7125 by about ninety degrees counterclockwise can fluidically decouple the ionization core 7120 from the nMSC 7110 and fluidically couple the ionization core 7130 to the nMSC 7115 as shown in FIG. 71B. While a ninety degree rotation is used in FIG. 71B, the exact number of degrees the platform 7125 rotates can vary from about five degrees to about ninety degrees, for example. In some instances, another ionization core or nMSC can be present. Referring to FIG. 71C, a system 7150 is shown which comprises an additional ionization core 7160. Referring to FIG. 71D, a system 7170 is shown which comprises a fourth ionization core 7180. The additional ionization cores 7160, 7180 are typically different from each other and also different from the cores 7120, 7130 to expand the possible types of ionization cores which may be present in a particular system. In FIG. 71C, rotation of the platform 7125 by about 180 degrees can fluidically couple the ionization core 7160 and the nMSC 7110. In FIG. 71D, rotation of the platform 7125 by about 90 degrees clockwise or 270 degrees counterclockwise can fluidically couple the ionization core 7180 and the nMSC 7110.

Figure 72A:
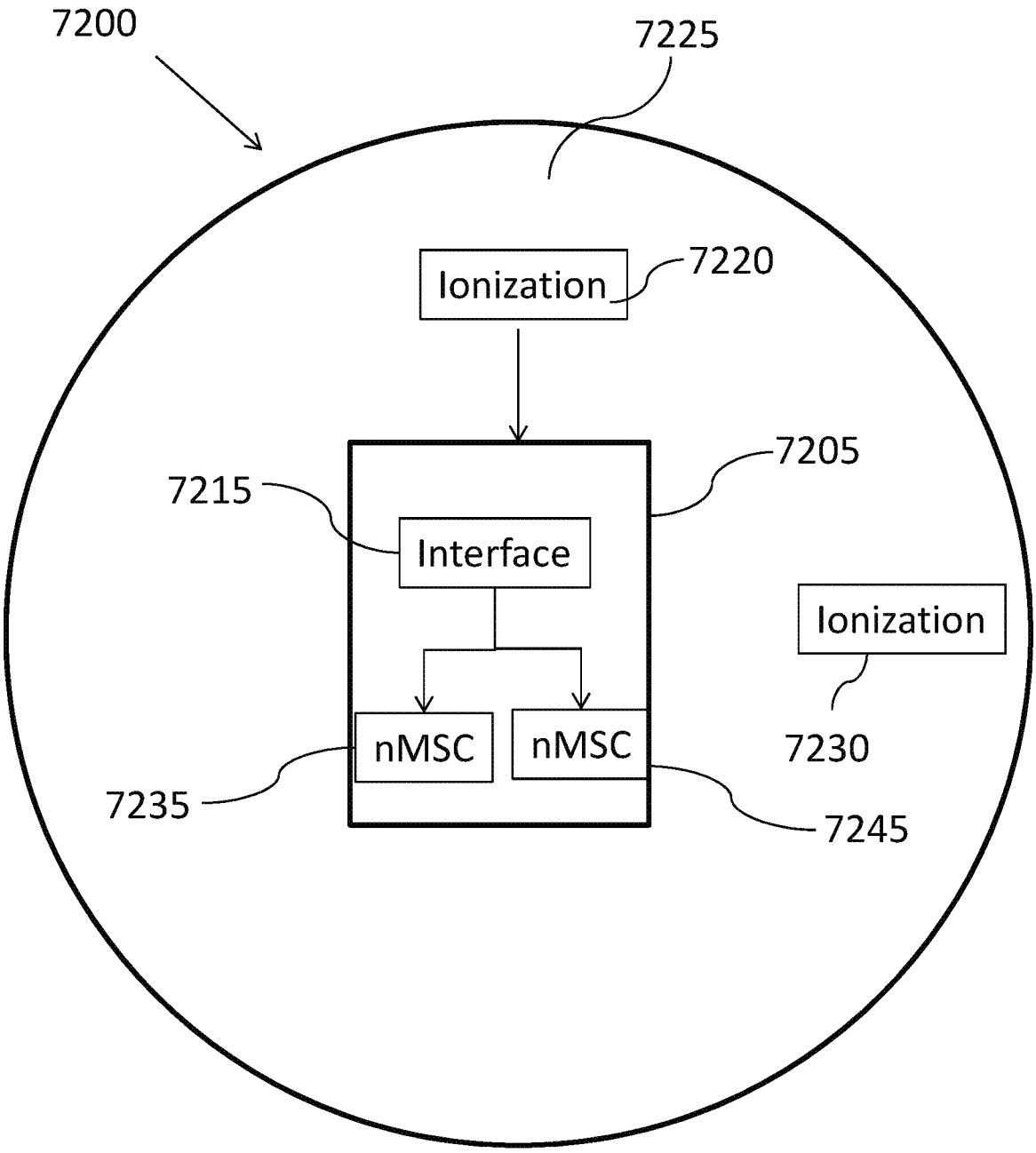
FIGS. 72A, 72B, 72C and 72D are illustrations of another system comprising a rotatable stage with one or more ionization cores, in accordance with certain configurations.
Figure 72B:
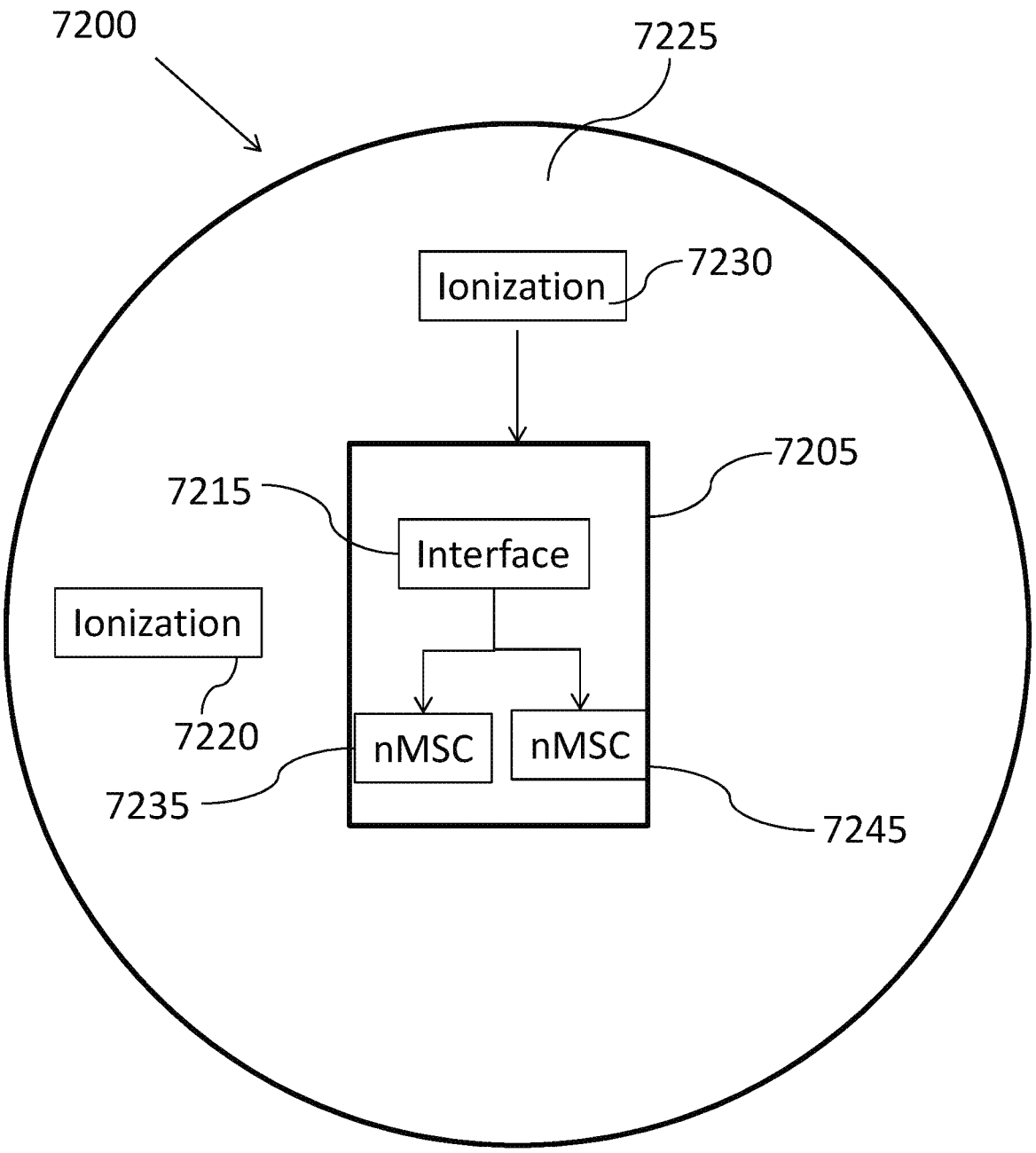
Figure 72C:
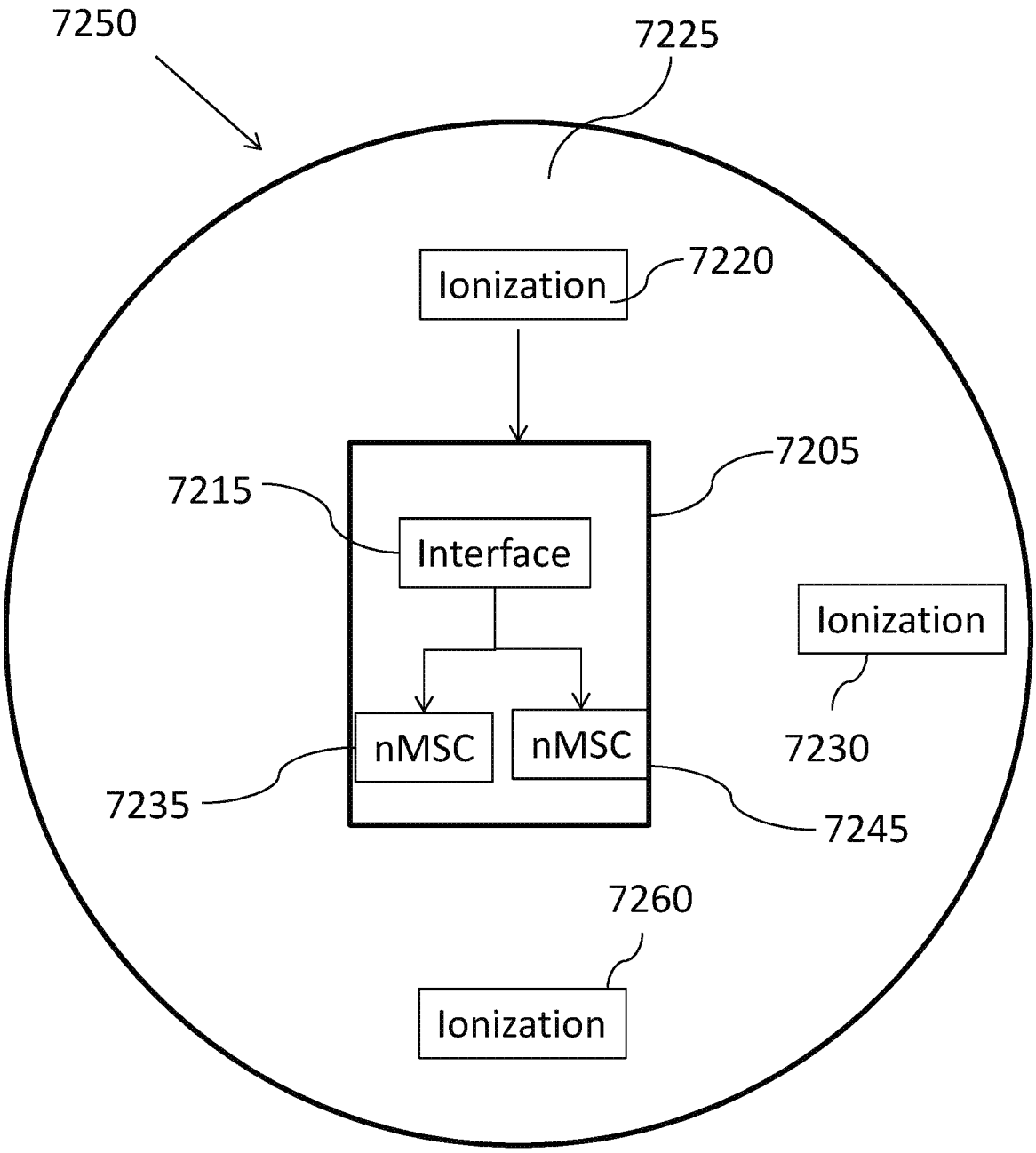
Figure 72D:
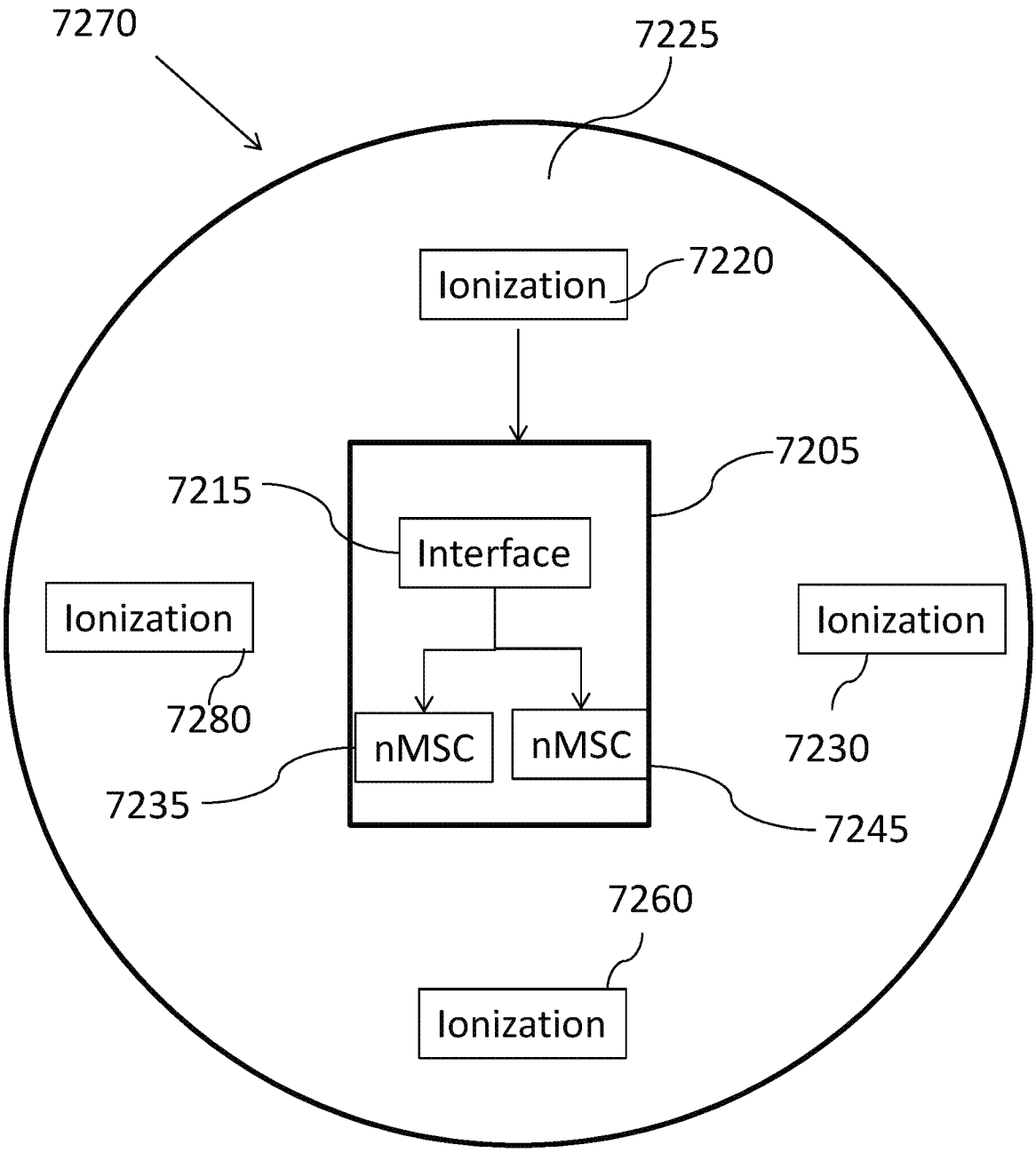

In some configurations, two or more ionization cores can be present on a rotatable disk or stage and circumferential rotation can be implemented to fluidically couple/decouple the ionization stages to two nMSCs through an interface. Referring to FIG. 72A, a system 7200 comprises two ionization cores 7220, 7230, an interface 7215 and two nMSC 7235, 7245. The ionization cores 7220, 7230 may comprise an inorganic ion source and/or an organic ion source. In some examples, one of the ionization cores 7220, 7230 may comprise an inorganic ion source and the other of the ionization cores 7220, 7230 may comprise an organic ion source. The nMSCs 7235, 7345 can be designed to select ions, e.g., can select inorganic ions or organic ions or both. In some examples, one of the nMSCs 7235, 7245 may select inorganic ions and the other of the nMSCs 7235, 7245 may select organic ions. In certain examples, the exact configuration of the interface 7215 can depend on the particular sample provided from the ionization cores 6220, 6230, and illustrative interfaces may comprise multipole deflectors which can receive/deflect ions in a co-planar manner or in a non-coplanar manner. Illustrative deflectors are described for example in commonly assigned U.S. Patent Publication Nos. 20140117248, 20150136966 and 20160172176, and certain specific types of deflectors are described in more detail herein. In use of the system 7200, the interface 7215 and the nMSCs 7235, 7345 are centrally positioned in a mass analyzer housing 7205. The ionization cores 7220, 7230 can circumferentially rotate between various positions using a platform or stage 7225. For example, as shown in FIG. 72A, ionization core 7220 can be present in a first position which fluidically couples the interface 7215 to the core 7220. The ionization core 7230 is fluidically decoupled from the interface 7215 in FIG. 71A. Circumferential rotation of the stage 7225 by about ninety degrees counterclockwise can fluidically decouple the ionization core 7220 from the interface 7215 and fluidically couple the ionization core 7230 to the interface 7215 as shown in FIG. 71B. While a ninety degree rotation is used in FIG. 71B, the exact number of degrees the platform 7225 rotates can vary from about five degrees to about ninety degrees, for example. In some instances, another ionization core or nMSC can be present. Referring to FIG. 72C, a system 7250 is shown which comprises an additional ionization core 7260. Referring to FIG. 71D, a system 7270 is shown which comprises a fourth ionization core 7280. The additional ionization cores 7260, 7280 are typically different from each other and also different from the cores 7220, 7230 to expand the possible types of ionization cores which may be present in a particular system. In FIG. 72C, rotation of the platform 7225 by about 180 degrees can fluidically couple the ionization core 7160 and the interface 7215. In FIG. 72D, rotation of the platform 7225 by about 90 degrees clockwise or 270 degrees counterclockwise can fluidically couple the ionization core 7180 and the interface 7225. If desired, the nature and type of ionization cores 7220, 7230, 7260 and 7280 can be linked to a configuration of the interface 7215 such that positioning of the cores 7220, 7230, 7260, 7280 to provide ions to the interface 7215 results in the interface providing ions to one of the nMSCs 7235, 7245. For example, where the nMSC 7235 is configured to select/filter inorganic ions and where the cores 7220, 7280 provide inorganic ions, the interface 7215 can be configured to provide the received inorganic ions to the nMSC 7235 when ions from either of the cores 7220, 7280 are provided to the interface 7215. In this configuration, the nMSC 7245 is not used or active. Where the nMSC 7245 is configured to select/filter organic ions and where the cores 7230, 7260 provide organic ions, the interface 7215 can be configured to provide the received organic ions to the nMSC 7245 when ions from either of the cores 7230, 7260 are provided to the interface 7215. In this configuration, the nMSC 7235 is not used or active.

Figure 73A:
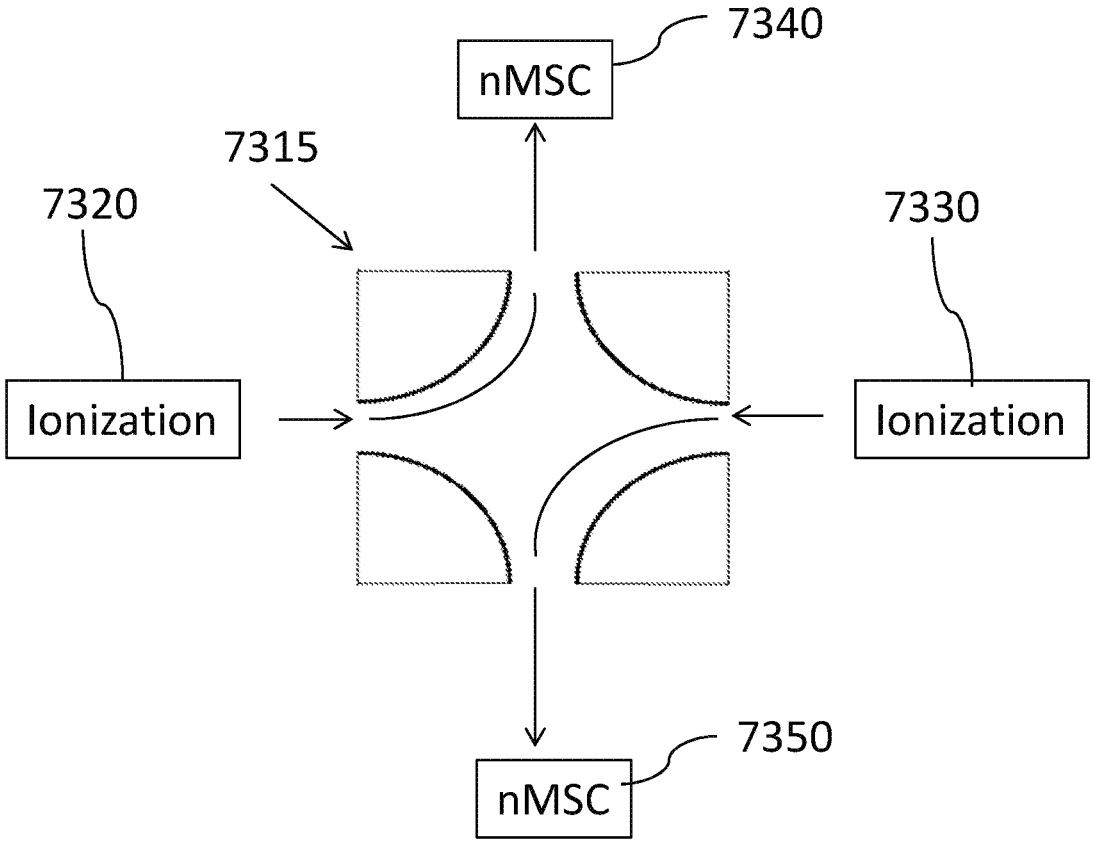
FIGS. 73A and 73B are illustrations of an interface comprising a deflector, in accordance with certain examples.
Figure 73B:
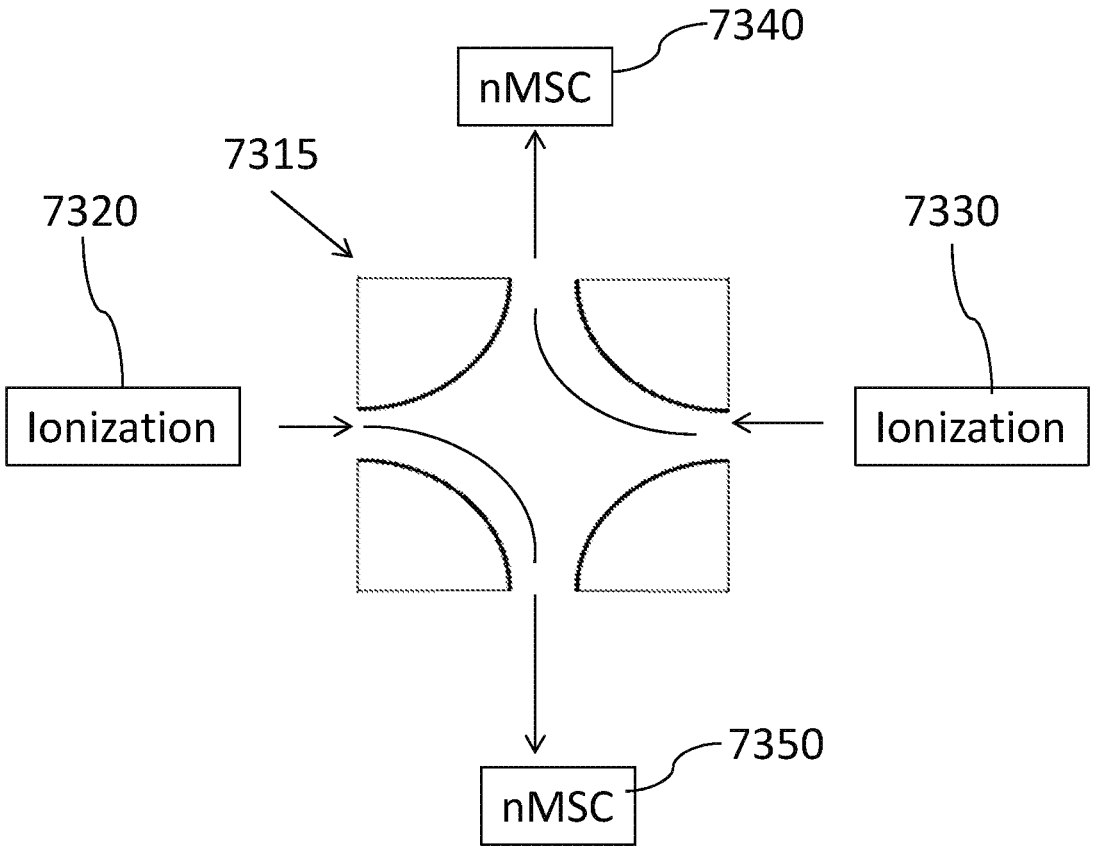

While certain configurations are described where a single ionization core provides ions to an interface during any one analysis period, if desired, ions from different ionization cores can be provided to an interface at the same time. For example, different ionization cores positioned in a coplanar manner can provide ions into different inlets of an interface. Referring to FIG. 73A, an illustration is shown where ions from a first ionization core 7320 and ions from a second ionization core 7320 are provided to an interface 7315. In this first configuration of the interface 7315, ions from the ionization core 7320 are provided to the mass analyzer comprising the nMSC 7340, and ions from the ionization core 7330 are provided to the mass analyzer comprising the nMSC 7350. For example, the ionization core 7320 may comprise an inorganic ion source, and the inorganic ions can be provided to a nMSC 7340 configured to select/filter inorganic ions. The ionization core 7330 may comprise an organic ion source, and the organic ions can be provided to a nMSC 7350 configured to select/filter organic ions. By altering the voltages on the poles of the interface 7315, it is possible to redirect the ions from the various ionization cores 7320, 7330 to different MS cores. For example and as shown in FIG. 73B, ions from the ionization core 7320 could instead be provided to the nMSC 7340, and ions from the ionization core 7330 could be provided to the nMSC 7350. The interface 7315 is a coplanar interface in that the ions from the ionization cores 7320, 7330 generally are provided to the interface in the same two-dimensional plane, e.g., in the same x-y plane. While two nMSCs 7340, 7350 are shown in FIGS. 73A and 73B, it may be desirable to omit one of the nMSCs. For example, where the nMSC 7340 is a dual core MS, the nMSC 7350 can be omitted and inorganic ions from the core 7320 can be filtered by the nMSC 7340 and organic ions from the core 7330 can also be filtered by the nMSC 7340 depending on the overall configuration of the dual core MS. In some examples, ions from one of the cores 7320, 7330 can be directed away from the dual core MS when ions from the other one of the cores 7320, 7330 are directed into the dual core MS. In instances where the dual core MS is configured for inorganic ion detection and the ionization core 7320 provide inorganic ions, and the ionization core 7330 provides organic ions, then the organic ions from the core 7330 can be directed to waste or another component of the system. When it is desirable to filter/detect the organic ions from the ionization core 7330, then the inorganic ions from the core 7320 can be directed to waste or another component of the system and the organic ions from the core 7330 can be provided to the dual core MS. While the ionization cores 7320, 7330 and the nMSCs 7340, 7350 are shown as being positioned about 180 degrees apart from each other in FIGS. 73A and 73B, if desired, the ionization cores 7320, 7330 or the nMSCs 7340, 7350 could be positioned adjacent to each other, and the interface could be reconfigured to direct the entering ions along a desired trajectory. Further, while the interface 7315 is configured to bend the incoming ions through a single bend of about ninety degrees, a double bend interface or multi-bend interface can be used to guide ions within the interface through a desired trajectory. Suitable multipole assemblies which can be used in the interfaces described herein to provide single, double or multi-bends are described in more detail in commonly assigned U.S. Patent Publication Nos. 20140117248, 20150136966 and 20160172176.

In certain embodiments, the systems described herein may comprise more than a single rotatable stage or moveable platform. For example, the system may comprise a mass analyzer comprising a nMSC positioned on one platform and an interface positioned on another platform. Each of the nMSCs and the interface can be moved to various positions to fluidically couple/decouple that component to another core component of the system. Similarly, a sample operation core, ionization core, etc. can be present on a moveable platform or stage to permit movement of the core components individually relative to the position of the other core components. Movement can be provided linearly, rotationally, circumferentially or in multiple dimensions to position the various core components suitably relative to the position of one or more other core components.

Figure 74A:
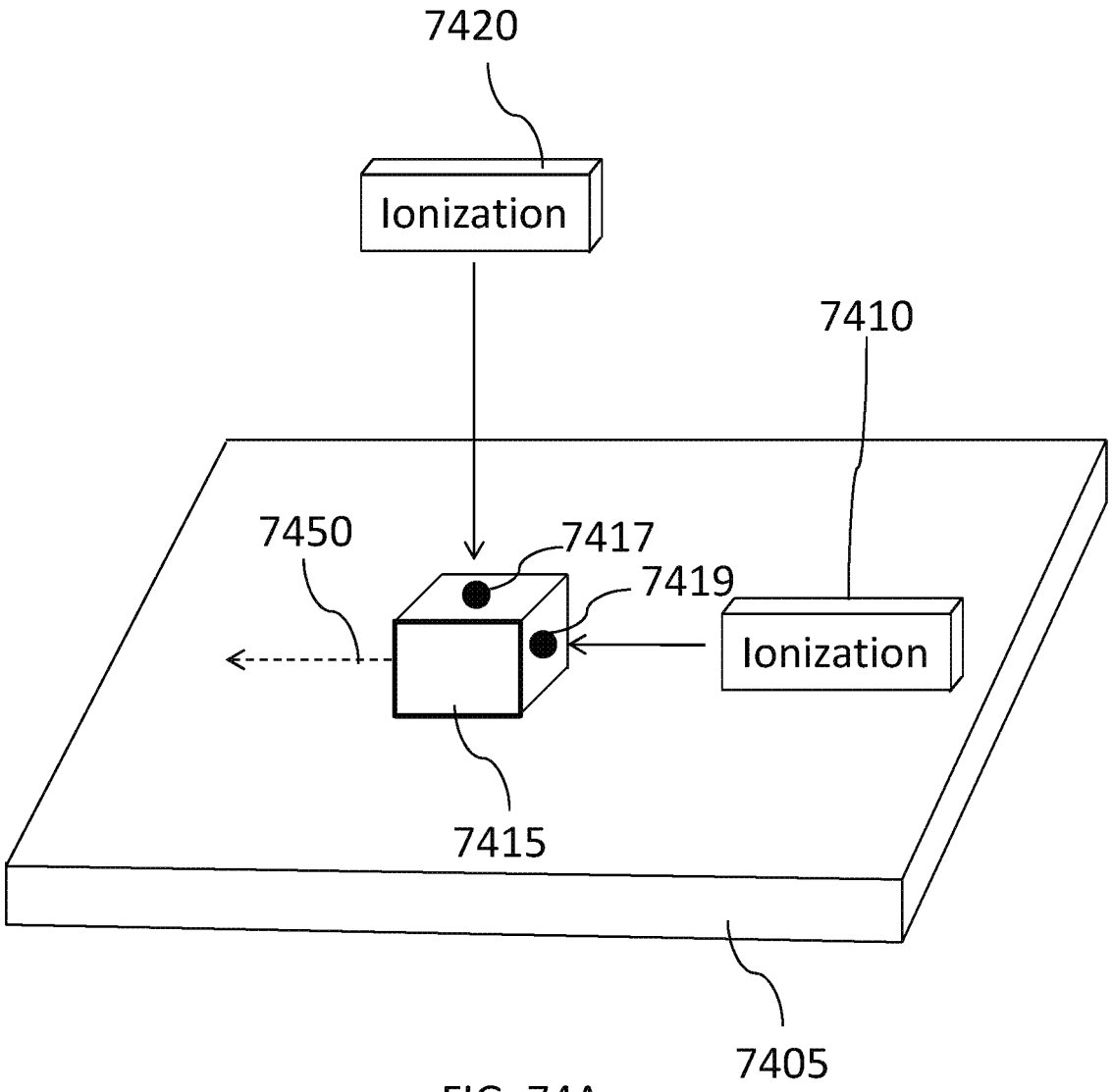
FIGS. 74A and 74B are illustrations of systems comprising an interface comprising a non-coplanar deflector, in accordance with certain embodiments.
Figure 74B:
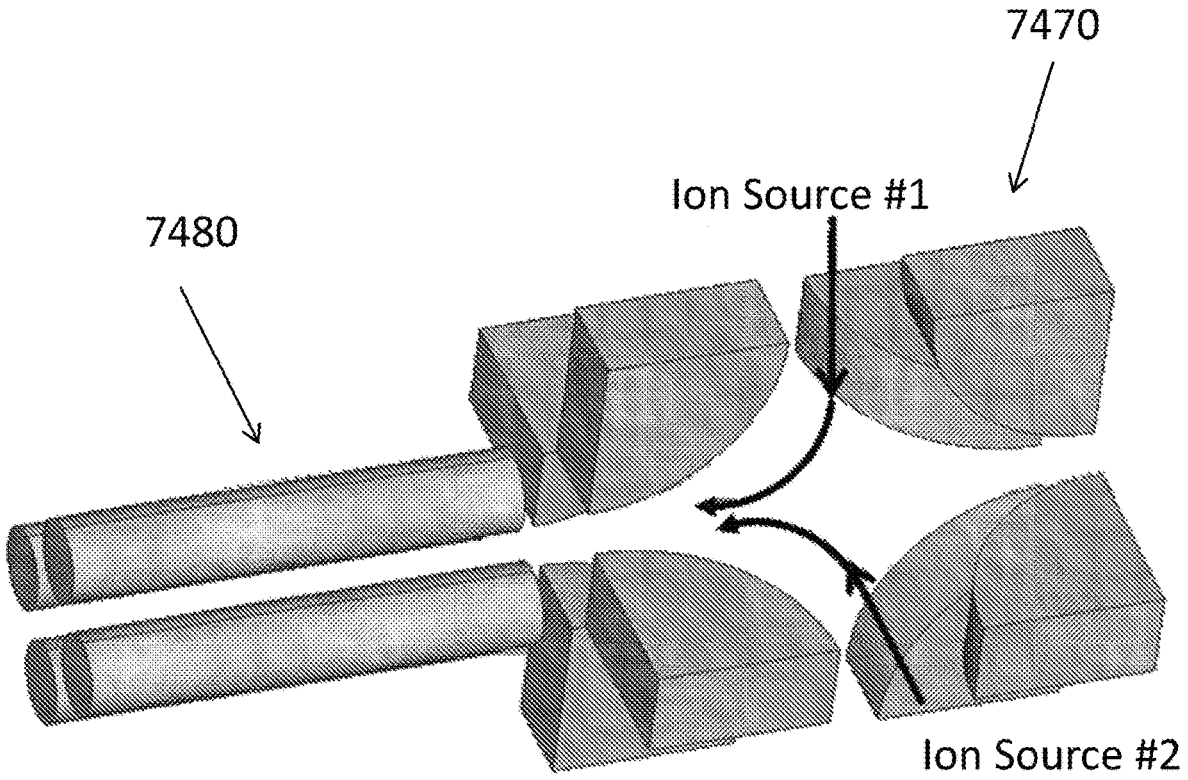

In other instances, different ionization cores positioned in a non-coplanar manner can provide ions into different inlets of an interface. One illustration is shown schematically in FIG. 74A. Ions from a first ionization core 7410 are provided to an interface 7415 positioned on a support 7405 in a first x-y plane, and ions from a second ionization core 7420, positioned above the support 7405, are provided to the interface 7415 in a different plane than the first x-y plane. The ions from the core 7410 enter the interface 7415 through an opening 7419 on a side of the interface 7415, and the ions from the core 7420 enter the interface 7415 though an opening 7417 on a different side of the interface 7415. The ions can be provided from the interface 7415 in the direction of arrow 7450 to one or more downstream nMSCs (not shown). In some examples, the interface 7415 is configured to provide only ions from the ionization core 7410 during a particular analysis period, whereas in other configurations, only ions from the ionization core 7420 are provided during a different analysis period. For example, the core 7410 may provide inorganic ions, and the core 7420 may provide organic ions. A downstream dual core MS can be configured to detect inorganic ions during a first period, and the interface 7415 can provide ions only from the core 7410 during the first period. The downstream dual core MS can be reconfigured to select/filter organic ions during a second period, and the interface 7415 can provide ions only from the core 7410 during the second period. The interface 7415 and the dual core MS may switch back and forth such that analysis of both inorganic ions and organic ions are performed sequentially. One particular illustration of a non-coplanar interface is shown in FIG. 74B. The interface comprises an octopole deflector 7470 which is shown fluidically coupled to a quadrupole rod assembly 7480, e.g., a quadrupole rod assembly which is part of a nMSC. Two ion sources can be positioned orthogonally from each other and fluidically coupled to the octopole deflector 7470. Ions from ion source #1 can enter the interface through a top surface, and ions from ion source #2 can enter the interface through a side surface. The deflector 7470 can direct the ions from the different sources into the quadrupole assembly 7480 for selection/filtering.

Figure 75A:
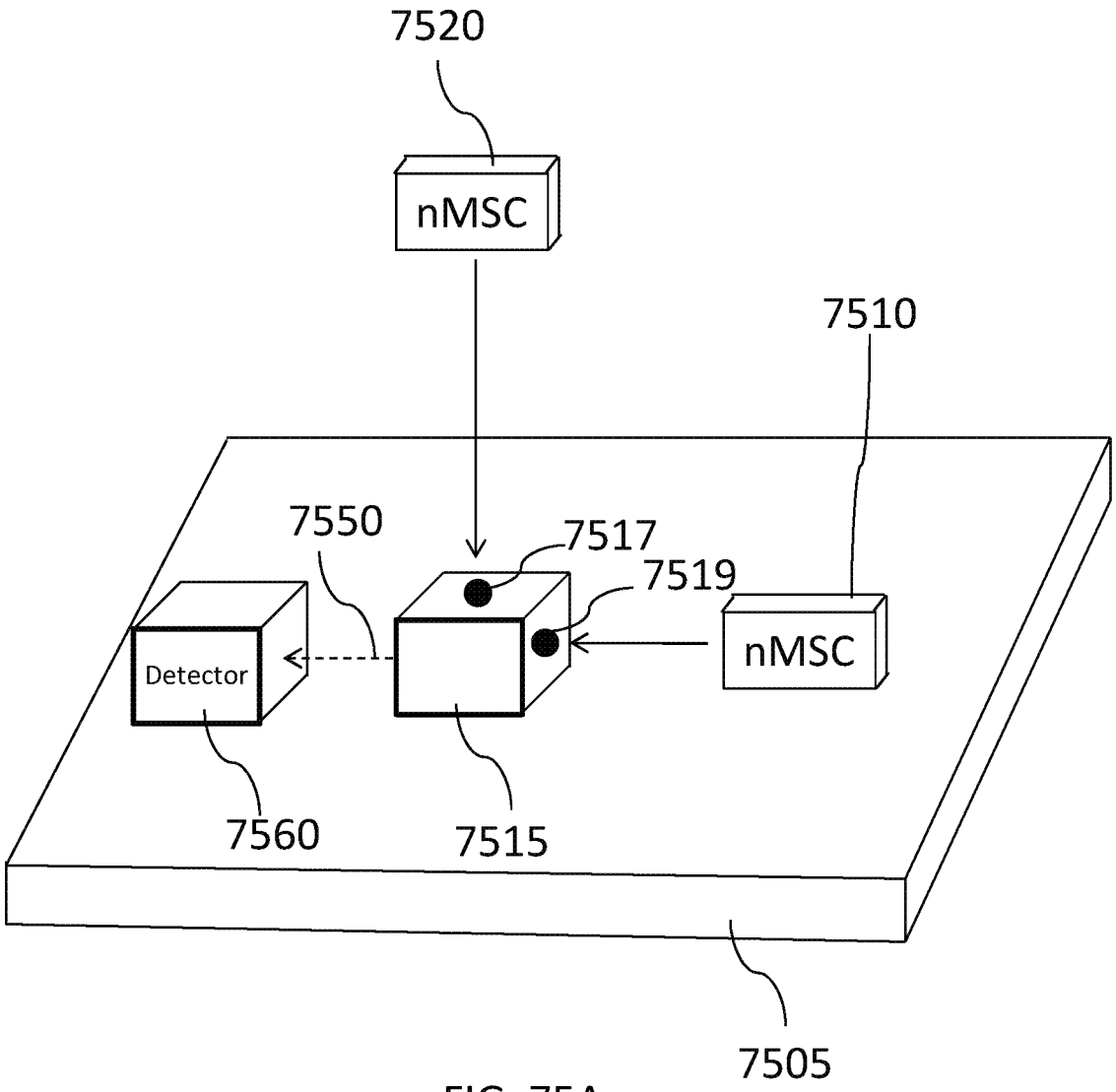
FIG. 75A is another illustration of a system comprising an interface comprising a non-coplanar deflector, in accordance with certain examples.

In some examples, a non-coplanar interface can be present between two or more nMSCs and a common detector. For example and referring to FIG. 75A, a first nMSC 7510 is positioned on a support 7505. A second nMSC 7520 is positioned above the support 7505. An interface 7515 is fluidically coupled to each of the nMSCs 7510, 7520 and to a detector 7560. The ions from the nMSC 7510 enter the interface 7515 through an opening 7519 on a side of the interface 7515, and the ions from the nMSC 7520 enter the interface 7515 though an opening 7517 on a different side of the interface 7515. The ions can be provided from the interface 7515 in the direction of arrow 7550 to a downstream detector 7560. In certain examples, the interface 7515 is configured to provide only ions from the nMSC 7510 to the detector 7560 during a particular analysis period, whereas in other configurations, only ions from the nMSC 7520 are provided to the detector 7560 during a different analysis period. For example, the nMSC 7510 may provide inorganic ions, and the nMSC 7520 may provide organic ions. The downstream detector 7560 can sequentially detect the inorganic and organic ions provided from the two nMSCs 7510, 7520. If desired, a second detector can be present and the interface 7515 can be configured to provide ions to both the detector 7560 and the second detector, e.g., either simultaneously or sequentially.

Figure 75B:
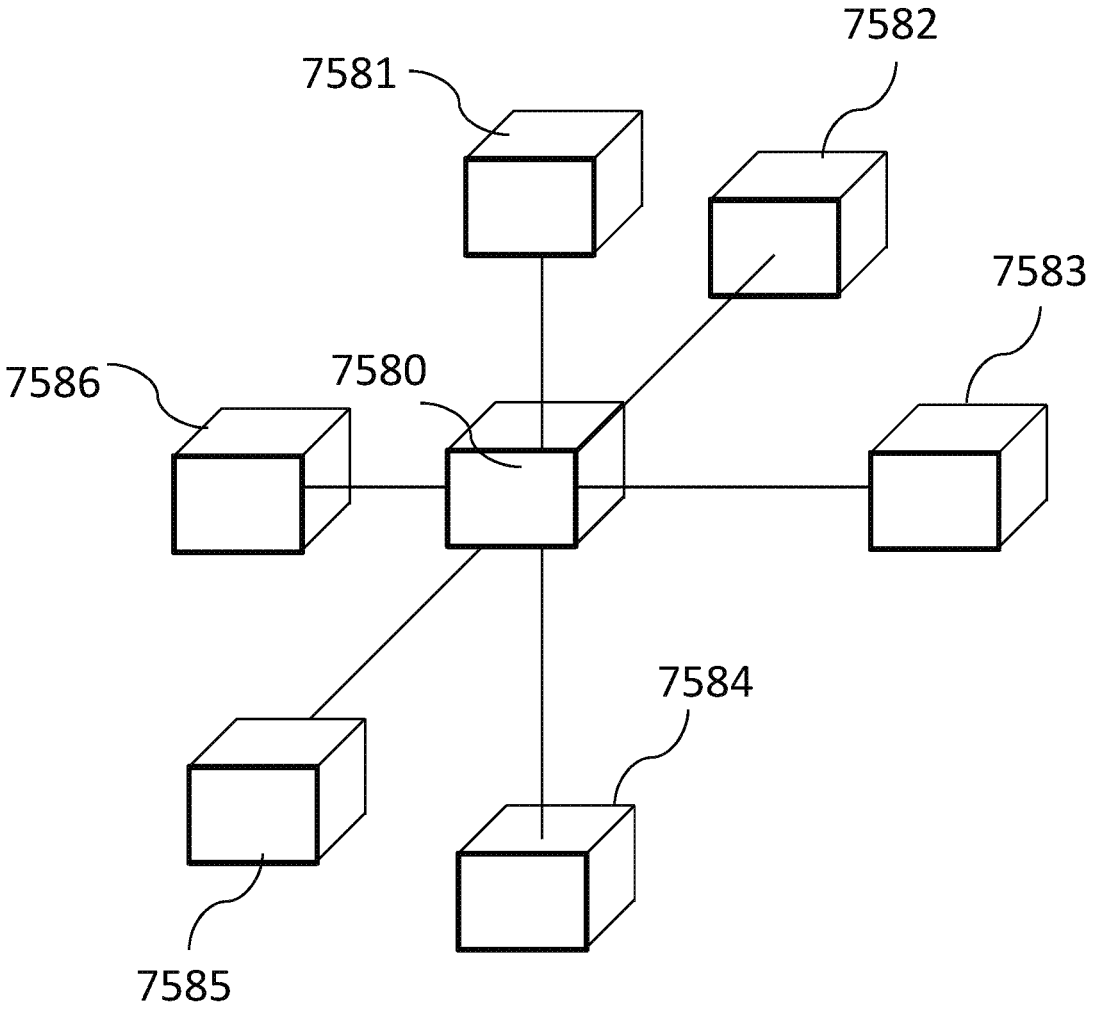
FIG. 75B is an illustration of a multi-dimensional interface coupled to one or more cores, in accordance with certain configurations.

As noted in some instanced herein, where non-coplanar interfaces are used, the interfaces may comprise multipole assemblies to guide the incoming ions in a desired direction. For example a first multipole, e.g., a first quadrature assembly, can be fluidically coupled to a second multipole, e.g., a quadrature assembly, in an interface housing to receive and guide ions from different non-coplanar cores of the system. In some instances, the multipoles can form an octopole which can be configured to receive ions in more than a single plane and direct ions to a same plane or different planes. In some examples, deflectors which can receive and/or direct ions in more than one plane are referred to herein as multi-dimensional deflectors. For example, the deflector may comprise a central quadrupole with one or more other quadrupoles positioned at a suitable angle to the central quadrupole. Referring to FIG. 75B, a central deflector 7580 is shown that can receive and/or direct ions from one or more of the cores 7581, 7582, 7583, 7584, 7585, 7586. In some instances, the central deflector may comprise a central quadrature assembly and one or more stacked quadrature assemblies fluidically coupled to the central quadrature assembly. For example, where each of cores 7581, 7582 and 7583 comprises an ionization core, the deflector 850 may comprise three coupled quadrupoles that can receive ions from the three ionization cores and direct the ions along a different path, e.g., toward one or more of the cores 7584, 7585, 7586. If desired, five of the six cores 7581, 7582, 7583, 7584, 7585, 7586 may be ionization cores and the remaining cores may comprise a mass analyzer comprising a nMSC as described herein. In other examples, at least two of the cores 7581, 7582, 7583, 7584, 7585, 7586 may be mass analyzers comprising one or more nMSCs, and any one or more of the other four cores may comprise an ionization core. In some examples, the central deflector 7580 may be positioned between two or more nMSCs and a detector. For example, core 7584 may comprise a detector, and the cores 7581, 7582, 7583, 7585 and 7586 may each comprise a mass analyzer comprising a nMSC, etc. which can select ions and provide the selected ions to the central deflector 7580. The central deflector can be configured to provide the received ions from any one or more of the cores 7581, 7582, 7583, 7585 and 7586 to the detector in the core 7584. In some examples, the number of individual quadrupoles present in the central deflector 7580 may mirror the number of separate cores coupled to the central deflector 7580. In other instances, the number of individual quadrupoles present in the central deflector 7580 may comprise an "n+1" or a "n−1" configuration where n is the number of separate cores coupled to the central deflector 7580, depending on the exact angles which the cores provide ions to the central deflector 7580 and/or depending on the exact angles the central deflector provides ions to another core.

In some embodiments, the interfaces described herein may take the form of a mechanical switch or an electrical switch. Where mechanical switches are used, the switch may comprise a shutter or orifice which can be opened and closed to permit the passage of analyte/ions or inhibit the passage of sample/ions. In other instances, an electrical switch can be present to permit passage of analyte/ions or inhibit passage of analyte or ions. Illustrative electrical switches may comprise or provide one or more electric or magnetic fields which can direct the analyte/ions toward a desired direction or function as a "blocking wall" to prohibit passage of the analyte/ions from a particular core component.

Common MS Components

Figure 76:
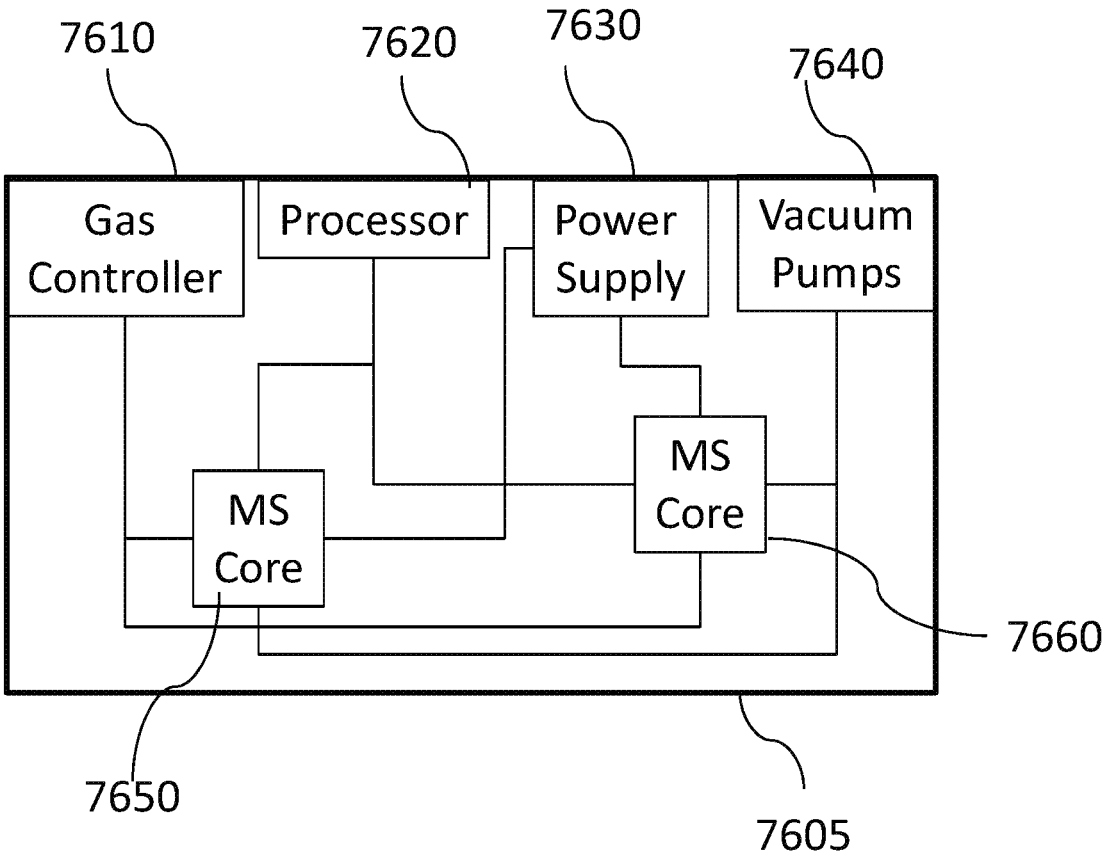
FIG. 76 is an illustration of some common MS components which can be used by different mass analyzers of a IOMS system, in accordance with certain embodiments.

In certain embodiments, the various mass spectrometry cores described herein may desirably use common MS components including, but not limited to, gas controllers, power supplies, processors, pumps, a common instrument housing and the like. Referring to FIG. 76 a general schematic of some of these common components is shown. The system 7600 may comprise gas controllers 7610, a processor 7620 (which may be integral or present as part of a computer system or other device as noted below), one or more vacuum pumps 7640 and one or more power supplies 7630. These common components can be electrically coupled to one or more single MS cores, dual core MSs or multi-MS cores, e.g., such as MS core 7650 and MS core 7660. If desired, only one MS core 7650 can be present and the other MS core 7660 can be omitted. For example, where the mass analyzer 7650 comprises a dual core MS, the mass analyzer 7660 may not be needed for use. It is a substantial attribute that different MS cores can be present and use common MS components, which can result in lower overall costs and fewer components present in the systems described herein. If desired, a common detector (not shown) may be present and used by the MS cores 7650, 7660 as described in detail herein. While not shown, one or more reaction/collision cells can also be commonly used by the different MS cores 7650, 7660 or each core may comprise a respective reaction/collision cell. Illustrative reaction/collision cells are described, for example, in commonly assigned U.S. Pat. Nos. 8,426,804, 8,884,217 and 9,190,253.

In certain embodiments, the gas controllers of the systems described herein can provide a desired gas or gas to some core component of the system. The controller can control flow rate, regulate gas pressure or otherwise control gas flow into and out of the system. The power supply of the system may be AC or DC and may be a fixed power supply, a portable power supply or may take other forms which can provide a current or voltage to the various components of the system. The vacuum pumps typically comprise a roughing pump and a turbomolecular pump. The roughing pump (foreline pump) can be used to provide a rough vacuum and a turbomolecular pump can be used to provide a high vacuum, e.g., $10^{-4}$ Torr, $10^{-6}$ Torr, $10^{-8}$ Torr or lower. The high vacuum prevents deviation of ions from a selected path and can provide for collision free ion trajectories and reduce background noise. The exact pressure used can depend on the particular components present in the mass analyzer. Rotary pumps, diffusion pumps and other similar pumps can be used as vacuum pumps in the systems described herein. If desired, valves, vacuum gauges, sensors, etc. may also be present to control and/or monitor the various pressures in the systems.

In certain embodiments, the IOMS systems described herein may comprise suitable common hardware circuitry including, for example, a microprocessor and/or suitable software for operating the system. The processor can be integral to the instrument housing or may be present on one or more accessory boards, printed circuit boards or computers electrically coupled to the components of the IOMS system. The processor can be used, for example, to control gas flows, to control movement of any core components, to control voltages or frequencies applied to or used with the nMSCs, to detect ions using a detector, etc. The processor is typically electrically coupled to one or more memory units to receive data from the core components of the IOMS system and permit adjustment of the various system parameters as needed or desired. The processor may be part of a general-purpose computer such as those based on Unix, Intel PENTIUM-type processor, Motorola PowerPC, Sun UltraSPARC, Hewlett-Packard PA-RISC processors, or any other type of processor. One or more of any type computer system may be used according to various embodiments of the technology. Further, the system may be connected to a single computer or may be distributed among a plurality of computers attached by a communications network. It should be appreciated that other functions, including network communication, can be performed and the technology is not limited to having any particular function or set of functions. Various aspects of the systems and methods may be implemented as specialized software executing in a general-purpose computer system. The computer system may include a processor connected to one or more memory devices, such as a disk drive, memory, or other device for storing data. Memory is typically used for storing programs, calibrations and data during operation of the sampling system. Components of the computer system may be coupled by an interconnection device, which may include one or more buses (e.g., between components that are integrated within a same machine) and/or a network (e.g., between components that reside on separate discrete machines). The interconnection device provides for communications (e.g., signals, data, instructions) to be exchanged between components of the system. The computer system typically can receive and/or issue commands within a processing time, e.g., a few milliseconds, a few microseconds or less, to permit rapid control of the IOMS systems. For example, computer control can be implemented with a dual core MS to permit rapid switching between inorganic ion filtering and organic ion filtering. The processor typically is electrically coupled to a power source which can vary, for example, a direct current source, a battery, a rechargeable battery, an electrochemical cell, a fuel cell, a solar cell, a wind turbine, a hand crank generator, an alternating current source as, for example, 120V AC power or 240V AC power or combinations of any of these types of power sources. The power source can be shared by the other components of the system including the MS cores, detectors, etc. The system may also include one or more input devices, for example, a keyboard, mouse, trackball, microphone, touch screen, manual switch (e.g., override switch) and one or more output devices, for example, a printing device, display screen, speaker. In addition, the system may contain one or more communication interfaces that connect the computer system to a communication network (in addition or as an alternative to the interconnection device). The system may also include suitable circuitry to convert signals received from the core components of the IOMS system. Such circuitry can be present on a printed circuit board or may be present on a separate board or device that is electrically coupled to the printed circuit board through a suitable interface, e.g., a serial ATA interface, ISA interface, PCI interface or the like or through one or more wireless interfaces, e.g., Bluetooth, WiFi, Near Field Communication or other wireless protocols and/or interfaces.

In certain embodiments, the storage system used with the IOMS systems typically includes a computer readable and writeable nonvolatile recording medium in which codes can be stored that can be used by a program to be executed by the processor or information stored on or in the medium to be processed by the program. The medium may, for example, be a disk, solid state drive or flash memory. Typically, in operation, the processor causes data to be read from the nonvolatile recording medium into another memory that allows for faster access to the information by the processor than does the medium. This memory is typically a volatile, random access memory such as a dynamic random access memory (DRAM) or static memory (SRAM). It may be located in the storage system or in the memory system. The processor generally manipulates the data within the integrated circuit memory and then copies the data to the medium after processing is completed. For example, the processor may receive signals from the various core components and adjust gas flow rates, interface parameters, ionization source parameters, detector parameters, etc. A variety of mechanisms are known for managing data movement between the medium and the integrated circuit memory element and the technology is not limited thereto. The technology is also not limited to a particular memory system or storage system. In certain embodiments, the system may also include specially-programmed, special-purpose hardware, for example, an application-specific integrated circuit (ASIC) or a field programmable gate array (FPGA). Aspects of the technology may be implemented in software, hardware or firmware, or any combination thereof. Further, such methods, acts, systems, system elements and components thereof may be implemented as part of the systems described above or as an independent component. Although specific systems are described by way of example as one type of system upon which various aspects of the technology may be practiced, it should be appreciated that aspects are not limited to being implemented on the described system. Various aspects may be practiced on one or more systems having a different architecture or components. The system may comprise a general-purpose computer system that is programmable using a high-level computer programming language. The systems may be also implemented using specially programmed, special purpose hardware. In the systems, the processor is typically a commercially available processor such as the well-known Pentium class processors available from the Intel Corporation. Many other processors are available. Such a processor usually executes an operating system which may be, for example, the Windows 95, Windows 98, Windows NT, Windows 2000 (Windows ME), Windows XP, Windows Vista, Windows 7, Windows 8 or Windows 10 operating systems available from the Microsoft Corporation, MAC OS X, e.g., Snow Leopard, Lion, Mountain Lion or other versions available from Apple, the Solaris operating system available from Sun Microsystems, or UNIX or Linux operating systems available from various sources. Many other operating systems may be used, and in certain embodiments a simple set of commands or instructions may function as the operating system.

In certain examples, the processor and operating system may together define a platform for which application programs in high-level programming languages may be written. It should be understood that the technology is not limited to a particular system platform, processor, operating system, or network. Also, it should be apparent to those skilled in the art, given the benefit of this disclosure, that the present technology is not limited to a specific programming language or computer system. Further, it should be appreciated that other appropriate programming languages and other appropriate systems could also be used. In certain examples, the hardware or software can be configured to implement cognitive architecture, neural networks or other suitable implementations. If desired, one or more portions of the computer system may be distributed across one or more computer systems coupled to a communications network. These computer systems also may be general-purpose computer systems. For example, various aspects may be distributed among one or more computer systems configured to provide a service (e.g., servers) to one or more client computers, or to perform an overall task as part of a distributed system. For example, various aspects may be performed on a client-server or multi-tier system that includes components distributed among one or more server systems that perform various functions according to various embodiments. These components may be executable, intermediate (e.g., IL) or interpreted (e.g., Java) code which communicate over a communication network (e.g., the Internet) using a communication protocol (e.g., TCP/IP). It should also be appreciated that the technology is not limited to executing on any particular system or group of systems. Also, it should be appreciated that the technology is not limited to any particular distributed architecture, network, or communication protocol.

In some instances, various embodiments may be programmed using an object-oriented programming language, such as, for example, SQL, SmallTalk, Basic, Java, Javascript, PHP, C++, Ada, Python, iOS/Swift, Ruby on Rails or C # (C-Sharp). Other object-oriented programming languages may also be used. Alternatively, functional, scripting, and/or logical programming languages may be used. Various configurations may be implemented in a non-programmed environment (e.g., documents created in HTML, XML or other format that, when viewed in a window of a browser program, render aspects of a graphical-user interface (GUI) or perform other functions). Certain configurations may be implemented as programmed or non-programmed elements, or any combination thereof. In some instances, the IOMS system can be controlled through a remote interface such as a mobile device, tablet, laptop computer or other portable devices which can communicate with the IOMS system through a wired or wireless interface and permit operation of the IOMS system remotely if desired.

In certain examples, a method of sequentially detecting inorganic ions and organic ions using a mass analyzer fluidically coupled to an ionization core comprises sequentially selecting (i) ions from the inorganic ions received from the ionization core and (ii) ions from the organic ions received from the ionization core, in which the mass analyzer comprises a first single core mass spectrometer and a second single core mass spectrometer each configured to use a common processor, a common power source and at least one common vacuum pump, wherein the first single core mass spectrometer is configured to select the ions from the inorganic ions received from the ionization core and the second single core mass spectrometer is configured to select the ions from the organic ions received from the ionization core. In some examples, the method comprises providing the selected inorganic ions from the first single core mass spectrometer to a first detector during a first analysis period. In other embodiments, the method comprises providing the selected organic ions from the second single core mass spectrometer to the first detector during a second analysis period different from the first analysis period. In some instances, the method comprises providing the selected inorganic ions from the first single core mass spectrometer to a first detector during a first analysis period and providing the selected organic ions from the second single core mass spectrometer to a second detector during the first analysis period. In certain examples, the method comprises providing ions to the first single core mass spectrometer during a first analysis period while preventing ion flow to the second single core mass spectrometer during the first analysis period. In other examples, the method comprises providing ions to the second single core mass spectrometer during a second analysis period while preventing ion flow to the first single core mass spectrometer during the second analysis period. In some embodiments, the method comprises configuring the ionization core with an inorganic ion source and an organic ion source separate from the inorganic ion source. In some examples, the method comprises providing ions from the inorganic ion source to the first single core mass spectrometer during a first analysis period while preventing ion flow from the organic ion source to the second single core mass spectrometer during the first analysis period. In some embodiments, the method comprises providing ions from the organic ions source to the second single core mass spectrometer during a second analysis period while preventing ion flow from the inorganic ion source to the first single core mass spectrometer during the second analysis period. In other instances, the method comprises configuring the mass analyzer with an interface configured to provide ions to a detector from only one of the first single core mass spectrometer and the second single core mass spectrometer during a first analysis period.

In other examples, a method of sequentially detecting inorganic ions and organic ions using a mass analyzer fluidically coupled to an ionization core comprises sequentially selecting (i) ions from the inorganic ions received from the ionization core and (ii) ions from the organic ions received from the ionization core, in which the mass analyzer comprises a dual core mass spectrometer configured to select both the inorganic ions and the organic ions. In some instances, the method comprises providing the selected inorganic ions from the dual core mass spectrometer to a first detector during a first analysis period. In other examples, the method comprises providing the selected organic ions from the dual core mass spectrometer to the first detector during a second analysis period different from the first analysis period. In certain embodiments, the method comprises providing the selected inorganic ions from the dual core mass spectrometer to a first detector during a first analysis period and providing the selected organic ions from the dual core mass spectrometer to a second detector during a second analysis period. In other examples, the method comprises providing inorganic ions to the dual core mass spectrometer during a first analysis period while preventing organic ion flow to the dual core mass spectrometer during the first analysis period. In some examples, the method comprises providing organic ions to the dual core mass spectrometer during a second analysis period while preventing inorganic ion flow to the dual core mass spectrometer during the second analysis period. In certain instances, the method comprises configuring the ionization core with an inorganic ion source and an organic ion source separate from the inorganic ion source. In some examples, the method comprises configuring the dual core mass spectrometer co to comprise a dual quadrupole assembly. In other examples, the method comprises configuring the dual core mass spectrometer to comprise a dual quadrupole assembly fluidically coupled to a first detector through an interface and fluidically coupled to a second detector through the interface and a quadrupole assembly. In some examples, the method comprises configuring the interface to comprise a non-coplanar interface.

In other embodiments, a method of selecting ions provided from an ionization core comprising two different ionization sources using a dual core mass spectrometer comprises sequentially providing ions from an ionization core comprising an inorganic ionization source and an organic ionization source to the dual core mass spectrometer, selecting ions from the provided ions from the inorganic ionization source using a first frequency provided to the dual core mass spectrometer, and selecting ions from the provided ions from the organic ionization source using a second frequency provided to the dual core mass spectrometer, in which the first frequency is different from the second frequency. In some examples, the method comprises configuring the dual core mass spectrometer to switch between the first frequency and the second frequency after a selection period. In other embodiments, the method comprises configuring the selection period to be 1 millisecond or less. In some examples, the method comprises providing an interface between the inorganic ionization source and the dual core mass spectrometer and between the organic ionization source and the dual core mass spectrometer, wherein the interface is configured to provide ions from the inorganic ionization source to the dual core mass spectrometer when the first frequency is provided to the dual core mass spectrometer and is configured to provide ions from the organic ionization source to the dual core mass spectrometer when the second frequency is provided to the dual core mass spectrometer. In some instances, the method comprises configuring a detector to detect the selected inorganic ions when the first frequency is provided to the dual core mass spectrometer. In some examples, the method comprises configuring the detector to detect the selected organic ions when the second frequency is provided to the dual core mass spectrometer. In certain instances, the method comprises configuring the dual core mass spectrometer with a multipole assembly. In other examples, the method comprises configuring the multipole assembly to comprise a dual quadrupole assembly. In some embodiments, the method comprises configuring the multipole assembly to comprise a triple quadrupole assembly. In some instances, the method comprises configuring the detector to comprise at least one or more an electron multiplier, a Faraday cup, a multichannel plate, a scintillation detector, an imaging detector or a time of flight device.

Certain specific examples of mass spectrometers which can analyze both inorganic and organic ions are described in more detail below.

Example 1

Figure 77:
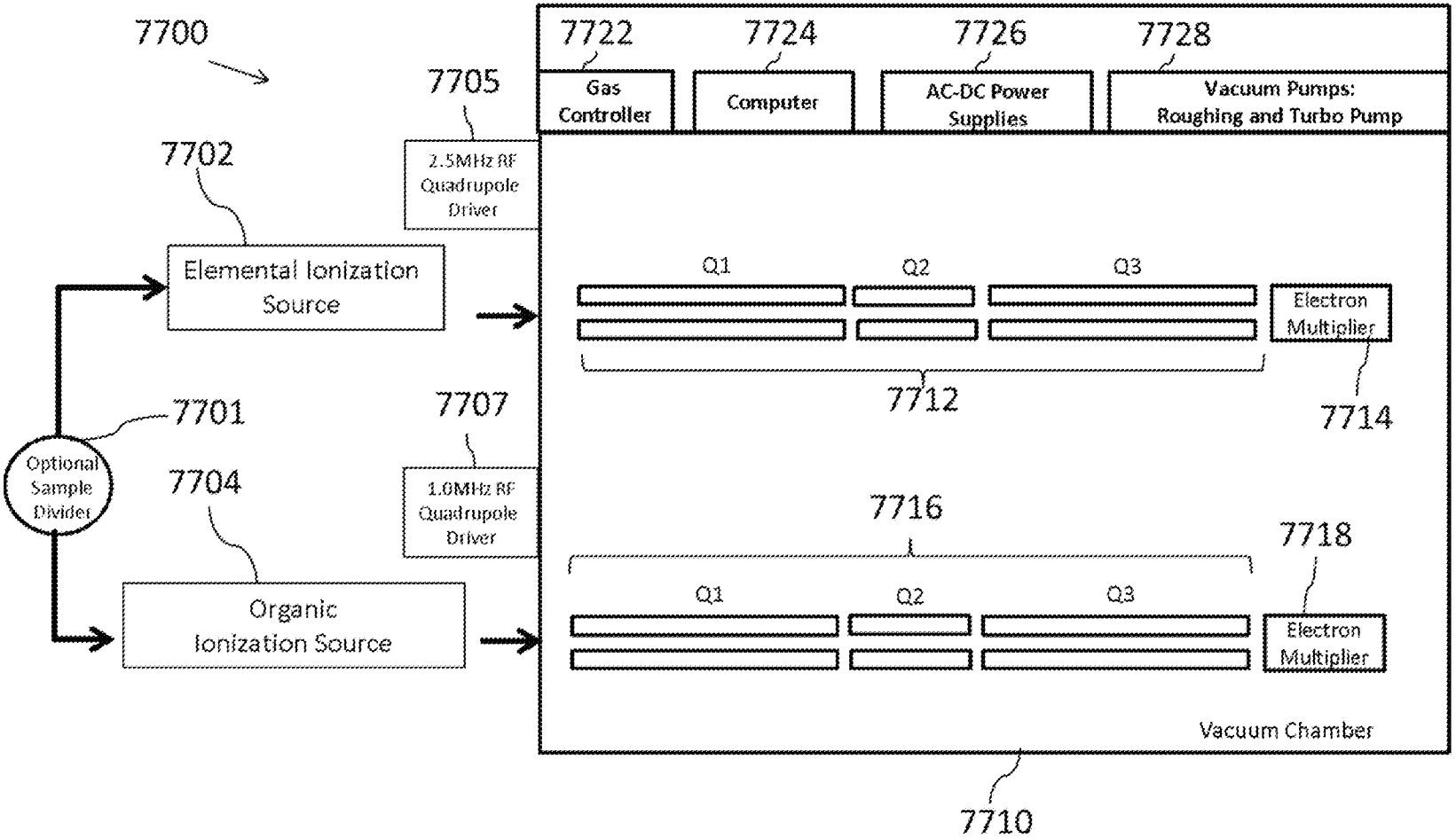
FIG. 77 is a block diagram of an IOMS system comprising two single core mass spectrometers each comprising a respective detector, in accordance with certain examples.

One configuration of an IOMS 7700 is shown in FIG. 77. The IOMS 7700 comprises an elemental ionization source 7702, e.g., an ICP, CCP, a microwave plasma, flame, arc, spark, etc. and an organic ionization source 7704, e.g., a ESI, API, APCI, DESI, MALDI or any one or more of the other organic ionization sources described herein. While not shown, each of the sources 7702, 7704 can be fluidically coupled to a sample operation core and can receive sample through an interface 7701, which can be configured to divide/provide sample to each of the sources 7702, 7704. The source 7702 is fluidically coupled to a first MS core 7712 positioned with a vacuum chamber 7710. The first MS core 7712 comprises a triple quadrupole assembly, which can be considered a single core mass spectrometer, coupled to a first electron multiplier 7714. The MS core 7712 can be electrically coupled to a 2.5 MHz RF driver 7705 such that the core 7712 selects inorganic ions and provides the selected inorganic ions to the EM 7714 for detection. The source 7704 is fluidically coupled to a second MS core 7716 positioned within the vacuum chamber 7710. The second MS core 7716 comprises a triple quadrupole assembly, which can be considered a single core mass spectrometer, coupled to a second electron multiplier 7718. The MS core 7716 can be electrically coupled to a 1.0 MHz RF driver 7707 such that the MS core 7716 selects organic ions and provides the selected organic ions to the EM 7718 for detection. The mass spectrometer cores 7712, 7714 share several common MS components including a gas controller 7722, a computer 7724, an AC-DC power supply 7726, and vacuum pumps 7728. The drivers 7705, 7707 may be present in separate RF generators or a common RF generator.

Example 2

Figure 78:
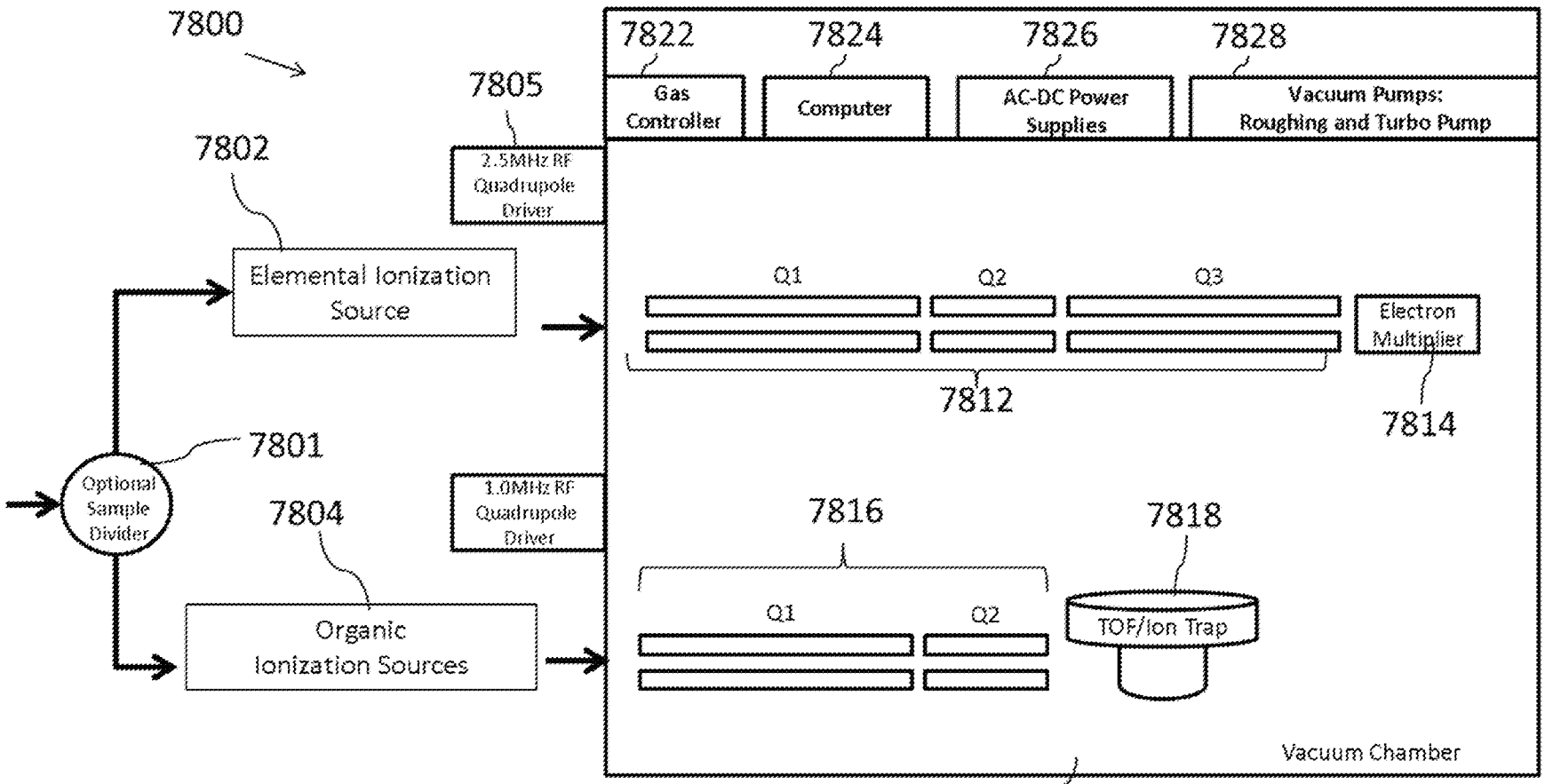
FIG. 78 is a block diagram of an IOMS system comprising two single core mass spectrometers each comprising a respective different detector, in accordance with certain examples.

Another configuration of an IOMS 7800 is shown in FIG. 78. The IOMS 7800 comprises an elemental ionization source 7802, e.g., an ICP, CCP, a microwave plasma, flame, arc, spark, etc., and an organic ionization source 7804, e.g., a ESI, API, APCI, DESI, MALDI or any one or more of the other organic ionization sources described herein. While not shown, each of the sources 7802, 7804 can be fluidically coupled to a sample operation core and can receive sample through an interface 7801, which can be configured to divide/provide sample to each of the sources 7802, 7804. The source 7802 is fluidically coupled to a first MS core 7812 positioned with a vacuum chamber 7810. The first MS core 7812 comprises a triple quadrupole assembly, which can be considered a single core mass spectrometer, coupled to a first electron multiplier 7814. The MS core 7812 can be electrically coupled to a 2.5 MHz RF driver 7805 such that the core 7812 selects inorganic ions and provides the selected inorganic ions to the EM 7814 for detection. The source 7804 is fluidically coupled to a second MS core 7816 positioned within the vacuum chamber 7810. The second MS core 7816 comprises a double quadrupole assembly, which can be considered a single core mass spectrometer, coupled to a time of flight device or an ion trap 7818. The MS core 7816 can be electrically coupled to a 1.0 MHz RF driver 7807 such that the MS core 7816 selects organic ions and provides the selected organic ions to the TOF/ion trap 7818 for detection. The mass spectrometer cores 7812, 7814 share several common MS components including a gas controller 7822, a computer 7824, an AC-DC power supply 7826, and vacuum pumps 7828. The drivers 7805, 7807 may be present in separate RF generators or a common RF generator.

Example 3

Figure 79:
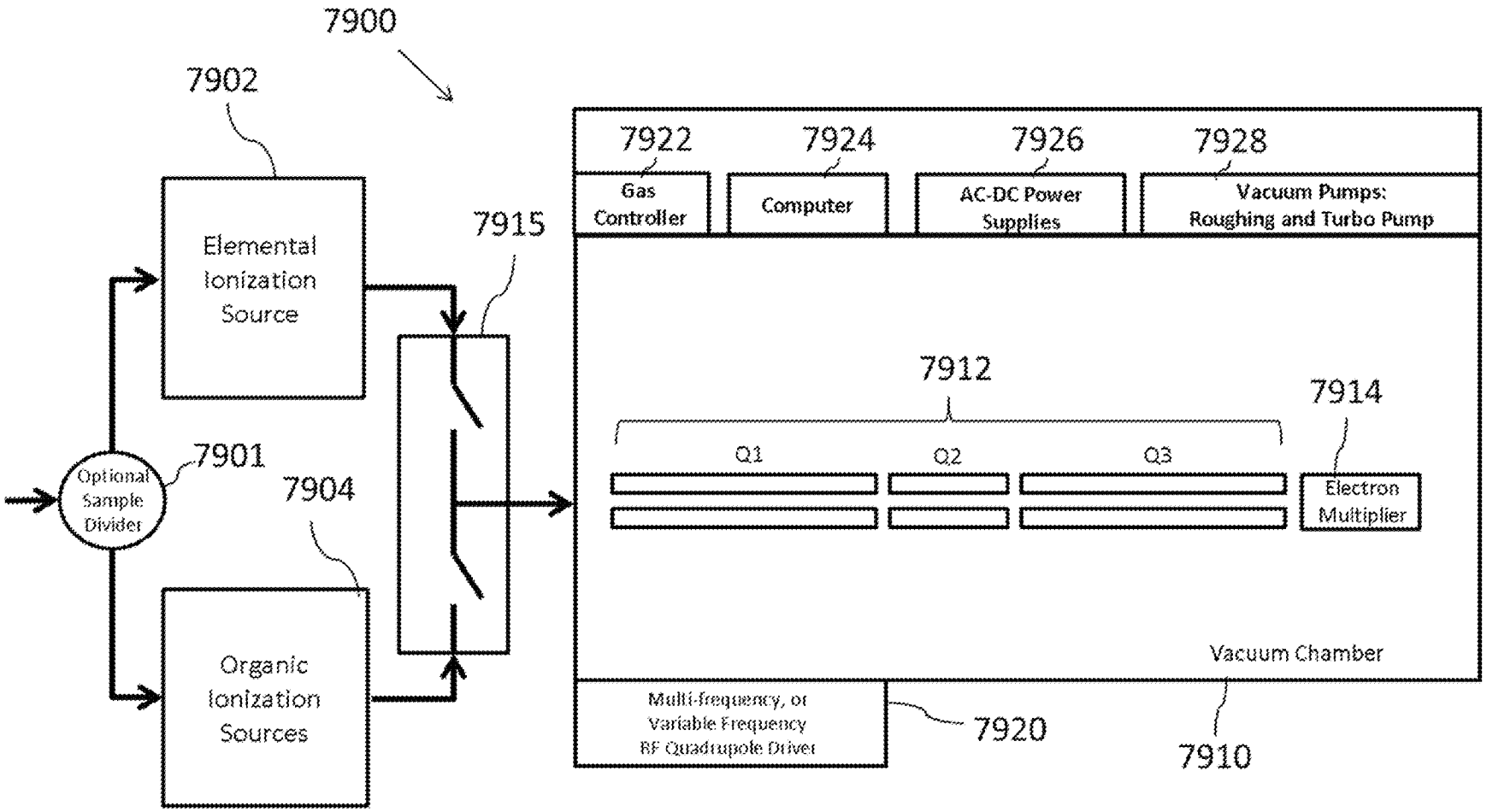
FIG. 79 is a block diagram of an IOMS system comprising a dual core mass spectrometer, in accordance with certain examples.

Another configuration of an IOMS 7900 is shown in FIG. 79. The IOMS 7900 comprises an elemental ionization source 7902, e.g., e.g., an ICP, CCP, a microwave plasma, flame, arc, spark, etc., and an organic ionization source 7904, e.g., a ESI, API, APCI, DESI, MALDI or any one or more of the other organic ionization sources described herein. While not shown, each of the sources 7902, 7904 can be fluidically coupled to a sample operation core and can receive sample through an interface 7901, which can be configured to divide/provide sample to each of the sources 7902, 7904. The source 7902 is fluidically coupled to a MS core 7912 positioned with a vacuum chamber 7910. The MS core 7912 comprises a triple quadrupole assembly 7912, which in this example can be considered a dual core mass spectrometer, coupled to a first electron multiplier 7914. The MS core 7912 can be electrically coupled to a variable frequency or multi-frequency driver 7920 such that the dual core MS 7912 selects inorganic ions at a first frequency, e.g., 2.5 MHz, and provides the selected inorganic ions to the EM 7914 for detection. The source 7904 can also be fluidically coupled to the MS core 7912 positioned within the vacuum chamber 7910. The MS core 7912 can be electrically coupled to the driver 7920 such that the MS core 7912 selects organic ions at a second frequency, e.g. 1.0 MHz, and provides the selected organic ions to the EM 7914 for detection. The system 7900 comprises an interface 7915 that can be configured to provide ions from either the source 7902 or the source 7904 (or both) to the MS core 7912 during any particular analysis period. The system 7900 also comprises common MS components including a gas controller 7922, a computer 7924, an AC-DC power supply 7926, and vacuum pumps 7928.

Example 4

Figure 80:
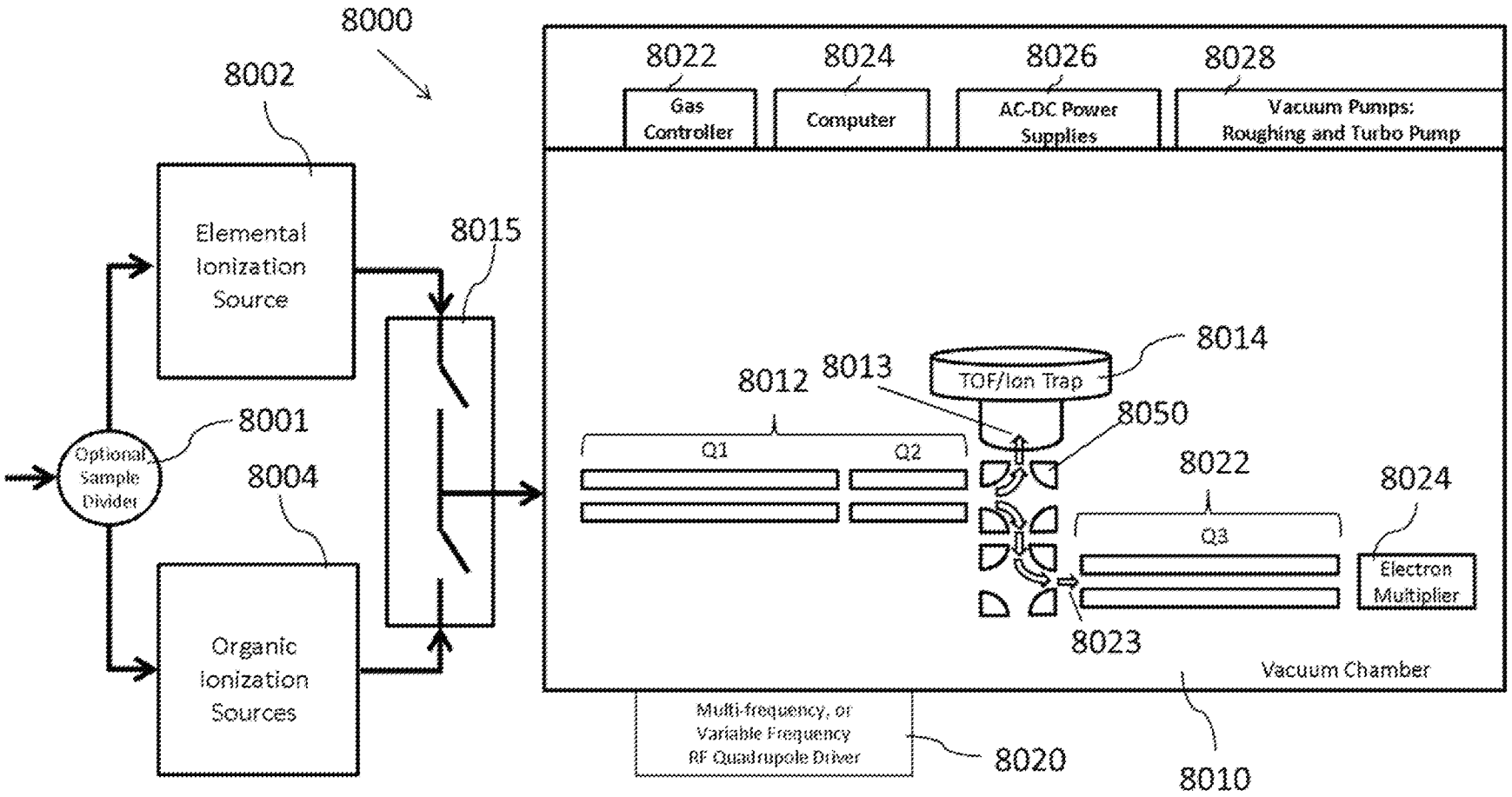
FIG. 80 is a block diagram of an IOMS system comprising a dual core mass spectrometer and two detectors, in accordance with certain examples.

Another configuration of an IOMS 8000 is shown in FIG. 80. The IOMS 8000 comprises an elemental ionization source 8002, e.g., an ICP, CCP, a microwave plasma, flame, arc, spark, etc., and an organic ionization source 8004, e.g., a ESI, API, APCI, DESI, MALDI or any one or more of the other organic ionization sources described herein. While not shown, each of the sources 8002, 8004 can be fluidically coupled to a sample operation core and can receive sample through an interface 8001, which can be configured to divide/provide sample to each of the sources 8002, 8004. Each of the sources 8002, 8004 is fluidically coupled to a MS core 8012 positioned with a vacuum chamber 8020. The MS core 8012 comprises a double quadrupole assembly. The MS core 8012 can select ions and provide them to a deflector 8050, which can be configured to either provide ions to a TOF/ion trap 8014 or can be configured to provide ions to a core 8022 comprising a quadrupole Q3. For example, organic ions can be selected and provided to the TOF/ion trap 8014 using a first frequency, e.g., 1.0 MHz, provided to the MS core 8012 by a multi-frequency driver 8020. Where inorganic ions are provided to the MS core 8012, the inorganic ions can be provided to the deflector 8050 and to the core 8022 using a second frequency, e.g., from the multi-frequency source 8020. The selected inorganic ions can be provided from the MS core 8012 to the EM detector 8024. The system 8000 also comprises common MS components including a gas controller 8022, a computer 8024, an AC-DC power supply 8026, and vacuum pumps 8028 which can be used by both the core 8012 and the core 8022 and other components of the system 8000.

Example 5

Figure 81:
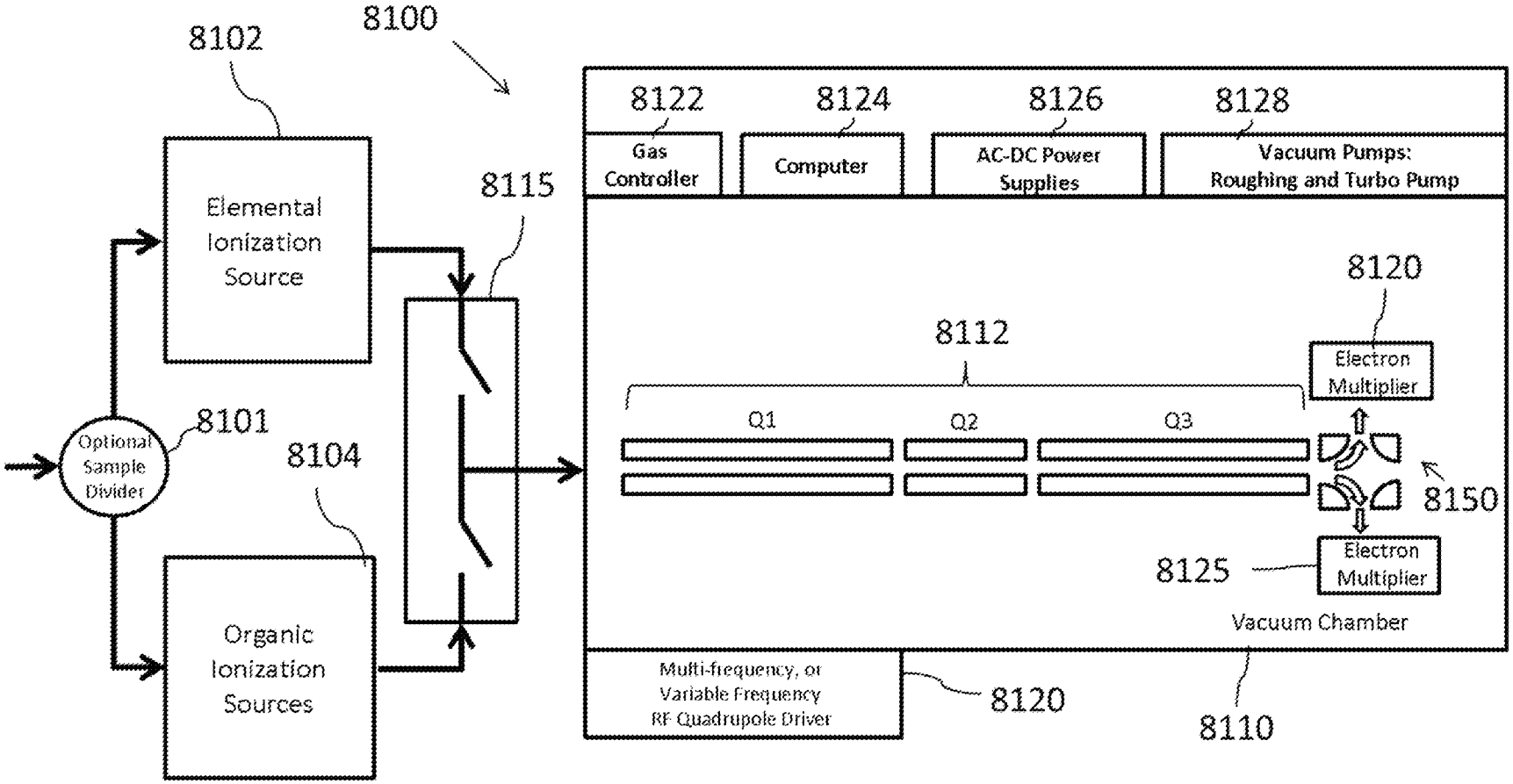
FIG. 81 is a block diagram of another IOMS system comprising a dual core mass spectrometer and two detectors, in accordance with certain examples.

Another configuration of an IOMS 8100 is shown in FIG. 81. The IOMS 8100 comprises an elemental ionization source 8102, e.g., e.g., an ICP, CCP, a microwave plasma, flame, arc, spark, etc., and an organic ionization source 8104, e.g., a ESI, API, APCI, DESI, MALDI or any one or more of the other organic ionization sources described herein. While not shown, each of the sources 8102, 8104 can be fluidically coupled to a sample operation core and can receive sample through an interface 8101, which can be configured to divide/provide sample to each of the sources 8102, 8104. Each of the sources 8102, 8104 is fluidically coupled to a dual core MS 8112 positioned with a vacuum chamber 8110. The dual core MS 8112 comprises a triple quadrupole assembly. The dual core MS 8112 can select ions (inorganic ions or organic ions) and provide them to a deflector 8150. For example, the core 8112 can be used to filter and detect organic ions, e.g., by running Q1 and Q3 at 1 MHz, and routing the organic ions to detector 8120, e.g., a first electron multiplier, using the deflector 8150. The core 8112 can also be used to filter and detect inorganic ions, e.g., by running Q1 and Q3 at 2.5 MHz, and routing the inorganic ions to the detector 8125, e.g., a second electron multiplier. The system 8100 also comprises common MS components including a gas controller 8122, a computer 8124, an AC-DC power supply 8126, and vacuum pumps 8128 which can be used by both the core 8112 and other components of the system 8100.

Example 6

A dual core mass spectrometer as described herein can be used to measure the mercury levels in agricultural crops including rice or other grains. An IOMS system may comprise a liquid chromatography device coupled to an ICP device and an ESI device as ionization sources. Each of the ionization sources can be coupled to a triple quad dual core mass spectrometer comprising an electron multiplier detector. Mercury, methylmercury and other mercury compounds and complexes can be measured using the IOMS system.

Example 7

A dual core mass spectrometer as described herein can be used to measure free and metal bound phytochelatins. An IOMS system may comprise a liquid chromatography device can be coupled an ICP device and an ESI device as ionization sources. Each of the ionization sources can be coupled to a triple quad dual core mass spectrometer comprising an electron multiplier detector. The levels of metal bound phytochelatins and free phytochelatins can be measured using the IOMS system.

Example 8

A dual core mass spectrometer as described herein can be used to measure fatty acids and fatty acids complexed to metals such as arsenic. An IOMs system may comprise a liquid chromatography device coupled to an ICP device and an ESI device as ionization sources. Each of the ionization sources can be coupled to a triple quad dual core mass spectrometer comprising an electron multiplier detector. The levels of fatty acids and fatty acids complexed to metals such as arsenic can be measured using the IOMS system.

Example 9

A dual core mass spectrometer as described herein can be used to measure selenium levels and selenium metabolites in tissue samples. An IOMS system may comprise a liquid chromatography device coupled to an ICP device and an ESI device as ionization sources. Each of the ionization sources can be coupled to a triple quad dual core mass spectrometer comprising an electron multiplier detector. The levels of selenium and selenium metabolites can be measured using the IOMS system.

Example 10

An IOMS system comprising two single MS cores can be used to measured selenium levels in agricultural crops such as soybeans. The IOMS system may comprise a liquid chromatography device coupled to an ICP device and an ESI device as ionization sources. Each single MS core may comprise a triple quad mass spectrometer. One single core MS can be fluidically coupled to an electron multiplier. The other single core MS can be fluidically coupled to an ion trap. The levels of selenium can be measured using the IOMS system.

Example 11

An IOMS system comprising two single MS cores can be used to measured species and metabolites present in cerebrospinal fluid (CSF). The IOMS system may comprise a gas chromatography device and a liquid chromatography device each coupled to an ICP device and a direct flow injection device. Each single MS core may comprise a triple quad mass spectrometer. Alternatively, one single MS core may comprise a dual quad coupled to a TOF device. One single core MS can be fluidically coupled to an electron multiplier. The other single core MS can be fluidically coupled to an electron multiplier or an ion trap or the TOF device. The levels of different inorganic and organic species in the CSF can be measured using the IOMS system.

Example 12

An IOMS system comprising a dual core MS can be used to measure inorganic and organic contaminants in water samples. The IOMS system may comprise a HPLC coupled to an ICP device and an ESI device as ionization sources. Each of the ionization sources can be coupled to a triple quad dual core mass spectrometer comprising an electron multiplier detector. The levels of each of the inorganic contaminants and organic contaminants in the water samples can be measured using the IOMS system.

Example 13

An IOMS system comprising a dual core MS can be used to measure inorganic and organic drug metabolites. The IOMS system may comprise a HPLC coupled to an ICP device and an ESI device as ionization sources. Each of the ionization sources can be coupled to a triple quad dual core mass spectrometer comprising an electron multiplier detector. The levels of the drug metabolites can be measured using the IOMS system. In particular, free levels of lithium and other light weight elements can be measured.

When introducing elements of the examples disclosed herein, the articles "a," "an," "the" and "said" are intended to mean that there are one or more of the elements. The terms "comprising," "including" and "having" are intended to be open-ended and mean that there may be additional elements other than the listed elements. It will be recognized by the person of ordinary skill in the art, given the benefit of this disclosure, that various components of the examples can be interchanged or substituted with various components in other examples.

Although certain aspects, examples and embodiments have been described above, it will be recognized by the person of ordinary skill in the art, given the benefit of this disclosure, that additions, substitutions, modifications, and alterations of the disclosed illustrative aspects, examples and embodiments are possible.

What is claimed is:

1. A method of sequentially detecting inorganic ions and organic ions using a mass analyzer fluidically coupled to an ionization core, the method comprising sequentially selecting (i) ions from the inorganic ions received from the ionization core and (ii) ions from the organic ions received from the ionization core, in which the mass analyzer comprises a first single core mass spectrometer and a second single core mass spectrometer each configured to use a common processor, a common power source and at least one common vacuum pump, wherein the first single core mass spectrometer is configured to select the ions from the inorganic ions received from the ionization core and the second single core mass spectrometer is configured to select the ions from the organic ions received from the ionization core.

2. The method of claim 1, further comprising providing the selected inorganic ions from the first single core mass spectrometer to a first detector during a first analysis period.

3. The method of claim 2, further comprising providing the selected organic ions from the second single core mass spectrometer to the first detector during a second analysis period different from the first analysis period.

4. The method of claim 1, further comprising providing the selected inorganic ions from the first single core mass spectrometer to a first detector during a first analysis period and providing the selected organic ions from the second single core mass spectrometer to a second detector during the first analysis period.

5. The method of claim 1, further comprising providing ions to the first single core mass spectrometer during a first analysis period while preventing ion flow to the second single core mass spectrometer during the first analysis period.

6. The method of claim 5, further comprising providing ions to the second single core mass spectrometer during a second analysis period while preventing ion flow to the first single core mass spectrometer during the second analysis period.

7. The method of claim 6, further comprising configuring the ionization core with an inorganic ion source and an organic ion source separate from the inorganic ion source.

8. The method of claim 7, further comprising providing ions from the inorganic ion source to the first single core mass spectrometer during a first analysis period while preventing ion flow from the organic ion source to the second single core mass spectrometer during the first analysis period.

9. The method of claim 7, further comprising providing ions from the organic ions source to the second single core mass spectrometer during a second analysis period while preventing ion flow from the inorganic ion source to the first single core mass spectrometer during the second analysis period.

10. The method of claim 1, further comprising configuring the mass analyzer with an interface configured to provide ions to a detector from only one of the first single core mass spectrometer and the second single core mass spectrometer during a first analysis period.

11. A method of sequentially detecting inorganic ions and organic ions using a mass analyzer fluidically coupled to an ionization core, the method comprising sequentially selecting (i) ions from the inorganic ions received from the ionization core and (ii) ions from the organic ions received from the ionization core, in which the mass analyzer comprises a dual core mass spectrometer configured to select both the inorganic ions and the organic ions.

12. The method of claim 11, further comprising providing the selected inorganic ions from the dual core mass spectrometer to a first detector during a first analysis period.

13. The method of claim 12, further comprising providing the selected organic ions from the dual core mass spectrometer to the first detector during a second analysis period different from the first analysis period.

14. The method of claim 11, further comprising providing the selected inorganic ions from the dual core mass spectrometer to a first detector during a first analysis period and providing the selected organic ions from the dual core mass spectrometer to a second detector during a second analysis period.

15. The method of claim 11, further comprising providing inorganic ions to the dual core mass spectrometer during a first analysis period while preventing organic ion flow to the dual core mass spectrometer during the first analysis period.

16. The method of claim 15, further comprising providing organic ions to the dual core mass spectrometer during a second analysis period while preventing inorganic ion flow to the dual core mass spectrometer during the second analysis period.

17. The method of claim 16, further comprising configuring the ionization core with an inorganic ion source and an organic ion source separate from the inorganic ion source.

18. The method of claim 17, further comprising configuring the dual core mass spectrometer co to comprise a dual quadrupole assembly.

19. The method of claim 17, further comprising configuring the dual core mass spectrometer to comprise a dual quadrupole assembly fluidically coupled to a first detector through an interface and fluidically coupled to a second detector through the interface and a quadrupole assembly.

20. The method of claim 19, further comprising configuring the interface to comprise a non-coplanar interface.

* * * * *